US006677053B2

(12) United States Patent
Yamaji et al.

(10) Patent No.: US 6,677,053 B2
(45) Date of Patent: Jan. 13, 2004

(54) SURFACE-TREATED STEEL SHEET AND PRODUCTION METHOD THEREFOR

(75) Inventors: Takafumi Yamaji, Kawasaki (JP); Kenji Morita, Kawasaki (JP); Akira Matsuzaki, Fukuyama (JP); Masaaki Yamashita, Fukuyama (JP); Etsuo Hamada, Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 10/024,297

(22) Filed: Dec. 17, 2001

(65) Prior Publication Data

US 2002/0155314 A1 Oct. 24, 2002

Related U.S. Application Data

(63) Continuation of application No. PCT/JP00/03876, filed on Jun. 15, 2000.

(30) Foreign Application Priority Data

| | | |
|---|---|---|
| Apr. 21, 2000 | (JP) | 2000-120241 |
| Apr. 21, 2000 | (JP) | 2000-120242 |
| Apr. 21, 2000 | (JP) | 2000-120243 |
| Apr. 28, 2000 | (JP) | 2000-130328 |
| Apr. 28, 2000 | (JP) | 2000-130329 |
| Apr. 28, 2000 | (JP) | 2000-130330 |
| Apr. 28, 2000 | (JP) | 2000-130331 |
| Apr. 28, 2000 | (JP) | 2000-130332 |
| Apr. 28, 2000 | (JP) | 2000-130333 |

(51) Int. Cl.[7] ..... B32B 15/04; C23C 22/00

(52) U.S. Cl. ..... 428/621; 148/251; 148/253; 148/255; 148/256; 148/257; 148/258; 148/263; 148/264; 148/265; 148/267; 148/268; 148/273; 148/274; 148/275; 427/372.2; 427/384; 427/407.1; 427/409; 427/419.1; 428/623; 428/626; 428/628; 428/658; 428/659; 428/472; 428/472.3; 428/689; 428/925

(58) Field of Search ..... 428/621, 623, 428/626, 628, 658, 659, 472, 472.3, 689, 92.5; 427/372.2, 384, 407.1, 409, 419.1; 148/251, 253, 255, 256, 257, 258, 263, 264, 265, 267, 268, 273, 274, 275

(56) References Cited

U.S. PATENT DOCUMENTS

| | | | | |
|---|---|---|---|---|
| 5,429,880 A | * | 7/1995 | Kubota et al. | 428/623 |
| 5,897,948 A | | 4/1999 | Sakon et al. | |

FOREIGN PATENT DOCUMENTS

| | | | |
|---|---|---|---|
| JP | 55-131178 | A | 10/1980 |
| JP | 59-177381 | A | 10/1984 |
| JP | 61-110777 | A | 5/1986 |
| JP | 63-65088 | A | 3/1988 |
| JP | 63-166974 | A | 7/1988 |
| JP | 1-53353 | B2 | 11/1989 |
| JP | 2-34792 | A | 2/1990 |
| JP | 9-241858 | A | 9/1997 |
| JP | 10-176280 | A | 6/1998 |
| JP | 11-302814 | A | 11/1999 |
| JP | 11-343559 | A | 12/1999 |
| WO | WO 97/00337 | A | 1/1997 |

* cited by examiner

*Primary Examiner*—Robert R. Koehler
(74) *Attorney, Agent, or Firm*—Frishauf, Holtz, Goodman & Chick, P.C.

(57) ABSTRACT

A surface-treated steel sheet includes a steel sheet, an Al—Zn-base alloy plating layer formed on the steel sheet, a chemical conversion film provided on the alloy plating layer, and a concentric layer of a Cr compound that is formed on the alloy plating layer of the chemical conversion film. The surface-treated steel sheet may include a steel sheet, an zinc-base plating layer formed on the steel sheet, and a film that contains chromium and calcium and that is formed on the zinc-base plating layer.

54 Claims, No Drawings

SURFACE-TREATED STEEL SHEET AND PRODUCTION METHOD THEREFOR

This application is a continuation patent application of International Application PCT/JP00/03876 filed Jun. 15, 2000 which was not published under PCT Article 21 (2) in English.

FIELD OF THE INVENTION

The present invention relates to a surface-treated steel sheet having a high corrosion resistance and a method for producing the same.

DESCRIPTION OF THE RELATED ARTS

Conventionally, chromate treatment films have been widely used in primary anticorrosion treatment. The chromate treatment film is formed on a surface of a zinc-base-plated steel sheet to protect the surface from corrosion until a consumer uses the steel sheet. In recent years, however, even after a product has been fabricated using such a steel-sheet material, the steel-sheet material is still required to maintain the corrosion-resisting function.

Among zinc-base-plated steel sheets, a Zn—Al-base-alloy-plated steel sheet has a relatively high corrosion resistance. The resistance is higher than that of the zinc-base-plated steel sheet. The Zn—Al-base-alloy-plated steel sheet is therefore enjoying increasing demands in industrial fields, particularly in the field of building materials.

In the recent building-material field, however, the severity of requirements is increasing for the durability of the corrosion resistance and maintenance-free properties of materials. With this background, the appearance of the surface of the Zn—Al-base-alloy-plated steel sheet is required to be durable for a longer period in various environments. Inherently, the appearance of the surface is required to be maintained in the fabrication of products in various shapes. As such, additional functions are required for the conventional chromate treatment film formed by applying a primary-rust-preventing treatment onto a Zn-5% Al-alloy-plated steel sheet that contains about 5 wt % Al to protect corrosion in a period until the steel sheet is used by a consumer. The required functions are as follows:

(a) a function (processed-portion corrosion resistance) of providing a high corrosion resistance even after the steel sheet fabricated into an intended product in a corrosive environment; and (b) a function of inhibiting a blacken phenomenon in which the plated surface of the sheet material is blackened when the sheet material is stored outdoors for several days prior to fabrication.

Furthermore, the following functions are required for a Zn-55% Al plating alloy that contains about 55 wt % Al:

(a) a function of providing a high corrosion resistance even after the steel sheet fabricated into an intended product in a corrosive environment (processed-portion corrosion resistance); and (b) a function of inhibiting a blacken phenomenon in which the plated surface of the sheet material is blackened in a humid environment (producing antiblackening resistance).

Chromate treatment films are broadly grouped into the following three types. They are an electrolysis-type chromate treatment film, a reaction-type chromate treatment film formed of a principal component of a trivalent-chromium compound, and a coating-type chromate treatment film formed of a compound of trivalent chromium and hexavalent chromium.

In these chromate-treatment films, the refractory trivalent chromium works as a barrier against corrosion-introducing factors, such as chloride ions and oxygen. That is, the refractory trivalent chromium provides barrier effects against the corrosion factors. On the other hand, in the coating-type chromate treatment film, the hexavalent chromium is dissolved out to a damaged portion of the chromate treatment film, and passivates the damaged portion. Thereby, the hexavalent chromium forms the film with corrosion-inhibiting effects (which hereinbelow will be referred to as "self-healing effects").

For the above-described reasons, the coating-type chromate treatment film is applied for coating in many cases in which the processed-portion corrosion resistance is required. However, since the hexavalent chromium has high oxidizeability, it is prone to be reduced to trivalent chromium as time passes. In addition, since the hexavalent chromium is water-soluble, it is prone to be dissolved out of the compositional system. Hence, in many cases, when the film is damaged, a phenomenon occurs in which the film loses residual hexavalent chromium sufficient to allow the film to impart self-healing effects. Thus, the provision of a sufficient processed-portion corrosion resistance cannot be insured.

In this field, there are known technical methods proposed to solve the above-described problems. The methods can be broadly grouped into two types (1) and (2) described as follows.

(1) Methods of a type for reducing the extent of damage on a film

For example, JP-A-2-34792, (the term "JP-A" referred herein signifies the "unexamined Japanese patent publication"). discloses a method in which a fluorine-based resin is added in a chromate treatment film to have lubricity. Another example method of the type (1) is disclosed in JP-A-10-1762809. In this method, a thermoplastic elastomer is included in a film to impart ductility to the film. Concurrently, this method reduces the extent of a damaged film portion caused by sliding operation in, for example, press-forming. This enables the self-healing effects to be obtained with a relatively small amount of hexavalent chromium.

(2) Methods of a type for minimizing the dissolution amount of hexavalent chromium contained in a film For example, one of the methods of the captioned type is disclosed in Domestic Republication of PCT International Publication for Patent Application No. 9-800337. According to the disclosed method, refractory chromium hydrochloric acid is dispersed within a film to inhibit chromium from being dissolved out in sound film portions. On the other hand, in a damaged film portion, corrosion reaction (the pH value increases) is used as a trigger to dissolve hexavalent chromium. This enables the film to impart self-healing effects.

In the methods of the type (1) above, a reduction can be achieved in regard to the extent of film damage caused in fabrication operations, such as press-forming and bending. This surely enables the film to impart a certain degree of the self-healing effects. However, reduction effects cannot be obtained for film damage caused when the film is in contact with, for example, a sharp-edged metal piece. In addition, since the resin to be included in the film is expensive, the method is problematic in both the economy and productivity.

In the methods of the type (2), the durability of the self-healing effects is improved in comparison to the case where water-soluble chromium acid is applied onto the steel-sheet surface to form the film. On the other hand, however, the water-solubility restricts the level of the self-healing effects that can be obtained. Even when the highest possible level of the self-healing effects is obtained in the above method, the level is equivalent to the level that can be achieved immediately after water-soluble chromium compound is included in the film. In addition, generally, films including the chromium hydrochloric acid tend to be discolored. The discoloration significantly reduces the value of products, particularly, products that are used without coating.

In a Zn—Al-base-alloy-plated steel sheet, a sacrificial anticorrosion action and a passivation-film forming action work in a synergetic manner. This causes a high corrosion resistance to be imparted. Nevertheless, however, since the aluminum (Al) has inherent properties to form an active metal, when a passivation film is damaged, a blackened phenomenon easily occurs in a humid environment.

The following describes four methods proposed for inhibiting the blackening behavior of a Zn—Al-base-alloy-plated steel sheet that contains 4 to 25 wt % Al:

(1) Method in which treatment is performed after plated is performed using solution that contains Ni ions and Co ions (according to JP-A-59-177381);

(2) Method in which a heat treatment is performed after skin-pass rolling (according to JP-A-55-131178);

(3) Method in which plated surfaces are cleaned using alkali water solution (according to JP-A-61-110777); and (4) Method in which post-plating blasting is performed prior to a chromate treatment (JP-A-63-166974).

In practice, when these proposed methods are applied, an improvement effect can be recognized in a normal humid environment in regard to the antiblackening resistance of the Zn—Al-base-alloy-plated steel sheet that contains 4 to 25 wt % Al. However, in many practical cases, during construction of building structures such as roofs, external walls, Zn—Al-base-alloy-plated steel sheets that each contain 4 to 25 wt % Al are stored outdoors. Also, in many cases, the steel sheets are thus stored outdoors in a sheet state or in a state in which the materials as formed by, for example, roll-forming, are stacked. When the steel sheets are stored in this manner in a natural environment, the steel-sheet surfaces are easily wetted because of, for example, dewing. Thereby, the surfaces of the sheet materials are easily blackened in a couple of days.

In addition, any one of the above-described methods requires dedicated processing facilities. This arises problems in economy and productivity.

In addition, JP-B-1-53353, (the term "JP-B" referred herein signifies the "examined Japanese patent publication") discloses a method of inhibiting the blackening behavior of an Al—Zn-base-alloy-plated steel sheet that contains 25 to 75 wt % Al. In this method, the treatment is performed using a treatment liquid made by mixing chromium acid and resin at a ratio that is at least a predetermined ratio. The treatment resultantly prevents chromium acid from directly reacting to the plating, and improves the antiblackening resistance. Moreover, JP-A-59-177381 and No. 63-65088 each disclose an antiblackening-resistance inhibiting method. In the method, pretreatment for chromate treatment is performed after plating by using Ni and Co.

According to the method in which the treatment is performed using the treatment liquid made by mixing chromium acid and resin at a ratio that is at least a predetermined ratio, antiblackening resistance can securely be obtained to a certain extent for the Zn—Al-base-alloy-plated steel sheet that contains 25 to 75 wt % Al. However, complete resistance cannot be insured. In addition, since the resin is mixed with the chromium acid at a ratio that is higher or equal to a predetermined ratio, the service life of the treatment liquid is significantly shortened. To use the resin sufficient to withstand the oxidant effects of the chromium acid, the production cost increases. This makes the method to be disadvantageous in the cost.

In addition, since the pretreatment is performed using the metals such as Ni and Co, while the antiblackening resistance may be improved, use of the expensive metals increases the production cost.

SUMMARY OF THE INVENTION

It is an object of the present invention to provide a surface-treated steel sheet having a high corrosion resistance and a method for producing the same.

To achieve the object, first, the present invention provides a surface-treated steel sheet comprising a steel sheet, an Al—Zn-base alloy plating layer formed on the steel sheet, a chemical conversion film provided on the alloy plating layer, and a concentric layer of a Cr compound that is formed on the alloy plating layer of the chemical conversion film. The alloy plating layer contains Al in an amount of from 20 to 75%. The chemical conversion film is formed by applying a chemical treatment liquid containing principal components of an aqueous organic resin and chromic acid. The chemical conversion film has a weight ratio of resin/Cr in a range of from 20 to 200, and the coating weight of the Cr in a range of from 3 to 50 mg/m$^2$ (as converted to metallic chromium). The concentric layer contains a Cr compound in a ratio of resin/Cr that is below the level that is 0.8 times a mean ratio of resin/Cr of the chemical conversion film.

Second, the present invention provides a surface-treated steel sheet comprising a steel sheet, a zinc-base plating layer formed on the steel sheet, a film that is formed on the zinc-base plating layer and that contains chromium in an amount of from 0.1 to 100 mg/m$^2$ and calcium in an amount of from 0.1 to 200 mg/m$^2$.

A method for producing the surface-treated steel sheet described above may comprise the steps of (a) preparing a treatment liquid containing a water-soluble chromium compound, calcium or a compound of the calcium, (b) applying the treatment liquid onto a surface of a zinc-base-plated steel sheet, and (c) forming a film by heating at a highest-reachable sheet temperature in a range of from 60 to 300° C. without performing rinsing. The treatment liquid contains hexavalent chromium ions in a range of from 0.1 to 50 g/l and calcium in a range of from 1 to 50 g/l.

In addition, a method for producing the surface-treated steel sheet may comprise the steps of (a) preparing a treatment liquid containing a water-soluble chromium compound in which a chromium compound comprises a trivalent-chromium compound, and calcium or a compound of the calcium, (b) applying the treatment liquid onto a surface of a zinc-base-plated steel sheet, and (c) forming a film by heating the zinc-base-plated steel sheet at a highest-reachable sheet temperature in a range of from 60 to 300° C. without performing rinsing.

Third, the present invention provides a surface-treated steel sheet comprising a steel sheet; a zinc-base plating layer formed on the steel sheet; and a film that is formed on the zinc-base plating layer and that contains chromium and a compound containing phosphoric acid and at least one selected from a group of zinc and aluminum. The chromium is in an amount of from 0.1 to 100 mg/m$^2$, and the compound is in an amount of from 0.1 to 100 mg/m$^2$ as converted to phosphorus.

A method for producing the surface-treated steel sheet as described above may comprise the steps of (a) preparing a treatment liquid containing a water-soluble chromium compound and one of phosphoric acid and salt thereof, (b) applying the treatment liquid onto a surface of a zinc-base-plated steel sheet, and (c) forming a film by heating at a highest-reachable sheet temperature in a range of from 60 to 300° C. without performing rinsing. The treatment liquid contains hexavalent chromium ions in a range of from 0.1 to 50 g/l and phosphoric acid in a range of from 1 to 50 g/l.

In addition, a method for producing the surface-treated steel sheet as described above may be established to include the steps of (a) preparing a treatment liquid containing a water-soluble chromium compound in which a chromium compound is composed of a trivalent-chromium compound, and one of phosphoric acid and salt thereof, (b) applying the treatment liquid onto a surface of a zinc-base-plated steel sheet, and (c) forming a film by heating the zinc-base-plated steel sheet at a highest-reachable sheet temperature in a range of from 60 to 300° C. without performing rinsing. The treatment liquid contains trivalent chromium ions in a range of from 0.1 to 50 g/l and phosphoric acid in a range of from 1 to 50 g/l.

Fourth, the present invention provides a surface-treated steel sheet comprising a steel sheet; a zinc-base plating layer formed on the steel sheet; and a film that is formed on the zinc-base plating layer and that contains chromium, calcium, and a compound containing phosphoric acid and at least one selected from a group of zinc and aluminum. The chromium is in a range of from 0.1 to 100 mg/m$^2$, the calcium is in a range of from 1 to 200 mg/m$^2$, and the compound is in a range of from 0.1 to 100 mg/m$^2$ as converted to phosphorus.

A method for producing the surface-treated steel sheet as described above may comprise the steps of (a) preparing a treatment liquid containing a water-soluble chromium compound, one of calcium and a compound thereof, and one of phosphoric acid and salt thereof, (b) applying the treatment liquid onto a surface of a zinc-base-plated steel sheet, and (c) forming a film by heating at a highest-reachable sheet temperature in a range of from 60 to 300° C. without performing rinsing.

In addition, a method for producing the surface-treated steel sheet as described above may comprise the steps of (a) preparing a treatment liquid containing a water-soluble chromium compound in which a chromium compound is composed of a trivalent-chromium compound, calcium or a compound thereof, and one of phosphoric acid and salt thereof, (b) applying the treatment liquid onto a surface of a zinc-base-plated steel sheet, and (c) forming a film by heating at a highest-reachable sheet temperature in a range of from 60 to 300° C. without performing rinsing.

Fifth, the present invention provides a surface-treated steel sheet comprising a steel sheet; a zinc-base plating layer that is formed on the steel sheet that contains 30 wt % zinc; and a film that is formed on the zinc-base plating layer and that contains an organic resin, Cr, Ca, and silica or a silica-group compound. The film is formed such that the coating weight of the organic resin is in a range of from 50 to 5,000 mg/m$^2$, the coating weight of the Cr is in a range of from 1 to 100 mg/m$^2$, the coating weight the Ca is in a range of from 0.001 to 0.2 in Ca/organic resin (weight ratio), and the coating weight of the silica or the silica-group compound is in a range of from 0.001 to 0.5 in $SiO_2$/organic resin (weight ratio).

A method for producing the surface-treated steel sheet as described above includes the steps of:

(a) preparing an aqueous treatment liquid containing one of a water-soluble organic resin and a water-dispersible organic resin, one of water-soluble chromic acid and chromate, a Ca compound, and one of silica and a silica-group compound;

(b) applying the aqueous treatment liquid onto a surface of a zinc-base-plated steel sheet containing a zinc-base plating layer containing at least 30 wt % zinc; and (c) drying the applied treatment liquid at a sheet temperature in a range of from 60 to 250° C. without performing rinsing.

Sixth, the present invention provides a method for producing a surface-treated steel sheet, comprising the steps of:

applying chromate treatment onto a surface of a zinc-base-plated steel sheet containing at least 30 wt % zinc;

applying a treatment liquid containing an organic resin, a Ca compound, and one of silica and a silica-group compound; and forming a film by drying the applied treatment liquid at a sheet temperature in a range of from 60 to 250° C.

In the formed, the coating weight of the organic resin is in a range of from 50 to 5,000 mg/m$^2$, the coating weight of the Cr is in a range of from 1 to 100 mg/m$^2$, the coating weight of the Ca is in a range of from 0.001 to 0.2 in Ca/organic resin (weight ratio), and the coating weight of one of the silica and the silica-group compound is in a range of from 0.001 to 0.5 in $SiO_2$/organic resin (weight ratio).

Seventh, the present invention provides a surface-treated steel sheet, comprising:

a steel sheet;

a zinc-base plating layer that is formed on the steel sheet that contains 30 wt % zinc; and a film that is formed on the zinc-base plating layer and that contains an organic resin, Cr, Ca, and phosphoric acid or a phosphoric acid compound. The film is formed such that the coating weight of the organic resin is in a range of from 50 to 5,000 mg/m$^2$, the coating weight of the Cr is in a range of from 1 to 100 mg/m$^2$, the coating weight of the Ca is in a range of from 0.001 to 0.2 in Ca/organic resin (weight ratio), and the total coating weight of one of the phosphoric acid or the phosphoric acid compound is in a range of from 0.001 to 0.5 in $PO_4$/organic resin (weight ratio).

A present invention provides a method for producing the surface-treated steel sheet as described above includes the steps of:

(a) preparing an aqueous treatment liquid containing one of a water-soluble organic resin and a water-dispersible organic resin, one of water-soluble chromic acid and chromate, a Ca compound, and at least one phosphoric acid compound selected from a group of zinc phosphate, aluminum phosphate, condensed zinc phosphate, and condensed aluminum phosphate;

(b) applying the aqueous treatment liquid onto a surface of a zinc-base-plated steel sheet containing a zinc-base plating layer containing at least 30 wt % zinc; and (c) drying the applied treatment liquid at a sheet temperature in a range of from 60 to 250° C. without performing rinsing.

Eighth, the present invention provides a method for producing a surface-treated steel sheet, comprising the steps of:

applying chromate treatment onto a surface of a zinc-base-plated steel sheet containing at least 30 wt % zinc;

applying a treatment liquid containing an organic resin, a Ca compound, and at least one phosphoric acid compound selected from a group of zinc phosphate, aluminum phosphate, condensed zinc phosphate, and condensed aluminum phosphate; and forming a film by drying the applied treatment liquid at a sheet temperature in a range of from 60 to 250° C.

The film is formed such that the coating weight of the organic resin is in a range of from 50 to 5,000 mg/m$^2$, the coating weight of the Cr is in a range of from 1 to 100 mg/m$^2$, the coating weight of the Ca is in a range of from 0.001 to 0.2 in Ca/organic resin (weight ratio), and the total coating weight of the phosphoric acid compound(s) is in a range of from 0.001 to 0.5 in $PO_4$/organic resin (weight ratio).

Ninth, the present invention provides a surface-treated steel sheet comprising a steel sheet; a zinc-base plating layer that is formed on the steel sheet that contains 30 wt % zinc; and a film that is formed on the zinc-base plating layer and that contains an organic resin, Cr, and a complex compound containing Ca—$PO_4$—$SiO_2$ as a principal component. The film satisfies conditions in which the coating weight of the organic resin is in a range of from 50 to 5,000 mg/m$^2$, the coating weight of the Cr is in a range of from 1 to 100 mg/m$^2$, a weight ratio of (Ca+$SiO_2$+$PO_4$)/organic resin is in a range of from 0.01 to 0.5, and a weight ratio of (Ca+$SiO_2$)/$PO_4$ is in a range of from 0.05 to 0.8.

A method for producing the surface-treated steel sheet as described above includes the steps of:

(a) preparing an aqueous treatment liquid containing one of a water-soluble organic resin and a water-dispersible organic resin, one of water-soluble chromic acid and chromate, and a complex compound containing Ca—$PO_4$—$SiO_2$ as a principal component;

(b) applying the aqueous treatment liquid onto a surface of a zinc-base-plated steel sheet containing a zinc-base plating layer containing at least 30 wt % zinc; and (c) drying the applied treatment liquid at a sheet temperature in a range of from 60 to 250° C.

Tenth, the present invention provides a production method for a surface-treated steel sheet, including the steps of:

applying chromate treatment onto a surface of a zinc-base-plated steel sheet containing at least 30 wt % zinc;

applying a treatment liquid containing an organic resin and a complex compound containing Ca—$PO_4$—$SiO_2$ as a principal component; and forming a film by drying the applied treatment liquid at a sheet temperature in a range of from 60 to 250° C.

The film is formed such that the coating weight of the organic resin is in a range of from 50 to 5,000 mg/m$^2$, the coating weight of the Cr is in a range of from 1 to 100 mg/m$^2$, a weight ratio of (Ca+$SiO_2$+$PO_4$)/organic resin is in a range of from 0.01 to 0.5, and a weight ratio of (Ca+$SiO_2$)/$PO_4$ is in a range of from 0.05 to 0.8.

EMBODIMENT FOR CARRYING OUT THE INVENTION

Embodiment 1

Embodiment 1 relates to Al—Zn-base-alloy-plated steel sheets including chemical conversion films. The chemical conversion film is formed through application of the treatment liquid containing principal components of an aqueous organic resin and chromium acid. In addition, phosphoric acid is added to the treatment liquid when necessary. The film is formed on an upper layer of an Al—Zn-base alloy plating layer containing Al in a range of 25 to 75%. The chemical conversion film is characterized as follows. A weight ratio of resin/Cr is in a range of from 20 to 200, the coating weight of Cr (as converted to metallic chromium) is in a range of from 3 to 50 mg/m$^2$, and a weight ratio of $PO_4$/Cr when phosphoric acid is added is in a range of from 0.5 to 4.0.

The alloy that contains 25 to 75% Al is used for the reason that the alloy has a high resistance against the ferrous corrosion, and can be used outdoors without coating. However, galling occurs at a roll-forming stage in the production, and the visual quality is significantly degraded due to corrosion-introducing factors in a corrosive environment. For these reasons, a corrosion-preventing film (a chemical conversion film) should be formed on the sheet.

As mentioned above, in the chemical conversion film formed on the plated surface, the resin/Cr weight ratio is in a range of from 20 to 200. When the weight ratio is below 20, the film is hardened to be brittle. In this case, when severely conditioned roll-forming is performed, the extent of damage is increased. When the weight ratio is above 200, the film is softened, and the extent of damage caused in the manufacture is increased. For these reasons, the resin/Cr weight ratio should be in a range of from 20 to 200. More preferably, the weight ratio should be in a range of from 50 to 150. Regarding the coating weight of Cr, it should be in a range of from 3 to 50 mg/m$^2$. When the coating weight is less than 3 mg/m$^2$, the film is degraded in all the properties of corrosion resistance, antiblackening resistance, and processability. Even when Cr greater in the coating weight than 50 mg/m$^2$ is added, significant improvement in the properties cannot be obtained. In this case, the color density is increased, or dissolvable Cr is increased. This is not preferable.

When the phosphoric acid is added, the $PO_4$/Cr weight ratio is in a range of from 0.5 to 4.0. When the weight ratio is below 0.5, it is difficult to form a Cr-compound concentric layer (Cr concentric layer). When the weight ratio is above 4.0, the stability of the treatment liquid is reduced, thereby making the film to be disadvantageous. The phosphoric acid may be added as orthophosphoric acid or condensed phosphoric or as metallic salt thereof. The reason for adding the phosphoric acid will be described below in detail.

The usable treatment liquid includes liquid that contains $Cr^{6+}$ or $Cr^{3+}$ as chromium acid. $Cr^{6+}$ is preferably prepared to be a dissolved state at the stage of treatment liquid. The reason for the above is that $Cr^{6+}$ significantly influences the forming of a Cr concentric layer.

For the aforementioned aqueous resin, from the viewpoint of the durability of the film, a so-called emulsion resin is preferably used. The emulsion resin becomes refractory when solidifying to form a film. For the emulsion resin, for example, the present mode allows use of one of the following types of resins that have a basic skeleton. They are an acrylic type, an acrylic-styrene type, an acrylic vinyl acetate type, a vinyl chloride type, a urethane type, ethylene type, a polyester type, and epoxy type. Usable resins also include those of types that have the aforementioned basic skeletons to which, for example, one of the following functional groups. The functional groups that may be used as additives are, for example, a hydroxyl group, a carboxyl group, an epoxy group, and a urethane group. Furthermore, a nonionic or anionic emulsifier may be added into an emulsion to stabilize water dispersion. Furthermore, the present mode allows a resin in which one of the aforementioned emulsifiers preliminarily included. A mean particle diameter in the aforementioned resins is in a range of from 0.01 to 2 $\mu$m.

However, the particle diameter is preferably below 1 μm from the viewpoint of forming a defect-minimized film. However, Embodiment 1 is not limited by the particle diameter.

Embodiment 1 allows use of additives that are generally used for the chromate treatment. Examples of the additives include ammonia and fluorine, or a compound that contains the two. However, the type of additives is not limited in the present invention.

In Embodiment 1, a Cr-compound concentric layer is formed on the Al—Zn-base alloy plating layer.

The Cr concentric layer significantly influences all the processability, corrosion resistance, and antiblackening resistance. The reasons theref or are considered to be as follows. The Cr concentric layer has a function that strongly couples the plating layer and the chemical conversion film to each other. In this case, the adhesion force increases, thereby preventing forming-attributable peeling of the chemical conversion film. Since this results in increasing the barrier effects of the chemical conversion film, the corrosion resistance and the antiblackening resistance are improved.

Basically, the Cr concentric layer in Embodiment 1 refers to a portion in the vicinity of an interface on the side of the chemical conversion film from an interface that is in contact with a plated-layer surface and the chemical conversion film (within a 20% range of a normal film thickness). For an analysis method therefor, while there are no limitations in Embodiment 1, there are known methods. The known methods include a method in which cross sections of a chemical conversion film are analyzed through a TEM-EDX. In other known methods, a chemical conversion film is ground from the surface thereof. Then, cross sections are observed through a TEM, and are analyzed from the surface through an EDX, an EPMA, or a scanning Auger electron spectroscopy. The amount of film adhesion of the overall chemical conversion film can be verified through measurement of, for example, Cr and P from the surface. In this case, a fluorescent X rays or an EPMA is used. However, Embodiment 1 is not limited by the method, and allows use of any method capable of performing logical analyses.

In Embodiment 1, the resin/Cr ratio in the Cr concentric layer should be below a value that is 0.8 times a mean value of resin/Cr ratios in the overall chemical conversion film. When the resin/Cr ratio exceeds the ratio of 0.8 times, the intended effects described above cannot be achieved. Regarding the lower limit of the resin/Cr ratio in the Cr concentric layer, no specific limit should be set. However, when the pH value of the treatment liquid is excessively reduced (for example, to be lower than 0.5) to cause significant concentration, problems are caused in, for example, the stability of the treatment liquid. In this view, the excessive reduction is not preferable.

In addition, in Embodiment 1, as described above, the phosphoric acid is added when necessary. The added phosphoric acid provides etching effects to the plated-layer surface. The etching effects work to form the Cr concentric layer. The reason is that the addition of the phosphoric acid improves the corrosion resistance of the chemical conversion film. Furthermore, in the present invention, the aforementioned effects are found to significantly improve when the phosphoric acid ions as well in the Cr concentric layer are concentrated. In this particular example, the phosphoric acid in the Cr concentric layer was concentrated 1.01 times or greater in terms of $PO_4$/Cr of the chromium concentric layer with respect to the mean $PO_4$/Of the aforementioned chemical conversion film. Thereby, the aforementioned effects were verified.

Additional additives are available that are capable of imparting etching effects similar to those described above when they are added in the chemical conversion film. The additives include sulphate ions ($SO_4^{2-}$) and nitric acid ions ($NO^{3-}$). However, compared in the corrosion resistance to a chemical conversion film containing aforementioned additives, a phosphoric-acid-added film was found superior thereto.

In the Al—Zn-base alloy plating layer containing at least 25% and at most 75% (25 to 75%) Al, a phase (A) phase and a phase (B) are formed. The phase A contains at least 50% Al, and the phase B contains at least 60% Zn. In the present invention, an area ratio of surfaces of A and B was set to achieve B/A(A+B)=0.1 to 0.6. When B/A(A+B) is bellow 0.1, good processability cannot be obtained. When B/A(A+B) exceeds 0.6, the corrosion resistance decreases. For factors influencing the aforementioned ratio, various conditions can be considered. The conditions include the plating temperature, post-plating cooling conditions, the plating coating weight, conditions of skinpass processing that is ordinarily performed to secure material properties of the steel sheet, and conditions of a tension leveler. When these conditions are appropriately adjusted, B/A(A+B)=0.1 to 0.6 can be achieved. However, the adjusting means is not limited thereto.

In Embodiment 1, the Cr-compound concentric layer is preferably formed in the following manner. The concentric-layer thickness of a portion existing on the phase (phase B), which contains the principal component of Zn, of the Al—Zn-base alloy plating layer is greater than the concentric-layer thickness of a portion existing on the phase (phase A), which contains the principal component of Al. This is preferable to achieve desired corrosion resistance, antiblackening resistance, and processability. In the phase A in which Al is rich, since Al-oxide anticorrosion effects can be expected, the Cr-compound concentric layer can be formed to be relatively thin. However, in the phase B in which Zn is rich, sufficient Zn-oxide anticorrosion effects cannot be expected unless the Cr-compound concentric layer has a sufficient thickness. For this reason, when corrosion develops from the phase B, and the corrosion reaches the Al portion, corrosion of the active Al abruptly develops. To prevent the corrosion development, a Cr concentric layer should be formed on the phase B to be greater than the Cr concentric layer existing on the phase A. The Cr concentric layers individually formed on the phases A and B are influenced by various factors. The factors include the pH value of the treatment liquid, the moisture content in the treatment liquid to be applied onto the plated-layer surfaces, the viscosity of the treatment liquid, and post-coating thermal curing conditions (temperature rising speed, a heater, highest-temperature-reaching time, intrafurnce humidity, and the like). Adjustment of these conditions enables Cr concentric layers to be formed on the phases A and B. Concurrently, the adjustment enables the thickness of each of the layers to be adjusted.

Embodiment 1 is intended for the Al—Zn-base-alloy-plated steel sheet that contains 25 to 75% Al as an object. However, Embodiment 1 may be applied to plated steel sheets including a plated steel sheet and a generally-known 5% Al—Zn-plated steel sheet. However, these steel sheets are inferior in the corrosion resistance and the antiblackening resistance to the Al—Zn-base-alloy-plated steel sheet that contains 25 to 75% Al. For this reason, Embodiment 1 should be applied within an appropriately usable range.

EXAMPLE 1

Table 1 shows test samples (regarding the conditions of Al—Zn-base-alloy-plated steel sheets containing 25 to 75% Al, and chemical compositions and structures of films containing principal components of chromium acid and aqueous resin).

In the preparation of the individual test samples, anionic and nonionic acryl-base emulsion resin (number mean particle diameters thereof are ranged from 0.05 to 0.3 $\mu$m) for the aqueous resin. In addition, for the chromium acid, chromium acid having a Cr reduction ratio of 30% was used, and orthophosphoric acid was used for the system containing the additive of phosphoric acid. The pH value of the treatment liquid was adjusted by adding phosphoric acid or ammonia. After a predetermined amount of the treatment liquid was applied onto the steel-sheet surfaces, a film was formed at sheet temperatures in a range of from 80 to 200° C. In this way, each of the test samples was prepared. For curing furnaces, in addition to an air-heating furnace, an induction furnace was used to perform quick heating.

For the plated steel sheets, steel sheets having different properties were used. Specifically, the properties are different in plating-progress sheet temperature, cooling speed, and ratio of pressure adjustment performed through a post-plating skinpass or a leveler.

Among the above, analysis was performed using the methods described below for the plated conditions and film structures containing principal components of the chromium acid and the aqueous resin.

(Plating Conditions)

The plating film was observed by using a microtome cross-section abrasion method, and EDX analysis was performed for the plating film with a spot diameter of 1 $\mu$m. Through this procedure, Al and Zn concentrations were obtained. In addition, SEM observation was performed for the surface, and TEM observation was performed for the cross section. Through comparison to a TEM image, the distribution conditions of the Al concentration and the Zn concentration (the phase A and the phase B) in a SEM image were identified.

Subsequently, the area ratio between the phases A and B was measured. From a surface SEM photograph (2500× magnification), the phases A and B were identified, the areas thereof were measured using image-analysis software "NIHimage", and the area ratio B/A(A+B) was measured. In this case, depending on the determination for the interface between the phases A and B, errors in a range of at most 5% occurred in the area ratio.

(Conditions of Chemical Conversion Films)

Hereinbelow, a description will be made regarding a verification method for the existence of the Cr concentric layer in the phase B. The verification method is important to control the distribution of chromium in the chromium-containing resin of the Al—Zn-alloy-plated steel sheet according to Embodiment 1.

The film surface was ground off from the surface layer of the test sample. In this case, a rubber eraser according to JIS S 6050 was used to directly rub the surface of the test sample coated with the chromium-containing aqueous organic resin. Then, analysis was performed according to the scanning Auger electron spectroscopy in which the analysis depth is sufficiently small. For the position of the Cr concentric layer, an analysis-intended test sample was analyzed with the above-described plated-condition observation method. Based on the observation result, the relationship between the concentric layer and the phase B was known.

JP-B-60-145383 discloses that Cr in the resin can shifts lower, that is, toward the steel sheet, according to the curing repetition cycle. To prevent the shift of Cr, in the analysis of the present example, sufficient care was taken for processing environments. Particularly, care was taken for the temperature in the period from the time when the manufactured steel sheets are cut out to the time when peeling operation and analysis are performed. In these environments, processing such as dry abrasion was performed. Concurrently, each of the test samples was adjusted in an environment in which the humidity was kept below 60%.

Evaluation methods applied for the test samples were as follow:

Corrosion resistance: Evaluated according to the occurrence extent of white rust and black rust on the surface after 1,000-hour salt spray testing.

Evaluation Criteria:

5: No abnormality; 4: Rust area less than 10%; 3: Rust area 10% to less than 25%; 2: Rust area 25% to less than 50%; and 1: Rust area at least 50%

Antiblackening resistance: 1,000-hour humidity cabinet testing (HCT) performed for stacked steel sheets.

Evaluation Criteria:

A: No abnormality;

B-1: No abnormality when front-viewed, abnormal area less than 25% when diagonally viewed;

B-2: No abnormality when front-viewed, abnormal area 25% to less than 50% when diagonally viewed;

B-3: No abnormality when front-viewed, abnormal area at least 50% when diagonally viewed;

C-1: Abnormal area less than 10% when front-viewed, abnormal area less than 25% when diagonally viewed;

C-2: Abnormal area less than 10% when front-viewed, abnormal area 25% to less than 50% when diagonally viewed;

C-3: Abnormal area 10% when front-viewed, abnormal area at least 50% when diagonally viewed;

D-1: Abnormal area 10% to less than 25% when front-viewed, abnormal area less than 25% when diagonally viewed;

D-2: Abnormal area 10% to less than 25% when front-viewed, abnormal area 25% to less than 50% when diagonally viewed;

D-3: Abnormal area 10% to less than 25% when front-viewed, abnormal area at least 50% when diagonally viewed;

E-1: Abnormal area 10% to less than 50% when front-viewed, abnormal area less than 25% when diagonally viewed;

E-2: Abnormal area 10% to less than 50% when front-viewed, abnormal area 25% to less than 50% when diagonally viewed; and E-3: Abnormal area 10% to less than 50% when front-viewed, abnormal area at least 50% when diagonally viewed.

Processability: Draw-bead testing was performed. In the testing, a bead having a 10-mm$^2$ planar end was used to press a test sample, and the test sample was slidably drawn at a pressing load of 500 kgf. Moreover, draw-bead testing was performed at a pressing load of 300 kgf by using a bead having an end diameter of 5 mm and a deformation height of 5 mm. Then, inspection was performed for the extent of galling occurred on the plating on the test-sample surface. Furthermore, adhesion testing was performed by using an adhesive tape for the surface of the bead used in the bead-draw testing. The processability was evaluated according to the adhesion extent of the chemical conversion film.

Evaluation Criteria:

A: No galling; B: Galled area less than 10%; C: Galled area 10% to less than 25%; D: Galled area 25% to less than 50%; and E: Galled area at least 50%.

Adhesion of Chemical Conversion Film:

5: Not adhered; 4: Adhered less than 10% of tape; 3: Adhered 10% to less than 25% of tape; 2: Adhered 25% to less than 50% of tape; and 1: Adhered at least 50% of tape.

Table 2 shows the results of the evaluation.

Item No. 1 is out of the invention-governing range in the Cr concentration and is therefore inferior to item No. 2 in the corrosion resistance, the antiblackening resistance, and the processability. Item No. 3 has a ration of resin/Cr that is below the invention-governing range and is therefore inferior in the corrosion resistance and the processability. Item No. 6 has a ration of resin/Cr that is above the invention-governing range and is therefore inferior in the corrosion resistance, the antiblackening resistance, and the processability. Item No. 7 has a less amount of Cr adhesion than the invention-governing range is therefore inferior in the corrosion resistance, the antiblackening resistance, and the processability. Item No. 10 has an amount of Cr adhesion that is greater than the invention-governing range; therefore, the chemical conversion film is apt to peel off.

EXAMPLE 2

Test samples are shown in Table 3. The test samples were prepared by adding orthophosphoric acid, phosphoric acid, and nitric acid to the condition of item No. 2 shown in Table 1. The test samples were evaluated according to a method that is similar to those of Example 1, and the results are shown in Table 4.

TABLE 1

| No. | Plating surface B/(A + B) | Resin/Cr (1) | $PO_4$/Cr | Cr coating weight mg/m$^2$ | Cr concentration (2) | Distribution of Cr concentric layer | Remarks |
|---|---|---|---|---|---|---|---|
| 1 | 0.4 | 75 | 0 | 20 | 0.9 | A ≈ B | Comparative example |
| 2 | 0.4 | 75 | 0 | 20 | 0.7 | B > A | Invention example |
| 3 | 0.4 | 15 | 1.5 | 20 | 0.6 | B > A | Comparative example |
| 4 | 0.4 | 40 | 1.5 | 20 | 0.6 | B > A | Invention example |
| 5 | 0.4 | 150 | 1.5 | 20 | 0.7 | B > A | Invention example |
| 6 | 0.4 | 250 | 1.5 | 20 | 0.8 | B > A | Comparative example |
| 7 | 0.4 | 75 | 1.5 | 1 | — | — | Comparative example |
| 8 | 0.4 | 75 | 1.5 | 10 | 0.7 | B > A | Invention example |
| 9 | 0.4 | 75 | 1.5 | 30 | 0.7 | B > A | Invention example |
| 10 | 0.4 | 75 | 1.5 | 20 | 0.7 | B > A | Comparative example |
| 11 | 0.4 | 75 | 1.5 | 20 | 0.3 | B > A | Invention example |
| 12 | 0.4 | 75 | 3.5 | 20 | 0.2 | B > A | Invention example |

TABLE 1-continued

| No. | Plating surface B/(A + B) | Resin/Cr (1) | $PO_4$/Cr | Cr coating weight mg/m$^2$ | Cr concentration (2) | Distribution of Cr concentric layer | Remarks |
|---|---|---|---|---|---|---|---|
| 13 | 0.4 | 75 | 5 | 20 | 0.2 | B > A | Invention example |
| 14 | 0.05 | 75 | 1.5 | 20 | 0.3 | B > A | Invention example |
| 15 | 0.2 | 75 | 1.5 | 20 | 0.3 | B > A | Invention example |
| 16 | 0.5 | 75 | 1.5 | 20 | 0.3 | B > A | Invention example |
| 17 | 0.7 | 75 | 1.5 | 20 | 0.3 | B > A | Invention example |
| 18 | 0.4 | 75 | 1.5 | 20 | 0.2 | B = A | Invention example |

(1) Resin/Cr ratio in a chemical treatment liquid.

(2) Cr concentration: Ratio between two resin/Cr ratios, one being a resin/Cr ratio in the vicinity of an interface between a chemical conversion film and a plating layer, and the other one being a resin/Cr ratio in a chemical treatment liquid.

(3) Thicknesses of concentric layers of a phase A and a phase B.

TABLE 2

| No. | Corrosion resistance | Anti-blackening resistance | Processability (Evaluation for galling) | Processability (Evaluation for adhesion) | Remarks |
|---|---|---|---|---|---|
| 1 | 3 | D-2 | A | 2 | Comparative example |
| 2 | 4 | B-1 | A | 3 | Invention example |
| 3 | 2 | A | E | 5 | Comparative example |
| 4 | 4 | A | C | 5 | Invention example |
| 5 | 4 | B-1 | A | 3 | Invention example |
| 6 | 3 | D-2 | A | 2 | Comparative example |
| 7 | 1 | F | E | 2 | Comparative example |
| 8 | 4 | B-1 | B | 5 | Invention example |
| 9 | 5 | A | A | 5 | Invention example |
| 10 | 5 | A* | A | 1 | Comparative example |
| 11 | 5 | A | A | 5 | Invention example |
| 12 | 5 | B-2 | A | 5 | Invention example |
| 13** | 5 | B-3 | A | 5 | Invention example |
| 14 | 5 | A | A | 3 | Invention example |
| 15 | 5 | A | A | 4 | Invention example |
| 16 | 5 | A | A | 5 | Invention example |
| 17 | 4 | B-3 | A | 5 | Invention example |
| 18 | 4 | B-1 | A | 5 | Invention example |

*Nonuniformity occurred because of Cr dissolution.

**The treatment liquid gelled after several days has passed.

TABLE 3

| No. | Plating surface B/(A + B) | Resin/Cr (1) | Additive | Additive/Cr (4) | Cr coating weight mg/m$^2$ | Cr concentration (2) | Distribution of Cr concentric layer (3) | Distribution of additive concentration (5) | Remarks |
|---|---|---|---|---|---|---|---|---|---|
| 19 | 0.4 | 75 | None | 0 | 20 | 0.7 | B > A | None | Comparative example |
| 20 | 0.4 | 75 | $H_3PO_4$ | 0.3 | 20 | 0.7 | B > A | 1.01 | Invention example |
| 21 | 0.4 | 75 | $H_3PO_4$ | 0.7 | 20 | 0.5 | B > A | 1.15 | Comparative example |
| 22 | 0.4 | 75 | $H_3PO_4$ | 1.5 | 20 | 0.3 | B > A | 1.2 | Invention example |
| 23 | 0.4 | 75 | $H_2SO_4$ | 0.1 | 20 | 0.6 | B > A | 1.03 | Invention example |
| 24 | 0.4 | 75 | $H_2SO_4$ | 0.7 | 20 | 0.3 | B > A | 1.2 | Comparative example |
| 25 | 0.4 | 75 | $H_2SO_4$ | 1.5 | 20 | 0.2 | B > A | 1.4 | Comparative example |
| 26 | 0.4 | 75 | $HNO_3$ | 0.1 | 20 | 0.7 | B > A | 1.01 | Invention example |
| 27 | 0.4 | 75 | $HNO_3$ | 0.7 | 20 | 0.4 | B > A | 1.2 | Invention example |
| 28 | 0.4 | 75 | $HNO_3$ | 1.5 | 20 | 0.3 | B > A | 1.2 | Comparative example |

TABLE 4

| No. | Corrosion resistance | Anti-blackening resistance | Process-ability (Evaluation for galling) | Process-ability (Evaluation for adhesion) | Remarks |
|---|---|---|---|---|---|
| 19 | 4 | B-1 | A | 3 | Invention example |
| 20 | 4–5 | B-1 | A | 3 | Invention example |
| 21 | 4–5 | A | A | 5 | Invention example |
| 22 | 5 | A | A | 5 | Invention example |
| 23 | 4 | B-1 | A | 3 | Invention example |
| 24 | 4 | B-2 | A | 5 | Invention example |
| 25 | 4 | B-2 | A | 5 | Invention example |
| 26 | 4 | B-1 | A | 3 | Invention example |
| 27 | 4 | B-1 | A | 5 | Invention example |
| 28 | 4 | B-2 | A | 5 | Invention example |

Embodiment 2

Embodiment 2 relates to surface-treated steel sheets comprising a steel sheet, a zinc-base plating layer formed on the steel sheet, and a film formed on the zinc-base plating layer. The film formed on the zinc-base plating layer contains 0.1 to 100 mg/m$^2$ of chromium and 0.1 to 200 mg/m$^2$ of calcium. (First Pattern)

Preferably, the zinc-base plating layer is either a Zn—Al-base plating layer containing 4 to 25 wt % Al or a Zn—Al-base plating layer containing 25 to 75 wt % Al. (Second and Third Patterns).

A method for producing the surface-treated steel sheet comprises the steps of (a) preparing a treatment liquid containing water-soluble chromium compound, and calcium or a compound thereof, (b) applying the treatment liquid onto a surface of the zinc-base-plated steel sheet, and (c)forming a film by heating the surface at a highest-reachable sheet temperature in a range of from 60 to 300° C. without performing rinsing. The treatment liquid contains hexavalent chromium ions in a range of from 0.1 to 50 g/l and calcium in a range of from 1 to 50 g/l. (Fourth Pattern)

Preferably, a weight ratio of trivalent chromium ions/(trivalent chromium ions+hexavalent chromium ions) in the treatment liquid is in a range of from 0.2 to 0.8. (Fifth Pattern)

A method for producing the surface-treated steel sheet comprises the steps of (a) preparing a treatment liquid containing water-soluble chromium compound, and calcium or a compound thereof, in which the water-soluble chromium compound contains chromium compound composed of a trivalent-chromium compound; (b) applying the treatment liquid onto a surface of the zinc-base-plated steel sheet, and (c) forming a film by heating the surface at a highest-reachable sheet temperature in a range of from 60 to 300° C. without performing rinsing. The treatment liquid contains trivalent chromium ions in a range of from 0.1 to 50 g/l and calcium in a range of from 1 to 50 g/l. (Sixth Pattern)

Preferably, the water-soluble chromium compound is chromium carboxylate. (Seventh Pattern)

For the base steel sheets, i.e., the zinc-base-plated steel sheets, various steel sheets are usable. The usable steel sheets include zinc-base-plated steel sheets, Zn—Ni-plated steel sheets, Zn—Fe-plated steel sheets (electroplated steel sheets or molten-zinc-base-alloy-plated steel sheets), Zn—Cr-plated steel sheets, Zn—Mn-plated steel sheets, Zn—Co-plated steel sheets, Zn—Co—Cr-plated steel sheets, Zn—Ni—Cr—plated steel sheets, Zn—Cr—Fe-plated steel sheets, Zn—Al-base-plated steel sheets (such as Zn-5% Al-alloy-plated steel sheets or Zn-55% Al-alloy-plated steel sheets), Zn—Mg-plated steel sheets, and Zn—Al—Mg-plated steel sheets. The usable steel sheets also include zinc-base-composite-plated steel sheets (such as Zn—$SiO_2$-dispersion-plated steel sheets) that are individually formed by dispersing a metallic oxide, a polymer, or the like in the plating film of one of the aforementioned plated steel sheets. Furthermore, the usable steel sheets include multilayer-plated steel sheets individually having at least two layers of the identical or different plating types among those shown above.

The Zn—Al-base-plated steel sheet that contains 4 to 25 wt % Al contains 4 to 25 wt % Al as an indispensable component, and further contains small amounts of materials of other elements, such as La, Ce, Mg, and Si, depending on the necessity. A so-called Zn-5% Al-alloy-plated steel sheet belongs to the steel sheet of that type.

The Zn—Al-base-plated steel sheet that contains 25 to 75 wt % Al contains 25 to 75 wt % Al as an indispensable component, and further contains small amounts of materials of other elements, such as La, Ce, Mg, and Si, depending on the necessary. A so-called Zn-55% Al-alloy-plated steel sheet belongs to the steel sheet of that type.

For the method of plating the steel sheet, appropriately executable one may optionally be selected from an electrolytic decomposition method, a fusion coating method, and a vapor deposition method.

For coating and forming of the Embodiment-2 film on the plated surface, pretreatments may be performed depending on the necessities to prevent defects and nonuniformity that can be caused during the forming of the film. The pretreatments include an alkaline degreasing treatment, a solvent degreasing treatment and a surface-conditioning treatment (an alkaline surface-conditioning treatment or an acidic surface-conditioning treatment). In addition, to further improve blackening-prevention effects under an environment where the film of the present invention is used, the plated surface may preliminarily be subjected to surface-conditioning treatment using acidic or alkaline solution containing ferrous-base metallic ions (Ni ions, Co ions, and Fe ions). Furthermore, when necessary to further improve the blackening-prevention effects for a steel sheet to be coated with an electroplated base plating, an electroplating bath may contain at least 1 ppm of ferrous-group metallic ions (Ni ions, Co ions, Fe ions). Thereby, these metallic ions can be included into the plating film. In this case, no specific limitation should be set for the upper limit of the ferrous-base metal concentration in the plating film.

Embodiment 2 is characterized to form a chemical conversion film on a surface of the zinc-base-plated steel sheet. In this case, the chemical conversion film contains a compound composed of chromium (A) having barrier effects, and calcium (B) having a self-healing function effects.

In the above, the coating weight of the chromium in the film is preferably in a range of from 0.1 to 100 mg/m$^2$. When the chromium coating weight is below 0.1 mg/m$^2$, sufficient chromium-attributable barrier effects cannot be produced. When the chromium coating weight exceeds 100 mg/m$^2$, while the treatment time increases, no improvement can be expected in the barrier effects. From this viewpoint, it is more preferable that the chromium coating weight should be in a range of from 10 to 70 mg/m$^2$.

The calcium in the film is not specifically limited. The calcium may be any one of the followings. They are metallic calcium, calcium oxide, calcium hydroxide; single-type salt that contains only calcium as cation, for example, calcium silicate, Ca carbonate, calcium phosphate, and calcium molybdate; and double-type salt that contains cation other than calcium cation such as calcium-zinc phosphate, calcium-magnesium phosphate, and calcium-zinc molybdate. Alternatively, the above may be mixed. An implementation mechanism for the above is considered to be as follows. In a damaged film portion, the calcium that is less noble than plating metal is caused to dissolve preferential to the plating metal, and the dissolution of the plating metal is thereby inhibited. Consequently, the dissolved calcium deposits in the damaged film portion to form a protection film. This allows a high processed-portion corrosion resistance and antiblackening resistance to be produced for either the Zn—Al-base-plated steel sheet that contains 4 to 25 wt % Al or the Zn—Al-base-plated steel sheet that contains 25 to 75 wt % Al.

The coating weight of the calcium in the film is preferably in a range of from 0.1 to 200 mg/m$^2$. When the coating weight is below 0.1 mg/m$^2$, reduction occurs in the self-healing effects that can be imparted because of the function of calcium. In addition, reduction occurs in the implementation effects of the calcium-attributable processed-portion corrosion resistance and antiblackening resistance of the Zn—Al-base-plated steel sheet that contains 4 to 25 wt % Al and the Zn—Al-base-plated steel sheet that contains 25 to 75 wt % Al. On the other hand, when the calcium coating weight is greater than 200 mg/m$^2$, the dissolution amount excessively increases. Because of the increase, the corrosion resistance is reduced even in a sound film portion (film portion where no damage is caused by processing and the like). From this viewpoint, it is more preferable that the coating weight of the compound should be in a range of from 10 to 100 mg/m$^2$.

Significant improvement can be expected in the processed-portion corrosion resistance by allowing the chromium compound and the calcium compound to coexist in the film. In addition, the aforementioned coexistence enables significant improvement to be expected in the antiblackening resistance of the Zn—Al-base-plated steel sheet that contains 4 to 25 wt % Al and the Zn—Al-base-plated steel sheet that contains 25 to 75 wt % Al.

A mechanism of the above is considered to be as follows. Since the chromium-contained refractory film provides not only barrier effects, but also effects (binder effects) of binding calcium in the film, the calcium is included uniformly and firmly in the film. Consequently, the above-described self-healing effects can be imparted more effectively. In addition, the corrosion reaction can be inhibited earlier. In addition, the mechanism allows the blackening behavior to be inhibited in the Zn—Al-base-plated steel sheet that contains 4 to 25 wt % Al and the Zn—Al-base-plated steel sheet that contains 25 to 75 wt % Al.

In addition to the above-described film components, the film may further contain oxide fine particles of, for example, silicon oxide, aluminum oxide, zirconium oxide, titanium oxide, cerium oxide, and antimonium oxide.

In addition to the aforementioned film components, the film may further contain organic polymeric resins. For example, the organic polymeric resins are epoxy resins, polyhydroxypolyether resins, acrylic copolymer resins, ethylene-acrylic acid copolymer resins, alkyd resins, polybutadiene resins, phenol resins, polyurethane resins, polyamine resins, and polyphenylene resins.

In Embodiment 2, the treatment liquid contains the water-soluble chromium compound and the calcium or a compound thereof. The steel-sheet surface is coated with the treatment liquid that contains (i) hexavalent chromium ions in a range of from 0.1 to 50 g/l and (ii) calcium in a range of from 1 to 50 g/l. The coated surface is then heated in a highest-reachable sheet temperature in a range of from 60 to 300° C. without performing rinsing. In this way, chemical conversion films are formed. This method enables the production of a surface-treated steel sheet that has a high processed-portion corrosion resistance. In addition, the method enables a high antiblackening resistance to be produced on either the Zn—Al-base-plated steel sheet that contains 4 to 25 wt % Al or the Zn—Al-base-plated steel sheet that contains 25 to 75 wt % Al.

In the above, the concentration of the hexavalent chromium ions affects the plating as follows. When the hexavalent chromium ions are below 0.1 g/l, since the coating amount should be significantly increased to obtain a desired chromium coating weight, nonuniformed coating is prone to occur. When the hexavalent chromium ions are above 50 g/l, since the reactivity of the treatment liquid is extremely high, the dissolution amount of the plating film increases. This reduces the stability of the treatment liquid. The case is therefore not preferable.

The type of the hexavalent chromium ions is not specifically limited as long as the ions are water-soluble. For example, chromic acid and ammonium chromate belong to the type; and refractory chromium, such as zinc chromate, strontium chromate, and barium chromate, do not belong to the type.

In the above-described water-soluble chromium compound, the weight ratio (as converted to metallic chromium) of trivalent chromium ions/(trivalent chromium ions+hexavalent chromium ions) is preferably in a range of from 0.2 to 0.8. This enables the production of a surface-treated steel sheet that has a high processed-portion corrosion resistance. In addition, the antiblackening resistance can further be improved for either the Zn—Al-base-plated steel sheet that contains 4 to 25 wt % Al or the Zn—Al-base-plated steel sheet that contains 25 to 75 wt % Al.

A case is not preferable in which the weight ratio (as converted to metallic chromium) of trivalent chromium ions/(trivalent chromium ions+hexavalent chromium ions) is below 0.2. In this case, the concentration of hexavalent chromium ions excessively increases, and the refractory property of the film decreases. In addition, in a corrosive environment, the case does not contribute to the corrosion resistance. For the Zn—Al-base-plated steel sheet that contains 4 to 25 wt % Al and the Zn—Al-base-plated steel sheet that contains 25 to 75 wt % Al, the case does not contribute even to the antiblackening resistance, and the dissolution amount of the ions increases. Thus, the case is not preferable from the viewpoint of economy and environmental applicability. On the other hand, the weight ratio of trivalent chromium ions/(trivalent chromium ions+hexavalent chromium ions) is above 0.8, the treatment liquid is prone to gel, significantly decreasing the stability of the treatment liquid.

In Embodiment 2, the treatment liquid contains the water-soluble chromium compound, in which the chromium compound is composed of a trivalent-chromium compound, and the calcium or a compound thereof. The steel-sheet surface is coated with the treatment liquid that contains (i) trivalent chromium ions in a range of from 0.1 to 50 g/l and (ii) calcium in a range of from 1 to 50 g/l. The coated surface is then heated at a highest-reachable sheet temperature in a range of from 60 to 300° C. without performing rinsing. In this way, a chemical conversion film is formed. This method enables the production of a surface-treated steel sheet that has a high processed-portion corrosion resistance. In addition, the method enables the high antiblackening resistance to be further improved for either the Zn—Al-base-plated steel sheet that contains 4 to 25 wt % Al or the Zn—Al-base-plated steel sheet that contains 25 to 75 wt % Al. In this method of the present invention, since the treatment liquid does not contain hexavalent chromium ions, it does not cause the problem of out-of-system dissolution of hexavalent chromium when the steel sheet is used. In addition, the method can provide high self-healing capability without relying on the hexavalent chromium.

In the above, the concentration of the trivalent chromium ions affects the plating as follows. When the trivalent chromium ions are below 0.1 g/l, since the coating amount should be significantly increased to obtain a desired chromium coating weight, nonuniformed coating is prone to occur. When the trivalent chromium ions are above 50 g/l, since the reactivity of the treatment liquid is extremely high, the dissolution amount of the plating film increases. This reduces the stability of the treatment liquid. The case is therefore not preferable.

The trivalent-chromium compound is not specifically limited as long as the compound is water-soluble. Examples thereof include chromium chloride, chromium sulfate, chromium acetate, and chromium formate. Preferably, the trivalent-chromium compound is chromium carboxylate such as chromium acetate or chromium formate.

The calcium or the compound thereof that is to coexist with the water-soluble chromium compound is not specifically limited. The calcium or the compound may by any one of calcium oxide and calcium hydroxide; a single-type salt that contains only calcium as cation, for example, calcium silicate, calcium carbonate, calcium phosphate, and calcium molybdate; and a double-type salt that contains cation other than calcium cation such as calcium-zinc phosphate, calcium-magnesium phosphate, and calcium-zinc molybdate. Alternatively, the above may be mixed. The usable compounds also include products that are reactant with other compounds in the treatment liquid. Alternatively, calcium or calcium ions may be used.

The concentration of the calcium affects the plating as follows. When the calcium concentration is set below 1 g/l, the calcium necessary to provide sufficient self-healing effects cannot be included in the film. Also, the calcium necessary to provide sufficient processed-portion corrosion resistance and antiblackening resistance cannot be included in the film on either the Zn—Al-base-plated steel sheet that contains 4 to 25 wt % Al or the Zn—Al-base-plated steel sheet that contains 25 to 75 wt % Al. When the calcium concentration is set above 50 g/l, since the amount of the calcium in the film is extremely high, the corrosion resistance of a sound film portion is reduced. The case is therefore not preferable.

Furthermore, as a film-deposition assistant, inorganic acid may be included. Examples of the inorganic acid are phosphoric acid, polyphosphoric acid, boric acid, and phosphoric acid.

For an application method for the above-described treatment liquid, there are no specific limitations. For example, the method may be a roll-coater method, a ringer-roll method, a dipping method, and an air-knife squeezing method.

Preferably, after coating, the coated surface is heated at a highest-reachable sheet temperature in a range of from 60 to 300° C. without performing rinsing. When the highest-reachable sheet temperature is below 60° C., trivalent-chromium compound having excellent barrier effects is not sufficiently formed. When the highest-reachable sheet temperature is above 300° C., cracks occurs in the film. The cracks are so innumerous, so that self-healing effects of the film do not work. Thus, in either out-of-range case, the corrosion resistance significantly decreases in processed portions and sound portions of the film.

EXAMPLE 1

For original processing steel sheets, zinc-base-plated steel sheets of the types shown in Table 5 were used. With treatment-liquid compositions and curing temperatures that are shown in Tables 6 to 8, roll-coater coating was performed. Without performing rinsing, heat-curing was performed, and individual chemical conversion films were formed. The coating weight was controlled through variables such as the coating amount, the roll-coater peripheral speed, and pressing forces. Surface-treated steel sheets thus obtained were. evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to 100 cycles of the following compound corrosion testing.

3 wt % salt spray testing (30° C.; 0.5 hours)

↓

Humidity cabinet testing (30° C.; 95% RH; 1.5 hours)

↓

Hot-air curing testing (50° C.; 20%; 2.0 hours)

↓

Hot-air curing testing (30° C.; 20%; 2.0 hours)

The evaluation was performed for the rust-developed area ratio in 5-mm areas on two sides of the cut slit. The conditions (color tones) of developed rust depended on the Al concentration of the plating film. White rust was caused in zinc-plated steel sheets and Zn/Al-base-plated steel sheets having Al concentrations of at most 25 wt %. Rust ranging in color from gray to black was caused on Zn/Al-base-plated steel sheets having Al concentrations ranged from 25 to 75 wt %.

⊙: No rust

○+: Rust-developed area ratio=less than 5%

○: Rust-developed area ratio=at least 5% to less than 10%

○−: Rust-developed area ratio=at least 10% to less than 25%

Δ: Rust-developed area ratio=at least 25% to less than 50%

×: Rust-developed area ratio=at least 50%

(2) Corrosion Resistances of Sound Film Portions

The above-described compound corrosion testing was performed 200 cycles for each test sample for which no damage nor bending nor other processing was provided. Using criteria shown above, the evaluation was performed based on a rust-developed area ratio of the test-sample surface. Rust conditions were the same as in the case of the above-described processed-portion corrosion resistance.

(3) Antiblackening Resistances

Evaluation was performed for the antiblackening resistances of Zn/Al-base-plated steel sheets containing at least 4 wt % Al. In specific, the evaluation was performed by using the following two methods depending on the Al concentration. (Zn/Al-base-plated steel sheets with Al Concentrations of 4 to 25 wt %: item No. 2 in Table 5)

Test samples for which no damage nor bending nor other processing was provided were stacked, and placed in a humidity cabinet tester (HCT) for six days. The appearance of the test samples was visually observed, and the antiblackening resistance was evaluated according to the following criteria:

⊙: No changed portion in pre-testing and post-testing appearance

○: Slight dot-likely-changed portions in post-testing appearance (area=less than 10%)

Δ: Island-likely-changed portions in post-testing appearance (area=at least 10% to less than 50%)

×: Visibly-blackened portions or at-least-50%-surface-changed portions in post-testing appearance (Zn/Al-base-plated steel sheets with Al Concentrations of 25 to 75 wt %: Item No. 3 in Table 5)

Evaluation was performed for test samples for which no damage nor bending nor other processing was provided. Each of the test samples was held in a thermo-hygrostat chamber for 24 hours. The thermo-hygrostat apparatus was atmospherically controlled at a temperature of 80° C. and a relative humidity of 95% (RH). Evaluation was performed for the individual test samples in the above state by measuring a variation (ΔL value) in the whiteness (L value), that is, the (pre-testing L value−post-testing L value), according to the following criteria:

⊙: $\Delta L \geqq -1.0$

○: $-1.0 > \Delta L \geqq -2.0$

Δ: $-2.0 > \Delta L \geqq -4.0$

×: $-4.0 > \Delta L$

The evaluation results are shown in Tables 6 to 8.

TABLE 5

| No. | Type | Coating weight g/m² |
|---|---|---|
| 1 | Molten-Zn-plated steel sheet | 120 |
| 2 | Molten-Zn-5 wt % Al-0.5 wt % Mg-alloy-plated steel sheet | 90 |
| 3 | Molten-Zn-55 wt % Al-alloy-plated steel | 90 |

TABLE 6

| No. | Plated steel sheet *1 | Treatment-liquid composition (g/l) $Cr^{6+}$ | Ca | Curing temperature (° C.) | Film composition (mg/m²) Cr | Ca | Corosion resistance Sound film portion | Processed portion | Antiblackening resistance | Remarks |
|---|---|---|---|---|---|---|---|---|---|---|
| 1 | 1 | 0.1 | 0 | 140 | 0.1 | 0 | Δ | x | — | Comparative example |
| 2 | 1 | 1 | 1 | 140 | 0.1 | 0.1 | Δ | ○− | — | |
| 3 | 1 | 0.1 | 50 | 140 | 0.1 | 200 | Δ | ○− | — | |
| 4 | 1 | 0.1 | 50 | 140 | 0.1 | 300 | x | Δ | — | Comparative example |
| 5 | 1 | 2 | 0 | 140 | 20 | 0 | ○− | x | — | Comparative example |
| 6 | 1 | 0.5 | 1 | 140 | 20 | 20 | ○− | ○− | — | |
| 7 | 1 | 0.5 | 2 | 140 | 20 | 40 | ○− | ○ | — | |

TABLE 6-continued

| No. | Plated steel sheet *1 | Treatment-liquid composition (g/l) $Cr^{6+}$ | Ca | Curing temperature (° C.) | Film composition ($mg/m^2$) Cr | Ca | Corosion resistance Sound film portion | Processed portion | Antiblackening resistance | Remarks |
|---|---|---|---|---|---|---|---|---|---|---|
| 8 | 1 | 2 | 8 | 140 | 20 | 80 | ○− | ○+ | — | |
| 9 | 1 | 2 | 20 | 140 | 20 | 200 | ○− | ⊙ | — | |
| 10 | 1 | 2 | 30 | 140 | 20 | 300 | x | Δ | — | Comparative example |
| 11 | 1 | 4 | 0 | 140 | 40 | 0 | ○ | x | — | Comparative example |
| 12 | 1 | 40 | 20 | 140 | 40 | 20 | ○ | ○ | — | |
| 13 | 1 | 20 | 20 | 140 | 40 | 40 | ○ | ○+ | — | |
| 14 | 1 | 20 | 40 | 140 | 40 | 80 | ○ | ○+ | — | |
| 15 | 1 | 4 | 20 | 140 | 40 | 200 | ○ | ⊙ | — | |
| 16 | 1 | 2 | 30 | 140 | 40 | 300 | x | Δ | — | Comparative example |
| 17 | 1 | 50 | 0 | 140 | 100 | 0 | ○+ | x | — | Comparative example |
| 18 | 1 | 50 | 1 | 140 | 100 | 0.1 | ○+ | ○− | — | |
| 19 | 1 | 1 | 2 | 140 | 100 | 200 | .○+ | ○+ | — | |
| 20 | 1 | 10 | 30 | 140 | 100 | 300 | x | Δ | — | Comparative example |

*1Refer to Table 5

TABLE 7

| No. | Plated steel sheet *1 | Treatment-liquid composition (g/l) $Cr^{6+}$ | Ca | Curing temperature (° C.) | Film composition ($mg/m^2$) Cr | Ca | Corosion resistance Sound film portion | Processed portion | Antiblackening resistance | Remarks |
|---|---|---|---|---|---|---|---|---|---|---|
| 21 | 2 | 0.1 | 0 | 140 | 0.1 | 0 | ○− | Δ | x | Comparative example |
| 22 | 2 | 1 | 1 | 140 | 0.1 | 0.1 | ○− | ○− | ○ | |
| 23 | 2 | 0.1 | 50 | 140 | 0.1 | 200 | ○− | ○− | ○ | |
| 24 | 2 | 0.1 | 50 | 140 | 0.1 | 300 | Δ | Δ | ○ | Comparative example |
| 25 | 2 | 2 | 0 | 140 | 20 | 0 | ○ | Δ | Δ | Comparative example |
| 26 | 2 | 0.5 | 1 | 140 | 20 | 20 | ○ | ○ | ⊙ | |
| 27 | 2 | 0.5 | 2 | 140 | 20 | 40 | ○ | ○+ | ⊙ | |
| 28 | 2 | 2 | 8 | 140 | 20 | 80 | ○ | ⊙ | ⊙ | |
| 29 | 2 | 2 | 20 | 140 | 20 | 200 | ○ | ⊙ | ⊙ | |
| 30 | 2 | 2 | 30 | 140 | 20 | 300 | Δ | Δ | ○ | Comparative example |
| 31 | 2 | 4 | 0 | 140 | 40 | 0 | ○+ | Δ | Δ | Comparative example |
| 32 | 2 | 40 | 20 | 140 | 40 | 20 | ○+ | ○+ | ⊙ | |
| 33 | 2 | 20 | 20 | 140 | 40 | 40 | ○+ | ⊙ | ⊙ | |
| 34 | 2 | 20 | 40 | 140 | 40 | 80 | ○+ | ⊙ | ⊙ | |
| 35 | 2 | 4 | 20 | 140 | 40 | 200 | ○+ | ⊙ | ⊙ | |
| 36 | 2 | 2 | 30 | 140 | 40 | 300 | Δ | Δ | ○ | Comparative example |
| 37 | 2 | 50 | 0 | 140 | 100 | 0 | ⊙ | Δ | Δ | Comparative example |
| 38 | 2 | 50 | 1 | 140 | 100 | 0.1 | ⊙ | ○− | ⊙ | |
| 39 | 2 | 1 | 2 | 140 | 100 | 200 | ⊙ | ⊙ | ⊙ | |
| 40 | 2 | 10 | 30 | 140 | 100 | 300 | Δ | Δ | ○ | Comparative example |

*1Refer to Table 5

TABLE 8

| No. | Plated steel sheet *1 | Treatment-liquid composition (g/l) $Cr^{6+}$ | Ca | Curing temperature (° C.) | Film composition ($mg/m^2$) Cr | Ca | Corosion resistance Sound film portion | Processed portion | Antiblackening resistance | Remarks |
|---|---|---|---|---|---|---|---|---|---|---|
| 41 | 3 | 0.1 | 0 | 140 | 0.1 | 0 | ○ | Δ | x | Comparative example |
| 42 | 3 | 1 | 1 | 140 | 0.1 | 0.1 | ○ | ○ | ○ | |
| 43 | 3 | 0.1 | 50 | 140 | 0.1 | 200 | ○ | ○ | ○ | |

TABLE 8-continued

| No. | Plated steel sheet *1 | Treatment-liquid composition (g/l) $Cr^{6+}$ | Ca | Curing temperature (° C.) | Film composition ($mg/m^2$) Cr | Ca | Corosion resistance Sound film portion | Processed portion | Antiblackening resistance | Remarks |
|---|---|---|---|---|---|---|---|---|---|---|
| 44 | 3 | 0.1 | 50 | 140 | 0.1 | 300 | ○− | Δ | ○ | Comparative example |
| 45 | 3 | 2 | 0 | 140 | 20 | 0 | ○+ | Δ | Δ | Comparative example |
| 46 | 3 | 0.5 | 1 | 140 | 20 | 20 | ○+ | ◎ | ◎ | |
| 47 | 3 | 0.5 | 2 | 140 | 20 | 40 | ○+ | ◎ | ◎ | |
| 48 | 3 | 2 | 8 | 140 | 20 | 80 | ○+ | ◎ | ◎ | |
| 49 | 3 | 2 | 20 | 140 | 20 | 200 | ○+ | ◎ | ◎ | |
| 50 | 3 | 2 | 30 | 140 | 20 | 300 | ○− | Δ | ○ | Comparative example |
| 51 | 3 | 4 | 0 | 140 | 40 | 0 | ◎ | Δ | Δ | Comparative example |
| 52 | 3 | 40 | 20 | 140 | 40 | 20 | ◎ | ◎ | ◎ | |
| 53 | 3 | 20 | 20 | 140 | 40 | 40 | ◎ | ◎ | ◎ | |
| 54 | 3 | 20 | 40 | 140 | 40 | 80 | ◎ | ◎ | ◎ | |
| 55 | 3 | 4 | 20 | 140 | 40 | 200 | ◎ | ◎ | ◎ | |
| 56 | 3 | 2 | 30 | 140 | 40 | 300 | ○− | Δ | ○ | Comparative example |
| 57 | 3 | 50 | 0 | 140 | 100 | 0 | ◎ | Δ | Δ | Comparative example |
| 58 | 3 | 50 | 1 | 140 | 100 | 0.1 | ◎ | ○ | ◎ | |
| 59 | 3 | 1 | 2 | 140 | 100 | 200 | ◎ | ◎ | ◎ | |
| 60 | 3 | 10 | 30 | 140 | 100 | 300 | ○− | Δ | ○ | Comparative example |
| 61 | 3 | 0.5 | 1 | 50 | 20 | 20 | Δ | Δ | ○ | Comparative example for production method |
| 62 | 3 | 0.5 | 1 | 60 | 20 | 20 | ○− | ○− | ◎ | |
| 63 | 3 | 0.5 | 1 | 300 | 20 | 20 | ○+ | ◎ | ◎ | |
| 64 | 3 | 0.5 | 1 | 320 | 20 | 20 | Δ | Δ | ○ | Comparative example for production method |

*1Refer to Table 5

According to Tables 6 to 8, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, the following can be known by comparison to the comparison examples of the steel sheets that contain at least 4 wt % Al and that are each plated with a film that is out of the range of the first pattern. In the comparison, the antiblackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

Furthermore, with the film formed in the range of the first pattern, high film quality can be obtained for the steel sheets produced according to the conditions within the range of the fourth pattern. However, the film quality is degraded for the steel sheets of the comparative examples (item Nos. 61 and 64) on which the film was formed at curing temperatures that are out of the range of the fourth pattern.

EXAMPLE 2

For original processing steel sheets, zinc-base-plated steel sheets of the types shown in Table 5 were used. With treatment-liquid compositions and curing temperatures that are shown in Tables 9 to 11, roll-coater coating was performed. Without performing rinsing, heat-curing was performed, and individual chemical conversion films were formed. The coating weight was controlled through variables such as the coating amount, the roll-coater peripheral speed, and pressing forces. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to a 120-hour salt spray testing that conforms to JIS Z 2371. Evaluation was performed for the rust-developed area ratio in 5-mm areas on two sides of the cut slit. The conditions (color tones) of developed rust were the same as in the case of the evaluation of the processed-portion corrosion resistance in Example 1.

(2) Corrosion Resistances of Sound Film Portions

The above-described salt spray testing was performed for 360 hours for each test sample for which no damage nor bending nor other processing was provided. Using the same criteria set in Example 1, the evaluation was performed based on the rust-developed area ratio of the test-sample surface. Rust conditions were the same as in the case of the above-described evaluation of the processed-portion corrosion resistances.

(3) Antiblackening Resistances

Evaluation was performed for the antiblackening resistances of Zn/Al-base-plated steel sheets containing at least 4 wt % Al in the same manners as those in Example 1.

The evaluation results are shown in Tables 9 to 11.

TABLE 9

| No. | Plated steel sheet*1 | Treatment-liquid compostion (g/l) $Cr^{6+}$ | Ca | Cr reduction ratio*2 | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 1 | 1 | 0.1 | 0 | 0.4 | 140 | 0.1 | 0 | Δ | x | — | Comparative example |
| 2 | 1 | 1 | 1 | 0.4 | 140 | 0.1 | 0.1 | Δ | ○− | — | |
| 3 | 1 | 0.1 | 50 | 0.4 | 140 | 0.1 | 200 | Δ | ○− | — | |
| 4 | 1 | 0.1 | 50 | 0.4 | 140 | 0.1 | 300 | x | Δ | — | Comparative example |
| 5 | 1 | 2 | 0 | 0.4 | 140 | 20 | 0 | ○− | x | — | Comparative example |
| 6 | 1 | 2 | 2 | 0.4 | 140 | 20 | 20 | ○− | ○− | — | |
| 7 | 1 | 2 | 4 | 0.4 | 140 | 20 | 40 | ○− | ○ | — | |
| 8 | 1 | 2 | 8 | 0.4 | 140 | 20 | 80 | ○− | ○+ | — | |
| 9 | 1 | 2 | 20 | 0.4 | 140 | 20 | 200 | ○− | ◎ | — | |
| 10 | 1 | 2 | 30 | 0.4 | 140 | 20 | 300 | x | Δ | — | Comparative example |
| 11 | 1 | 4 | 0 | 0.4 | 140 | 40 | 0 | ○ | x | — | Comparative example |
| 12 | 1 | 40 | 20 | 0.4 | 140 | 40 | 20 | ○ | ○ | — | |
| 13 | 1 | 20 | 20 | 0.4 | 140 | 40 | 40 | ○ | ○+ | — | |
| 14 | 1 | 20 | 40 | 0.4 | 140 | 40 | 80 | ○ | ○+ | — | |
| 15 | 1 | 4 | 20 | 0.4 | 140 | 40 | 200 | ○ | ◎ | — | |
| 16 | 1 | 2 | 30 | 0.4 | 140 | 40 | 300 | x | Δ | — | Comparative example |
| 17 | 1 | 50 | 0 | 0.4 | 140 | 100 | 0 | ○+ | x | — | Comparative example |
| 18 | 1 | 50 | 1 | 0.4 | 140 | 100 | 0.1 | ○+ | ○− | — | |
| 19 | 1 | 1 | 2 | 0.4 | 140 | 100 | 200 | ○+ | ○+ | — | |
| 20 | 1 | 10 | 30 | 0.4 | 140 | 100 | 300 | x | Δ | — | Comparative example |

*1Refer to Table 5

*2Trivalent chromium ions/total Cr, total Cr = Trivalent chromium ions + hexavalent chromium ions

TABLE 10

| No. | Plated steel sheet*1 | Treatment-liquid compostion (g/l) $Cr^{6+}$ | Ca | Cr reduction ratio*2 | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 21 | 2 | 0.1 | 0 | 0.4 | 140 | 0.1 | 0 | ○− | Δ | x | Comparative example |
| 22 | 2 | 1 | 1 | 0.4 | 140 | 0.1 | 0.1 | ○− | ○− | ○ | |
| 23 | 2 | 0.1 | 50 | 0.4 | 140 | 0.1 | 200 | ○− | ○− | ○ | |
| 24 | 2 | 0.1 | 50 | 0.4 | 140 | 0.1 | 300 | Δ | Δ | ○ | Comparative example |
| 25 | 2 | 2 | 0 | 0.4 | 140 | 20 | 0 | ○ | Δ | Δ | Comparative example |
| 26 | 2 | 2 | 2 | 0.4 | 140 | 20 | 20 | ○ | ○ | ◎ | |
| 27 | 2 | 2 | 4 | 0.4 | 140 | 20 | 40 | ○ | ○+ | ◎ | |
| 28 | 2 | 2 | 8 | 0.4 | 140 | 20 | 80 | ○ | ◎ | ◎ | |
| 29 | 2 | 2 | 20 | 0.4 | 140 | 20 | 200 | ○ | ◎ | ◎ | |
| 30 | 2 | 2 | 30 | 0.4 | 140 | 20 | 300 | Δ | Δ | ○ | Comparative example |
| 31 | 2 | 4 | 0 | 0.4 | 140 | 40 | 0 | ○+ | Δ | Δ | Comparative example |
| 32 | 2 | 40 | 20 | 0.4 | 140 | 40 | 20 | ○+ | ○+ | ◎ | |
| 33 | 2 | 20 | 20 | 0.4 | 140 | 40 | 40 | ○+ | ◎ | ◎ | |
| 34 | 2 | 20 | 40 | 0.4 | 140 | 40 | 80 | ○+ | ◎ | ◎ | |
| 35 | 2 | 4 | 20 | 0.4 | 140 | 40 | 200 | ○+ | ◎ | ◎ | |

TABLE 10-continued

| No. | Plated steel sheet*1 | Treatment-liquid compostion (g/l) $Cr^{6+}$ | Ca | Cr reduction ratio*2 | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 36 | 2 | 2 | 30 | 0.4 | 140 | 40 | 300 | Δ | Δ | ○ | Comparative example |
| 37 | 2 | 50 | 0 | 0.4 | 140 | 100 | 0 | ◎ | Δ | Δ | Comparative example |
| 38 | 2 | 50 | 1 | 0.4 | 140 | 100 | 0.1 | ◎ | ○− | ◎ | |
| 39 | 2 | 1 | 2 | 0.4 | 140 | 100 | 200 | ◎ | ◎ | ◎ | |
| 40 | 2 | 10 | 30 | 0.4 | 140 | 100 | 300 | Δ | Δ | ○ | Comparative example |

*1Refer to Table 5
*2Trivalent chromium ions/total Cr, total Cr = Trivalent chromium ions + hexavalent chromium ions

TABLE 11

| No. | Plated steel sheet*1 | Treatment-liquid compostion (g/l) $Cr^{6+}$ | Ca | Cr reduction ratio*2 | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 41 | 3 | 0.1 | 0 | 0.4 | 140 | 0.1 | 0 | ○ | Δ | x | Comparative example |
| 42 | 3 | 1 | 1 | 0.4 | 140 | 0.1 | 0.1 | ○ | ○ | ○ | |
| 43 | 3 | 0.1 | 50 | 0.4 | 140 | 0.1 | 200 | ○ | ○ | ○ | |
| 44 | 3 | 0.1 | 50 | 0.4 | 140 | 0.1 | 300 | ○− | Δ | ○ | Comparative example |
| 45 | 3 | 2 | 0 | 0.4 | 140 | 20 | 0 | ○+ | Δ | Δ | Comparative example |
| 46 | 3 | 2 | 2 | 0.4 | 140 | 20 | 20 | ○+ | ◎ | ◎ | |
| 47 | 3 | 2 | 4 | 0.4 | 140 | 20 | 40 | ○+ | ◎ | ◎ | |
| 48 | 3 | 2 | 8 | 0.4 | 140 | 20 | 80 | ○+ | ◎ | ◎ | |
| 49 | 3 | 2 | 20 | 0.4 | 140 | 20 | 200 | ○+ | ◎ | ◎ | |
| 50 | 3 | 2 | 30 | 0.4 | 140 | 20 | 300 | ○− | Δ | ○ | Comparative example |
| 51 | 3 | 4 | 0 | 0.4 | 140 | 40 | 0 | ◎ | Δ | Δ | Comparative example |
| 52 | 3 | 40 | 20 | 0.4 | 140 | 40 | 20 | ◎ | ◎ | ◎ | |
| 53 | 3 | 20 | 20 | 0.4 | 140 | 40 | 40 | ◎ | ◎ | ◎ | |
| 54 | 3 | 20 | 40 | 0.4 | 140 | 40 | 80 | ◎ | ◎ | ◎ | |
| 55 | 3 | 4 | 20 | 0.4 | 140 | 40 | 200 | ◎ | ◎ | ◎ | |
| 56 | 3 | 2 | 30 | 0.4 | 140 | 40 | 300 | ○− | Δ | ○ | Comparative example |
| 57 | 3 | 50 | 0 | 0.4 | 140 | 100 | 0 | ◎ | Δ | Δ | Comparative example |
| 58 | 3 | 50 | 1 | 0.4 | 140 | 100 | 0.1 | ◎ | ○ | ◎ | |
| 59 | 3 | 1 | 2 | 0.4 | 140 | 100 | 200 | ◎ | ◎ | ◎ | |
| 60 | 3 | 10 | 30 | 0.4 | 140 | 100 | 300 | ○− | Δ | ○ | Comparative example |
| 61 | 3 | 0.5 | 1 | 0.4 | 50 | 20 | 20 | Δ | Δ | ○ | Comparative example for production method |
| 62 | 3 | 0.5 | 1 | 0.4 | 60 | 20 | 20 | ○− | ○− | ◎ | |
| 63 | 3 | 0.5 | 1 | 0.4 | 300 | 20 | 20 | ○+ | ◎ | ◎ | |
| 64 | 3 | 0.5 | 1 | 0.4 | 320 | 20 | 20 | Δ | Δ | ○ | Comparative example for production method |
| 65 | 3 | 0.5 | 1 | 0.1 | 140 | 20 | 20 | ○− | Δ | ○ | Comparative example for production method (5th pattern) |
| 66 | 3 | 0.5 | 1 | 0.2 | 140 | 20 | 20 | ○− | ○− | ◎ | |
| 67 | 3 | 0.5 | 1 | 0.8 | 140 | 20 | 20 | ○− | ○− | ◎ | |
| 68 | 3 | 0.5 | 1 | 0.9 | 140 | — | — | | Treatment liquid gelled | | Comparative example for |

TABLE 11-continued

| No. | Plated steel sheet*1 | Treatment-liquid compostion (g/l) $Cr^{6+}$ | Ca | Cr reduction ratio*2 | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| | | | | | | | | | | | production method (5th pattern) |

*1Refer to Table 5

*2Trivalent chromium ions/total Cr, total Cr = Trivalent chromium ions + hexavalent chromium ions According to Tables 9 to 11, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, the following can be known by comparison to the comparison examples of the steel sheets that contain at least 4 wt % Al and that are each plated with a film that is out of the range of the first pattern. In the comparison, the antiblackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

In addition, regarding the deposition of the film in the range of the first pattern, the following can be known by comparison to the comparison examples of the steel sheets (item Nos. 61 and 64) that are plated with the film formed at temperatures that are out of the range of the fourth pattern. In the comparison, higher film quality can be obtained with the steel sheets that are plated with the film formed at a curing temperature that is within the range of the fourth pattern. Furthermore, the following can be known by comparison to the case (item No. 65) of film deposition with the treatment liquid of which the Cr reduction ratio is below the range of the fifth pattern. In the comparison, higher film quality can be obtained when the film is formed with the treatment liquid of which the Cr reduction ratio is within the range of the fifth pattern. In the case (item No. 68) using the treatment liquid of which the Cr reduction ratio is above the range of the fifth pattern, since the treatment liquid gelled, evaluation was not performed for the corresponding steel sheet.

EXAMPLE 3

For original processing steel sheets, zinc-base-plated steel sheets of the types shown in Table 5 were used. For the trivalent-chromium compounds, chromic salts of types as shown in Table 12 were used. With treatment-liquid compositions and curing temperatures that are shown in Tables 13 to 15, roll-coater coating was performed. Without performing rinsing, heat-curing was performed, and individual chemical conversion films were formed. The coating weight was controlled through variables such as the coating amount, the roll-coater peripheral speed, and pressing forces. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to 100 cycles of the following compound corrosion testing in the listed order:

3 wt % salt spray testing (30° C.; 0.5 hours)

↓

Humidity cabinet testing (30° C.; 95% RH; 1.5 hours)

Using the same criteria as those in Example 1, evaluation was performed for the rust-developed area ratio in 5-mm areas on two sides of the cut slit. The conditions (color tones) of developed rust were the same as in the case of the evaluation of the processed-portion corrosion resistance in Example 1.

(2) Corrosion Resistances of Sound Film Portions

The above-described compound corrosion testing was performed 200 cycles for each test sample for which no damage nor bending nor other processing was provided. Using the same criteria as described above, the evaluation was performed based on a rust-developed area ratio of the test-sample surface. Rust conditions were the same as in the case of the above-described evaluation of the processed-portion corrosion resistances.

(3) Antiblackening Resistances

Evaluation was performed for the antiblackening resistances of Zn/Al-base-plated steel sheets containing at least 4 wt % Al in the same manners as those in Example 1.

The evaluation results are shown in Tables 13 to 15.

TABLE 12

| No. | Type |
|---|---|
| 1 | chromium (III) chloride |
| 2 | chromium (III) nitrate |
| 3 | chromium (III) formate |
| 4 | chromium (III) acetate |

TABLE 13

| No. | Plated steel sheet *1 | Treatment-liquid composition (g/l) $Cr^{3+}$ Type*2 | $Cr^{3+}$ | Ca | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 1 | 1 | 4 | 0.1 | 0 | 140 | 0.1 | 0 | Δ | x | — | Comparative example |
| 2 | 1 | 4 | 1 | 1 | 140 | 0.1 | 0.1 | Δ | ○− | — | |
| 3 | 1 | 4 | 0.1 | 50 | 140 | 0.1 | 200 | Δ | ○− | — | |
| 4 | 1 | 4 | 0.1 | 50 | 140 | 0.1 | 300 | x | Δ | — | Comparative example |
| 5 | 1 | 4 | 2 | 0 | 140 | 20 | 0 | ○− | x | — | Comparative example |
| 6 | 1 | 4 | 0.5 | 1 | 140 | 20 | 20 | ○− | ○− | — | |
| 7 | 1 | 4 | 0.5 | 4 | 140 | 20 | 40 | ○− | ○ | — | |
| 8 | 1 | 4 | 2 | 8 | 140 | 20 | 80 | ○− | ○+ | — | |
| 9 | 1 | 4 | 2 | 20 | 140 | 20 | 200 | ○− | ⊙ | — | |
| 10 | 1 | 4 | 2 | 30 | 140 | 20 | 300 | x | Δ | — | Comparative example |
| 11 | 1 | 4 | 4 | 0 | 140 | 40 | 0 | ○ | x | — | Comparative example |
| 12 | 1 | 4 | 40 | 20 | 140 | 40 | 20 | ○ | ○ | — | |
| 13 | 1 | 4 | 20 | 20 | 140 | 40 | 40 | ○ | ○+ | — | |
| 14 | 1 | 4 | 20 | 40 | 140 | 40 | 80 | ○ | ○+ | — | |
| 15 | 1 | 4 | 4 | 20 | 140 | 40 | 200 | ○ | ⊙ | — | |
| 16 | 1 | 4 | 2 | 30 | 140 | 40 | 300 | x | Δ | — | Comparative example |
| 17 | 1 | 4 | 50 | 0 | 140 | 100 | 0 | ○+ | x | — | Comparative example |
| 18 | 1 | 4 | 50 | 1 | 140 | 100 | 0.1 | ○+ | ○− | — | |
| 19 | 1 | 4 | 1 | 2 | 140 | 100 | 200 | ○+ | ○+ | — | |
| 20 | 1 | 4 | 10 | 30 | 140 | 100 | 300 | x | Δ | — | Comparative example |

*1Refer to Table 5
*2Refer to Table 12

TABLE 14

| No. | Plated steel sheet *1 | Treatment-liquid composition (g/l) $Cr^{3+}$ Type*2 | $Cr^{3+}$ | Ca | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 21 | 2 | 4 | 0.1 | 0 | 140 | 0.1 | 0 | ○− | Δ | x | Comparative example |
| 22 | 2 | 4 | 1 | 1 | 140 | 0.1 | 0.1 | ○− | ○− | ○ | |
| 23 | 2 | 4 | 0.1 | 50 | 140 | 0.1 | 200 | ○− | ○− | ○ | |
| 24 | 2 | 4 | 0.1 | 50 | 140 | 0.1 | 300 | Δ | Δ | ○ | Comparative example |
| 25 | 2 | 4 | 2 | 0 | 140 | 20 | 0 | ○ | Δ | Δ | Comparative example |
| 26 | 2 | 4 | 0.5 | 1 | 140 | 20 | 20 | ○ | ○ | ⊙ | |
| 27 | 2 | 4 | 0.5 | 4 | 140 | 20 | 40 | ○ | ○+ | ⊙ | |
| 28 | 2 | 4 | 2 | 8 | 140 | 20 | 80 | ○ | ⊙ | ⊙ | |
| 29 | 2 | 4 | 2 | 20 | 140 | 20 | 200 | ○ | ⊙ | ⊙ | |
| 30 | 2 | 4 | 2 | 30 | 140 | 20 | 300 | Δ | Δ | ○ | Comparative example |
| 31 | 2 | 4 | 4 | 0 | 140 | 40 | 0 | ○+ | Δ | Δ | Comparative example |
| 32 | 2 | 4 | 40 | 20 | 140 | 40 | 20 | ○+ | ○+ | ⊙ | |
| 33 | 2 | 4 | 20 | 20 | 140 | 40 | 40 | ○+ | ⊙ | ⊙ | |
| 34 | 2 | 4 | 20 | 40 | 140 | 40 | 80 | ○+ | ⊙ | ⊙ | |
| 35 | 2 | 4 | 4 | 20 | 140 | 40 | 200 | ○+ | ⊙ | ⊙ | |
| 36 | 2 | 4 | 2 | 30 | 140 | 40 | 300 | Δ | Δ | ○ | Comparative example |
| 37 | 2 | 4 | 50 | 0 | 140 | 100 | 0 | ⊙ | Δ | Δ | Comparative example |
| 38 | 2 | 4 | 50 | 1 | 140 | 100 | 0.1 | ⊙ | ○− | ⊙ | |

TABLE 14-continued

| No. | Plated steel sheet *1 | Treatment-liquid composition (g/l) $Cr^{3+}$ Type*2 | | Ca | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 39 | 2 | 4 | 1 | 2 | 140 | 100 | 200 | ◎ | ◎ | ◎ | |
| 40 | 2 | 4 | 10 | 30 | 140 | 100 | 300 | Δ | Δ | ○ | Comparative example |

*1Refer to Table 5
*2Refer to Table 12

TABLE 15

| No. | Plated steel sheet *1 | Treatment-liquid composition (g/l) $Cr^{3+}$ Type*2 | | Ca | Curing temperature (° C.) | Film composition (mg/m²) Cr | Ca | Corrosion resistance Sound film portion | Processed portion | Antiblackening resistance | Remarks |
|---|---|---|---|---|---|---|---|---|---|---|---|
| 41 | 3 | 4 | 0.1 | 0 | 140 | 0.1 | 0 | ○ | Δ | x | Comparative example |
| 42 | 3 | 4 | 1 | 1 | 140 | 0.1 | 0.1 | ○ | ○ | ○ | |
| 43 | 3 | 4 | 0.1 | 50 | 140 | 0.1 | 200 | ○ | ○ | ○ | |
| 44 | 3 | 4 | 0.1 | 50 | 140 | 0.1 | 300 | ○− | Δ | ○ | Comparative example |
| 45 | 3 | 4 | 2 | 0 | 140 | 20 | 0 | ○+ | Δ | Δ | Comparative example |
| 46 | 3 | 4 | 0.5 | 1 | 140 | 20 | 20 | ○+ | ◎ | ◎ | |
| 47 | 3 | 4 | 0.5 | 4 | 140 | 20 | 40 | ○+ | ◎ | ◎ | |
| 48 | 3 | 4 | 2 | 8 | 140 | 20 | 80 | ○+ | ◎ | ◎ | |
| 49 | 3 | 4 | 2 | 20 | 140 | 20 | 200 | ○+ | ◎ | ◎ | |
| 50 | 3 | 4 | 2 | 30 | 140 | 20 | 300 | ○− | Δ | ○ | Comparative example |
| 51 | 3 | 4 | 4 | 0 | 140 | 40 | 0 | ◎ | Δ | Δ | Comparative example |
| 52 | 3 | 4 | 40 | 20 | 140 | 40 | 20 | ◎ | ◎ | ◎ | |
| 53 | 3 | 4 | 20 | 20 | 140 | 40 | 40 | ◎ | ◎ | ◎ | |
| 54 | 3 | 4 | 20 | 40 | 140 | 40 | 80 | ◎ | ◎ | ◎ | |
| 55 | 3 | 4 | 4 | 20 | 140 | 40 | 200 | ◎ | ◎ | ◎ | |
| 56 | 3 | 4 | 2 | 30 | 140 | 40 | 300 | ○− | Δ | ○ | Comparative example |
| 57 | 3 | 4 | 50 | 0 | 140 | 100 | 0 | ◎ | Δ | Δ | Comparative example |
| 58 | 3 | 4 | 50 | 1 | 140 | 100 | 0.1 | ◎ | ○ | ◎ | |
| 59 | 3 | 4 | 1 | 2 | 140 | 100 | 200 | ◎ | ◎ | ◎ | |
| 60 | 3 | 4 | 10 | 30 | 140 | 100 | 300 | ○− | Δ | ○ | Comparative example |
| 61 | 3 | 4 | 0.5 | 1 | 50 | 20 | 20 | Δ | Δ | ○ | Comparative example for production method |
| 62 | 3 | 4 | 0.5 | 1 | 60 | 20 | 20 | ○− | ○− | ◎ | |
| 63 | 3 | 4 | 0.5 | 1 | 300 | 20 | 20 | ○+ | ◎ | ◎ | |
| 64 | 3 | 4 | 0.5 | 1 | 320 | 20 | 20 | Δ | Δ | ○ | Comparative example for production method |
| 65 | 3 | 1 | 0.5 | 1 | 140 | 20 | 20 | ○ | ○ | ○ | |
| 66 | 3 | 2 | 0.5 | 1 | 140 | 20 | 20 | ○ | ○ | ○ | |
| 67 | 3 | 3 | 0.5 | 1 | 140 | 20 | 20 | ○+ | ◎ | ◎ | |

*1Refer to Table 5
*2Refer to Table 12

According to Tables 13 to 15, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, as can be seen by comparison of item Nos. 46 and 65 to 67, the corrosion resistances and the antiblackening resistances are higher in the cases (item Nos. 46 and 67) using chromium carboxylate as a trivalent-chromium compound.

In addition, the following can be known by comparison to the comparison examples of the steel sheets that contain at least 4 wt % Al and that are each plated with a film that is out of the range of the first pattern. In the comparison, the antiblackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

In addition, regarding the deposition of the film in the range of the first pattern, higher film quality can be obtained with the steel sheets that are plated with the film formed at a curing temperature that is within the range of the sixth pattern. However, the film quality is degraded for the steel sheets of the comparative examples (item Nos. 60 and 64) on which the film was formed at curing temperatures that are out of the range of the sixth pattern.

Embodiment 3

Embodiment 3 has the following basic characteristics:

(1) A surface-treated steel sheet characterized as follows. A film is formed on a surface of a zinc-base-plated steel sheet. The film contains (A) chromium in a range of from 0.1 to 100 mg/m$^2$ and a compound containing phosphoric acid and at least one selected from the group consisting of zinc and aluminum in a range of from 0.1 to 100 mg/m$^2$ (as converted to phosphorus). (First Pattern)

(2) The surface-treated steel sheet according to item (1), characterized in that the zinc-base-plated steel sheet is a Zn—Al-base-plated steel sheet that contains 4 to 25 wt % aluminum (Al). (Second Pattern)

(3) The surface-treated steel sheet according to item (2), characterized in that the zinc-base-plated steel sheet is a Zn—Al-base--plated steel sheet that contains 25 to 75 wt % Al. (Third Pattern)

(4) A method for producing one of the surface-treated steel sheets as described in items (1) to (3), characterized as follows. The film is formed through application of a treatment liquid containing (i) trivalent chromium ions in a range of from 0.1 to 50 g/l and (ii) phosphoric acid in a range of from 1 to 50 g/l. Then, the coated surface is heated at a highest-reachable sheet temperature in a range of from 60 to 300° C. without performing rinsing. (Fourth Pattern)

(5) The production method according to item (4), characterized in that the weight ratio of trivalent chromium ions/(trivalent chromium ions+hexavalent chromium ions) in the treatment liquid is in a range of from 0.2 to 0.8. (Fifth Pattern)

(6) A production method for producing one of the surface-treated steel sheets as described in items (1) to (3), characterized as follows. A treatment liquid contains a water-soluble chromium compound and phosphoric acid or salt thereof, in which the water-soluble chromium compound contains a chromium compound composed of a trivalent-chromium compound. The film is formed through application of the treatment liquid onto the steel-sheet surface. Then, the coated surface is heated at a highest-reachable sheet temperature in a range from 60 to 300° C. without performing rinsing, in which the treatment liquid contains (i) trivalent chromium ions in a range of from 0.1 to 50 g/l and (ii) phosphoric acid in a range from 1 to 50 g/l. (Sixth Pattern)

(7) The production method according to item (6), characterized in that the water-soluble chromium compound is chromium carboxylate. (Seventh Pattern)

Hereinbelow, a description will be made regarding details of Embodiment 3 and reasons for limitations thereof.

For the base steel sheets, i.e., the zinc-base-plated steel sheets, various steel sheets are usable. The usable steel sheets include zinc-base-plated steel sheets, Zn—Ni-plated steel sheets, Zn—Fe-plated steel sheets (electroplated steel sheets or molten-zinc-base-alloy-plated steel sheets), Zn—Cr-plated steel sheets, Zn—Mn-plated steel sheets, Zn—Co-plated steel sheets, Zn—Co—Cr-plated steel sheets, Zn—Ni—Cr-plated steel sheets, Zn—Cr—Fe-plated steel sheets, Zn—Al-base-plated steel sheets (such as Zn-5% Al-alloy-plated steel sheets or Zn-55% Al-alloy-plated steel sheets), Zn—Mg-plated steel sheets, and Zn—Al-Mg-plated steel sheets. The usable steel sheets also include zinc-base-composite-plated steel sheets (such as Zn—$SiO_2$-dispersion-plated steel sheets) that are individually formed by dispersing a metallic oxide, a polymer, or the like in the plating film of one of the aforementioned plated steel sheets. Furthermore, the usable steel sheets include multilayer-plated steel sheets individually at least two layers of the identical or different plating types among those shown above.

The Zn—Al-base-plated steel sheet that contains 4 to 25 wt % Al contains 4 to 25 wt % Al as an indispensable component, and further contains small amounts of materials of other elements, such as La, Ce, Mg, and Si, depending on the necessity. A so-called Zn-5% Al-alloy-plated steel sheet belongs to the steel sheet of that type.

The Zn—Al-base-plated steel sheet that contains 25 to 75 wt % Al contains 25 to 75 wt % Al as an indispensable component, and further contains small amounts of materials of other elements, such as La, Ce, Mg, and Si, depending on the necessary. A so-called Zn-55% Al-alloy-plated steel sheet belongs to the steel sheet of that type.

For coating and forming of the Embodiment-3 film on the plated surface, pretreatments may be performed depending on requirements to prevent defects and nonuniformity that can be caused during the forming of the film. The pretreatments include an alkaline degreasing treatment, a solvent degreasing treatment and a surface-conditioning treatment (an alkaline surface-conditioning treatment or an acidic surface-conditioning treatment). In addition, to further improve blackening-prevention effects under an environment where the film of the present invention is used, the plated surface may preliminarily be subjected to a surface-conditioning treatment using acidic or alkaline solution containing ferrous-base metallic ions (Ni ions, Co ions, and Fe ions). Furthermore, when necessary to further improve the blackening-prevention effects for a steel sheet to be coated with an electroplated base plating, an electroplating bath may contain at least 1 ppm of ferrous-base metallic ions (Ni ions, Co ions, Fe ions). Thereby, these metals can be included into the plating film. In this case, no specific limitation should be set for the upper limit of the ferrous-base metal concentration in the plating film.

Embodiment 3 is characterized to form chemical conversion films on the surface of the zinc-base-plated steel sheet, in which the chemical conversion films contain a compound formed of (A) the chromium having barrier effects and (B) either one of the zinc and the aluminum or both of them and the phosphoric acid having a self-healing function effects.

In this case, the coating weight of the chromium in the film is preferably in a range of from 0.1 to 100 mg/m$^2$. When the chromium coating weight is below 0.1 mg/m$^2$, sufficient chromium-attributed barrier effects cannot be imparted. When the chromium coating weight exceeds 100 mg/m$^2$, while the treatment time increases, no improvement can be expected in the barrier effects. From this viewpoint, it is more preferable that the chromium coating weight should be in a range of from 10 to 70 mg/m$^2$.

The compound composed of either one of the zinc and the aluminum or both of them and the phosphoric acid is not limited by, for example, the skeleton and the degree of condensation of phosphoric acid ions. The compound may be normal salt, dihydrogen salt, monohydrogen salt, or phosphate. The normal salt may be any one of orthophosphoric acid and all the types of condensed phosphate such as polyphosphate. An implementation mechanism for the above is such that, in a damaged film portion in either a corrosive environment or a humid environment, with dissolution of plating metal as a trigger, phosphoric acid ions disassociated by hydrolysis cause complex-forming reaction with the dissolved metal and thereby form a protective film. This mechanism is considered to produce a high processed-portion corrosion resistance and a high antiblackening resistance for the Zn—Al-base plating layer that contains 4 to 25 wt % Al and the Zn—Al-base plating layer that contains 25 to 75 wt % Al.

The coating weight of the compound composed of either one of the zinc and the aluminum or both of them and the phosphoric acid in the film is preferably in a range of from 0.1 to 100 mg/m$^2$. When the coating weight is below 0.1 mg/m$^2$, reduction occurs in the self-healing effects that can be caused by the compound composed of either one of the zinc and the aluminum or both of them and the phosphoric acid. In addition, reduction occurs in the implementation effects of the processed-portion corrosion resistance and antiblackening resistance for the Zn—Al-base-plated steel sheet that contains 4 to 25 wt % Al and the Zn—Al-base-plated steel sheet that contains 25 to 75 wt % Al. On the other hand, when the coating weight of the compound is greater than 100 mg/m$^2$, while the cost increases, proportional improvement cannot be expected in the processed-portion corrosion resistance and the antiblackening resistance of the Zn—Al-base plating layer that contains 4 to 25 wt % Al and the Zn—Al-base plating layer that contains 25 to 75 wt % Al. From this viewpoint, it is more preferable that the coating weight of the compound should be in a range of from 1 to 50 mg/m$^2$.

Significant improvement in the processed-portion corrosion resistance can be expected by allowing the aforementioned chromium and compound composed of either one of the zinc and the aluminum or both of them and the phosphoric acid to coexist in the film. In addition, the aforementioned coexistence enables significant improvement to be expected in either the Zn—Al-base-plated steel sheet that contains 4 to 25 wt % Al or the antiblackening resistance of the Zn—Al-base-plated steel sheet that contains 25 to 75 wt % Al.

A mechanism of the above is considered to be as follows. Since the chromium-contained refractory film provides not only barrier effects, but also effects (binder effects) of binding the compound composed of either one of the zinc and the aluminum or both of them and the phosphoric acid in the film, the calcium is included uniformly and firmly in the film. Consequently, the above-described self-healing effects can be imparted more effectively, and the corrosion reaction can thereby be inhibited earlier. In addition, the mechanism allows the blackening behavior to be inhibited in either the Zn—Al-base-plated steel sheet that contains 4 to 25 wt % Al or the Zn—Al-base-plated steel sheet that contains 25 to 75 wt % Al.

In addition to the above-described film components, the film may further contain oxide fine particles of, for example, silicon oxide, aluminum oxide, zirconium oxide, titanium oxide, cerium oxide, and antimonium oxide.

In addition to the aforementioned film components, the film may further contain an organic polymeric resin. For example, the organic polymeric resin that may be included is an epoxy resin, a polyhydroxypolyether resin, an acrylic copolymer resins, an ethylene-acrylic acid copolymer resin, an alkyd resin, a polybutadiene resin, a phenol resin, a polyurethane resin, a polyamine resin, or a polyphenylene resin.

In Embodiment 3, the treatment liquid contains the water-soluble chromium compound and the phosphoric acid or salt thereof. The steel-sheet surface is coated with the treatment liquid that contains (i) hexavalent chromium ions in a range of from 0.1 to 50 g/l and (ii) phosphoric acid in a range of from 1 to 50 g/l. The coated surface is then heated at a highest-reachable sheet temperature in a range of from 60 to 300° C. without performing rinsing. In this way, chemical conversion films are formed. This method enables the production of a surface-treated steel sheet that has a high processed-portion corrosion resistance. In addition, the method enables a high antiblackening resistance to be imparted on either the Zn—Al-base-plated steel sheet that contains 4 to 25 wt % Al or the Zn—Al-base-plated steel sheet that contains 25 to 75 wt % Al.

In the above, the concentration of the hexavalent chromium ions affects the plating as follows. When the hexavalent chromium ions are below 0.1 g/l, since the coating amount should be significantly increased to obtain a desired chromium coating weight, nonuniformed coating is prone to occur. When the hexavalent chromium ions are above 50 g/l, since the reactivity of the treatment liquid is extremely high, the dissolution amount of the plating film increases. This reduces the stability of the treatment liquid. The case is therefore not preferable.

The type of the hexavalent chromium ions is not specifically limited as long as the ions are water-soluble. For example, chromic acid and ammonium chromate belong to the type; and refractory chromium, such as zinc chromate, strontium chromate, and barium chromate, do not belong to the type.

In the above-described water-soluble chromium compound, the weight ratio (as converted to metallic chromium) of trivalent chromium ions/(trivalent chromium ions+hexavalent chromium ions) is preferably in a range of from 0.2 to 0.8. This enables the production of a surface-treated steel sheet that has a high processed-portion corrosion resistance. In addition, the antiblackening resistance can further be improved for either the Zn—Al-base-plated steel sheet that contains 4 to 25 wt % Al or the Zn—Al-base-plated steel sheet that contains 25 to 75 wt % Al.

A case is not preferable in which the weight ratio (as converted metallic chromium) of trivalent chromium ions/(trivalent chromium ions+hexavalent chromium ions) is below 0.2. In this case, the concentration of hexavalent chromium ions excessively increases, and the refractory property of the film decreases. In addition, in a corrosive environment, the case does not contribute to the corrosion resistance. For the Zn—Al-base-plated steel sheet that contains 4 to 25 wt % Al and the Zn—Al-base-plated steel sheet that contains 25 to 75 wt % Al, the case does not contribute even to the antiblackening resistance, and the dissolution amount of the ions increases. Thus, the case is not preferable from the viewpoint of economy and environmental applicability. On the other hand, the weight ratio of trivalent chromium ions/(trivalent chromium ions+hexavalent chromium ions) is above 0.8, the treatment liquid is prone to gel, significantly decreasing the stability of the treatment liquid.

In Embodiment 3, the treatment liquid contains the water-soluble chromium compound, in which the chromium compound is composed of a trivalent-chromium compound, the phosphoric acid or salt thereof. The steel-sheet surface is coated with the treatment liquid that contains (i) trivalent chromium ions in a range of from 0.1 to 50 g/l and (ii) calcium in a range of from 1 to 50 g/l. The coated surface is then heated at a highest-reachable sheet temperature in a range of from 60 to 300° C. without performing rinsing. In this way, a chemical conversion film is formed. This method enables the production of a surface-treated steel sheet that has a high processed-portion corrosion resistance. In addition, the method enables the high antiblackening resistance to be further improved for either the Zn—Al-base-plated steel sheet that contains 4 to 25 wt % Al or the Zn—Al-base-plated steel sheet that contains 25 to 75 wt % Al. In the method according to Embodiment 3, since the treatment liquid does not contain hexavalent chromium ions, it does not cause the problem of out-of-system dissolution of hexavalent chromium when the steel sheet is used. In addition, the method can provide high self-healing capability without relying on the hexavalent chromium.

In the above, the concentration of the trivalent chromium ions affects the plating as follows. When the trivalent chromium ions are below 0.1 g/l, since the coating amount should be significantly increased to obtain a desired chromium coating weight, nonuniformed coating is prone to occur. When the trivalent chromium ions are above 50 g/l, since the reactivity of the treatment liquid is extremely high, the dissolution amount of the plating film increases. This reduces the stability of the treatment liquid. The case is therefore not preferable.

The trivalent-chromium compound is not specifically limited as long as the compound is water-soluble. Examples thereof include chromium chloride, chromium sulfate, chromium acetate, and chromium formate. Preferably, the trivalent-chromium compound is chromium carboxylate such as chromium acetate or chromium formate.

The phosphoric acid or the salt thereof to be included to coexist with the water-soluble chromium compound are not limited by, for example, the skeleton and the degree of condensation of phosphoric acid ions. The salt may be normal salt, dihydrogen salt, monohydrogen salt, or phosphate. The normal salt may be any one of orthophosphoric acid and all the types of condensed phosphate such as polyphosphate, or a mixture thereof. Furthermore, the present mode allows phosphoric acid or phosphoric acid ions to be used.

The concentration of the phosphoric acid affects the plating as follows. When the phosphoric-acid concentration is set below 1 g/l, the phosphoric acid necessary to provide sufficient self-healing effects is not be maintained in the film. Also, the phosphoric acid necessary to provide sufficient processed-portion corrosion resistance and antiblackening resistance is insufficient in the film on either the Zn—Al-base-plated steel sheet that contains 4 to 25 wt % Al or the Zn—Al-base-plated steel sheet that contains 25 to 75 wt % Al. When the phosphoric-acid concentration is set above 50 g/l, since the reactivity of the treatment liquid is extremely high, the dissolution amount of the plating film increases, and the stability of the treatment liquid is reduced by dissolved zinc. The case is therefore not preferable.

Furthermore, as a film-deposition assistant, inorganic acid may be included. Examples of the inorganic acid are phosphoric acid, polyphosphoric acid, boric acid, and phosphoric acid.

For an application method for the above-described treatment liquid, there are no specific limitations. For example, the method may be a roll-coater method, a ringer-roll method, a dipping method, and an air-knife squeezing method.

Preferably, after coating, the coated surface is heated at a highest-reachable sheet temperature in a range of from 60 to 300° C. without performing rinsing. When the highest-reachable sheet temperature is below 60° C., trivalent-chromium compound having high barrier effects is not sufficiently formed. When the highest-reachable sheet temperature is above 300° C., cracks occur in the film. The cracks are so innumerous, so that self-healing effects of the film do not work. Thus, in either out-of-range case, the corrosion resistance significantly decreases in processed portions and sound portions of the film.

EXAMPLE 1

For original processing steel sheets, zinc-base-plated steel sheets of the types shown in Table 16 were used. With treatment-liquid compositions and curing temperatures that are shown in Tables 18 to 20, roll-coater coating was performed. Without performing rinsing, heat-curing was performed, and chemical conversion films were formed. The coating weight was controlled through variables such as the coating amount, the roll-coater peripheral speed, and pressing forces. Table 17 shows compounds ("Zn,Al-Phosphoric Acid" in Tables 18 to 20) composed of either one of the zinc and the aluminum or both of them and the phosphoric acid in the chemical conversion films. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to 100 cycles of the following compound corrosion testing.

3 wt % salt spray testing (30° C.; 0.5 hours)

↓

Humidity cabinet testing (30° C.; 95% RH; 1.5 hours)

↓

Hot-air curing testing (50° C.; 20%; 2.0 hours)

↓

Hot-air curing testing (30° C.; 20%; 2.0 hours)

The evaluation was performed for the rust-developed area ratio in 5-mm areas on two sides of the cut slit. The conditions (color tones) of developed rust depended on the Al concentration of the plating film. White rust was caused in zinc-plated steel sheets and Zn/Al-base-plated steel sheets having Al concentrations of at most 25 wt %. Rust ranging in color from gray to black was caused on Zn/Al-base-plated steel sheets having Al concentrations ranged from 25 to 75 wt %.

◎: No rust

○+: Rust-developed area ratio=less than 5%

○: Rust-developed area ratio=at least 5% to less than 10%

○−: Rust-developed area ratio=at least 10% to less than 25%

Δ: Rust-developed area ratio=at least 25% to less than 50%

×: Rust-developed area ratio=at least 50%

(2) Corrosion Resistances of Sound Film Portions

The above-described compound corrosion testing was performed 200 cycles for each test sample for which no damage nor bending nor other processing was provided. Using criteria shown above, the evaluation was performed based on a rust-developed area ratio of the test-sample surface. Rust conditions were the same as in the case of the above-described processed-portion corrosion resistance.

(3) Antiblackening Resistances

Evaluation was performed for the antiblackening resistances of Zn/Al-base-plated steel sheets containing at least 4 wt % Al. In specific, the evaluation was performed by using the following two methods depending on the Al concentration.

(Zn/Al-base-plated steel sheets with Al Concentrations of 4 to 25 wt %: item No. 2 in Table 16)

Test samples for which no damage nor bending nor other processing was provided were stacked, and placed in a humidity cabinet tester (HCT) for six days. The appearance of the test samples was visually observed, and the antiblackening resistance was evaluated according to the following criteria:

⊙: No changed portion in pre-testing and post-testing appearance

○: Slight dot-likely-changed portions in post-testing appearance (area=less than 10%)

Δ: Island-likely-changed portions in post-testing appearance (area=at least 10% to less than 50%)

×: Visibly-blackened portions or at-least 50% surface-change portion in post-testing appearance (Zn/Al-base-plated steel sheets with Al Concentrations of 25 to 75 wt %: Item No. 3 in Table 16)

Evaluation was performed for test samples for which no damage nor bending nor other processing was provided. Each of the test samples was held in a thermo-hygrostat chamber for 24 hours. The thermo-hygrostat apparatus was atmospherically controlled at a temperature of 80° C. and relative humidity 95% RH. Evaluation was performed for the individual test samples in the above state by measuring a variation (ΔL value) in the whiteness (L value), that is, the (pre-testing L value−post-testing L value), according to the following criteria:

⊙: ΔL≧−1.0; ○: −1.0>ΔL≧−2.0; Δ: −2.0 >ΔL≧−4.0; ×: −4.0>ΔL

The evaluation results are shown in Tables 18 to 20.

TABLE 16

| No. | Type | Coating weight g/m$^2$ |
|---|---|---|
| 1 | Molten-Zn-plated steel sheet | 120 |
| 2 | Molten-Zn-5 wt % Al-0.5 wt % Mg-alloy-plated steel sheet | 90 |
| 3 | Molten-Zn-55 wt % Al-alloy-plated steel sheet | 90 |

TABLE 17

| No. | Type and composition |
|---|---|
| 1 | Zinc phosphate |
| 2 | Aluminum phosphate |
| 3 | Zinc phosphite |
| 4 | Dihydrogen aluminum tripolyphosphate |
| 5 | Zinc phosphate (50 wt %) + dihydrogen aluminum tripolyphosphate (50 wt %) |

TABLE 18

| | | Treatment-liquid composition (g/l) | | | Film composition (mg/m$^2$) | | | Corrosion resistance | | | |
|---|---|---|---|---|---|---|---|---|---|---|---|
| | | | | Curing | | Zn, Al-phosphoric acid*2 | | | | | |
| No. | Plated steel sheet*1 | $Cr^{6+}$ | Phosphoric acid | temperature (° C.) | Cr | Type*3 | | Sound film Portion | Processed Portion | Antiblackening resistance | Remarks |
| 1 | 1 | 0.1 | 0 | 140 | 0.1 | 1 | 0 | Δ | x | — | Comparative Example |
| 2 | 1 | 1 | 3 | 140 | 0.1 | 1 | 0.1 | Δ | ○− | — | |
| 3 | 1 | 0.1 | 50 | 140 | 0.1 | 1 | 100 | Δ | ○− | — | |
| 4 | 1 | 0.1 | 50 | 140 | 0.1 | 1 | 200 | x | Δ | — | Comparative Example |
| 5 | 1 | 2 | 0 | 140 | 20 | 1 | 0 | ○− | x | — | Comparative Example |
| 6 | 1 | 0.5 | 3 | 140 | 20 | 1 | 20 | ○− | ○− | — | |
| 7 | 1 | 0.5 | 6 | 140 | 20 | 1 | 40 | ○− | ○ | — | |
| 8 | 1 | 2 | 24 | 140 | 20 | 1 | 80 | ○− | ○+ | — | |
| 9 | 1 | 2 | 50 | 140 | 20 | 1 | 100 | ○− | ⊙ | — | |
| 10 | 1 | 2 | 50 | 140 | 20 | 1 | 200 | x | Δ | — | Comparative Example |
| 11 | 1 | 4 | 0 | 140 | 40 | 1 | 0 | ○ | x | — | Comparative Example |
| 12 | 1 | 4 | 6 | 140 | 40 | 1 | 20 | ○ | ○ | — | |
| 13 | 1 | 2 | 6 | 140 | 40 | 1 | 40 | ○ | ○+ | — | |
| 14 | 1 | 2 | 12 | 140 | 40 | 1 | 80 | ○ | ○+ | — | |
| 15 | 1 | 2 | 30 | 140 | 40 | 1 | 100 | ○ | ⊙ | — | |
| 16 | 1 | 2 | 45 | 140 | 40 | 1 | 200 | x | Δ | — | Comparative Example |
| 17 | 1 | 50 | 0 | 140 | 100 | 1 | 0 | ○+ | x | — | Comparative Example |

TABLE 18-continued

| No. | Plated steel sheet*1 | Treatment-liquid composition (g/l) $Cr^{6+}$ | Treatment-liquid composition (g/l) Phosphoric acid | Curing temperature (° C.) | Film composition (mg/m²) Cr | Film composition (mg/m²) Zn, Al-phosphoric acid*2 Type*3 | Film composition (mg/m²) Zn, Al-phosphoric acid*2 | Corrosion resistance Sound film Portion | Corrosion resistance Processed Portion | Antiblackening resistance | Remarks |
|---|---|---|---|---|---|---|---|---|---|---|---|
| 18 | 1 | 50 | 3 | 140 | 100 | 1 | 0.1 | ○+ | ○− | — | |
| 19 | 1 | 1 | 6 | 140 | 100 | 1 | 100 | ○+ | ○+ | — | |
| 20 | 1 | 1 | 9 | 140 | 100 | 1 | 200 | x | Δ | — | Comparative Example |

*1Refer to Table 16,
*2As converted to phosphorus,
*3Refer to Table 17

TABLE 19

| No. | Plated steel sheet*1 | Treatment-liquid composition (g/l) $Cr^{6+}$ | Treatment-liquid composition (g/l) Phosphoric acid | Curing temperature (° C.) | Film composition (mg/m²) Cr | Film composition (mg/m²) Zn, Al-phosphoric acid*2 Type*3 | Film composition (mg/m²) Zn, Al-phosphoric acid*2 | Corrosion resistance Sound film Portion | Corrosion resistance Processed Portion | Antiblackening resistance | Remarks |
|---|---|---|---|---|---|---|---|---|---|---|---|
| 21 | 2 | 0.1 | 0 | 140 | 0.1 | 1 | 0 | ○− | Δ | x | Comparative Example |
| 22 | 2 | 1 | 3 | 140 | 0.1 | 1 | 0.1 | ○− | ○− | ○ | |
| 23 | 2 | 0.1 | 50 | 140 | 0.1 | 1 | 100 | ○− | ○− | ○ | |
| 24 | 2 | 0.1 | 50 | 140 | 0.1 | 1 | 200 | Δ | Δ | ○ | Comparative Example |
| 25 | 2 | 2 | 0 | 140 | 20 | 1 | 0 | ○ | Δ | Δ | Comparative Example |
| 26 | 2 | 0.5 | 3 | 140 | 20 | 1 | 20 | ○ | ○ | ◎ | |
| 27 | 2 | 0.5 | 6 | 140 | 20 | 1 | 40 | ○ | ○+ | ◎ | |
| 28 | 2 | 2 | 24 | 140 | 20 | 1 | 80 | ○ | ◎ | ◎ | |
| 29 | 2 | 2 | 50 | 140 | 20 | 1 | 100 | ○ | ◎ | ◎ | |
| 30 | 2 | 2 | 50 | 140 | 20 | 1 | 200 | Δ | Δ | ○ | Comparative Example |
| 31 | 2 | 4 | 0 | 140 | 40 | 1 | 0 | ○+ | Δ | Δ | Comparative Example |
| 32 | 2 | 4 | 6 | 140 | 40 | 1 | 20 | ○+ | ○+ | ◎ | |
| 33 | 2 | 2 | 6 | 140 | 40 | 1 | 40 | ○+ | ◎ | ◎ | |
| 34 | 2 | 2 | 12 | 140 | 40 | 1 | 80 | ○+ | ◎ | ◎ | |
| 35 | 2 | 2 | 30 | 140 | 40 | 1 | 100 | ○+ | ◎ | ◎ | |
| 36 | 2 | 2 | 45 | 140 | 40 | 1 | 200 | Δ | Δ | ○ | Comparative Example |
| 37 | 2 | 50 | 0 | 140 | 100 | 1 | 0 | ◎ | Δ | Δ | Comparative Example |
| 38 | 2 | 50 | 3 | 140 | 100 | 1 | 0.1 | ◎ | ○− | ◎ | |
| 39 | 2 | 1 | 6 | 140 | 100 | 1 | 100 | ◎ | ◎ | ◎ | |
| 40 | 2 | 1 | 9 | 140 | 100 | 1 | 200 | Δ | Δ | ○ | Comparative Example |

*1Refer to Table 16,
*2As converted to phosphorus,
*3Refer to Table 17

TABLE 20

| No. | Plated steel sheet*1 | Treatment-liquid composition (g/l) $Cr^{6+}$ | Treatment-liquid composition (g/l) Phosphoric acid | Curing temperature (° C.) | Film composition (mg/m²) Cr | Film composition (mg/m²) Zn, Al-phosphoric acid*2 Type*3 | Film composition (mg/m²) Zn, Al-phosphoric acid*2 | Corrosion resistance Sound film Portion | Corrosion resistance Processed Portion | Antiblackening resistance | Remarks |
|---|---|---|---|---|---|---|---|---|---|---|---|
| 41 | 3 | 0.1 | 0 | 140 | 0.1 | 1 | 0 | ○ | Δ | x | Comparative Example |
| 42 | 3 | 1 | 3 | 140 | 0.1 | 1 | 0.1 | ○ | ○ | ○ | |
| 43 | 3 | 0.1 | 50 | 140 | 0.1 | 1 | 100 | ○ | ○ | ○ | |
| 44 | 3 | 0.1 | 50 | 140 | 0.1 | 1 | 200 | ○− | Δ | ○ | Comparative Example |

TABLE 20-continued

| No. | Plated steel sheet*1 | Treatment-liquid composition (g/l) $Cr^{6+}$ | Phosphoric acid | Curing temperature (° C.) | Film composition (mg/m²) Cr | Zn, Al-phosphoric acid*2 Type*3 | | Corrosion resistance Sound film Portion | Processed Portion | Antiblackening resistance | Remarks |
|---|---|---|---|---|---|---|---|---|---|---|---|
| 45 | 3 | 2 | 0 | 140 | 20 | 1 | 0 | ○+ | Δ | Δ | Comparative Example |
| 46 | 3 | 0.5 | 3 | 140 | 20 | 1 | 20 | ○+ | ◎ | ◎ | |
| 47 | 3 | 0.5 | 6 | 140 | 20 | 1 | 40 | ○+ | ◎ | ◎ | |
| 48 | 3 | 2 | 24 | 140 | 20 | 1 | 80 | ○+ | ◎ | ◎ | |
| 49 | 3 | 2 | 50 | 140 | 20 | 1 | 100 | ○+ | ◎ | ◎ | |
| 50 | 3 | 2 | 50 | 140 | 20 | 1 | 200 | ○− | Δ | ○ | Comparative Example |
| 51 | 3 | 4 | 0 | 140 | 40 | 1 | 0 | ◎ | Δ | Δ | Comparative Example |
| 52 | 3 | 4 | 6 | 140 | 40 | 1 | 20 | ◎ | ◎ | ◎ | |
| 53 | 3 | 2 | 6 | 140 | 40 | 1 | 40 | ◎ | ◎ | ◎ | |
| 54 | 3 | 2 | 12 | 140 | 40 | 1 | 80 | ◎ | ◎ | ◎ | |
| 55 | 3 | 2 | 30 | 140 | 40 | 1 | 100 | ◎ | ◎ | ◎ | |
| 56 | 3 | 2 | 45 | 140 | 40 | 1 | 200 | ○− | Δ | ○ | Comparative Example |
| 57 | 3 | 50 | 0 | 140 | 100 | 1 | 0 | ◎ | Δ | Δ | Comparative Example |
| 58 | 3 | 50 | 3 | 140 | 100 | 1 | 0.1 | ◎ | ○ | ◎ | |
| 59 | 3 | 1 | 6 | 140 | 100 | 1 | 100 | ◎ | ◎ | ◎ | |
| 60 | 3 | 1 | 9 | 140 | 100 | 1 | 200 | ○− | Δ | ○ | Comparative Example |
| 61 | 3 | 0.5 | 3 | 50 | 20 | 1 | 20 | Δ | Δ | ○ | Comparative example for production method |
| 62 | 3 | 0.5 | 3 | 60 | 20 | 1 | 20 | ○− | ○− | ◎ | |
| 63 | 3 | 0.5 | 3 | 300 | 20 | 1 | 20 | ○+ | ◎ | ◎ | |
| 64 | 3 | 0.5 | 3 | 320 | 20 | 1 | 20 | Δ | Δ | ○ | Comparative example for production method |
| 65 | 3 | 0.5 | 3 | 140 | 20 | 2 | 20 | ○+ | ◎ | ◎ | |
| 66 | 3 | 0.5 | 3 | 140 | 20 | 3 | 20 | ○ | ○+ | ◎ | |
| 67 | 3 | 0.5 | 3 | 140 | 20 | 4 | 20 | ○+ | ◎ | ◎ | |
| 68 | 3 | 0.5 | 3 | 140 | 20 | 5 | 20 | ○+ | ◎ | ◎ | |

*1Refer to Table 16,
*2As converted to phosphorus,
*3Refer to Table 17

According to Tables 18 to 20, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, the following can be known by comparison to the comparison examples of the steel sheets that contain at least 4 wt % Al and that are each plated with a film that is out of the range of the first pattern. In the comparison, the antiblackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

Furthermore, with the film formed in the range of the first pattern, high film quality can be obtained for the steel sheets produced according to the conditions within the range of the fifth pattern. However, the film quality is degraded for the steel sheets of the comparative examples (item Nos. 61 and 64) on which the film was formed at curing temperatures that are out of the range of the fifth pattern.

EXAMPLE 2

For original processing steel sheets, zinc-base-plated steel sheets of the types shown in Table 16 were used. With treatment-liquid compositions and curing temperatures that are shown in Tables 21 to 23, roll-coater coating was performed. Without performing rinsing, heat-curing was performed, and individual chemical conversion films were formed. The coating weight was controlled through variables such as the coating amount, the roll-coater peripheral speed, and pressing forces. Table 17 shows compounds ("Zn,Al-phosphoric acid" in Tables 21 to 23) composed of either one of the zinc and the aluminum or both of them and the phosphoric acid. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to a 120-hour salt spray testing that conforms to JIS Z 2371. Evaluation was performed for the rust-developed area ratio in 5-mm areas on two sides of the cut slit. The conditions (color tones) of developed rust were the same as in the case of the evaluation of the processed-portion corrosion resistance in Example 1.

(2) Corrosion Resistances of Sound Film Portions

The above-described salt spray testing was performed for 360 hours for each test sample for which no damage nor bending nor other processing was provided. Using the same criteria set in Example 1, the evaluation was performed based on a rust-developed area ratio of the test-sample surface. Rust conditions were the same as in the case of the above-described evaluation of the processed-portion corrosion resistances.

(3) Antiblackening Resistances

Evaluation was performed for the antiblackening resistances of Zn/Al-base-plated steel sheets containing at least 4 wt % Al in the same manners as those in Example 1.

The evaluation results are shown in Tables 21 to 23.

TABLE 21

| | | Treatment-liquid composition (g/l) | | | | Film composition (mg/m²) | | | Corrosion resistance | | | |
|---|---|---|---|---|---|---|---|---|---|---|---|---|
| | Plated | | | Cr | Curing | | Zn, Al-phosphoric acid*3 | | | | Anti- | |
| | steel | | Phosphoric | reduction | temperature | | | | Sound film | Processed | blackening | |
| No. | sheet*1 | $Cr^{6+}$ | acid | ratio*2 | (° C.) | Cr | Type*4 | | Portion | Portion | resistance | Remarks |
| 1 | 1 | 0.1 | 0 | 0.4 | 140 | 0.1 | 1 | 0 | Δ | x | — | Comparative Example |
| 2 | 1 | 1 | 3 | 0.4 | 140 | 0.1 | 1 | 0.1 | Δ | ○− | — | |
| 3 | 1 | 0.1 | 50 | 0.4 | 140 | 0.1 | 1 | 100 | Δ | ○− | — | |
| 4 | 1 | 0.1 | 50 | 0.4 | 140 | 0.1 | 1 | 200 | x | Δ | — | Comparative Example |
| 5 | 1 | 2 | 0 | 0.4 | 140 | 20 | 1 | 0 | ○− | x | — | Comparative Example |
| 6 | 1 | 0.5 | 3 | 0.4 | 140 | 20 | 1 | 20 | ○− | ○− | — | |
| 7 | 1 | 0.5 | 6 | 0.4 | 140 | 20 | 1 | 40 | ○− | ○ | — | |
| 8 | 1 | 2 | 24 | 0.4 | 140 | 20 | 1 | 80 | ○− | ○+ | — | |
| 9 | 1 | 2 | 50 | 0.4 | 140 | 20 | 1 | 100 | ○− | ⊙ | — | |
| 10 | 1 | 2 | 50 | 0.4 | 140 | 20 | 1 | 200 | x | Δ | — | Comparative Example |
| 11 | 1 | 4 | 0 | 0.4 | 140 | 40 | 1 | 0 | ○ | x | — | Comparative Example |
| 12 | 1 | 4 | 6 | 0.4 | 140 | 40 | 1 | 20 | ○ | ○ | — | |
| 13 | 1 | 2 | 6 | 0.4 | 140 | 40 | 1 | 40 | ○ | ○+ | — | |
| 14 | 1 | 2 | 12 | 0.4 | 140 | 40 | 1 | 80 | ○ | ○+ | — | |
| 15 | 1 | 2 | 30 | 0.4 | 140 | 40 | 1 | 100 | ○ | ⊙ | — | |
| 16 | 1 | 2 | 45 | 0.4 | 140 | 40 | 1 | 200 | x | Δ | — | Comparative Example |
| 17 | 1 | 50 | 0 | 0.4 | 140 | 100 | 1 | 0 | ○+ | x | — | Comparative Example |
| 18 | 1 | 50 | 3 | 0.4 | 140 | 100 | 1 | 0.1 | ○+ | ○− | — | |
| 19 | 1 | 1 | 6 | 0.4 | 140 | 100 | 1 | 100 | ○+ | ○+ | — | |
| 20 | 1 | 1 | 9 | 0.4 | 140 | 100 | 1 | 200 | x | Δ | — | Comparative Example |

*1Refer to Table 16,
*2Trivalent chromium ions/total Cr, total Cr = Trivalent chromium ions + hexavalent chromium ions
*3As converted to phosphorus,
*4Refer to Table 17

TABLE 22

| | | Treatment-liquid composition (g/l) | | | | Film composition (mg/m²) | | | Corrosion resistance | | | |
|---|---|---|---|---|---|---|---|---|---|---|---|---|
| | Plated | | | Cr | Curing | | Zn, Al-phosphoric acid*3 | | | | Anti- | |
| | steel | | Phosphoric | reduction | temperature | | | | Sound film | Processed | blackening | |
| No. | sheet*1 | $Cr^{6+}$ | acid | ratio*2 | (° C.) | Cr | Type*4 | | Portion | Portion | resistance | Remarks |
| 21 | 2 | 0.1 | 0 | 0.4 | 140 | 0.1 | 1 | 0 | ○− | Δ | x | Comparative Example |
| 22 | 2 | 1 | 3 | 0.4 | 140 | 0.1 | 1 | 0.1 | ○− | ○− | ○ | |
| 23 | 2 | 0.1 | 50 | 0.4 | 140 | 0.1 | 1 | 100 | ○− | ○− | ○ | |
| 24 | 2 | 0.1 | 50 | 0.4 | 140 | 0.1 | 1 | 200 | Δ | Δ | ○ | Comparative Example |
| 25 | 2 | 2 | 0 | 0.4 | 140 | 20 | 1 | 0 | ○ | Δ | Δ | Comparative Example |
| 26 | 2 | 0.5 | 3 | 0.4 | 140 | 20 | 1 | 20 | ○ | ○ | ⊙ | |
| 27 | 2 | 0.5 | 6 | 0.4 | 140 | 20 | 1 | 40 | ○ | ○+ | ⊙ | |
| 28 | 2 | 2 | 24 | 0.4 | 140 | 20 | 1 | 80 | ○ | ⊙ | ⊙ | |
| 29 | 2 | 2 | 50 | 0.4 | 140 | 20 | 1 | 100 | ○ | ⊙ | ⊙ | |

TABLE 22-continued

| No. | Plated steel sheet*1 | Treatment-liquid composition (g/l) $Cr^{6+}$ | Phosphoric acid | Cr reduction ratio*2 | Curing temperature (° C.) | Film composition (mg/m²) Cr | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|
| 30 | 2 | 2 | 50 | 0.4 | 140 | 20 | 1 | 200 | Δ | Δ | ○ | Comparative Example |
| 31 | 2 | 4 | 0 | 0.4 | 140 | 40 | 1 | 0 | ○+ | Δ | Δ | Comparative Example |
| 32 | 2 | 4 | 6 | 0.4 | 140 | 40 | 1 | 20 | ○+ | ○+ | ◎ | |
| 33 | 2 | 2 | 6 | 0.4 | 140 | 40 | 1 | 40 | ○+ | ◎ | ◎ | |
| 34 | 2 | 2 | 12 | 0.4 | 140 | 40 | 1 | 80 | ○+ | ◎ | ◎ | |
| 35 | 2 | 2 | 30 | 0.4 | 140 | 40 | 1 | 100 | ○+ | ◎ | ◎ | |
| 36 | 2 | 2 | 45 | 0.4 | 140 | 40 | 1 | 200 | Δ | Δ | ○ | Comparative Example |
| 37 | 2 | 50 | 0 | 0.4 | 140 | 100 | 1 | 0 | ◎ | Δ | Δ | Comparative Example |
| 38 | 2 | 50 | 3 | 0.4 | 140 | 100 | 1 | 0.1 | ◎ | ○− | ◎ | |
| 39 | 2 | 1 | 6 | 0.4 | 140 | 100 | 1 | 100 | ◎ | ◎ | ◎ | |
| 40 | 2 | 1 | 9 | 0.4 | 140 | 100 | 1 | 200 | Δ | Δ | ○ | Comparative Example |

*1Refer to Table 16,
*2Trivalent chromium ions/total Cr, total Cr = Trivatent chromium ions + hevavalent chromium ions
*3As converted to phosphorus,
*4Refer to Table 17

TABLE 23

| No. | Plated steel sheet*1 | Treatment-liquid composition (g/l) $Cr^{6+}$ | Phosphoric acid | Cr reduction ratio*2 | Curing temperature (° C.) | Film composition (mg/m²) Cr | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|
| 41 | 3 | 0.1 | 0 | 0.4 | 140 | 0.1 | 1 | 0 | ○ | Δ | x | Comparative Example |
| 42 | 3 | 1 | 3 | 0.4 | 140 | 0.1 | 1 | 0.1 | ○ | ○ | ○ | |
| 43 | 3 | 0.1 | 50 | 0.4 | 140 | 0 1 | 1 | 100 | ○ | ○ | ○ | |
| 44 | 3 | 0.1 | 50 | 0.4 | 140 | 0.1 | 1 | 200 | ○− | Δ | ○ | Comparative Example |
| 45 | 3 | 2 | 0 | 0.4 | 140 | 20 | 1 | 0 | ○+ | Δ | Δ | Comparative Example |
| 46 | 3 | 0.5 | 3 | 0.4 | 140 | 20 | 1 | 20 | ○+ | ◎ | ◎ | |
| 47 | 3 | 0.5 | 6 | 0.4 | 140 | 20 | 1 | 40 | ○+ | ◎ | ◎ | |
| 48 | 3 | 2 | 24 | 0.4 | 140 | 20 | 1 | 80 | ○+ | ◎ | ◎ | |
| 49 | 3 | 2 | 50 | 0.4 | 140 | 20 | 1 | 100 | ○+ | ◎ | ◎ | |
| 50 | 3 | 2 | 50 | 0.4 | 140 | 20 | 1 | 200 | ○− | Δ | ○ | Comparative Example |
| 51 | 3 | 4 | 0 | 0.4 | 140 | 40 | 1 | 0 | ◎ | Δ | Δ | Comparative Example |
| 52 | 3 | 4 | 6 | 0.4 | 140 | 40 | 1 | 20 | ◎ | ◎ | ◎ | |
| 53 | 3 | 2 | 6 | 0.4 | 140 | 40 | 1 | 40 | ◎ | ◎ | ◎ | |
| 54 | 3 | 2 | 12 | 0.4 | 140 | 40 | 1 | 80 | ◎ | ◎ | ◎ | |
| 55 | 3 | 2 | 30 | 0.4 | 140 | 40 | 1 | 100 | ◎ | ◎ | ◎ | |
| 56 | 3 | 2 | 45 | 0.4 | 140 | 40 | 1 | 200 | ○− | Δ | ○ | Comparative Example |
| 57 | 3 | 50 | 0 | 0.4 | 140 | 100 | 1 | 0 | ◎ | Δ | Δ | Comparative Example |
| 58 | 3 | 50 | 3 | 0.4 | 140 | 100 | 1 | 0.1 | ◎ | ○ | ◎ | |
| 59 | 3 | 1 | 6 | 0.4 | 140 | 100 | 1 | 100 | ◎ | ◎ | ◎ | |
| 60 | 3 | 1 | 9 | 0.4 | 140 | 100 | 1 | 200 | ○− | Δ | ○ | Comparative Example |
| 61 | 3 | 0.5 | 3 | 0.4 | 50 | 20 | 1 | 20 | Δ | Δ | ○ | Comparative example for production method |
| 62 | 3 | 0.5 | 3 | 0.4 | 60 | 20 | 1 | 20 | ○− | ○− | ◎ | |
| 63 | 3 | 0.5 | 3 | 0.4 | 300 | 20 | 1 | 20 | ○+ | ◎ | ◎ | |
| 64 | 3 | 0.5 | 3 | 0.4 | 320 | 20 | 1 | 20 | Δ | Δ | ○ | Comparative example for |

TABLE 23-continued

| No. | Plated steel sheet*1 | Treatment-liquid composition (g/l) $Cr^{6+}$ | Phosphoric acid | Cr reduction ratio*2 | Curing temperature (° C.) | Film composition (mg/m²) Cr | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|
| | | | | | | | | | | | | production method |
| 65 | 3 | 0.5 | 3 | 0.4 | 140 | 20 | 2 | 20 | ○+ | ◎ | ◎ | |
| 66 | 3 | 0.5 | 3 | 0.4 | 140 | 20 | 3 | 20 | ○ | ○+ | ◎ | |
| 67 | 3 | 0.5 | 3 | 0.4 | 140 | 20 | 4 | 20 | ○+ | ◎ | ◎ | |
| 68 | 3 | 0.5 | 3 | 0.4 | 140 | 20 | 5 | 20 | ○+ | ◎ | ◎ | |
| 69 | 3 | 0.5 | 3 | 0.1 | 140 | 20 | 1 | 20 | ○− | Δ | ○ | Comparative example of production method (5th Invention) |
| 70 | 3 | 0.5 | 3 | 0.2 | 140 | 20 | 1 | 20 | ○− | ○− | ◎ | |
| 71 | 3 | 0.5 | 3 | 0.8 | 140 | 20 | 1 | 20 | ○− | ○− | ◎ | |
| 72 | 3 | 0.5 | 3 | 0.9 | 140 | — | — | — | Treatment liquid gelled | | | Comparative example of production method (5th Invention) |

*1Refer to Table 16,
*2Trivalent chromium ions/total Cr, total Cr = Trivalent chromium ions + hexavalent chromium ions
*3As converted to phosphorus,
*4Refer to Table 17

According to Tables 21 to 23, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, the following can be known by comparison to the comparison examples of the steel sheets that contain at least 4 wt % Al and that are each plated with a film that is out of the range of the first pattern. In the comparison, the antiblackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

In addition, regarding the deposition of the film in the range of the first pattern, the following can be known by comparison to the comparison examples of the steel sheets (item Nos. 61 and 64) that are plated with the film formed at a temperature that is out of the range of the fourth pattern. In the comparison, higher film quality can be obtained with the steel sheets that are plated with the film formed at curing at a temperature that is within of the fourth pattern. Furthermore, the following can be known by comparison to the case (item No. 69) of film deposition with the treatment liquid of which the Cr reduction ratio is below the range of the fifth pattern. In the comparison, higher film quality can be obtained in the case of film deposition with the treatment liquid of which the Cr reduction ratio is within the range of the fifth pattern. In the case (item No. 72) using the treatment liquid of which the Cr reduction ratio is above the range of the fifth pattern, since the treatment liquid gelled, evaluation was not performed for the corresponding steel sheet.

EXAMPLE 3

For original processing steel sheets, zinc-base-plated steel sheets of the types shown in Table 16 were used. For the trivalent-chromium compounds, chromic salts of types as shown in Table 24 were used. With treatment-liquid compositions and curing temperatures that are shown in Tables 25 to 27, roll-coater coating was performed. Without performing rinsing, heat-curing was performed, and individual chemical conversion films were formed. The coating weight was controlled through variables such as the coating amount, the roll-coater peripheral speed, and pressing forces. Table 17 shows compounds ("Zn,Al-phosphoric acid" in Tables 25 to 27) composed of either one of the zinc and the aluminum or both of them and the phosphoric acid. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to 100 cycles of the following compound corrosion testing:

3 wt % salt spray testing (30° C.; 0.5 hours)

↓

Humidity cabinet testing (30° C.; 95% RH; 1.5 hours)

Using the same criteria as those in Example 1, evaluation was performed for the rust-developed area ratio in 5-mm areas on two sides of the cut slit. The conditions (color tones) of developed rust were the same as in the case of the evaluation of the processed-portion corrosion resistance in Example 1.

(2) Corrosion Resistances of Sound Film Portions

The above-described compound corrosion testing was performed 200 cycles for each test sample for which no damage nor bending nor other processing was provided. Using the same criteria as described above, the evaluation was performed based on a rust-developed area ratio of the test-sample surface. Rust conditions were the same as in the case of the above-described evaluation of the processed-portion corrosion resistances.

(3) Antiblackening Resistances

Evaluation was performed for the antiblackening resistances of Zn/Al-base-plated steel sheets containing at least 4 wt % Al in the same manners as those in Example 1.

Evaluation results are shown in Tables 25 to 27.

TABLE 24

| No. | Type |
|---|---|
| 1 | chromium (III) chloride |
| 2 | chromium (III) nitrate |
| 3 | chromium (III) formate |
| 4 | chromium (III) acetate |

TABLE 25

| | | Treatment-liquid composition (g/l) | | | Curing | Film composition (mg/m²) | | | Corrosion resistance | | Anti- | |
|---|---|---|---|---|---|---|---|---|---|---|---|---|
| No. | Plated steel sheet*1 | Type*2 | $Cr^{3+}$ | Ca | temperature (° C.) | Cr | Type*4 | Zn, Al-phosphoric acid*3 | Sound film Portion | Processed Portion | blackening resistance | Remarks |
| 1 | 1 | 4 | 0.1 | 0 | 140 | 0.1 | 1 | 0 | Δ | x | — | Comparative Example |
| 2 | 1 | 4 | 1 | 3 | 140 | 0.1 | 1 | 0.1 | Δ | ○− | — | |
| 3 | 1 | 4 | 0.1 | 50 | 140 | 0.1 | 1 | 100 | Δ | ○− | — | |
| 4 | 1 | 4 | 0.1 | 50 | 140 | 0.1 | 1 | 200 | x | Δ | — | Comparative Example |
| 5 | 1 | 4 | 2 | 0 | 140 | 20 | 1 | 0 | ○− | x | — | Comparative Example |
| 6 | 1 | 4 | 0.5 | 3 | 140 | 20 | 1 | 20 | ○− | ○− | — | |
| 7 | 1 | 4 | 0.5 | 6 | 140 | 20 | 1 | 40 | ○− | ○− | — | |
| 8 | 1 | 4 | 2 | 24 | 140 | 20 | 1 | 80 | ○− | ○+ | — | |
| 9 | 1 | 4 | 2 | 50 | 140 | 20 | 1 | 100 | ○− | ⊙ | — | |
| 10 | 1 | 4 | 2 | 50 | 140 | 20 | 1 | 200 | x | Δ | — | Comparative Example |
| 11 | 1 | 4 | 4 | 0 | 140 | 40 | 1 | 0 | ○ | x | — | Comparative Example |
| 12 | 1 | 4 | 4 | 6 | 140 | 40 | 1 | 20 | ○ | ○ | — | |
| 13 | 1 | 4 | 2 | 6 | 140 | 40 | 1 | 40 | ○ | ○+ | — | |
| 14 | 1 | 4 | 2 | 12 | 140 | 40 | 1 | 80 | ○ | ○+ | — | |
| 15 | 1 | 4 | 2 | 30 | 140 | 40 | 1 | 100 | ○ | ⊙ | — | |
| 16 | 1 | 4 | 2 | 45 | 140 | 40 | 1 | 200 | x | Δ | — | Comparative Example |
| 17 | 1 | 4 | 50 | 0 | 140 | 100 | 1 | 0 | ○+ | x | — | Comparative Example |
| 18 | 1 | 4 | 50 | 3 | 140 | 100 | 1 | 0.1 | ○+ | ○− | — | |
| 19 | 1 | 4 | 1 | 6 | 140 | 100 | 1 | 100 | ○+ | ○+ | — | |
| 20 | 1 | 4 | 1 | 9 | 140 | 100 | 1 | 200 | x | Δ | — | Comparative Example |

*1Refer to Table 16,
*2Refer to Table 24,
*3As converted to phosphorus,
*4Refer to Table 17

TABLE 26

| | | Treatment-liquid composition (g/l) | | | Curing | Film composition (mg/m²) | | | Corrosion resistance | | Anti- | |
|---|---|---|---|---|---|---|---|---|---|---|---|---|
| No. | Plated steel sheet*1 | Type*2 | $Cr^{3+}$ | Ca | temperature (° C.) | Cr | Type*4 | Zn, Al-phosphoric acid*3 | Sound film Portion | Processed Portion | blackening resistance | Remarks |
| 21 | 2 | 4 | 0.1 | 0 | 140 | 0.1 | 1 | 0 | ○− | Δ | X | Comparative Example |
| 22 | 2 | 4 | 1 | 3 | 140 | 0.1 | 1 | 0.1 | ○− | ○− | ○ | |
| 23 | 2 | 4 | 0.1 | 50 | 140 | 0.1 | 1 | 100 | ○− | ○− | ○ | |
| 24 | 2 | 4 | 0.1 | 50 | 140 | 0.1 | 1 | 200 | Δ | Δ | ○ | Comparative Example |
| 25 | 2 | 4 | 2 | 0 | 140 | 20 | 1 | 0 | ○ | Δ | Δ | Comparative Example |

TABLE 26-continued

| No. | Plated steel sheet*1 | Treatment-liquid composition (g/l) Type*2 | $Cr^{3+}$ | Ca | Curing temperature (° C.) | Film composition (mg/m²) Cr | Type*4 | Zn, Al-phosphoric acid*3 | Corrosion resistance Sound film Portion | Processed Portion | Anti-blackening resistance | Remarks |
|---|---|---|---|---|---|---|---|---|---|---|---|---|
| 26 | 2 | 4 | 0.5 | 3 | 140 | 20 | 1 | 20 | ○ | ○ | ◎ | |
| 27 | 2 | 4 | 0.5 | 6 | 140 | 20 | 1 | 40 | ○ | ○+ | ◎ | |
| 28 | 2 | 4 | 2 | 24 | 140 | 20 | 1 | 80 | ○ | ◎ | ◎ | |
| 29 | 2 | 4 | 2 | 50 | 140 | 20 | 1 | 100 | ○ | ◎ | ◎ | |
| 30 | 2 | 4 | 2 | 50 | 140 | 20 | 1 | 200 | Δ | Δ | ○ | Comparative Example |
| 31 | 2 | 4 | 4 | 0 | 140 | 40 | 1 | 0 | ○+ | Δ | Δ | Comparative Example |
| 32 | 2 | 4 | 4 | 6 | 140 | 40 | 1 | 20 | ○+ | ○+ | ◎ | |
| 33 | 2 | 4 | 2 | 6 | 140 | 40 | 1 | 40 | ○+ | ◎ | ◎ | |
| 34 | 2 | 4 | 2 | 12 | 140 | 40 | 1 | 80 | ○+ | ◎ | ◎ | |
| 35 | 2 | 4 | 2 | 30 | 140 | 40 | 1 | 100 | ○+ | ◎ | ◎ | |
| 36 | 2 | 4 | 2 | 45 | 140 | 40 | 1 | 200 | Δ | Δ | ○ | Comparative Example |
| 37 | 2 | 4 | 50 | 0 | 140 | 100 | 1 | 0 | ◎ | Δ | Δ | Comparative Example |
| 38 | 2 | 4 | 50 | 3 | 140 | 100 | 1 | 0.1 | ○ | ○− | ◎ | |
| 39 | 2 | 4 | 1 | 6 | 140 | 100 | 1 | 100 | ◎ | ◎ | ◎ | |
| 40 | 2 | 4 | 1 | 9 | 140 | 100 | 1 | 200 | Δ | Δ | ○ | Comparative Example |

*1Refer to Table 16,
*2Refer to Table 24,
*3As converted to phosphorus,
*4Refer to Table 17

TABLE 27

| No. | Plated steel sheet*1 | Treatment-liquid composition (g/l) Type*2 | $Cr^{3+}$ | Ca | Curing temperature (° C.) | Film composition (mg/m²) Cr | Type*4 | Zn, Al-phosphoric | Corrosion resistance Sound film Portion | Processed Portion | Anti-blackening resistance | Remarks |
|---|---|---|---|---|---|---|---|---|---|---|---|---|
| 41 | 3 | 4 | 0.1 | 0 | 140 | 0.1 | 1 | 0 | ○ | Δ | X | Comparative Example |
| 42 | 3 | 4 | 1 | 3 | 140 | 0.1 | 1 | 0.1 | ○ | ○ | ○ | |
| 43 | 3 | 4 | 0.1 | 50 | 140 | 0.1 | 1 | 100 | ○ | ○ | ○ | |
| 44 | 3 | 4 | 0.1 | 50 | 140 | 0.1 | 1 | 200 | ○− | Δ | ○ | Comparative Example |
| 45 | 3 | 4 | 2 | 0 | 140 | 20 | 1 | 0 | ○+ | Δ | Δ | Comparative Example |
| 46 | 3 | 4 | 0.5 | 3 | 140 | 20 | 1 | 20 | ○+ | ◎ | ◎ | |
| 47 | 3 | 4 | 0.5 | 6 | 140 | 20 | 1 | 40 | ○+ | ◎ | ◎ | |
| 48 | 3 | 4 | 2 | 24 | 140 | 20 | 1 | 80 | ○+ | ◎ | ◎ | |
| 49 | 3 | 4 | 2 | 50 | 140 | 20 | 1 | 100 | ○+ | ◎ | ◎ | |
| 50 | 3 | 4 | 2 | 50 | 140 | 20 | 1 | 200 | ○− | Δ | ○ | Comparative Example |
| 51 | 3 | 4 | 4 | 0 | 140 | 40 | 1 | 0 | ◎ | Δ | Δ | Comparative Example |
| 52 | 3 | 4 | 4 | 6 | 140 | 40 | 1 | 20 | ◎ | ◎ | ◎ | |
| 53 | 3 | 4 | 2 | 6 | 140 | 40 | 1 | 40 | ◎ | ◎ | ◎ | |
| 54 | 3 | 4 | 2 | 12 | 140 | 40 | 1 | 80 | ◎ | ◎ | ◎ | |
| 55 | 3 | 4 | 2 | 30 | 140 | 40 | 1 | 100 | ◎ | ◎ | ◎ | |
| 56 | 3 | 4 | 2 | 45 | 140 | 40 | 1 | 200 | ○− | Δ | ○ | Comparative Example |
| 57 | 3 | 4 | 50 | 0 | 140 | 100 | 1 | 0 | ◎ | Δ | Δ | Comparative Example |
| 58 | 3 | 4 | 50 | 3 | 140 | 100 | 1 | 0.1 | ◎ | ○ | ◎ | |
| 59 | 3 | 4 | 1 | 6 | 140 | 100 | 1 | 100 | ◎ | ◎ | ◎ | |
| 50 | 3 | 4 | 1 | 9 | 140 | 100 | 1 | 200 | ○− | Δ | ○ | Comparative Example |
| 61 | 3 | 4 | 0.5 | 3 | 50 | 20 | 1 | 20 | Δ | Δ | ○ | Comparative example for production method |
| 62 | 3 | 4 | 0.5 | 3 | 60 | 20 | 1 | 20 | ○− | ○− | ◎ | |
| 63 | 3 | 4 | 0.5 | 3 | 300 | 20 | 1 | 20 | ○+ | ◎ | ◎ | |
| 64 | 3 | 4 | 0.5 | 3 | 320 | 20 | 1 | 20 | Δ | Δ | ○ | Comparative example for production method |
| 65 | 3 | 4 | 0.5 | 3 | 140 | 20 | 2 | 20 | ○+ | ◎ | ◎ | |
| 66 | 3 | 4 | 0.5 | 3 | 140 | 20 | 3 | 20 | ○ | ○+ | ◎ | |
| 67 | 3 | 4 | 0.5 | 3 | 140 | 20 | 4 | 20 | ○+ | ◎ | ◎ | |
| 68 | 3 | 4 | 0.5 | 3 | 140 | 20 | 5 | 20 | ○ | ◎ | ◎ | |
| 69 | 3 | 1 | 0.5 | 3 | 140 | 20 | 1 | 20 | ○ | ○ | ○ | |

TABLE 27-continued

| | | | | | | Film composition ($mg/m^2$) | | | | | | |
|---|---|---|---|---|---|---|---|---|---|---|---|---|
| | | Treatment-liquid | | | Curing | | | | Corrosion resistance | | Anti- | |
| | Plated steel | composition (g/l) | | | temperature | | Zn, Al-phosphoric | | Sound film | Processed | blackening | |
| No. | sheet*1 | Type*2 | $Cr^{3+}$ | Ca | (° C.) | Cr | Type*4 | | Portion | Portion | resistance | Remarks |
| 70 | 3 | 2 | 0.5 | 3 | 140 | 20 | 1 | 20 | ○ | ○ | ○ | |
| 71 | 3 | 3 | 0.5 | 3 | 140 | 20 | 1 | 20 | ○+ | ◎ | ◎ | |

*1Refer to Table 16.
*2Refer to Table 24,
*3As converted to phosphorus,
*4Refer to Table 17

According to Tables 25 to 27, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, as can be seen by comparison of item Nos. 46 and 69 to 71, the corrosion resistances and the antiblackening resistances are higher in the cases (item Nos. 46 and 71) using chromium carboxylate as a trivalent-chromium compound. In addition, the following can be known by comparison to the comparison examples of the steel sheets that contain at least 4 wt % Al and that are each plated with a film that is out of the range of the first pattern. In the comparison, the antiblackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

In addition, regarding the deposition of the film in the range of the first pattern, higher film quality can be obtained with the steel sheets that are plated with the film formed at curing at a temperature that is within of the sixth pattern. However, the film quality is degraded for the steel sheets of the comparative examples (item Nos. 61 and 64) on which films were individually formed at curing temperatures that are out of the range of the sixth pattern.

Embodiment 4

Embodiment 4 has the following basic characteristics:

(1) A surface-treated steel sheet characterized as follows. A film is formed on a surface of a zinc-base-plated steel sheet. The film contains (A) chromium in a range of from 0.1 to 100 $mg/m^2$, (B) calcium in range of from 0.1 to 200 $mg/m^2$, (C) a compound containing the phosphoric acid and at least one selected from the group consisting of the zinc and the aluminum, the compound being in a range of from 0.1 to 100 $mg/m^2$ (as converted to phosphorus). (First Pattern)

(2) The surface-treated steel sheet according to item (1), characterized in that the zinc-base-plated steel sheet is a Zn—Al-base-plated steel sheet that contains 4 to 25 wt % aluminum (Al). (Second Pattern)

(3) The surface-treated steel sheet according to item (2), characterized in that the zinc-base-plated steel sheet is a Zn—Al-base-plated steel sheet that contains 25 to 75 wt % Al. (Third Pattern)

(4) A method for producing one of the surface-treated steel sheets as described in items (1) to (3), characterized as follows. The film is formed through application of a treatment liquid containing (i) hexavalent chromium ions in a range of from 0.1 to 50 g/l and (ii) calcium in a range of from 1 to 50 g/l, and phosphoric acid in a range of from 1 to 50 g/l. Then, the coated surface is heated at a highest-reachable sheet temperature in a range of from 60 to 300° C. without performing rinsing. (Fourth Pattern)

(5) The method according to item (4), characterized in that the weight ratio of trivalent chromium ions/(trivalent chromium ions+hexavalent chromium ions) in the treatment liquid is in a range of from 0.2 to 0.8. (Fifth Pattern)

(6) A method for producing one of the surface-treated steel sheets as described in items (1) to (3), characterized as follows. A treatment liquid contains a water-soluble chromium compound, calcium or a compound thereof, and phosphoric acid or salt thereof, in which the water-soluble chromium compound contains a chromium compound composed of a trivalent-chromium compound. The film is formed through application of the treatment liquid. Then, the coated surface is heated at a highest-reachable sheet temperature in a range from 60 to 300° C. without performing rinsing. The treatment liquid contains (i) trivalent chromium ions in a range of from 0.1 to 50 g/l, (ii) calcium in a range of from 1 to 50 g/l, and (ii) phosphoric acid in a range from 1 to 50 g/l. (Sixth Pattern)

(7) The production method according to item (6), characterized in that the water-soluble chromium compound is chromium carboxylate. (Seventh Pattern)

Hereinbelow, a description will be made regarding details of the Embodiment 4 and reasons for limitations thereof.

For the base steel sheets, i.e., the zinc-base-plated steel sheets, various steel sheets are usable. The usable steel sheets include zinc-base-plated steel sheets, Zn—Ni-plated steel sheets, Zn—Fe-plated steel sheets (electroplated steel sheets or molten-zinc-base-alloy-plated steel sheets), Zn—Cr-plated steel sheets, Zn—Mn-plated steel sheets, Zn—Co-plated steel sheets, Zn—Co—Cr-plated steel sheets, Zn—Ni—Cr-plated steel sheets, Zn—Cr—Fe-plated steel sheets, Zn—Al-base-plated steel sheets (such as Zn-5% Al-alloy-plated steel sheets or Zn-55% Al-alloy-plated steel sheets), Zn—Mg-plated steel sheets, and Zn—Al—Mg-plated steel sheets. The usable steed sheets also include zinc-base-composite-plated steel sheets (such as Zn—$SiO_2$-dispersion-plated steel sheets) that are individually formed by dispersing a metallic oxide, a polymer, or the like in the plating film of one of the aforementioned plated steel sheets.

Furthermore, the usable steel sheets include multilayer-plated steel sheets individually having at least two layers of the identical or different plating types among those shown above.

The Zn—Al-base-plated steel sheet that contains 4 to 25 wt % Al contains 4 to 25 wt % Al as an indispensable component, and further contains small amounts of materials of other elements, such as La, Ce, Mg, and Si, depending on the necessity. A so-called Zn-5% Al-alloy-plated steel sheet belongs to the steel sheet of that type.

The Zn—Al-base-plated steel sheet that contains 25 to 75 wt % Al contains 25 to 75 wt % Al as an indispensable component, and further contains small amounts of materials of other elements, such as La, Ce, Mg, and Si, depending on the necessary. A so-called Zn-55% Al-alloy-plated steel sheet belongs to the steel sheet of that type.

For coating and forming of the Embodiment-3 film on the plated surface, pretreatments may be performed depending on requirements to prevent defects and nonuniformity that can be caused during the forming of the film. The pretreatments include an alkaline degreasing treatment, a solvent degreasing treatment and a surface-conditioning treatment (an alkaline surface-conditioning treatment or an acidic surface-conditioning treatment). In addition, to further improve blackening-prevention effects under an environment where the film of the present invention is used, the plated surface may preliminarily be subjected to surface-conditioning treatment using acidic or alkaline solution containing ferrous-base metallic ions (Ni ions, Co ions, and Fe ions). Furthermore, when necessary to further improve the blackening-prevention effects for a steel sheet to be coated with an electroplated base plating, an electroplating bath may contain at least 1 ppm of iron-base metallic ions (Ni ions, Co ions, Fe ions). Thereby, these metals can be included into the plating film. In this case, no specific limitation should be set for the upper limit of the ferrous-base metal concentration in the plating film.

Embodiment 4 is characterized to form chemical conversion films on a surface of the zinc-base-plated steel sheet, in which the chemical conversion films contain compounds formed of (A) the chromium having barrier effects and (B) the calcium having self-healing effects, and (C) the compound composed of either one of the zinc and the aluminum or both of them and the phosphoric acid.

In this case, the coating weight of the chromium in the film is preferably in a range of from 0.1 to 100 mg/m$^2$. When the chromium coating weight is below 0.1 mg/m$^2$, sufficient chromium-attributable barrier effects cannot be imparted. When the chromium coating weight exceeds 100 mg/m$^2$, while the treatment time increases, no improvement can be expected in the barrier effects. From this viewpoint, it is more preferable that the chromium coating weight should be in a range of from 10 to 70 mg/m$^2$.

The calcium in the film is not specifically limited. The calcium may be any one of the followings. They are metallic calcium, calcium oxide, calcium hydroxide; single-type salt that contains only calcium as cation, for example, calcium silicate, calcium carbonate, calcium phosphate, and calcium molybdate; and double-type salt that contains cation other than calcium cation such as calcium-zinc phosphate, calcium-magnesium phosphate, and calcium-zinc molybdate. Alternatively, the above may be mixed. An implementation mechanism for the above is considered to be as follows. In a damaged film portion, the calcium that is less noble than plating metal is caused to dissolve preferential to the plating metal, and the dissolution of the plating metal is thereby inhibited. Consequently, the dissolved calcium deposits in the damaged film portion to form a protection film. This allows a high processed-portion corrosion resistance and an antiblackening resistance to be imparted on the Zn—Al-base-plated steel sheet that contains 4 to 25 wt % Al and the Zn—Al-base-plated steel sheet that contains 25 to 75 wt % Al.

The coating weight of the calcium in the film is preferably in a range of from 0.1 to 200 mg/m$^2$. When the coating weight is below 0.1 mg/m$^2$, reduction occurs in the self-healing effects that can be produced because of the function of calcium. In addition, reduction occurs in the implementation effects of the calcium-attributable processed-portion corrosion resistance and antiblackening resistance of the Zn—Al-base-plated steel sheet that contains 4 to 25 wt % Al and the Zn—Al-base-plated steel sheet that contains 25 to 75 wt % Al. On the other hand, when the calcium coating weight is greater than 200 mg/m$^2$, the dissolution amount excessively increases. Because of the increase, the corrosion resistance is reduced even in a sound film portion (film portion where no damage is caused by processing and the like). From this viewpoint, it is more preferable that the coating weight of the compound should be in a range of from 10 to 100 mg/m$^2$.

The compound composed of either one of the zinc and the aluminum or both of them and the phosphoric acid is not limited by, for example, the skeleton and the degree of condensation of phosphoric acid ions. The compound may be normal salt, dihydrogen salt, monohydrogen salt, or phosphite. The normal salt may be any one of orthophosphoric acid and all the types of condensed phosphate such as polyphosphate. An implementation mechanism for the above is considered as follows. In a damaged film portion in a corrosive environment, with dissolution of plating metal as a trigger, phosphoric acid ions disassociated by hydrolysis cause complex-forming reaction with the dissolved metal and thereby form a protective film.

The coating weight of the compound composed of either one of the zinc and the aluminum or both of them and the phosphoric acid in the film is preferably in a range of from 0.1 to 100 mg/m$^2$. When the coating weight is below 0.1 mg/m$^2$, reduction occurs in the self-healing effects that can be caused by the compound composed of either one of the zinc and the aluminum or both of them and the phosphoric acid. In addition, reduction occurs in the processed-portion corrosion resistance and antiblackening resistance of the Zn—Al-base-plated steel sheet that contains 4 to 25 wt % Al and the Zn—Al-base-plated steel sheet that contains 25 to 75 wt % Al. On the other hand, when the coating weight of the compound is greater than 100 mg/m$^2$, while the cost increases, proportional improvement cannot be expected in the processed-portion corrosion resistance and the antiblackening resistance of the Zn—Al-base plating layer that contains 4 to 25 wt % Al and the Zn—Al-base plating layer that contains 25 to 75 wt % Al. From this viewpoint, it is more preferable that the coating weight of the compound should be in a range of from 1 to 50 mg/m$^2$.

Among the three above compounds, by including either a compound composed of (A) chromium and (B) calcium or the compound composed of (C) either one of the zinc and the aluminum or the both of them and the phosphoric acid, the effect of improving the processed-portion corrosion resistance is obtained. The processed-portion corrosion resistance can be significantly improved by including the three compounds to coexist. Moreover, the coexistence enables significant improvement to be expected in the antiblackening resistance of either the Zn—Al-base-plated steel sheet that contains 4 to 25 wt % Al or the antiblackening resistance of the Zn—Al-base-plated steel sheet that contains 25 to 75 wt % Al.

A mechanism of the improvements is considered to be as follows:

1) In a corrosive environment, calcium dissolves preferential to the plating metal;
2) As a result of the above, the compound composed of either one of the zinc and the aluminum or the both of them and the phosphoric acid causes hydrolysis reaction to be disassociated into phosphoric acid ions; and
3) The phosphoric acid ions having high complex formability causes hydrolysis reaction with calcium ions, thereby forming a well-densified and refractory protective film.

According to the mechanism, corrosive reaction can be inhibited earlier. Concurrently, blackening behavior can be inhibited in either the Zn—Al-base-plated steel sheet that contains 4 to 25 wt % Al or the antiblackening resistance in the Zn—Al-base-plated steel sheet that contains 25 to 75 wt % Al.

In addition to the above-described film components, the film may further contain oxide fine particles of, for example, silicon oxide, aluminum oxide, zirconium oxide, titanium oxide, cerium oxide, and antimonium oxide.

In addition to the aforementioned film components, the film may further contain an organic polymeric resin. For example, the organic polymeric resin that may be included is an epoxy resin, a polyhydroxypolyether resin, an acrylic copolymer resin, an ethylene-acrylic acid copolymer resin, an alkyd resin, a polybutadiene resin, a phenol resin, a polyurethane resin, a polyamine resin, and a polyphenylene resin.

In Embodiment 4, the treatment liquid contains the water-soluble chromium compound, the calcium or a compound thereof, and the phosphoric acid or salt thereof. The steel-sheet surface is coated with the treatment liquid that contains (i) hexavalent chromium ions in a range of from 0.1 to 50 g/l, (ii) calcium in a range of from 1 to 50 g/l, and (iii) phosphoric acid in a range of from 1 to 50 g/l. The coated surface is then heated at a highest-reachable sheet temperature in a range of from 60 to 300° C. without performing rinsing. In this way, chemical conversion films are formed. This method enables the production of a surface-treated steel sheet that has a high processed-portion corrosion resistance. In addition, the method enables a high antiblackening resistance to be imparted on either the Zn—Al-base-plated steel sheet that contains 4 to 25 wt % Al or the Zn—Al-base-plated steel sheet that contains 25 to 75 wt % Al.

In the above, the concentration of the hexavalent chromium ions affects the plating as follows. When the hexavalent chromium ions are below 0.1 g/l, since the coating amount should be significantly increased to obtain a desired chromium coating weight, nonuniformed coating is prone to occur. When the hexavalent chromium ions are above 50 g/l, since the reactivity of the treatment liquid is extremely high, the dissolution amount of the plating film increases. This reduces the stability of the treatment liquid. The case is therefore not preferable.

The type of the hexavalent chromium ions is not specifically limited as long as the ions are water-soluble. For example, chromic acid and ammonium chromate belong to the type; and, refractory chromium compounds, such as zinc chromate, strontium chromate, and barium chromate do not belong to the type.

In the above-described water-soluble chromium compound, the weight ratio (as converted to metallic chromium) of trivalent chromium ions/(trivalent chromium ions+hexavalent chromium ions) is preferably in a range of from 0.2 to 0.8. This enables the production of a surface-treated steel sheet that has a high processed-portion corrosion resistance. In addition, the antiblackening resistance can further be improved for either the Zn—Al-base-plated steel sheet that contains 4 to 25 wt % Al or the Zn—Al-base-plated steel sheet that contains 25 to 75 wt % Al.

A case is not preferable in which the weight ratio (as converted to metallic chromium) of trivalent chromium ions/(trivalent chromium ions+hexavalent chromium ions) is below 0.2. In this case, the concentration of hexavalent chromium ions excessively increases, and the refractory property of the film decreases. In addition, in a corrosive environment, the case does not contribute to the corrosion resistance. For the Zn—Al-base-plated steel sheet that contains 4 to 25 wt % Al and the Zn—Al-base-plated steel sheet that contains 25 to 75 wt % Al, the case does not contribute even to the antiblackening resistance, and the dissolution amount of the ions increases. Thus, the case is not preferable from the viewpoint of economy and environmental applicability. On the other hand, the weight ratio of trivalent chromium ions/(trivalent chromium ions+hexavalent chromium ions) is above 0.8, the treatment liquid is prone to gel, significantly decreasing the stability of the treatment liquid.

In Embodiment 4, the treatment liquid contains the water-soluble chromium compound, in which the chromium compound is composed of a trivalent-chromium compound, the calcium or salt thereof, and the phosphoric acid or salt thereof. The steel-sheet surface is coated with the treatment liquid that contains (i) trivalent chromium ions in a range of from 0.1 to 50 g/l, (ii) calcium in a range of from 1 to 50 g/l, and (ii) phosphoric acid in a range from 1 to 50 g/l. The coated surface is then heated at a highest-reachable sheet temperature at a range of from 60 to 300° C. without performing rinsing. In this way, a chemical conversion film is formed. This method enables the production of a surface-treated steel sheet that has a high processed-portion corrosion resistance. In addition, the method enables the high antiblackening resistance to be further improved for either the Zn—Al-base-plated steel sheet that contains 4 to 25 wt % Al or the Zn—Al-base-plated steel sheet that contains 25 to 75 wt % Al. In the method according to Embodiment 4, since the treatment liquid does not contain hexavalent chromium ions, it does not cause the problem of out-of-system dissolution of hexavalent chromium when the steel sheet is used. In addition, the method can provide high self-healing capability without relying on the hexavalent chromium.

In the above, the concentration of the trivalent chromium ions affects the plating as follows. When the trivalent chromium ions are below 0.1 g/l, since the coating amount should be significantly increased to obtain a desired chromium coating weight, nonuniformed coating is prone to occur. When the trivalent chromium ions are above 50 g/l, since the reactivity of the treatment liquid is extremely high, the dissolution amount of the plating film increases. This reduces the stability of the treatment liquid. The case is therefore not preferable.

The trivalent-chromium compound is not specifically limited as long as the compound is water-soluble. Examples thereof include chromium chloride, chromium sulfate, chromium acetate, and chromium formate. Preferably, the trivalent-chromium compound is chromium carboxylate such as chromium acetate or chromium formate.

The calcium or the compound thereof is not specifically limited. The calcium or the compound thereof may be any one of calcium oxide and calcium hydroxide; single-type salt that contains only calcium as cation, for example, calcium silicate, calcium carbonate, calcium phosphate, and calcium molybdate; and double-type salt that contains cation other than calcium cation such as calcium-zinc phosphate, calcium-magnesium phosphate, and calcium-zinc molybdate. Alternatively, the above may be mixed. The usable calcium or the compound thereof also includes a product reactant with other compounds in the treatment liquid. Alternatively, calcium or calcium ions may be used.

The concentration of the calcium affects the plating as follows. When the calcium concentration is set below 1 g/l, the calcium necessary to provide sufficient self-healing effects cannot be included in the formed film. Also, the calcium necessary to provide sufficient processed-portion corrosion resistance and antiblackening resistance cannot be included in the film on either the Zn—Al-base-plated steel sheet that contains 4 to 25 wt % Al or the Zn—Al-base-plated steel sheet that contains 25 to 75 wt % Al. In a case where the calcium concentration is set above 50 g/l, since the amount of the calcium in the film is extremely high, the corrosion resistance of a sound film portion is reduced. The case is therefore not preferable.

The phosphoric acid or the salt thereof to be included to coexist with the water-soluble chromium compound is not limited by, for example, the skeleton and the degree of condensation of phosphoric acid ions. The salt may be normal salt, dihydrogen salt, monohydrogen salt, or phosphate. The normal salt may be any one of orthophosphoric acid and all the types of condensed phosphate such as polyphosphate, or a mixture thereof. Furthermore, the present mode allows phosphoric acid or phosphoric acid ions to be used.

The concentration of the phosphoric acid affects the plating as follows. When the phosphoric-acid concentration is set below 1 g/l, the phosphoric acid necessary to provide sufficient self-healing effects cannot be included in the formed film. Also, the phosphoric acid necessary to provide sufficient processed-portion corrosion resistance and antiblackening resistance is insufficient in the film on either the Zn—Al-base-plated steel sheet that contains 4 to 25 wt % Al or the Zn—Al-base-plated steel sheet that contains 25 to 75 wt % Al. When the phosphoric-acid concentration is set above 50 g/l, since the reactivity of the treatment liquid is extremely high, the dissolution amount of the plating film increases, and the stability of the treatment liquid is reduced by dissolved zinc. The case is therefore not preferable.

Furthermore, as a film-deposition assistant, inorganic acid may be included. Examples of the inorganic acid are phosphoric acid, polyphosphoric acid, boric acid, and phosphoric acid.

For an application method for the above-described treatment liquid, there are no specific limitations. For example, the method may be a roll-coater method, a ringer-roller method, a dipping method, and an air-knife squeezing method.

Preferably, after coating, the coated surface is heated at a highest-reachable sheet temperature in a range of from 60 to 300° C. without performing rinsing. When the highest-reachable sheet temperature is below 60° C., trivalent-chromium compound having excellent barrier effects is not sufficiently formed. When the highest-reachable sheet temperature is above 300° C., cracks occurs in the film. The cracks are innumerous, so that self-healing effects of the film do not work. Thus, in either out-of-range case, the corrosion resistance significantly decreases in processed portions and sound portions of the film.

EXAMPLE 1

For original processing steel sheets, zinc-base-plated steel sheets of the types shown in Table 28 were used. With treatment-liquid compositions and curing temperatures that are shown in Tables 30 and 31, roll-coater coating was performed. Without performing rinsing, heat-curing was performed, and chemical conversion films were formed. The coating weight was controlled through variables such as the coating amount, the roll-coater peripheral speed, and pressing forces. Table 29 shows compounds ("Zn,Al-Phosphoric Acid" in Tables 30 and 31) composed of either one of the zinc and the aluminum or both of them and the phosphoric acid in the chemical conversion films. Surface-treated steel sheets thus obtained were evaluated for quality in the manners described as follows. (1) Processed-Portion Corrosion Resistances A slit in the size of 0.3 mm (width) and 5 cm (length) was scribed using a knife cutter on each test-sample surface to reach a steel surface. The test sample was subjected to 100 cycles of compound corrosion testing in the order listed below.

3 wt % salt spray testing (30° C.; 0.5 hours)

↓

Humidity cabinet testing (30° C.; 95% RH; 1.5 hours)

↓

Hot-air curing testing (50° C.; 20%; 2.0 hours)

↓

Hot-air curing testing (30° C.; 20%; 2.0 hours)

The evaluation was performed for the rust-developed area ratio in 5-mm areas on two sides of the cut slit. The conditions (color tones) of developed rust depended on the Al concentration of the plating film. White rust was caused in zinc-plated steel sheets and Zn/Al-base-plated steel sheets having Al concentrations of at most 25 wt %. Rust ranging in color from gray to black was caused on Zn/Al-base-plated steel sheets having Al concentrations ranged from 25 to 75 wt %.

◎: No rust

○+: Rust-developed area ratio=less than 5%

○: Rust-developed area ratio=at least 5% to less than 10%

○−: Rust-developed area ratio=at least 10% to less than 25%

Δ: Rust-developed area ratio=at least 25% to less than 50%

×: Rust-developed area ratio=at least 50%

(2) Corrosion Resistances of Sound Film Portions

The above-described compound corrosion testing was performed 300 cycles for each test sample for which no damage nor bending nor other processing was provided. Using criteria shown above, the evaluation was performed based on a rust-developed area ratio of the test-sample surface. Rust conditions were the same as in the case of the above-described processed-portion corrosion resistance.

(3) Antiblackening Resistances

Evaluation was performed for the antiblackening resistances of Zn/Al-base-plated steel sheets containing at least 4 wt % Al. In specific, the evaluation was performed by using the following two methods depending on the Al concentration.

(Zn/Al-base-plated steel sheets with Al Concentrations of 4 to 25 wt %: item No. 2 in Table 28)

Test samples for which no damage nor bending nor other processing was provided were stacked, and placed in a humidity cabinet tester (HCT) for six days. The appearance of the test samples was visually observed, and the antiblackening resistance was evaluated according to the following criteria:

◎: No changed portion in pre-testing and post-testing appearance

○: Slight dot-likely-changed portions in post-testing appearance (area=less than 10%)

Δ: island-likely-changed portions in post-testing appearance (area=at least 10% to less than 50%)

×: Visibly-blackened portions or at-least-50%-surface-changed portion in post-testing appearance (Zn/Al-base-plated steel sheets with Al Concentrations of 25 to 75 wt %: Item No. 3 in Table 28)

Evaluation was performed for test samples for which no damage nor bending nor other processing was provided. Each of the test samples was held in a thermo-hygrostat chamber for 24 hours. The thermo-hygrostat apparatus was atmospherically controlled at a temperature of 80° C. and of a relative humidity (RH) of 95%. Evaluation was performed for the individual test samples in the above state by measuring a variation (ΔL value) in the whiteness (L value), that is, the (pre-testing L value−post-testing L value), according to the following criteria:

◎: $\Delta L \geqq -1.0$

○: $-1.0 > \Delta L \geqq -2.0$

Δ: $-2.0 > \Delta L \geqq -4.0$ and

×: $-4.0 > \Delta L$

The evaluation results are shown in Tables 30 and 31.

TABLE 28

| No. | Type | Coating weight g/m$^2$ |
|---|---|---|
| 1 | Molten-Zn-plated steel sheet | 120 |
| 2 | Molten-Zn-5 wt % Al-0.5 wt % Mg-alloy-plated steel sheet | 90 |
| 3 | Molten-Zn-55 wt % Al-alloy-plated steel sheet | 90 |

TABLE 29

| No. | Type and composition |
|---|---|
| 1 | Zinc phosphate |
| 2 | Aluminum phosphate |
| 3 | Zinc phosphite |
| 4 | Dihydrogen aluminum tripolyphosphate |
| 5 | Zinc phosphate (50 wt %) + dihydrogen aluminum tripolyphosphate (50 wt %) |

TABLE 30

| | | Treatment-liquid composition (g/l) | | | Curing | Film composition (mg/m$^2$) | | | | Corrosion resistance | | Anti- | |
|---|---|---|---|---|---|---|---|---|---|---|---|---|---|
| | Plated steel | | | Phosphoric | temperature | | | Zn, Al-phosphoric | | Sound film | Processed | blackening | |
| No. | sheet*1 | $Cr^{6+}$ | Ca | acid | (° C.) | Cr | Ca | Type*3 | | Portion | Portion | resistance | Remarks |
| 1 | 1 | 1 | 1 | 3 | 140 | 0.1 | 0.1 | 1 | 0.1 | Δ | ○− | — | |
| 2 | 1 | 30 | 1 | 3 | 140 | 30 | 0.1 | 1 | 0.1 | ○− | ○− | — | |
| 3 | 1 | 3 | 3 | 1 | 140 | 30 | 30 | 1 | 0.1 | ○− | ○ | — | |
| 4 | 1 | 30 | 1 | 50 | 140 | 30 | 0.1 | 1 | 20 | ○− | ○ | — | |
| 5 | 1 | 3 | 3 | 6 | 140 | 30 | 30 | 1 | 20 | ○ | ○ | — | |
| 6 | 1 | 3 | 30 | 6 | 140 | 30 | 300 | 1 | 20 | X | Δ | — | Comparative Example |
| 7 | 1 | 0.1 | 1 | 50 | 140 | 30 | 30 | 1 | 200 | X | Δ | — | Comparative Example |
| 8 | 1 | 50 | 50 | 50 | 140 | 100 | 200 | 1 | 100 | ○+ | ○+ | — | |
| 9 | 1 | 3 | 3 | 6 | 140 | 30 | 30 | 2 | 20 | ○ | ○ | ○ | — |
| 10 | 1 | 3 | 3 | 6 | 140 | 30 | 30 | 3 | 20 | ○ | ○ | ○ | — |
| 11 | 1 | 3 | 3 | 6 | 140 | 30 | 30 | 4 | 20 | ○ | ○ | ○ | — |
| 12 | 1 | 3 | 3 | 6 | 140 | 30 | 30 | 4 | 20 | ○ | ○ | ○ | — |
| 13 | 2 | 1 | 1 | 3 | 140 | 0.1 | 0.1 | 1 | 0.1 | ○− | ○− | ○ | |
| 14 | 2 | 30 | 1 | 3 | 140 | 30 | 0.1 | 1 | 0.1 | ○ | ○− | ○ | |
| 15 | 2 | 3 | 3 | 1 | 140 | 30 | 30 | 1 | 0.1 | ○ | ○ | ○ | ○ |
| 16 | 2 | 30 | 1 | 50 | 140 | 30 | 0.1 | 1 | 20 | ○ | ○ | ○ | ○ |
| 17 | 2 | 3 | 3 | 6 | 140 | 30 | 30 | 1 | 20 | ○+ | ○+ | ◎ | |
| 18 | 2 | 3 | 30 | 6 | 140 | 30 | 300 | 1 | 20 | X | Δ | Δ | Comparative Example |
| 19 | 2 | 0.1 | 1 | 50 | 140 | 30 | 30 | 1 | 200 | X | Δ | Δ | Comparative Example |
| 20 | 2 | 50 | 50 | 50 | 140 | 100 | 200 | 1 | 100 | ◎ | ◎ | ◎ | |
| 21 | 2 | 3 | 3 | 6 | 140 | 30 | 30 | 2 | 20 | ○+ | ○+ | ◎ | |
| 22 | 2 | 3 | 3 | 6 | 140 | 30 | 30 | 3 | 20 | ○+ | ○+ | ◎ | |
| 23 | 2 | 3 | 3 | 6 | 140 | 30 | 30 | 4 | 20 | ○+ | ○+ | ◎ | |
| 24 | 2 | 3 | 3 | 6 | 140 | 30 | 30 | 4 | 20 | ○+ | ○+ | ◎ | |

*1Refer to Table 28

*2As converted to phosphorus

*3Refer to Table 29

TABLE 31

| No. | Plated steel sheet*1 | Treatment-liquid composition (g/l) $Cr^{6+}$ | Ca | Phosphoric acid | Curing temperature (° C.) | Film composition (mg/m²) Cr | Ca | Zn, Al-phosphoric acid*2 Type*3 | | Corrosion resistance Sound film Portion | Processed Portion | Anti-blackening resistance | Remarks |
|---|---|---|---|---|---|---|---|---|---|---|---|---|---|
| 25 | 3 | 1 | 1 | 3 | 140 | 0.1 | 0.1 | 1 | 0.1 | ○ | ○ | ○ | |
| 26 | 3 | 30 | 1 | 3 | 140 | 30 | 0.1 | 1 | 0.1 | ○+ | ○ | ○ | |
| 27 | 3 | 3 | 3 | 1 | 140 | 30 | 30 | 1 | 0.1 | ○+ | ○+ | ◎ | |
| 28 | 3 | 30 | 1 | 50 | 140 | 30 | 0.1 | 1 | 20 | ○+ | ○+ | ◎ | |
| 29 | 3 | 3 | 3 | 6 | 140 | 30 | 30 | 1 | 20 | ◎ | ◎ | ◎ | |
| 30 | 3 | 3 | 0 | 6 | 140 | 30 | 0 | 1 | 20 | ○+ | ○− | ○ | Comparative Example |
| 31 | 3 | 3 | 30 | 6 | 140 | 30 | 300 | 1 | 20 | Δ | Δ | Δ | Comparative Example |
| 32 | 3 | 0.1 | 1 | 50 | 140 | 30 | 30 | 1 | 200 | Δ | Δ | Δ | Comparative Example |
| 33 | 3 | 50 | 50 | 50 | 140 | 100 | 200 | 1 | 100 | ◎ | ◎ | ◎ | |
| 34 | 3 | 3 | 3 | 6 | 140 | 30 | 30 | 2 | 20 | ◎ | ◎ | ◎ | |
| 35 | 3 | 3 | 3 | 6 | 140 | 30 | 30 | 3 | 20 | ◎ | ◎ | ◎ | |
| 36 | 3 | 3 | 3 | 6 | 140 | 30 | 30 | 4 | 20 | ◎ | ◎ | ◎ | |
| 37 | 3 | 3 | 3 | 6 | 140 | 30 | 30 | 4 | 20 | ◎ | ◎ | ◎ | |
| 38 | 3 | 3 | 3 | 6 | 50 | 30 | 30 | 1 | 20 | Δ | Δ | ○ | Comparative example for production method |
| 39 | 3 | 3 | 3 | 6 | 60 | 30 | 30 | 1 | 20 | ○− | ○− | ◎ | |
| 40 | 3 | 3 | 3 | 6 | 300 | 30 | 30 | 1 | 20 | ○+ | ◎ | ◎ | |
| 41 | 3 | 3 | 3 | 6 | 320 | 30 | 30 | 1 | 20 | Δ | Δ | ○ | Comparative example for production method |

*1Refer to Table 28
*2As converted to phosphorus
*3Refer to Table 29

According to Tables 30 and 31, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, the following can be known by comparison to the comparison examples of the steel sheets that contain at least 4 wt % Al and that are each plated with a film that is out of the range of the first pattern. In the comparison, the anti-blackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

Furthermore, with the film formed in the range of the first pattern, high film quality can be obtained for the steel sheets produced according to the conditions that are within the range of the fourth pattern. However, the film quality is degraded for the steel sheets of the comparative examples (item Nos. 38 and 41) on which the film was formed at curing temperatures that are out of the range of the fourth pattern.

EXAMPLE 2

For original processing steel sheets, zinc-base-plated steel sheets of the types shown in Table 28 were used. With treatment-liquid compositions and curing temperatures that are shown in Tables 32 and 33, roll-coater coating was performed. Without rinsing, heat-curing was performed, and individual chemical conversion films were formed. The coating weight was controlled through variables such as the coating amount, the roll-coater peripheral speed, and pressing forces. Table 29 shows compounds ("Zn,Al-phosphoric acid" in Tables 32 and 33) composed of either one of the zinc and the aluminum or both of them and the phosphoric acid. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to a 200-hour salt spray testing that conforms to JIS Z 2371. Evaluation was performed based on the rust-developed area ratio in 5-mm areas on two sides of the cut slit. The conditions (color tones) of developed rust were the same as in the case of the evaluation of the processed-portion corrosion resistance in Example 1.

(2) Corrosion Resistances of Sound Film Portions

The above-described salt spray testing was performed for 400 hours for each test sample for which no damage nor bending nor other processing was provided. Using the same criteria set in Example 1, the evaluation was performed based on a rust-developed area ratio of the test-sample surface. Rust conditions were the same as in the case of the above-described evaluation of the processed-portion corrosion resistances.

(3) Antiblackening Resistances

Evaluation was performed for the antiblackening resistances of Zn/Al-base-plated steel sheets containing at least 4 wt % Al in the same manners as those in Example 1.

The evaluation results are shown in Tables 32 and 33.

TABLE 32

| No. | Plated steel sheet*1 | Treatment-liquid composition (g/l) $Cr^{6+}$ | Ca | Phosphoric acid | Cr reduction ratio*2 | Curing temperature (° C.) | Film composition (mg/m²) Cr | Ca | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|---|---|
| 1 | 1 | 1 | 1 | 3 | 0.4 | 140 | 0.1 | 0.1 | 1 | 0.1 | Δ | ○− | — | |
| 2 | 1 | 30 | 1 | 3 | 0.4 | 140 | 30 | 0.1 | 1 | 0.1 | ○− | ○− | — | |
| 3 | 1 | 3 | 3 | 1 | 0.4 | 140 | 30 | 30 | 1 | 0.1 | ○− | ○ | — | |
| 4 | 1 | 30 | 1 | 50 | 0.4 | 140 | 30 | 0.1 | 1 | 20 | ○− | ○ | — | |
| 5 | 1 | 3 | 3 | 6 | 0.4 | 140 | 30 | 30 | 1 | 20 | ○ | ○ | — | |
| 6 | 1 | 3 | 30 | 6 | 0.4 | 140 | 30 | 300 | 1 | 20 | X | Δ | — | Comparative Example |
| 7 | 1 | 0.1 | 1 | 50 | 0.4 | 140 | 30 | 30 | 1 | 200 | X | Δ | — | Comparative Example |
| 8 | 1 | 50 | 50 | 50 | 0.4 | 140 | 100 | 200 | 1 | 100 | ○+ | ○+ | — | |
| 9 | 1 | 3 | 3 | 6 | 0.4 | 140 | 30 | 30 | 2 | 20 | ○ | ○ | — | |
| 10 | 1 | 3 | 3 | 6 | 0.4 | 140 | 30 | 30 | 3 | 20 | ○ | ○ | — | |
| 11 | 1 | 3 | 3 | 6 | 0.4 | 140 | 30 | 30 | 4 | 20 | ○ | ○ | — | |
| 12 | 1 | 3 | 3 | 6 | 0.4 | 140 | 30 | 30 | 4 | 20 | ○ | ○ | — | |
| 13 | 2 | 1 | 1 | 3 | 0.4 | 140 | 0.1 | 0.1 | 1 | 0.1 | ○− | ○− | ○ | |
| 14 | 2 | 30 | 1 | 3 | 0.4 | 140 | 30 | 0.1 | 1 | 0.1 | ○ | ○− | ○ | |
| 15 | 2 | 3 | 3 | 1 | 0.4 | 140 | 30 | 30 | 1 | 0.1 | ○ | ○ | ○ | |
| 16 | 2 | 30 | 1 | 50 | 0.4 | 140 | 30 | 0.1 | 1 | 20 | ○ | ○ | ○ | |
| 17 | 2 | 3 | 3 | 6 | 0.4 | 140 | 30 | 30 | 1 | 20 | ○+ | ○+ | ⊙ | |
| 18 | 2 | 3 | 30 | 6 | 0.4 | 140 | 30 | 300 | 1 | 20 | X | Δ | Δ | Comparative Example |
| 19 | 2 | 0.1 | 1 | 50 | 0.4 | 140 | 30 | 30 | 1 | 200 | X | Δ | Δ | Comparative Example |
| 20 | 2 | 50 | 50 | 50 | 0.4 | 140 | 100 | 200 | 1 | 100 | ⊙ | ⊙ | ⊙ | |
| 21 | 2 | 3 | 3 | 6 | 0.4 | 140 | 30 | 30 | 2 | 20 | ○+ | ○+ | ⊙ | |
| 22 | 2 | 3 | 3 | 6 | 0.4 | 140 | 30 | 30 | 3 | 20 | ○+ | ○+ | ⊙ | |
| 23 | 2 | 3 | 3 | 6 | 0.4 | 140 | 30 | 30 | 4 | 20 | ○+ | ○+ | ⊙ | |
| 24 | 2 | 3 | 3 | 6 | 0.4 | 140 | 30 | 30 | 4 | 20 | ○+ | ○+ | ⊙ | |

*1Refer to Table 28
*2Trivalent chromium ions/total Cr, total Cr = Trivalent chromium ions + hexavalent chromium ions
*3As converted to phosphorus
*4Refer to Table 29

TABLE 33

| No. | Plated steel sheet*1 | Treatment-liquid composition (g/l) $Cr^{6+}$ | Ca | Phosphoric acid | Cr reduction ratio*2 | Curing temperature (° C.) | Film composition (mg/m²) Cr | Ca | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|---|---|
| 25 | 3 | 1 | 1 | 3 | 0.4 | 140 | 0.1 | 0.1 | 1 | 0.1 | ○ | ○ | ○ | |
| 26 | 3 | 30 | 1 | 3 | 0.4 | 140 | 30 | 0.1 | 1 | 0.1 | ○+ | ○ | ○ | |
| 27 | 3 | 3 | 3 | 1 | 0.4 | 140 | 30 | 30 | 1 | 0.1 | ○+ | ○+ | ⊙ | |
| 28 | 3 | 30 | 1 | 50 | 0.4 | 140 | 30 | 0.1 | 1 | 20 | ○+ | ○+ | ⊙ | |
| 29 | 3 | 3 | 3 | 6 | 0.4 | 140 | 30 | 30 | 1 | 20 | ⊙ | ⊙ | ⊙ | |
| 30 | 3 | 3 | 3 | 0 | 0.4 | 140 | 30 | 30 | — | 0 | ○+ | ○− | ○ | Comparative Example |
| 31 | 3 | 3 | 30 | 6 | 0.4 | 140 | 30 | 300 | 1 | 20 | Δ | Δ | Δ | Comparative Example |
| 32 | 3 | 0.1 | 1 | 50 | 0.4 | 140 | 30 | 30 | 1 | 200 | Δ | Δ | Δ | Comparative Example |
| 33 | 3 | 50 | 50 | 50 | 0.4 | 140 | 100 | 200 | 1 | 100 | ⊙ | ⊙ | ⊙ | |
| 34 | 3 | 3 | 3 | 6 | 0.4 | 140 | 30 | 30 | 2 | 20 | ⊙ | ⊙ | ⊙ | |
| 35 | 3 | 3 | 3 | 6 | 0.4 | 140 | 30 | 30 | 3 | 20 | ⊙ | ⊙ | ⊙ | |
| 36 | 3 | 3 | 3 | 6 | 0.4 | 140 | 30 | 30 | 4 | 20 | ⊙ | ⊙ | ⊙ | |
| 37 | 3 | 3 | 3 | 6 | 0.4 | 140 | 30 | 30 | 4 | 20 | ⊙ | ⊙ | ⊙ | |
| 38 | 3 | 3 | 3 | 6 | 0.4 | 50 | 30 | 30 | 1 | 20 | Δ | Δ | ○ | Comparative example for production method |
| 39 | 3 | 3 | 3 | 6 | 0.4 | 60 | 30 | 30 | 1 | 20 | ○− | ○− | ⊙ | |
| 40 | 3 | 3 | 3 | 6 | 0.4 | 300 | 30 | 30 | 1 | 20 | ○+ | ⊙ | ⊙ | |

TABLE 33-continued

| No. | Plated steel sheet*1 | Treatment-liquid composition (g/l) $Cr^{6+}$ | Ca | Phosphoric acid | Cr reduction ratio*2 | Curing temperature (° C.) | Film composition (mg/m²) Cr | Ca | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|---|---|
| 41 | 3 | 3 | 3 | 6 | 0.4 | 320 | 30 | 30 | 1 | 20 | Δ | Δ | ○ | Comparative example for production method |
| 42 | 3 | 3 | 3 | 6 | 0.1 | 140 | 30 | 30 | 1 | 20 | ○– | Δ | ○ | Comparative example of production method (5th invention) |
| 43 | 3 | 3 | 3 | 6 | 0.2 | 140 | 30 | 30 | 1 | 20 | ○ | ○ | ⊙ | |
| 44 | 3 | 3 | 3 | 6 | 0.8 | 140 | 30 | 30 | 1 | 20 | ○ | ○ | ⊙ | |
| 45 | 3 | 3 | 3 | 6 | 0.9 | 140 | — | — | — | — | Treatment liquid gelled | | | Comparative example of production method (5th invention) |

*1Refer to Table 28
*2Trivalent chromium ions/total Cr, total Cr = Trivalent chromium ions + hexavalent chromium ions
*3As converted to phosphorus
*4Refer to Table 29

According to Tables 32 and 33, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, the following can be known by comparison to the comparison examples of the steel sheets that contain at least 4 wt % Al and that are each plated with a film that is out of the range of the first pattern. In the comparison, the anti-blackening resistances are improved for the steel sheets that contain at least 4 wt % Al and that are each plated with a film that is within the range of the first pattern. More specifically, the antiblackening resistances are improved for the Zn—Al-base-plated steel sheets that each contain 4 to 25 wt % Al and that are placed in the stacked state. Also, the antiblackening resistances are improved for the Zn—Al-base-plated steel sheets that each contain 25 to 75 wt % Al and that are placed in the humid environment.

In addition, regarding the deposition of the film in the range of the first pattern, the following can be known by comparison to the comparison examples of the steel sheets (item Nos. 38 and 41) that are plated with the film formed at a temperature that is out of the range of the fourth pattern. In the comparison, higher film quality can be obtained with the steel sheets that are plated with the film formed at curing at a temperature that is within of the fourth pattern. Furthermore, the following can be known by comparison to the case (item No. 42) of film deposition with the treatment liquid of which the Cr reduction ratio is below the range of the fifth pattern. In the comparison, higher film quality can be obtained in the case of film deposition with the treatment liquid of which the Cr reduction ratio is within the range of the fifth pattern. In the case (item No. 45) using the treatment liquid of which the Cr reduction ratio is above the range of the fifth pattern, since the treatment liquid gelled, evaluation was not performed for the corresponding steel sheet.

EXAMPLE 3

For original processing steel sheets, zinc-base-plated steel sheets of the types shown in Table 28 were used. For the trivalent-chromium compounds, chromic salts of types as shown in Table 34 were used. With treatment-liquid compositions and curing temperatures that are shown in Tables 35 and 36, roll-coater coating was performed. Without rinsing, heat-curing was performed, and individual chemical conversion films were formed. The coating weight was controlled through variables such as the coating amount, the roll-coater peripheral speed, and pressing forces. Table 29 shows compounds ("Zn,Al-phosphoric acid" in Tables 35 and 36) composed of either one of the zinc and the aluminum or both of them and the phosphoric acid. Surface-treated steel sheets thus obtained were evaluated for quality in the manners described as follows.

(1) Processed-Portion Corrosion Resistances

A slit in the size of 0.3 mm (width) and 5 cm (length) was scribed using a knife cutter on each test-sample surface to reach a steel surface. The test sample was subjected to 200 cycles of the following compound corrosion testing:

3 wt % salt spray testing (30° C.; 0.5 hours)

↓

Humidity cabinet testing (30° C.; 95% RH; 1.5 hours)

Using the same criteria as those in Example 1, evaluation was performed for the rust-developed area ratio in 5-mm areas on two sides of the cut slit. The conditions (color tones) of developed rust were the same as in the case of the evaluation of the processed-portion corrosion resistance in Example 1.

(2) Corrosion Resistances of Sound Film Portions

The above-described compound corrosion testing was performed 300 cycles for each test sample for which no damage nor bending nor other processing was provided. Using the same criteria as described above, the evaluation was performed based on a rust-developed area ratio of the test-sample surface. Rust conditions were the same as in the case of the above-described evaluation of the processed-portion corrosion resistances.

(3) Antiblackening Resistances

Evaluation was performed for the antiblackening resistances of Zn/Al-base-plated steel sheets containing at least 4 wt % Al in the same manners as those in Example 1.

The evaluation results are shown in Tables 35 and 36.

TABLE 34

| No. | Type |
|---|---|
| 1 | chromium (III) chloride |
| 2 | chromium (III) nitrate |
| 3 | chromium (III) formate |
| 4 | chromium (III) acetate |

TABLE 35

| No. | Plated steel sheet*1 | Treatment-liquid composition (g/l) $Cr^{3+}$ Type*2 | $Cr^{3+}$ | Ca | Phosphoric acid | Curing temperature (° C.) | Film composition (mg/m²) Cr | Ca | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|---|---|
| 1 | 1 | 4 | 1 | 1 | 3 | 140 | 0.1 | 0.1 | 1 | 0.1 | Δ | ○− | — | |
| 2 | 1 | 4 | 30 | 1 | 3 | 140 | 30 | 0.1 | 1 | 0.1 | ○− | ○− | — | |
| 3 | 1 | 4 | 3 | 3 | 1 | 140 | 30 | 30 | 1 | 0.1 | ○− | ○ | — | |
| 4 | 1 | 4 | 30 | 1 | 50 | 140 | 30 | 0.1 | 1 | 20 | ○− | ○ | — | |
| 5 | 1 | 4 | 3 | 3 | 6 | 140 | 30 | 30 | 1 | 20 | ○ | ○ | — | |
| 6 | 1 | 4 | 3 | 30 | 6 | 140 | 30 | 300 | 1 | 20 | X | Δ | — | Comparative Example |
| 7 | 1 | 4 | 0.1 | 1 | 50 | 140 | 30 | 30 | 1 | 200 | X | Δ | — | Comparative Example |
| 8 | 1 | 4 | 50 | 50 | 50 | 140 | 100 | 200 | 1 | 100 | ○+ | ○+ | — | |
| 9 | 1 | 4 | 3 | 3 | 6 | 140 | 30 | 30 | 2 | 20 | ○ | ○ | — | |
| 10 | 1 | 4 | 3 | 3 | 6 | 140 | 30 | 30 | 3 | 20 | ○ | ○ | — | |
| 11 | 1 | 4 | 3 | 3 | 6 | 140 | 30 | 30 | 4 | 20 | ○ | ○ | — | |
| 12 | 1 | 4 | 3 | 3 | 6 | 140 | 30 | 30 | 4 | 20 | ○ | ○ | — | |
| 13 | 2 | 4 | 1 | 1 | 3 | 140 | 0.1 | 0.1 | 1 | 0.1 | ○− | ○− | ○ | |
| 14 | 2 | 4 | 30 | 1 | 3 | 140 | 30 | 0.1 | 1 | 0.1 | ○ | ○− | ○ | |
| 15 | 2 | 4 | 3 | 3 | 1 | 140 | 30 | 30 | 1 | 0.1 | ○ | ○ | ○ | |
| 16 | 2 | 4 | 30 | 1 | 50 | 140 | 30 | 0.1 | 1 | 20 | ○ | ○ | ○ | |
| 17 | 2 | 4 | 3 | 3 | 6 | 140 | 30 | 30 | 1 | 20 | ○+ | ○+ | ◎ | |
| 18 | 2 | 4 | 3 | 30 | 6 | 140 | 30 | 300 | 1 | 20 | X | Δ | Δ | Comparative Example |
| 19 | 2 | 4 | 0.1 | 1 | 50 | 140 | 30 | 30 | 1 | 200 | X | Δ | Δ | Comparative Example |
| 20 | 2 | 4 | 50 | 50 | 50 | 140 | 100 | 200 | 1 | 100 | ◎ | ◎ | ◎ | |
| 21 | 2 | 4 | 3 | 3 | 6 | 140 | 30 | 30 | 2 | 20 | ○+ | ○+ | ◎ | |
| 22 | 2 | 4 | 3 | 3 | 6 | 140 | 30 | 30 | 3 | 20 | ○+ | ○+ | ◎ | |
| 23 | 2 | 4 | 3 | 3 | 6 | 140 | 30 | 30 | 4 | 20 | ○+ | ○+ | ◎ | |
| 24 | 2 | 4 | 3 | 3 | 6 | 140 | 30 | 30 | 4 | 20 | ○+ | ○+ | ◎ | |

*1Refer to Table 28
*2Refer to Table 7
*3As converted to phosphorus
*4Refer to Table 29

TABLE 36

| No. | Plated steel sheet*1 | Treatment-liquid composition (g/l) $Cr^{3+}$ Type*2 | $Cr^{3+}$ | Ca | Phosphoric acid | Curing temperature (° C.) | Film composition (mg/m²) Cr | Ca | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|---|---|
| 25 | 3 | 4 | 1 | 1 | 3 | 140 | 0.1 | 0.1 | 1 | 0.1 | ○ | ○ | ○ | |
| 26 | 3 | 4 | 30 | 1 | 3 | 140 | 30 | 0.1 | 1 | 0.1 | ○+ | ○ | ○ | |
| 27 | 3 | 4 | 3 | 3 | 1 | 140 | 30 | 30 | 1 | 0.1 | ○+ | ○+ | ◎ | |
| 28 | 3 | 4 | 30 | 1 | 50 | 140 | 30 | 0.1 | 1 | 20 | ○+ | ○+ | ◎ | |
| 29 | 3 | 4 | 3 | 3 | 6 | 140 | 30 | 30 | 1 | 20 | ◎ | ◎ | ◎ | |
| 30 | 3 | 4 | 3 | 3 | 0 | 140 | 30 | 30 | — | 0 | ○+ | ○− | ○ | Comparative |

TABLE 36-continued

| No. | Plated steel sheet*1 | Treatment-liquid composition (g/l) $Cr^{3+}$ Type*2 | $Cr^{3+}$ | Ca | Phosphoric acid | Curing temperature (° C.) | Film composition ($mg/m^2$) Cr | Ca | Zn, Al-phosphoric acid*3 Type*4 | | Corrosion resistance Sound film Portion | Processed Portion | Anti-blackening resistance | Remarks |
|---|---|---|---|---|---|---|---|---|---|---|---|---|---|---|
| 31 | 3 | 4 | 3 | 30 | 6 | 140 | 30 | 300 | 1 | 20 | Δ | Δ | Δ | Example Comparative Example |
| 32 | 3 | 4 | 0.1 | 1 | 50 | 140 | 30 | 30 | 1 | 200 | Δ | Δ | Δ | Comparative Example |
| 33 | 3 | 4 | 50 | 50 | 50 | 140 | 100 | 200 | 1 | 100 | ◎ | ◎ | ◎ | |
| 34 | 3 | 4 | 3 | 3 | 6 | 140 | 30 | 30 | 2 | 20 | ◎ | ◎ | ◎ | |
| 35 | 3 | 4 | 3 | 3 | 6 | 140 | 30 | 30 | 3 | 20 | ◎ | ◎ | ◎ | |
| 36 | 3 | 4 | 3 | 3 | 6 | 140 | 30 | 30 | 4 | 20 | ◎ | ◎ | ◎ | |
| 37 | 3 | 4 | 3 | 3 | 6 | 140 | 30 | 30 | 4 | 20 | ◎ | ◎ | ◎ | |
| 38 | 3 | 4 | 3 | 3 | 6 | 50 | 30 | 30 | 1 | 20 | Δ | Δ | ○ | Comparative example for production method |
| 39 | 3 | 4 | 3 | 3 | 6 | 60 | 30 | 30 | 1 | 20 | ○− | ○− | ◎ | |
| 40 | 3 | 4 | 3 | 3 | 6 | 300 | 30 | 30 | 1 | 20 | ○+ | ◎ | ◎ | |
| 41 | 3 | 4 | 3 | 3 | 6 | 320 | 30 | 30 | 1 | 20 | Δ | Δ | ○ | Comparative example for production method |
| 42 | 3 | 1 | 3 | 3 | 6 | 140 | 30 | 30 | 1 | 20 | ○ | ○ | ○ | |
| 43 | 3 | 2 | 3 | 3 | 6 | 140 | 30 | 30 | 1 | 20 | ○ | ○ | ○ | |
| 44 | 3 | 3 | 3 | 3 | 6 | 140 | 30 | 30 | 1 | 20 | ◎ | ◎ | ◎ | |

*1Refer to Table 28
*2Refer to Table 34
*3As converted to phosphorus
*4Refer to Table 29

According to Tables 35 and 36, the following can be known by comparison to the comparative examples of steel sheets each plated with a film that is out of the range of the first pattern. In the comparison, the corrosion resistances of the sound film portion as well as the processed film portion are significantly improved for the steel sheets each plated with a film that is within the range of the first pattern. In addition, as can be seen by comparison of item Nos. 29 and 42 to 44, the corrosion resistances and the antiblackening resistances are higher in the cases (item Nos. 29 and 44) using chromium carboxylate as a trivalent-chromium compound.

In addition, the following can be known by comparison to the comparison examples of the steel sheets that contain at least 4 wt % Al and that are each plated with a film that is out of the range of the first pattern. In the comparison, the antiblackening resistances are improved for the steel sheets that each contain at least 4 wt % Al and that are each plated with a film that is within the range of the first pattern. More specifically, the antiblackening resistances are improved for the Zn—Al-base-plated steel sheets that each contains 4 to 25 wt % Al and that are placed in the stacked state. Also, the antiblackening resistances are improved for the Zn—Al-base-plated steel sheets that each contains 25 to 75 wt % Al and that are placed in the humid environment.

In addition, regarding the deposition of the film in the range of the first pattern, higher film quality can be obtained with the steel sheets that are plated with the film formed at curing at a temperature that is within of the sixth pattern. However, the film quality is degraded for the steel sheets of the comparative examples (item Nos. 38 and 41) on which films were individually formed at curing temperatures that are out of the range of the sixth pattern.

Embodiment 5

The inventors of the present invention found the following. Through the forming of the film containing the new additive Ca, improvement can be achieved in the corrosion resistance of the zinc-base-plated steel sheet containing at least 30% Al even after the zinc-base-plated steel sheet was worked. Furthermore, the film having the high antiblackening resistance can be formed on the so-called 5% Al-base steel sheet. Still furthermore, for the so-called 55% Al-base steel sheet, the inventors found conditions that enable the formation of the film having a significantly excellent effect of inhibiting development of black rust in a corrosive environment. The aforementioned black rust can develop in a manner that since the film has a large amount of the Al component and is therefore hard, cracks occur as a result of severe processing, and corrosion develops from the crack portions. Based on the finding, the inventors achieved Embodiment 5. Embodiment 5 has the following basic characteristics:

(1) A highly-corrosion-resistant surface-treated steel sheet characterized as follows. The steel sheet is a zinc-base-plated steel sheet that contains at least 30 wt % Zn and that has a film on a surface thereof. The film contains an organic resin, Cr, Ca, and silica or a silica-group compound. The film is formed such that the coating weight of the organic resin is in a range of from 50 to 5,000 $mg/m^2$, the coating weight of Cr is in a range of from 1 to 100 $mg/m^2$, the coating weight of Ca is in a range of from 0.001 to 0.2 in a ratio of Ca/organic resin (weight ratio), and the coating weight of the silica or the silica-group compound is in a range of from 0.001 to 0.5 in a ratio of $SiO_2$/organic resin (weight ratio). (First Pattern)

(2) The highly-corrosion-resistant surface-treated steel sheet according to item (1), characterized in that the zinc-base-plated steel sheet that contains at least 30 wt % Zn is a Zn—Al-alloy-plated steel sheet that contains 1 to 10 wt % Al. (Second Pattern)

(3) The highly-corrosion-resistant surface-treated steel sheet according to item (1), characterized in that the zinc-base-plated steel sheet that contains at least 30 wt % Zn is a Zn—Al-alloy-plated steel sheet that contains 40 to 70 wt % Al. (Third Pattern)

(4) A method for producing one of the surface-treated steel sheets described in items (1) to (3), characterized as follows. The film is formed by application of an aqueous treatment liquid onto the surface of the zinc-base-plated steel sheet that contains at least 30 wt % Zn. The aqueous treatment liquid contains a water-soluble or water-dispersible organic resin, water-soluble chromic acid or chromate, a Ca compound, and silica or silica-group compound. Curing is performed at sheet temperatures in a range of from 60 to 250° C. (Fourth Pattern)

(5) The method for producing the highly-corrosion-resistant surface-treated steel sheet according to item (4), characterized in that a ratio (weight ratio) of $Cr^{3+}/(Cr^{6+}+Cr^{3+})$ in the aqueous treatment liquid is 0.05 to 0.9. (Fifth Pattern)

(6) The method for producing the highly-corrosion-resistant surface-treated steel sheet according to item (4) characterized in that the water-soluble chromate in the aqueous treatment liquid is either $Cr^{3+}$ water-soluble chromic acid or chromic acid. (Sixth Pattern)

(7) The method for producing the highly-corrosion-resistant surface-treated steel sheet according to one of items (5) and (6), characterized as follows. The organic resin in the aqueous treatment liquid is an acryl-styrene copolymer emulsion resin. In the organic resin, a ratio of styrene/organic resin (weight ratio) is in a range of from 0.1 to 0.7, and the acid number is in a range of from 1 to 50. (Seventh Pattern)

In Embodiment 5, the types of the object steel sheets are limited as above for the following reasons. Steel sheets containing less-than-30% Zn are inferior in a sacrificial corrosion resistance of Zn. For this reason, the steel sheets tend to cause red rust that develops as a Fe-corrosion product. The steel sheets of this type allow red rust to develop even from a small defect caused on the film. From the viewpoint of the corrosion resistance of the steel sheet, the steel sheet should contain at least 30% Zn. However, since Zn is inherently active metal, the plating film is apt to corrode, and the amount of Zn should be limited from the viewpoint of long-term durability.

As a mean to improve the durability of the Zn-plated steel sheet, Zn—Al alloy plating was developed and has already been practically employed. Widely used steel sheets of this type include-plated steel sheets that each contain Al in a range of from 1 to 10%, and in addition, Mg, MM, or the like that is optionally added depending on the case (the steel sheet hereinbelow will be referred to as a 5% Al-base-plated steel sheet). The steel sheets of the aforementioned type also include-plated steel sheets that each contain Al in a range of from 40 to 70%, Si in a range of from 1 to 3%, and in addition, Ti or the like that is optionally added depending on the case (the steel sheet hereinbelow will be referred to as a 55% Al-base-plated steel sheet). The present invention has an object to improve the corrosion resistance of the aforementioned zinc-base-plated steel sheets that each contain at least 30 wt % Zn. Examples of the corresponding plated steel sheets used in the present markets include electro-Zn-plated steel sheets, molten-Zn-plated steel sheets, 5% Al-base-plated steel sheets, and 55% Al-base-plated steel sheets.

Compared to a Zn-plated steel sheet, while the 5% Al-base-plated steel sheet can be improved in the durability, it exhibits problems in that the surface is blackened in a high-temperature and/or high-humidity environment, and the commercial value thereof is therefore significantly decreases. Embodiment 5 improves the antiblackening resistance of the 5% Al-base-plated steel sheet and to thereby solve the above-described problems.

The 55% Al-base-plated steel sheet also exhibits problems. For this steel sheet, the corrosion resistance is improved. However, the film is formed to be hard, cracks occur during processing, and corrosion therefore develops from a processed portion. In addition, since the steel sheet contains much Al, much black rust develops, thereby significantly decreasing the visual quality. Embodiment 5 improves the processed-portion black-rust resistance of the 55% Al-base-plated steel sheet and to thereby solve the problems.

In Embodiment 5, when required, each of the individual plated steel sheets may be subjected to a pretreatment such as hot-water rinsing or alkaline degreasing. In addition, depending on the case, the steel sheet may be subjected to a pretreatment for adhering, for example, Ni, Co, and Fe, on the surface thereof.

(Organic-Film Coating weight: 50 to 5,000 $Mg/M^2$)

The plating-surface film is required to contain the organic resin in a range of from 50 to 5,000 $mg/m^2$. The organic resin has the effect of improving the corrosion resistance of a chromate film as well as the effect of preventing processing-attributed surface-damage development. These effects depend on the coating weight. When the organic-resin amount is below 50 $mg/m^2$, corrosion-resistance improving effects are not recognized. When the organic-resin amount is above 5,000 $mg/m^2$, the film peels during processing. A peeled substance can cause new surface-damage development. The case is therefore not preferable. For these reasons, the organic-resin coating weight should be in a range of from 50 to 5,000 $mg/m^2$. More preferably, the amount should be in a range of from 50 to 2,500 $mg/m^2$.

(Cr Coating weight: 1 to 100 $mg/m^2$)

The film is required to contain Cr in a range of from 1 to 100 $mg/m^2$. In particular, Cr has the effect of forming a stabilized passivation film, thereby improving the corrosion resistance of planar portions and improving the adhesion. Cr is therefore an indispensable component of the film. When Cr is below 1 $mg/m^2$, no improvement effects are recognized for both the corrosion resistance and adhesion. When the Cr coating weight is above 100 $mg/m^2$ the film is prone to peel off in portions in which severe processing is performed. For these reasons, the Cr coating weight should be in a range of from 1 to 100 $mg/m^2$.

(Ca: 0.001 to 0.2 in Ratio of Ca/Organic Resin (Weight Ratio))

Ca has the effect of improving the corrosion resistance of the chromate film. In addition, Ca has the effect of significantly improving the antiblackening resistance that is the problem specific to the 5% Al-base-plated steel sheet. Moreover, Ca has the effect of improving the processed-portion corrosion resistance that is the problem specific to the 55% Al-base-plated steel sheet. The effects of Ca are significantly influenced by the ratio to the organic resin. When the ratio of Ca/organic resin is below 0.001, sufficient effects cannot be obtained. When the ratio of Ca/organic resin is above 0.2, sufficient effects cannot be obtained.

When the ratio of Ca/organic resin is below 0.001, the processed-portion corrosion resistance and the antiblackening resistance are improved. At this ratio, however, since steel sheet is exposed to in a corrosive environment for a long time, a tendency is recognized in which the corrosion resistance decreases in planar portions. For these reasons, the ratio of Ca/organic resin (weight ratio) should be in a range of from 0.001 to 0.2. More preferably, the ratio should be in a range of from 0.005 to 0.1.

($SiO_2$: 0.001 to 0.5 in Ratio of $SiO_2$/Organic Resin (Weight Ratio)

$SiO_2$ is added for the reason that inclusion of $SiO_2$ together with Ca in the chromate film imparts the effect of significantly improving the corrosion resistance and antiblackening resistance of Ca. When the film contains at least 0.001 in the $SiO_2$/organic resin, Ca imparts either the corrosion-resistance improving effects or the blackening-phenomenon-resistance improving effects. However, when the ratio of $SiO_2$/organic resin is above 0.5, the film is prone to peel off during processing. For this reason, the ratio should be at most 0.5. $SiO_2$ may be added as a complex compound composed with Ca.

(Production Methods)

For producing one of the surface-treated steel sheets described above, the surface of the zinc-base-plated steel sheet containing at least 30% Zn is coated with the above-described aqueous treatment liquid. The aqueous treatment liquid contains the water-soluble or water-dispersible organic resin, the water-soluble chromic acid or chromate, the Ca compound, and the silica or silica compound. Then, curing is performed at sheet temperatures in a ranged of from 60 to 250° C. Hereinbelow, reasons for performing the above processing will be described.

To form the above-described film, the aqueous treatment liquid to be used is prepared by blending the organic resin, Cr, Ca, and silica or silica-group compound to satisfy a predetermined content range.

The organic resin to be used should be either water soluble or water dispersible. The type of the organic resin may be one of resins of an acrylic group, an acryl-styrene group, a urethane group, and a polyester group. However, for the treatment liquid, the resin preferably contains a nonionic-group component to allow stable dispersion together with other components. In addition, from the viewpoint of the corrosion resistance, a water-dispersible resin (emulsion resin) is preferably used instead of the water-soluble resin. Among the aforementioned resins, the acryl-styrene-group resin can be produced by an emulsion polymerization method that is advantageous in cost. Concurrently, the acryl-styrene-group resin is excellent in the corrosion resistance and the processability. In the acryl-styrene-group resin, when the ratio of styrene is below 10%, the corrosion resistance decreases; whereas, when the ratio of styrene is above 70%, the processability decreases. For these reasons, an inexpensive film having a corrosion resistance as well as excellent processability can be formed by using the acryl-styrene-group resin in which a ratio of styrene/organic resin (weight ratio) is in a range of from 0.1 to 0.7. When the acid number is below 1, the stability of the liquid is insufficient. However, when the acid number is above 50, the corrosion resistance decreases. For these reasons, the acid number should be in a range of from 1 to 50. This range enables excellent liquid stability and a high corrosion resistance to be compatibly obtained.

Other elements to be added, such as a dispersion stabilizer or a defoamer, greatly influence film properties (film adhesion, corrosion resistance, antiblackening resistance, water resistance, paint adhesion, slippage resistance, tape adhesion, PEF adhesion, and adhesion to defoamation urethane), liquid composition stability, and mechanical stability. It is therefore important to select the elements suitable to the above and other desired properties and usage conditions.

As a rust-preventing component, Cr plays an important role. Effects thereof greatly depend on the conditions of Cr in the treatment liquid. To allow Cr to impart rust prevention effects, Cr should be contained in a dissolved state. Suppose a film is formed with treatment liquid to which refractory chromates, such as $ZnCrO_4$, $SrCrO_4$, $BaCrO_4$, $CuCrO_4$, $FeCrO_4$, $Ag_2CrO_4$, and $SnCrO_4$ are added. In this case, the corrosion resistance of the film is low, and concurrently, the adhesion level is low.

The present invention allows the use one of the following elements as chromic acid. One element is prepared such that, for example, anhydrous chromic acid is dissolved into water, and a part thereof is reduced into $Cr^{3+}$ by using a reducer as well as anion such as phosphoric acid when necessary. Another element is in a state of a soluble $Cr^{3+}$ compound, such as Cr nitrate, Cr sulfate, or acetic acid Cr; and still another element is in a state of a mixture thereof. When the element is dissolved in liquid, it reacts with or is adsorbed to the plating surface during film formation. At this time, since the surface is stabilized, improvement effects are considered attainable for the corrosion resistance as well as the film adhesion. For the above-described reasons, the treatment liquid should contain the dissolved chromic component.

The ratio (weight ratio) of $Cr^{3+}/(Cr^{6+}+Cr^{3+})$ greatly influences the film properties. When the ratio is set to a range of from 0.05 to 0.9, the film strongly adheres to the plating. This enables the formation of a film that is further improved in the corrosion resistance. However, when the ratio is below 0.05, a film having a lower adhesion is formed. When the ratio is above 0.9, the corrosion resistance decreases. For these reasons, the ratio (weight ratio) of $Cr^{3+}/(Cr^{6+}+Cr^{3+})$ should be in a range of from 0.05 to 0.9. More preferably, the ratio should be in a range of from 0.2 to 0.6.

Recently, for solving the environmental problems, the trend has been growing toward high-evaluation of films formed not to contain $Cr^{6+}$. In conformity to the trend, the present invention enables the formation of films that do not contain $Cr^{6+}$. The mechanism for the above is considered as follows. The Ca compound substitutes $Cr^{6+}$ to impart self-healing effects, thereby enabling a higher corrosion resistance to be imparted in comparison to a film formed using $Cr^{3+}$ that does not contain the Ca compound.

As an adding method of Ca, Ca may be added in a state of a complex salt composed with Ca carbonate, Ca silicate, CaO, or silicic acid. However, the present invention is not limited by the above. Attention should be directed to the fact that the additive can change the pH value of the treatment liquid and adversely affects the liquid composition stability. A pH range of from 1 to 6.5 was already verified as a range necessary to disperse the indispensable component, but the dispersion was difficult in a pH range that is below 1 or in a pH range that is above 7. In addition, sufficient effects cannot be obtained in a state where the Ca component easily dissolves during film formation. It is therefore important that the additive should be included in the treatment liquid to form a compound that does not easily dissolve in the film. In Embodiment 5, the adding method for the Ca compound is not specifically limited.

The aqueous treatment liquid containing the above-described components is applied onto the steel-sheet surface by using, for example, a roll coater. Then, the coated surface is either heat-cured or cured with hot air, and a film is formed. The film-formation temperature should be above 60° C. At a temperature lower than 60° C., residual moisture in the film reduces the corrosion resistance; and consequently, the adhesion of a film is relatively low. Even in a case where the highest-reachable sheet temperature is increased higher than 250° C., the case only shows a tendency in which property-improving effects are not recognized, and a film having a reduced corrosion resistance is formed. For these reasons, the curing sheet temperature should be in a range of from 60 to 250° C.

Hereinbelow, an Example will be described.

With reference to Tables 37 to 39, treatment liquids were adjusted to have predetermined chemical compositions. The adjusted treatment liquids were applied on surfaces of the plated steel sheets of various types. Then, the surfaces were heat-cured at the highest-reachable sheet temperatures shown in Tables 37 to 39. The steel sheets were thus coated with plating films having the coating weights shown in Tables 37 to 39, and test samples were taken therefrom. The symbols in the "Plating" column in the tables are referred to in the description below. These symbols represent the types of the plated steel sheets as follows:

GI: Molten-Zn-plated steel sheet (plating amount: Z27; sheet thickness: 0.5 mm)

5Al: 5% Al—Zn-alloy-plated steel sheet (plating amount: Y22; sheet thickness: 0.5 mm)

55Al: 55% Al—Zn-alloy-plated steel sheet (plating amount: AZ-150; sheet thickness: 0.5 mm)

Al: Molten-Al-plated steel sheet (plating amount: 200 g/m$^2$; sheet thickness: 0.5 mm)

As the method for adding Ca and silica, which is shown in the present invention, a complex salt prepared in the following manner was added. Ca carbonate was dissolved in nitric water, soda silicate was added in the water, and a reactant product was thereby formed. Then, the reactant product was rinsed and filtered. In addition, when necessary, Ca-silicic acid compound (composition ratio of $CaO:SiO_2$= 9:1) appropriately grained into small particles was added. With the above being used as a base, silica ($SiO_2$) and Ca carbonate are appropriately added. Thereby, the ratio between Ca and $SiO_2$ in the complex salt was adjusted.

Humidity cabinet testing (50° C.; RH below 98%) was performed to evaluate the corrosion resistance of planar portions of each of the test samples. In addition, to evaluate processed-portion corrosion resistance, 600-hour humidity cabinet testing was performed for each test sample for which 3T-bending processing was performed. The rust-developed extent was evaluated for the bent portions according to the criteria shown below.

Evaluation Criteria for Bent-Portion Corrosion Resistances

10: white-rust developed area less than 10%, black-rust developed area less than 10%; 8: White-rust developed area at least 10% to less than 50%, black-rust developed area less than 10%; 6: White-rust developed area at least 50%, black-rust developed area less than 10%; 4: Black-rust developed area at least 10% to less than 50%; 2: Black-rust developed area at least 50%; and 1: Red rust developed.

For evaluation of the antiblackening resistance, the blackened extent was inspected according to the following criteria after 24 hours in an environment of 80° C. and 95% RH.

Evaluation Criteria for Blackening-Phenomenon-Resistances

5: No change; 4: Verifiable blacked area less than 25% when diagonally viewed; 3: Verifiable blacked area at least 25% when diagonally viewed; 2: Verifiable blacked area less than 25% when front-viewed; and 1: Verifiable blacked area at least 25% when front-viewed.

For evaluation of the processability, planar-portion sliding was performed in a manner in which a bead having a 1×10 mm planar end was used to press the surface of a 30 mm wide test sample at a predetermined load, and the test sample was slidably drawn in the pressed state at a predetermined speed. The testing was iterated by changing the pressing load, and the evaluation was performed according to a limiting pressing load at which galling occurred on the plating surface The evaluation results are shown in Tables 40 and 41.

TABLE 37

| No. | Plating | Type of resin (Note 1) | Type of chromic acid (Note 2) | Heating temperature (° C.) | Resin coating weight (mg/m$^2$) | Cr coating weight (mg/m$^2$) | Ca/resin (wt/wt) | $SiO_2$/resin (wt/wt) | Remarks (Note 3) Film | Remarks (Note 3) Production method |
|---|---|---|---|---|---|---|---|---|---|---|
| 1 | Gl | AcSt | 30% | 120 | 1500 | 20 | 0 | 0 | Out of range | |
| 2 | Gl | AcSt | 30% | 120 | 1500 | 20 | 0.03 | 0 | Out of range | |
| 3 | Gl | AcSt | 30% | 120 | 1500 | 20 | — | 0.05 | Out of range | |
| 4 | Gl | AcSt | 30% | 120 | 1500 | 20 | 0.03 | 0.05 | Within range | Within range |
| 5 | 5Al | AcSt | 30% | 120 | 1500 | 20 | 0 | 0 | Out of range | |
| 6 | 5Al | AcSt | 30% | 120 | 1500 | 20 | 0.03 | 0 | Out of range | |
| 7 | 5Al | AcSt | 30% | 120 | 1500 | 20 | — | 0.05 | Out of range | |
| 8 | 5Al | AcSt | 30% | 120 | 1500 | 20 | 0.03 | 0.05 | Within range | Within range |
| 9 | 55Al | AcSt | 30% | 120 | 1500 | 20 | 0 | 0 | Out of range | |
| 10 | 55Al | AcSt | 30% | 120 | 1500 | 20 | 0.03 | 0 | Out of range | |
| 11 | 55Al | AcSt | 30% | 120 | 1500 | 20 | — | 0.05 | Out of range | |

TABLE 37-continued

| No. | Plating | Type of resin (Note 1) | Type of chromic acid (Note 2) | Heating temperature (° C.) | Resin coating weight (mg/m²) | Cr coating weight (mg/m²) | Ca/resin (wt/wt) | $SiO_2$/resin (wt/wt) | Remarks (Note 3) Film | Production method |
|---|---|---|---|---|---|---|---|---|---|---|
| 12 | 55Al | AcSt | 30% | 120 | 1500 | 20 | 0.03 | 0.05 | Within range | Within range |
| 13 | Al | AcSt | 30% | 120 | 1500 | 20 | 0.03 | 0.05 | Out of range | |

(Note 1)
Type of resin: [AcSt]: Acryl-styrene copolymer resin (styrene polymerization ratio: 55%; acid number: 20); [Ac]: Acrylic resin (styrene polymerization ratio: 0%; acid number: 20); [AcSt2]: Acryl-styrene copolymer resin (styrene polymerization ratio: 5%; acid number: 20); [AcSt3]: Acryl-styrene copolymer resin (styrene polymerization ratio: 80%; acid number: 20); [AcSt4]: Acryl-styrene copolymer resin (styrene polymerization ratio: 30%; acid number: 20); [AcSt5]:Acryl-styrene copolymer resin (styrene polymerization ratio: 55%; acid number: 0); [AcSt6]: Acryl-styrene copolymer resin (styrene polymerization ratio: 30%; acid number: 60)
(Note 2)
Type of chromic acid: [30%][60%][95%]: Respectively, 30%, 60% and 95% reduction anhydrous chromic acid water solutions (each containing phosphoric acid by $PO_4$/Cr = 1.2); [0%]: Anhydrous chromic acid water solution; [Cr acetate]: Cr-acetate reagent water solution; [BaCr]: $BaCrO_4$; [SrCr]: $SrCrO_4$
(Note 3)
Remarks: In the production method, "within range/out of range" refers to the case within the range of the fourth Pattern, but out of the range in one of the fifth and seventh patterns

TABLE 38

| No. | Plating | Type of resin (Note 1) | Type of chromic acid (Note 2) | Heating temperature (° C.) | Resin coating weight (mg/m²) | Cr coating weight (mg/m²) | Ca/resin (wt/wt) | $SiO_2$/resin (wt/wt) | Remarks (Note 3) Film | Production method |
|---|---|---|---|---|---|---|---|---|---|---|
| 14 | 5Al | AcSt | 30% | 120 | 20 | 20 | 0.03 | 0.5 | Out of range | |
| 15 | 5Al | AcSt | 30% | 120 | 100 | 20 | 0.03 | 0.5 | Within range | Within range |
| 16 | 5Al | AcSt | 30% | 120 | 3000 | 20 | 0.01 | 0.05 | Within range | Within range |
| 17 | 5Al | AcSt | 30% | 120 | 6000 | 20 | 0.01 | 0.05 | Out of range | |
| 18 | 5Al | AcSt | 30% | 120 | 1500 | 0.3 | 0.03 | 0.05 | Out of range | |
| 19 | 5Al | AcSt | 30% | 120 | 1500 | 60 | 0.03 | 0.05 | Within range | Within range |
| 20 | 5Al | AcSt | 30% | 120 | 1500 | 150 | 0.03 | 0.05 | Out of range | |
| 21 | 5Al | AcSt | 30% | 120 | 1500 | 20 | 0.0001 | 0.05 | Out of range | |
| 22 | 5Al | AcSt | 30% | 120 | 1500 | 20 | 0.005 | 0.05 | Within range | Within range |
| 23 | 5Al | AcSt | 30% | 120 | 1500 | 20 | 0.1 | 0.05 | Within range | Within range |
| 24 | 5Al | AcSt | 30% | 120 | 1500 | 20 | 0.3 | 0.05 | Out of range | |
| 25 | 5Al | AcSt | 30% | 120 | 1500 | 20 | 0.03 | 0.0001 | Out of range | |
| 26 | 5Al | AcSt | 30% | 120 | 1500 | 20 | 0.03 | 0.01 | Within range | Within range |
| 27 | 5Al | AcSt | 30% | 120 | 1500 | 20 | 0.03 | 0.3 | Within range | |
| 28 | 5Al | AcSt | 30% | 120 | 1500 | 20 | 0.03 | 0.7 | Out of range | |

Notes 1 to 3 are the same as those in Table 37.

TABLE 39

| No. | Plating | Type of resin (Note 1) | Type of chromic acid (Note 2) | Heating temperature (° C.) | Resin coating weight (mg/m²) | Cr coating weight (mg/m²) | Ca/resin (wt/wt) | $SiO_2$/resin (wt/wt) | Remarks (Note 3) Film | Production method |
|---|---|---|---|---|---|---|---|---|---|---|
| 29 | 5Al | AcSt | BaCr | 120 | 1500 | 20 | 0.03 | 0.05 | Within range | Out of range |
| 30 | 5Al | AcSt | SrCr | 120 | 1500 | 20 | 0.03 | 0.05 | Within range | Out of range |
| 31 | 5Al | AcSt | 30% | 40 | 1500 | 20 | 0.03 | 0.05 | Within range | Out of range |
| 32 | 5Al | AcSt | 30% | 80 | 1500 | 20 | 0.03 | 0.05 | Within range | Within range |
| 33 | 5Al | AcSt | 30% | 200 | 1500 | 20 | 0.03 | 0.05 | Within range | Within range |
| 34 | 5Al | AcSt | 30% | 300 | 1500 | 20 | 0.03 | 0.05 | Within range | Out of range |
| 35 | 5Al | AcSt | 0% | 120 | 1500 | 20 | 0.03 | 0.05 | Within range | Within range/ out of range |
| 36 | 5Al | AcSt | 60% | 120 | 1500 | 20 | 0.03 | 0.05 | Within range | Within range |
| 37 | 5Al | AcSt | 95% | 120 | 1500 | 20 | 0.03 | 0.05 | Within range | Within range/ out of range |
| 38 | 5Al | AcSt | Cr acetate | 120 | 1500 | 20 | 0.03 | 0.05 | Within range | Within range |
| 39 | 5Al | Ac | 30% | 120 | 1500 | 20 | 0.03 | 0.05 | Within range | Within range/ out of range |
| 40 | 5Al | AcSt2 | 30% | 120 | 1500 | 20 | 0.03 | 0.05 | Within range | Within range/ out of range |
| 41 | 5Al | AcSt3 | 30% | 120 | 1500 | 20 | 0.03 | 0.05 | Within range | Within range/ out of range |
| 42 | 5Al | AcSt4 | 30% | 120 | 1500 | 20 | 0.03 | 0.05 | Within range | Within range |
| 43 | 5Al | AcSt5 | 30% | 120 | 1500 | 20 | 0.03 | 0.05 | Within range | Within range/ out of range |

TABLE 39-continued

| No. | Plating | Type of resin (Note 1) | Type of chromic acid (Note 2) | Heating temperature (° C.) | Resin coating weight (mg/m²) | Cr coating weight (mg/m²) | Ca/resin (wt/wt) | $SiO_2$/resin (wt/wt) | Remarks (Note 3) Film | Production method |
|---|---|---|---|---|---|---|---|---|---|---|
| 44 | 5Al | AcSt5 | 30% | 120 | 1500 | 20 | 0.03 | 0.05 | Within range | Within range/ out of range |

Notes 1 to 3 are the same as those in Table 3.

TABLE 40

| No. | Planar-portion corrosion resistance Time (hrs) | Processed-portion corrosion resistance | Antiblackening resistance | Processability load (kgf) | Quality for other aspects | Remarks (Note 1) Film | Production method |
|---|---|---|---|---|---|---|---|
| 1 | 240 | 5 | 3 | 150 | | Out of range | |
| 2 | 240 | 5 | 4 | 150 | | Out of range | |
| 3 | 240 | 5 | 3 | 150 | | Out of range | |
| 4 | 600 | 7 | 5 | 150 | | Within range | Within range |
| 5 | 480 | 6 | 1 | 150 | | Out of range | |
| 6 | 480 | 6 | 2 | 150 | | Out of range | |
| 7 | 600 | 7 | 1 | 150 | | Out of range | |
| 8 | 960 | 8 | 5 | 150 | | Within range | Within range |
| 9 | 1200 | 2 | 5 | 150 | | Out of range | |
| 10 | 1200 | 2 | 5 | 150 | | Out of range | |
| 11 | 1800 | 2 | 5 | 150 | | Out of range | |
| 12 | >2400 | 10 | 5 | 150 | | Within range | Within range |
| 13 | >2400 | 1 | 5 | 150 | | Out of range | |
| 14 | 600 | 7 | 4 | <50 | | Out of range | |
| 15 | 600 | 8 | 5 | 150 | | Within range | Within range |
| 16 | 1800 | 10 | 5 | 200 | | Within range | Within range |
| 17 | 1800 | 10 | 5 | 50 | | Out of range | |
| 18 | <120 | 5 | 1(White rust) | <50 | | Out of range | |
| 19 | 1800 | 10 | 5 | 200 | | Within range | Within range |
| 20 | 1800 | 10 | 5 | 200 | Appearance: significant coloration | Out of range | |
| 21 | 600 | 6 | 1 | 150 | | Out of range | |
| 22 | 960 | 8 | 5 | 150 | | Within range | Within range |
| 23 | 960 | 10 | 4 | 150 | | Within range | Within range |
| 24 | 120 | 6 | 3 | 100 | | Out of range | |
| 25 | 600 | 6 | 4 | 150 | | Out of range | |
| 26 | 960 | 8 | 5 | 150 | | Within range | Within range |
| 27 | 960 | 10 | 5 | 150 | | Within range | |
| 28 | 240 | 5 | 3 | 50 | | Out of range | |

Note 1) Remarks: In the production method, "within range/out of range" refers to the case within the range of the fourth pattern, but out of the range in one of the fifth and seventh patterns.

TABLE 41

| No. | Planar-portion corrosion resistance Time (hrs) | Processed-portion corrosion resistance | Antiblackening resistance | Processability load (kgf) | Quality for other aspects | Remarks (Note 1) Film | Production method |
|---|---|---|---|---|---|---|---|
| 29 | 600 | 7 | 4 | 150 | | Within range | Out of range |
| 30 | 600 | 7 | 4 | 150 | | Within range | Out of range |
| 31 | 600 | 8 | 4 | 150 | | Within range | Out of range |
| 32 | 720 | 8 | 5 | 150 | | Within range | Within range |
| 33 | 960 | 10 | 5 | 150 | | Within range | Within range |
| 34 | 600 | 8 | 4 | 150 | | Within range | Out of range |
| 35 | 600 | 10 | 4 | 125 | | Within range | Out of range |
| 36 | 960 | 10 | 5 | 150 | | Within range | Within range |
| 37 | 600 | 8 | 4 | 150 | Inferior in the treatment-liquid stability | Within range | Out of range |
| 38 | 720 | 10 | 4 | 150 | | Within range | Within range |
| 39 | 960 | 7 | 5 | 150 | | Within range | Within range/ out of range |

TABLE 41-continued

| No. | Planar-portion corrosion resistance Time (hrs) | Processed-portion corrosion resistance | Antiblackening resistance | Processability load (kgf) | Quality for other aspects | Remarks (Note 1) Film | Production method |
|---|---|---|---|---|---|---|---|
| 40 | 960 | 7 | 5 | 150 | | Within range | Within range/ out of range |
| 41 | 960 | 10 | 5 | 150 | | Within range | Within range/ out of range |
| 42 | 960 | 8 | 5 | 150 | | Within range | Within range |
| 43 | 960 | 10 | 5 | 150 | Somewhat inferior in the treatment-liquid stability | Within range | Within range/ out of range |
| 44 | 960 | 7 | 5 | 150 | | Within range | Within range/ out of range |

Note 1) Remarks: In the production method, "within range/out of range" refers to the case within the range of the fourth pattern, but out of the range in one of the fifth and seventh patterns.

Item Nos. 1 to 4 individually represent examples each having a film formed on the Al. Item Nos. 5 to 8 individually represent examples each having a film formed on the 55Al. Item No. 13 represents an example each having a film formed on the Al. Items Nos. 4, 8, and 12 represent examples in which films of the present invention are formed on the GI, 5Al, and 55Al, respectively, each of which contains at least 30% Zn. These examples impart the effect of improving the planar-portion corrosion resistance, the antiblackening resistance, and the processed-portion corrosion resistance. These properties correspond to the plating-related problems to be solved with the individual steel sheets. Items Nos. 4, 8, and 12 improves these properties to a level that cannot be achieved with conventional chromate films. Furthermore, the items each have the processability. On the other hand, in item No. 13 that does not contain Zn, red rust developed from a processed film portion. That is, a film having a lower processed-portion corrosion resistance is formed.

Item Nos. 14 to 17 individually represent examples each using the 5Al as the base. These examples were intended to examine the influence of the Cr coating weight. Item Nos. 18 to 20 individually represent examples each using 5Al's as the base. These examples were intended to examine the influence of the Cr coating weight. Item Nos. 21 to 24 individually represent examples each using 5Al's as the base. These examples were intended to examine the influence of the additive/resin. Similarly, item Nos. 25 to 28 individually represent examples each using 5Al's as the base. These examples were intended to examine the influence of the $SiO_2$/resin. When the resin coating weight is out of the range of the present invention, the processability is particularly low. When the Cr amount is small, all the properties are low. When an excessive amount of Cr adheres, a film formed has an excellent corrosion resistance, antiblackening resistance, and processability; however, the discoloration is significantly increased to an extent of causing a problem in the visual quality. The addition amounts of Ca or $SiO_2$ greatly influence the antiblackening resistance and the corrosion resistance. Therefore, one of them decreases in out of the range of Embodiment 5, and the compatibility thereof is difficult.

Item Nos. 29 to 44 individually represent examples intended to examine the influence of the production method. Item Nos. 29 and 30 individually represent examples each using chromic acid that is not in a state of aqueous solution. These examples each have a tendency in which the corrosion resistance and the antiblackening resistance are relatively low in comparison to those of item No. 8. Item Nos. 31 to 34 individually represent examples intended to examine the curing temperature. In the example, a tendency is recognized in which the antiblackening resistance decreases at curing temperatures that are out of the range of the present invention. Item Nos. 35 to 37 individually represent examples intended to examine the chromium reduction ratio. In each of these examples, when the reduction ratio is excessively low, the corrosion resistance decreases lower than that in the case where the reduction ratio is within the range of the present invention. Conversely, when the reduction ratio is excessively high, while preferable film properties can be obtained, the treatment liquid is prone to gel. This causes a problem in the liquid stability. Item No. 38 represents an example in which Cr acetate, and a film not containing $Cr^{6+}$ is formed. In this example, excellent film properties can be obtained, and concurrently, the liquid stability is excellent. Item Nos. 39 to 44 individually represent examples intended to examine the influence of the resin composition. These examples show high processed-portion corrosion resistances in comparison to that in the case of acrylic resin on item No. 39. This is attributable to conditions using an acryl-styrene-type resin having the styrene copolymerization ratio (styrene/organic-resin weight ratio) and the acid number that are within the range of the present invention. Regarding item No. 43, since the acid number is smaller than that within the range of Embodiment 5, the treatment-liquid stability is somewhat reduced.

Embodiment 6

The inventors of the present invention found the following. Through the forming of the film containing the new additive Ca, improvement can be achieved in the corrosion resistance of the zinc-base-plated steel sheet containing at least 30% Al even after the zinc-base-plated steel sheet was worked. Furthermore, the film having the high antiblackening resistance can be formed on the so-called 5% Al-base steel sheet. Still furthermore, for the so-called 55% Al-base steel sheet, the inventors found conditions that enable the formation of the film having a significantly excellent effect of inhibiting development of black rust in a corrosive environment. The aforementioned black rust can develop in a manner that since the film has a large amount of the Al component and is therefore hard, cracks occur as a result of severe processing, and corrosion develops from the crack portions. Based on the finding, the inventors achieved the present invention. The present invention has the following basic characteristics:

(1) A method for producing a highly-corrosion-resistant surface-treated steel sheet, characterized as follows. Chromate treatment is applied onto a surface of a zinc-base-plated steel sheet that contains at least 30 wt % Zn. Then, the chromate-treated surface is applied with a treatment liquid, and the surface is cured at sheet temperatures ranged from 60 to 250° C. to form a film. The treatment liquid contains an organic resin, a Ca compound, and silica or a compound thereof. The film is applied to satisfy the following conditions. The coating weight of an organic resin is in a range of from 50 to 5,000 mg/m$^2$, the coating weight of Cr is in a range of from 1 to 100 mg/m$^2$, the coating weight of Ca is in a range of from 0.001 to 0.2 in a ratio of Ca/organic resin (weight ratio), and the coating weight of the silica or the silica-group compound is in a range of from 0.001 to 0.5 in a ratio of $SiO_2$/organic resin (weight ratio). (First Pattern)

(2) The method for producing a highly-corrosion-resistant surface-treated steel sheet according to item (1). The method is characterized in that the zinc-base-plated steel sheet that contains at least 30 wt % Zn is a Zn—Al-alloy-plated steel sheet that contains 1 to 10 wt % Al. (Second Pattern)

(3) The method for producing a highly-corrosion-resistant surface-treated steel sheet according to item (1). The method is characterized in that the zinc-base-plated steel sheet that contains at least 30 wt % Zn is a Zn—Al-alloy-plated steel sheet that contains 40 to 70 wt % Al. (Third Pattern)

Hereinbelow, Embodiment 6 will be described in detail.

(Types of Steel sheets)

In Embodiment 6, the types of the object steel sheets are limited as above for the following reasons. Steel sheets containing less-than-30% Zn are inferior in a sacrificial corrosion resistance of Zn. For this reason, the steel sheets tend to cause red rust that develops as a Fe-corrosion product. The steel sheets of this type allow red rust to develop even from a small defect caused on the film. From the viewpoint of the corrosion resistance of the steel sheet, the steel sheet should contain at least 30% Zn. However, since Zn is inherently active metal, the plating film is apt to corrode, and the amount of Zn should be limited from the viewpoint of long-term durability.

As a mean to improve the durability of the Zn-plated steel sheet, Zn—Al alloy plating was developed and has already been practically employed. Widely used steel sheets of this type include plated steel sheets that each contain Al in a range of from 1 to 10%, and in addition, Mg, MM, or the like that is optionally added depending on the case (the steel sheet hereinbelow will be referred to as a 5% Al-base-plated steel sheet). The steel sheets of the aforementioned type also include the following plated steel sheets. Each of the steed sheets contains Al in a range of from 40 to 70%, Si in a range of from 1 to 3%, and in addition, Ti or the like that is optionally added depending on the case (the steel sheet hereinbelow will be referred to as a 55% Al-base-plated steel sheet). The present invention has an object to improve the corrosion resistance of the aforementioned zinc-base-plated steel sheets that each contain at least 30 wt % Zn. Examples of the corresponding plated steel sheets used in the present markets include electro-Zn-plated steel sheets, molten-Zn-plated steel sheets, 5% Al-base-plated steel sheets, and 55% Al-base-plated steel sheets.

Compared to a Zn-plated steel sheet, while the 5% Al-base-plated steel sheet can be improved in the durability, it exhibits problems in that the surface is blackened in a high-temperature and/or high-humidity environment, and the commercial value thereof is therefore significantly decreases. The present invention improves the antiblackening resistance of the 5% Al-base-plated steel sheet and to thereby solve the above-described problems.

The 55% Al-base-plated steel sheet also exhibits problems. For this steel sheet, the corrosion resistance is improved. However, the film is formed to be hard, cracks occur during processing, corrosion therefore develops from a processed portion. In addition, since the steel sheet contains much Al, much black rust develops, thereby significantly decreasing the visual quality. The present invention improves the processed-portion black-rust resistance of the 55% Al-base-plated steel sheet and to thereby solve the problems.

In the present invention, when required, each of the individual plated steel sheets may be subjected to a pretreatment such as hot-water rinsing or alkaline degreasing. In addition, depending on the case, the steel sheet may be subjected to a pretreatment for adhering, for example, Ni, Co, and Fe, on the surface thereof.

(Application of Chromate Treatment onto Surface of Plated steel sheet)

Because of the application of the chromate treatment on the surface of the plated steel sheet, the surface is passivated. The passivation enables the corrosion resistance to be significantly improved. The conditions of the chromate treatment are not specifically limited. Ordinarily, the chromate treatment uses a treatment liquid composed such that fluoride, anion, or the like is appropriately added as a reaction accelerator to chromic acid having the Cr reduction ratio of 10 to 40%. After the liquid is applied onto the surface, the surface is cured. Thereby, a film is formed. As the coating weight of the treatment liquid, at least 1 mg/m$^2$ is required to impart the above-described effects. However, application of the liquid in an amount exceeding 100 mg/m$^2$ is not effective to further improve the effects. The application of the excessive amount of the liquid causes discoloration-attributed degradation to become conspicuous in the visual quality. This is not preferable.

(Organic-Film Coating weight: 50 to 5,000 Mg/M$^2$)

The plating-surface film is required to contain the organic resin in a range of from 50 to 5,000 mg/m$^2$. The organic resin has the effect of improving the corrosion resistance of a chromate film as well as the effect of preventing processing-attributed surface-damage development. These effects depend on the coating weight. When the organic-resin amount is below 50 mg/m$^2$, corrosion-resistance improving effects are not recognized. When the organic-resin amount is above 5,000 mg/m$^2$, the film peels during processing. A peeled substance can cause new surface-damage development. The case is therefore not preferable. For these reasons, the organic-resin coating weight should be in a range of from 50 to 5,000 mg/m$^2$. More preferably, the amount should be in a range of from 50 to 2,500 mg/m$^2$.

The organic resin to be used should be either water soluble or water dispersible. The type of the organic resin may be one of resins of an acrylic group, an acryl-styrene group, a urethane group, and a polyester group. However, for the treatment liquid, the resin preferably contains a nonionic-group component to allow stable dispersion together with other components. In addition, from the viewpoint of the corrosion resistance, a water-dispersible resin (emulsion resin) is preferably used instead of the water-soluble resin. Among the aforementioned resins, the acryl-styrene-group resin can be produced using an emulsion polymerization method that is advantageous in cost.

Concurrently, the acryl-styrene-group resin is excellent in the corrosion resistance and the processability. In the acryl-styrene-group resin, when the ratio of styrene is below 10%, the corrosion resistance decreases; whereas, when the ratio of styrene is above 70%, the processability decreases. For these reasons, an inexpensive film having a corrosion resistance as well as excellent processability can be formed by using the acryl-styrene-group resin in which the ratio of styrene/organic resin is in a range of from 0.1 to 0.7. When the acid number is below 1, the stability of the liquid is insufficient. However, when the acid number is above 50, the corrosion resistance decreases. For these reasons, the acid number should be in a range of from 1 to 50. This range enables excellent liquid stability and a high corrosion resistance to be compatibly obtained.

Other elements to be added, such as a dispersion stabilizer or a defoamer, greatly influence film properties (film adhesion, corrosion resistance, antiblackening resistance, water resistance, paint adhesion, slippage resistance, tape adhesion, PEF adhesion, and adhesion to defoamation urethane), liquid composition stability, and mechanical stability. As such, essentially required is to select the elements suitable to the above and other desired properties and usage conditions.

(Ca: 0.001 to 0.2 in Ratio of Ca/Organic Resin (Weight Ratio))

Ca has the effect of improving the corrosion resistance of the chromate film. In addition, Ca has the effect of significantly improving the antiblackening resistance that is the problem specific to the 5% Al-base-plated steel sheet. Furthermore, Ca has the effect of improving the processed-portion corrosion resistance that is the problem specific to the 55% Al-base-plated steel sheet. The effects of Ca are significantly influenced by the ratio to the organic resin. When the ratio of Ca/organic resin is below 0.001, sufficient effects cannot be obtained. When a ratio of Ca/organic resin is above 0.2, sufficient effects cannot be obtained. When the ratio of Ca/organic resin is below 0.001, the processed-portion corrosion resistance and the antiblackening resistance are improved. However, since steel sheet is exposed to in a corrosive environment for a long time, a tendency is recognized in which the corrosion resistance decreases in planar portions. For these reasons, the ratio of Ca/organic resin (weight ratio) should be in a range of from 0.001 to 0.2. More preferably, the ratio should be in a range of from 0.005 to 0.1.

As an adding method of Ca, Ca may be added in a state of a complex salt composed with Ca carbonate, Ca silicate, CaO, or phosphoric acid. However, the present invention is not limited by the above. Attention should be directed to that fact that sufficient effects cannot be obtained in a state where the Ca component easily dissolves during film formation. As such, it is important that the additive should be included in the treatment liquid to form a compound that does not easily dissolve in the film. However, Embodiment 6 does not limit the adding method for the Ca compound.

($SiO_2$: 0.001 to 0.5 in Ratio of $SiO_2$/Organic Resin (Weight Ratio))

$SiO_2$ is added for the reason that inclusion of $SiO_2$ together with Ca in the chromate film imparts the effect of significantly improving the corrosion resistance and antiblackening resistance of Ca. When the film contains at least 0.001 in the $SiO_2$/organic resin, Ca imparts either the corrosion-resistance improving effects or the blackening-phenomenon-resistance improving effects. However, when the ratio of $SiO_2$/organic resin is above 0.5, the film is prone to peel off during processing. For this reason, the ratio should be at most 0.5. $SiO_2$ may be added as a complex compound composed with Ca.

(Curing Temperatures)

The aqueous treatment liquid containing the above-described components is applied using a roll coater or the like. Then, heat-curing or hot-air curing is performed to thereby form a film. In this case, the film-formation temperature should be set to 60° C. When the temperature is below 60° C., residual moisture in the film influences the film to be inferior in the corrosion resistance and the adhesion. Even in a case where the highest-reachable sheet temperature is increased higher than 250° C., the case only shows a tendency in which property-improving effects are not recognized, and a film having a reduced corrosion resistance is formed. For these reasons, the curing sheet temperatures should be in a range of from 60 to 250° C.

Hereinbelow, an Example will be described.

With reference to Tables 42 to 43, the chromate treatment was performed for plated steel sheets of various types. Then, the individual surfaces were applied with the treatment liquid containing organic resin, a Ca compound, and silica or a silica-group compound thereof which were adjusted to have predetermined chemical compositions. Subsequently, the surfaces were heat-cured at the highest-reachable sheet temperatures shown in Tables 42 to 43. The steel sheets were thus coated with plating films having the coating weights shown in Tables 42 to 43, and test samples were taken therefrom. The symbols in the "Plating" column in the tables are referred to in the description below. These symbols represent the types of the plated steel sheets as follows:

GI: Molten-Zn-plated steel sheet (plating amount: Z27; sheet thickness: 0.5 mm)

5Al: 5% Al—Zn-alloy-plated steel sheet (plating amount: Y22; sheet thickness: 0.5 mm)

55Al: 55% Al—Zn-alloy-plated steel sheet (plating amount: AZ-150; sheet thickness: 0.5 mm)

Al: Molten-Al-plated steel sheet (plating amount: 200 $g/m^2$; sheet thickness: 0.5 mm)

In the present Example, as the method for adding Ca and silica, a complex salt prepared in the following manner was added. Ca carbonate was dissolved in nitric water, soda silicate was added in the water, and a reactant product was thereby formed. Then, the reactant product was rinsed and filtered. In addition, when necessary, Ca-silicic acid compound (composition ratio of $CaO:SiO_2$=9:1) appropriately grained into small particles was added. With the above being used as a base, silica ($SiO_2$) and Ca carbonate are appropriately added. Thereby, the ratio between Ca and $SiO_2$ in the complex salt was adjusted.

Humidity cabinet testing (50° C.; RH below 98%) was performed to evaluate the corrosion resistance of planar portions of each of the test samples. In addition, to evaluate processed-portion corrosion resistance, 600-hour humidity cabinet testing was performed for each test sample for which 3T-bending processing was performed. The rust-developed extent was evaluated for the bent portions according to the criteria shown below.

Evaluation Criteria for Bent-Portion Corrosion Resistances

10: white-rust developed area less than 10%, black-rust developed area less than 10%; 8: White-rust developed area at least 10% to less than 50%, black-rust developed area less than 10%; 6: White-rust developed area at least 50%, black-rust developed area less than 10%; 4: Black-rust developed area at least 10% to less than 50%; 2: Black-rust developed area at least 50%; and 1: Red rust developed.

For evaluation of the antiblackening resistance, the blackened extent was inspected according to the following criteria after placing the test samples for 24 hours in an environment of 80° C. and 95% RH.

Evaluation Criteria for Blackening-Phenomenon-Resistances

5: No change; 4: Verifiable blacked area less than 25% when diagonally viewed; 3: Verifiable blacked area at least 25% when diagonally viewed; 2: Verifiable blacked area less than 25% when front-viewed; and 1: Verifiable blacked area at least 25% when front-viewed.

For evaluation of the processability, planar-portion sliding was performed in a manner in which a bead having a 1×10 mm planar end was used to press the surface of a 30 mm wide test sample at a predetermined load, and the test sample was slidably drawn in the pressed state at a predetermined speed. The testing was iterated by changing the pressing load, and the evaluation was performed according to a limiting pressing load at which galling occurred on the plating surface The evaluation results are shown in Table 44.

TABLE 42

| No. | Plating | Type of resin (Note 1) | Heating temperature (° C.) | Resin coating weight ($mg/m^2$) | Cr coating weight ($mg/m^2$) | Ca/resin (wt/wt) | $SiO_2$/resin (wt/wt) | Remarks Film |
|---|---|---|---|---|---|---|---|---|
| 1 | Gl | AcSt | 120 | 1500 | 20 | 0 | 0 | Out of range |
| 2 | Gl | AcSt | 120 | 1500 | 20 | 0.03 | 0 | Out of range |
| 3 | Gl | AcSt | 120 | 1500 | 20 | — | 0.05 | Out of range |
| 4 | Gl | AcSt | 120 | 1500 | 20 | 0.03 | 0.05 | Within range |
| 5 | 5Al | AcSt | 120 | 1500 | 20 | 0 | 0 | Out of range |
| 6 | 5Al | AcSt | 120 | 1500 | 20 | 0.03 | 0 | Out of range |
| 7 | 5Al | AcSt | 120 | 1500 | 20 | — | 0.05 | Out of range |
| 8 | 5Al | AcSt | 120 | 1500 | 20 | 0.03 | 0.05 | Within range |
| 9 | 55Al | AcSt | 120 | 1500 | 20 | 0 | 0 | Out of range |
| 10 | 55Al | AcSt | 120 | 1500 | 20 | 0.03 | 0 | Out of range |
| 11 | 55Al | AcSt | 120 | 1500 | 20 | — | 0.05 | Out of range |
| 12 | 55Al | AcSt | 120 | 1500 | 20 | 0.03 | 0.05 | Within range |
| 13 | Al | AcSt | 120 | 1500 | 20 | 0.03 | 0.05 | Out of range |

(Note 1) Type of resin: [AcSt]: Acryl-styrene copolymer resin (styrene polymerization ratio: 55%; acid number: 20)

TABLE 43

| No. | Plating | Type of resin (Note 1) | Heating temperature (° C.) | Resin coating weight ($mg/m^2$) | Cr coating weight ($mg/m^2$) | Ca/resin (wt/wt) | $SiO_2$/resin (wt/wt) | Remarks Film |
|---|---|---|---|---|---|---|---|---|
| 14 | 5Al | AcSt | 120 | 20 | 20 | 0.03 | 0.5 | Out of range |
| 15 | 5Al | AcSt | 120 | 100 | 20 | 0.03 | 0.5 | Within range |
| 16 | 5Al | AcSt | 120 | 3000 | 20 | 0.01 | 0.05 | Within range |
| 17 | 5Al | AcSt | 120 | 6000 | 20 | 0.01 | 0.05 | Out of range |
| 18 | 5Al | AcSt | 120 | 1500 | 0.3 | 0.03 | 0.05 | Out of range |
| 19 | 5Al | AcSt | 120 | 1500 | 60 | 0.03 | 0.05 | Within range |
| 20 | 5Al | AcSt | 120 | 1500 | 150 | 0.03 | 0.05 | Out of range |
| 21 | 5Al | AcSt | 120 | 1500 | 20 | 0.0001 | 0.05 | Out of range |
| 22 | 5Al | AcSt | 120 | 1500 | 20 | 0.005 | 0.05 | Within range |
| 23 | 5Al | AcSt | 120 | 1500 | 20 | 0.1 | 0.05 | Within range |
| 24 | 5Al | AcSt | 120 | 1500 | 20 | 0.3 | 0.05 | Out of range |
| 25 | 5Al | AcSt | 120 | 1500 | 20 | 0.03 | 0.0001 | Out of range |
| 26 | 5Al | AcSt | 120 | 1500 | 20 | 0.03 | 0.01 | Within range |
| 27 | 5Al | AcSt | 120 | 1500 | 20 | 0.03 | 0.3 | Within range |
| 28 | 5Al | AcSt | 120 | 1500 | 20 | 0.03 | 0.7 | Out of range |
| 29 | 5Al | AcSt | 40 | 1500 | 20 | 0.03 | 0.05 | Out of range |
| 30 | 5Al | AcSt | 80 | 1500 | 20 | 0.03 | 0.05 | Within range |
| 31 | 5Al | AcSt | 200 | 1500 | 20 | 0.03 | 0.05 | Within range |
| 32 | 5Al | AcSt | 300 | 1500 | 20 | 0.03 | 0.05 | Out of range |

(Note 1) Type of resin: [AcSt]: Acryl-styrene copolymer resin (styrene polymerization ratio: 55%; acid number: 20)

TABLE 44

| No. | Planar-portion corrosion resistance Time (hrs) | Processed-portion corrosion resistance | Antiblackening resistance | Processability Load (kgf) | Quality for other aspects | Remarks Film |
|---|---|---|---|---|---|---|
| 1 | 240 | 5 | 3 | 150 | | Out of range |
| 2 | 240 | 5 | 4 | 150 | | Out of range |
| 3 | 240 | 5 | 3 | 150 | | Out of range |
| 4 | 600 | 7 | 5 | 150 | | Within range |
| 5 | 480 | 6 | 1 | 150 | | Out of range |
| 6 | 480 | 6 | 2 | 150 | | Out of range |

TABLE 44-continued

| No. | Planar-portion corrosion resistance Time (hrs) | Processed-portion corrosion resistance | Antiblackening resistance | Processability Load (kgf) | Quality for other aspects | Remarks Film |
|---|---|---|---|---|---|---|
| 7 | 600 | 7 | 1 | 150 | | Out of range |
| 8 | 960 | 8 | 5 | 150 | | Within range |
| 9 | 1200 | 2 | 5 | 150 | | Out of range |
| 10 | 1200 | 2 | 5 | 150 | | Out of range |
| 11 | 1800 | 2 | 5 | 150 | | Out of range |
| 12 | >2400 | 10 | 5 | 150 | | Within range |
| 13 | >2400 | 1 | 5 | 150 | | Out of range |
| 14 | 600 | 7 | 4 | <50 | | Out of range |
| 15 | 600 | 8 | 5 | 150 | | Within range |
| 16 | 1800 | 10 | 5 | 200 | | Within range |
| 17 | 1800 | 10 | 5 | 50 | | Out of range |
| 18 | <120 | 5 | 1(White rust) | <50 | | Out of range |
| 19 | 1800 | 10 | 5 | 200 | | Within range |
| 20 | 1800 | 10 | 5 | 200 | Appearnace: significant coloration | Out of range |
| 21 | 600 | 6 | 1 | 150 | | Out of range |
| 22 | 960 | 8 | 5 | 150 | | Within range |
| 23 | 960 | 10 | 4 | 150 | | Within range |
| 24 | 120 | 6 | 3 | 100 | | Out of range |
| 25 | 600 | 6 | 4 | 150 | | Out of range |
| 26 | 960 | 8 | 5 | 150 | | Within range |
| 27 | 960 | 10 | 5 | 150 | | Within range |
| 28 | 240 | 5 | 3 | 50 | | Out of range |
| 29 | 480 | 6 | 3 | 150 | | Out of range |
| 30 | 720 | 8 | 5 | 150 | | Within range |
| 31 | 960 | 10 | 5 | 150 | | Within range |
| 32 | 480 | 6 | 4 | 150 | | Out of range |

Item Nos. 1 to 4 individually represent examples each having a film formed on the Al. Item Nos. 5 to 8 individually represent examples each having a film formed on the 55Al. Item No. 13 represents an example each having a film formed on the Al. Items Nos. 4, 8, and 12 represent examples in which films of the present invention are formed on the GI, 5Al, and 55Al, respectively, each of which contains at least 30% Zn. These examples impart the effect of improving the planar-portion corrosion resistance, the antiblackening resistance, and the processed-portion corrosion resistance. These properties correspond to the plating-related problems to be solved with the individual steel sheets. Items Nos. 4, 8, and 12 improves these properties to a level that cannot be achieved with conventional chromate films. Furthermore, the items each have the processability. On the other hand, in item No. 13 that does not contain Zn, red rust developed from a processed film portion. That is, a film having a lower processed-portion corrosion resistance is formed.

Item Nos. 14 to 17 individually represent examples each using the 5Al as the base. These examples were intended to examine the influence of the Cr coating weight. Item Nos. 18 to 20 individually represent examples each using 5Al's as the base. These examples were intended to examine the influence of the Cr coating weight. Item Nos. 21 to 24 individually represent examples each using 5Al's as the base. These examples were intended to examine the influence of the additive/resin. Similarly, item Nos. 25 to 28 individually represent examples each using 5Al's as the base. These examples were intended to examine the influence of the $SiO_2$/resin. When the resin-coating weight is out of the range of the present invention, the processability is particularly low. When the Cr amount is small, all the properties are low. When an excessive amount of Cr adheres, a film formed has an excellent corrosion resistance, antiblackening resistance, and processability; however, the discoloration is significantly increased to an extent of causing a problem in the visual quality. The addition amounts of Ca or $SiO_2$ greatly influence the antiblackening resistance and the corrosion resistance. Therefore, one of them decreases in out of the range of the present invention, and the compatibility thereof is difficult.

Item Nos. 29 to 32 individually represent examples intended to examine the influence of the curing temperature. These examples each have a tendency in which the antiblackening resistance is relatively low when the curing temperature is out of the range of the present invention.

Embodiment 7

The inventors of the present invention found the following. Through the forming of the film containing the new additive Ca, improvement can be achieved in the corrosion resistance of the zinc-base-plated steel sheet containing at least 30% Al even after the zinc-base-plated steel sheet was worked. Furthermore, the film having the high antiblackening resistance can be formed on the so-called 5% Al-base steel sheet. Still furthermore, for the so-called 55% Al-base steel sheet, the inventors found conditions that enable the formation of the film having a significantly excellent effect of inhibiting development of black rust in a corrosive environment. The aforementioned black rust can develop in a manner that since the film has a large amount of the Al component and is therefore hard, cracks occur as a result of severe processing, and corrosion develops from the crack portions. Based on the finding, the inventors achieved Embodiment 7. Embodiment 7 has the following basic characteristics:

(1) A highly-corrosion-resistant surface-treated steel sheet characterized as follows. The steel sheet is a zinc-base-plated steel sheet that contains at least 30 wt % Zn and that has a film on a surface thereof. The film contains an organic resin, Cr, Ca, and phosphoric acid or a phosphoric acid compound. The film is formed such that the coating weight of the organic resin is in a range of from 50 to 5,000 mg/m$^2$, the coating weight of Cr is in a range of from 1 to 100 mg/m$^2$, the coating weight of Ca is in a range of from 0.001 to 0.2 in a ratio of Ca/organic resin (weight ratio), and the total coating weight of the phosphoric acid or the phosphoric acid compound is in a range of from 0.001 to 0.5 in a ratio of $PO_4$/organic resin (weight ratio). (First Pattern)

(2) The highly-corrosion-resistant surface-treated steel sheet according to item (1), characterized in that the zinc-base-plated steel sheet that contains at least 30 wt % Zn is a Zn—Al-alloy-plated steel sheet that contains 1 to 10 wt % Al. (Second Pattern)

(3) The highly-corrosion-resistant surface-treated steel sheet according to item (1), characterized in that the zinc-base-plated steel sheet that contains at least 30 wt % Zn is a Zn—Al-alloy-plated steel sheet that contains 40 to 70 wt % Al. (Third Pattern)

(4) A method for producing one of the surface-treated steel sheets described in items (1) to (3), characterized as follows. The film is formed by application of an aqueous treatment liquid onto the surface of the zinc-base-plated steel sheet that contains at least 30 wt % Zn. The aqueous treatment liquid contains a water-soluble or water-dispersible organic resin, water-soluble chromic acid or chromate, a Ca compound, and one or two phosphoric acid compounds selected from zinc phosphate, aluminum phosphate, condensed zinc phosphate, and condensed aluminum phosphate. Curing is performed at sheet temperatures in a range of from 60 to 250° C. (Fourth Pattern)

(5) The method for producing the highly-corrosion-resistant surface-treated steel sheet according to item (4), characterized in that a ratio (weight ratio) of $Cr^{3+}/(Cr^{6+}+Cr^{3+})$ in the aqueous treatment liquid is 0.05 to 0.9. (Fifth Pattern)

(6) The method for producing the highly-corrosion-resistant surface-treated steel sheet according to item (4) characterized in that the water-soluble chromate in the aqueous treatment liquid is either $Cr^{3+}$ water-soluble chromic acid or chromic acid. (Sixth Pattern)

(7) The method for producing the highly-corrosion-resistant surface-treated steel sheet according to one of items (5) and (6), characterized as follows. The organic resin in the aqueous treatment liquid is an acryl-styrene copolymer emulsion resin. In the organic resin, a ratio of styrene/organic resin (weight ratio) is in a range of from 0.1 to 0.7, and the acid number is in a range of from 1 to 50. (Seventh Pattern)

Hereinbelow, Embodiment 7 will be described in detail.

In Embodiment 7, the types of the object steel sheets are limited as above for the following reasons. Steel sheets containing less-than-30% Zn are inferior in a sacrificial corrosion resistance of Zn. For this reason, the steel sheets tend to cause red rust that develops as a Fe-corrosion product. The steel sheets of this type allow red rust to develop even from a small defect caused on the film. From the viewpoint of the corrosion resistance of the steel sheet, the steel sheet should contain at least 30% Zn. However, since Zn is inherently active metal, the plating film is apt to corrode, and the amount of Zn should be limited from the viewpoint of long-term durability.

As a mean to improve the durability of the Zn-plated steel sheet, Zn—Al alloy plating was developed and has already been practically employed. Widely used steel sheets of this type include plated steel sheets that each contain Al in a range of from 1 to 10%, and in addition, Mg, MM, or the like that is optionally added depending on the case (the steel sheet hereinbelow will be referred to as a 5% Al-base-plated steel sheet). The steel sheets of the aforementioned type also include the following plated steel sheets. Each of the steel sheet contains Al in a range of from 40 to 70%, Si in a range of from 1 to 3%, and in addition, Ti or the like that is optionally added depending on the case (the steel sheet hereinbelow will be referred to as a 55% Al-base-plated steel sheet). The present invention has an object to improve the corrosion resistance of the aforementioned zinc-base-plated steel sheets that each contain at least 30 wt % Zn. Examples of the corresponding plated steel sheets used in the present markets include electro-Zn-plated steel sheets, molten-Zn-plated steel sheets, 5% Al-base-plated steel sheets, and 55% Al-base-plated steel sheets.

Compared to a Zn-plated steel sheet, while the 5% Al-base-plated steel sheet can be improved in the durability, it exhibits problems in that the surface is blackened in a high-temperature and/or high-humidity environment, and the commercial value thereof is therefore significantly decreases. Embodiment 7 improves the antiblackening resistance of the 5% Al-base-plated steel sheet and to thereby solve the above-described problems.

The 55% Al-base-plated steel sheet also exhibits problems. For this steel sheet, the corrosion resistance is improved. However, the film is hard, cracks occur during processing, and corrosion develops from a processed portion. In addition, since the steel sheet contains much Al, much black rust develops, thereby significantly decreasing the visual quality. Embodiment 7 improves the processed-portion black-rust resistance of the 55% Al-base-plated steel sheet and to thereby solve the problems.

In Embodiment 7, when required, each of the individual plated steel sheets may be subjected to a pretreatment such as hot-water rinsing or alkaline degreasing. In addition, depending on the case, the steel sheet may be subjected to a pretreatment for adhering, for example, Ni, Co, and Fe, on the surface thereof.

(Organic-Film Coating weight: 50 to 5,000 Mg/M$^2$)

The plating-surface film is required to contain the organic resin in a range of from 50 to 5,000 mg/m$^2$. The organic resin has the effect of improving the corrosion resistance of a chromate film as well as the effect of preventing processing-attributed surface-damage development. These effects depend on the coating weight. When the organic-resin amount is below 50 mg/m$^2$, corrosion-resistance improving effects are not recognized. When the organic-resin amount is above 5,000 mg/m$^2$, the film peels off during processing. A peeled substance can cause new surface-damage development. The case is therefore not preferable. For these reasons, the organic-resin coating weight should be in a range of from 50 to 5,000 mg/m$^2$. More preferably, the amount should be in a range of from 50 to 2,500 mg/m$^2$.

(Cr Coating weight: 1 to 100 mg/m$^2$)

The film is required to contain Cr in a range of from 1 to 100 mg/m$^2$. In particular, Cr has the effect of forming a stabilized passivation film, thereby improving the corrosion resistance of planar portions and improving the adhesion. Cr is therefore an indispensable component of the film. When Cr is below 1 mg/m$^2$, no improvement effects are recognized for both the corrosion resistance and adhesion. When the Cr coating weight is above 100 mg/m$^2$, the film is prone to peel off in portions in which severe processing is performed. For these reasons, the Cr coating weight should be in a range of from 1 to 100 mg/m$^2$.

(Ca: 0.001 to 0.2 in Ratio of Ca/Organic Resin (Weight Ratio))

Ca has the effect of improving the corrosion resistance of the chromate film. In addition, Ca has the effect of significantly improving the antiblackening resistance that is the problem specific to the 5% Al-base-plated steel sheet. Moreover, Ca has the effect of improving the processed-portion corrosion resistance that is the problem specific to the 55% Al-base-plated steel sheet. The effects of Ca are significantly influenced by the ratio to the organic resin. When the ratio of Ca/organic resin is below 0.001, sufficient effects cannot be obtained. When a ratio of Ca/organic resin is above 0.2, sufficient effects cannot be obtained. When a ratio of Ca/organic resin is below 0.001, the processed-portion corrosion resistance and the antiblackening resistance are improved. At this ratio, however, since steel sheet is exposed to in a corrosive environment for a long time, a tendency is recognized in which the corrosion resistance decreases in planar portions. For these reasons, the ratio of Ca/organic resin (weight ratio) should be in a range of from 0.001 to 0.2. More preferably, the ratio should be in a range of from 0.005 to 0.1.

($PO_4$: 0.001 to 0.5 in Ratio of PO4/Organic Resin (Weight Ratio))

$PO_4$ is added for the reason that inclusion of $PO_4$ together with Ca in the chromate film imparts the effect of significantly improving the corrosion resistance and antiblackening resistance of Ca. When the film contains at least 0.001 in the $PO_4$/organic resin, Ca imparts either the corrosion-resistance improving effects or the blackening-phenomenon-resistance improving effects. However, when the ratio of $PO_4$/organic resin is above 0.5, the film is prone to peel off during processing. For this reason, the ratio should be at most 0.5.

In the film, $PO_4$ was verified to exist in various states, for example, zinc phosphate, zinc tripolyphosphate, aluminum tripolyphosphate, and condensed phosphoric acid. The present invention is not limited by the existing state of phosphoric acid in the film. However, the present invention is intended such that a preferable state contains zinc phosphate or aluminum tripolyphosphate as a principal component and partially contains condensed phosphoric acid.

(Production Methods)

For producing one of the surface-treated steel sheets described above, the surface of the zinc-base-plated steel sheet containing at least 30% Zn is coated with the above-described aqueous treatment liquid. The aqueous treatment liquid contains the water-soluble or water-dispersible organic resin, the water-soluble chromic acid or chromate, the Ca compound, and the one or two phosphoric acid compounds selected from zinc phosphate, aluminum phosphate, condensed zinc phosphate, and condensed aluminum phosphate. Then, curing is performed at sheet temperatures in a ranged of from 60 to 250° C. Hereinbelow, reasons for performing the above processing will be described.

To form the above-described film, the aqueous treatment liquid to be used is prepared by blending the organic resin, Cr, Ca, and the $PO_4$-group compound to satisfy a predetermined content ratio.

The organic resin to be used should be either water soluble or water dispersible. The type of the organic resin may be one of resins of an acrylic group, an acryl-styrene group, a urethane group, and a polyester group. However, for the treatment liquid, the resin preferably contains a nonionic-group component to allow stable dispersion together with other components. In addition, from the viewpoint of the corrosion resistance, a water-dispersible resin (emulsion resin) is preferably used instead of the water-soluble resin. Among the aforementioned resins, the acryl-styrene-group resin can be produced by an emulsion polymerization method that is advantageous in cost. Concurrently, the acryl-styrene-group resin is excellent in the corrosion resistance and the processability. In the acryl-styrene-group resin, when a ratio of styrene is below 10%, the corrosion resistance decreases; whereas, when the ratio of styrene is above 70%, the processability decreases. For these reasons, an inexpensive film having a corrosion resistance as well as high processability can be formed by using the acryl-styrene-group resin in which a ratio of styrene/organic resin (weight ratio) is in a range of from 0.1 to 0.7. When the acid number is below 1, the stability of the liquid is insufficient. However, when the acid number is above 50, the corrosion resistance decreases. For these reasons, the acid number should be in a range of from 1 to 50. This range enables a high liquid stability and a high corrosion resistance to be compatibly obtained.

Other elements to be added, such as a dispersion stabilizer or a defoamer, greatly influence film properties (film adhesion, corrosion resistance, antiblackening resistance, water resistance, paint adhesion, slippage resistance, tape adhesion, PEF adhesion, and adhesion to defoamation urethane), liquid composition stability, and mechanical stability. As such, it is important to select the elements suitable to the above and other desired properties and usage conditions.

As a rust-preventing component, Cr plays an important role. Effects thereof greatly depend on the conditions of Cr in the treatment liquid. To allow Cr to impart rust prevention effects, Cr should be contained in a dissolved state. Suppose a film is formed with treatment liquid to which refractory chromates, such as $ZnCrO_4$, $SrCrO_4$, $BaCrO_4$, $CuCrO_4$, $FeCrO_4$, $Ag_2CrO_4$, and $SnCrO_4$ are added. In this case, the corrosion resistance of the film is low, and concurrently, the adhesion level is low.

The present invention allows the use one of the following elements as chromic acid. One element is prepared such that, for example, anhydrous chromic acid is dissolved into water, and a part thereof is reduced into $Cr^{3+}$ by using a reducer as well as anion such as phosphoric acid when necessary. Another element is in a state of a soluble $Cr^{3+}$ compound, such as Cr nitrate, Cr sulfate, or Cr acetate; and still another element is in a state of a mixture thereof. When the element is dissolved in liquid, it reacts with or is adsorbed to the plating surface during film formation. At this time, since the surface is stabilized, improvement effects are considered attainable for the corrosion resistance as well as the film adhesion. For the above-described reasons, the treatment liquid should contain the dissolved chromic component.

The ratio (weight ratio) of $Cr^{3+}/(Cr^{6+}+Cr^{3+})$ greatly influences the film properties. When the ratio is set to a range of from 0.05 to 0.9, the film strongly adheres to the plating. This enables the formation of a film that is further improved in the corrosion resistance. However, when the ratio is below 0.05, a film having a lower adhesion is formed. When the ratio is above 0.9, the corrosion resistance decreases. For these reasons, the ratio (weight ratio) of $Cr^{3+}/(Cr^{6+}+Cr^{3+})$ should be in a range of from 0.05 to 0.9. More preferably, the ratio should be in a range of from 0.2 to 0.6.

Recently, for solving the environmental problems, the trend is growing toward high-evaluation of the formation of films that do not contain $Cr^{6+}$. In conformity to the trend, the present invention enables the formation of films that do not contain $Cr^{6+}$. The mechanism for the above is considered as follows. The Ca compound substitutes $Cr^{6+}$ to impart self-healing effects, thereby enabling a higher corrosion resistance to be imparted in comparison to a film formed using Cr3+ that does not contain the Ca compound.

As an adding method of Ca, Ca may be added in a state of a complex salt composed with Ca carbonate, Ca silicate, CaO, or phosphoric acid. However, the above does not limit the present invention. Attention should be directed to the fact that the additive can change the pH value of the treatment liquid and adversely affects the liquid composition stability. A pH range of from 1 to 6.5 was already verified as a range necessary to disperse the indispensable component, but the dispersion was difficult in a pH range that is below 1 or in a pH range that is above 7. In addition, sufficient effects cannot be obtained in a state where the Ca component easily dissolves during film formation. It is therefore important that the additive should be included in the treatment liquid to form a compound that does not easily dissolve in the film. In the present invention, the adding method for the Ca compound is not specifically limited.

Hereinbelow, an adding method for the phosphoric acid components will be described. With phosphoric acid added in the treatment liquid, a compound such as zinc phosphate is produced. The zinc phosphate reacts with the plating during film formation. This reaction allows the Ca-attributable corrosion resistance and antiblackening resistance to be partly improved. However, when the addition amount of the compound is increased to obtain sufficient effects, much unreacted phosphoric acid remains in the film. The residual phosphoric acid causes a film to lack the capability of sufficiently improving properties such as the antiblackening resistance. To overcome this problem, the phosphoric acid components are preferably added in the state of a phosphoric acid compound composed of, for example, zinc phosphate, aluminum phosphate, zinc tripolyphosphate, and aluminum tripolyphosphate. Alternatively, the components are preferably added as a combination of the phosphoric acid compound and the phosphoric acid. These phosphoric acid compounds exist in a dispersed state as particles in the treatment liquid. Concurrently, the compounds exist in a dispersed state as particles in the film. In this case, the particle diameter significantly influences the film properties; therefore, the compound finely grained imparts the effect of improving the film properties. Ordinarily, particles ranged in diameter from 0.01 to 3 $\mu$m are usable.

The aqueous treatment liquid containing the above-described components is applied onto the steel-sheet surface by using, for example, a roll coater. Then, the coated surface is either heat-cured or cured with hot air, and a film is formed. The film-formation temperature should be higher than 60° C. At a temperature lower than 60° C., residual moisture in the film reduces the corrosion resistance; and consequently, the adhesion of a film is relatively low. Even in a case where the highest-reachable sheet temperature is increased higher than 250° C., the case shows a tendency in which property-improving effects are not recognized, and a film having a reduced corrosion resistance is formed. For these reasons, the curing sheet temperature should be in a range of from 60 to 250° C.

EXAMPLES

Hereinbelow, examples will be described.

With reference to Tables 45 to 47, treatment liquids were adjusted to have predetermined chemical compositions. The adjusted treatment liquids were applied onto surfaces of the plated steel sheets of various types. Then, the surfaces were heat-cured at the highest-reachable sheet temperatures shown in Tables 45 to 47. The steel sheets were thus coated with plating films having the coating weights shown in Tables 45 to 47, and test samples were taken therefrom. The symbols in the "Plating" column in the tables are referred to in the description below. These symbols represent the types of the plated steel sheets as follows:

GI: Molten-Zn-plated steel sheet (plating amount: Z27; sheet thickness: 0.5 mm)

5Al: 5% Al—Zn-alloy-plated steel sheet (plating amount: Y22; sheet thickness: 0.5 mm)

55Al: 55% Al—Zn-alloy-plated steel sheet (plating amount: AZ-150; sheet thickness: 0.5 mm)

Al: Molten-Al-plated steel sheet (plating amount: 200 g/m$^2$; sheet thickness: 0.5 mm) Salt spray testing (JIS Z 2371) was performed to evaluate corrosion resistances of planar portions of the test samples. The evaluation was performed based on the time at which a white-rust developed area reaches at least 10%. In addition, to evaluate processed-portion corrosion resistance, 240-hour salt spray testing was performed for each test sample for which 3T-bending processing was performed. The rust-developed extent was evaluated for the bent portions according to the criteria shown below. Evaluation Criteria for Bent-Portion Corrosion Resistances 10: white-rust developed area less than 10%, black-rust developed area less than 10%; 8: White-rust developed area at least 10% to less than 50%, black-rust developed area less than 10%; 6: White-rust developed area at least 50%, black-rust developed area less than 10%; 4: Black-rust developed area at least 10% to less than 50%; 2: Black-rust developed area at least 50%; and 1: Red rust developed.

For evaluation of the antiblackening resistance, the blackened extent was inspected according to the following criteria after placing the test samples for 24 hours in an environment of 80° C. and 95% RH.

Evaluation Criteria for Blackening-Phenomenon-Resistances

5: No change; 4: Verifiable blacked area less than 25% when diagonally viewed; 3: Verifiable blacked area at least 25% when diagonally viewed; 2: Verifiable blacked area less than 25% when front-viewed; and 1: Verifiable blacked area at least 25% when front-viewed.

For evaluation of the processability, planar-portion sliding was performed in a manner in which a bead having a 1×10 mm planar end was used to press the surface of a 30 mm wide test sample at a predetermined load, and the test sample was slidably drawn in the pressed state at a predetermined speed. The testing was iterated by changing the pressing load, and the evaluation was performed according to a limiting pressing load at which galling occurred on the plating surface The evaluation results are shown in Tables 48 and 49.

TABLE 45

| No. | Plating | Type of resin (Note 1) | Type of chromic acid (Note 2) | Ca additive | Phosphoric-acid additive | Heating temperature (° C.) | Resin coating weight (mg/m²) | Cr coating weight (mg/m²) | Ca/resin (wt/wt) | $PO_4$/resin (wt/wt) | Remarks (Note 3) Film | Remarks (Note 3) Production method |
|---|---|---|---|---|---|---|---|---|---|---|---|---|
| 1 | Gl | AcSt | 30% | — | — | 120 | 1500 | 20 | — | — | Out of range | |
| 2 | Gl | AcSt | 30% | Carbonate | — | 120 | 1500 | 20 | 0.02 | — | Out of range | |
| 3 | Gl | AcSt | 30% | — | Phosphoric acid and zinc phosphate | 120 | 1500 | 20 | — | 0.07 | Out of range | |
| 4 | Gl | AcSt | 30% | Silicate | Ditto | 120 | 1500 | 20 | 0.02 | 0.07 | Within range | Within range |
| 5 | 5Al | AcSt | 30% | — | — | 120 | 1500 | 20 | — | — | Out of range | |
| 6 | 5Al | AcSt | 30% | Carbonate | — | 120 | 1500 | 20 | 0.02 | — | Out of range | |
| 7 | 5Al | AcSt | 30% | — | Phosphoric acid and zinc phosphate | 120 | 1500 | 20 | — | 0.07 | Out of range | |
| 8 | 5Al | AcSt | 30% | Silicte | Ditto | 120 | 1500 | 20 | 0.02 | 0.07 | Within range | Within range |
| 9 | 55Al | AcSt | 30% | — | — | 120 | 1500 | 20 | — | — | Out of range | |
| 10 | 55Al | AcSt | 30% | Carbonate | — | 120 | 1500 | 20 | 0.02 | — | Out of range | |
| 11 | 55Al | AcSt | 30% | — | Phosphoric acid and zinc phosphate | 120 | 1500 | 20 | — | 0.07 | Out of range | |
| 12 | 55Al | AcSt | 30% | Silicate | Ditto | 120 | 1500 | 20 | 0.02 | 0.07 | Within range | Within range |
| 13 | Al | AcSt | 30% | Silicate | Ditto | 120 | 1500 | 20 | 0.02 | 0.07 | Out of range | |

(Note 1) Type of resin: [AcSt]: Acryl-styrene copolymer resin (styrene polymerization ratio: 55%; acid number: 20); [Ac]: Acrylic resin (styrene polymerization ratio: 0%; acid number: 20); [AcSt2]: Acryl-styrene copolymer resin (styrene polymerization ratio: 5%; acid number: 20); [AcSt3]: Acryl-styrene copolymer resin (styrene polymerization ratio: 80%; acid number: 20);
[AcSt4]: Acryl-styrene copolymer resin (styrene polymerization ratio; 30%; acid number: 20); [AcSt5]: Acryl-styrene copolymer resin (styrene polymerization ratio: 55%; acid number: 0); [AcSt6]: Acryl-styrene copolymer resin (styrene polymerization ratio: 30%; acid number: 60)
(Note 2) Type of chromic acid: [30%][60%][95%]: Respectively, 30%, 60%, and 95% reduction anhydrous chromic acid water solutions; [0%]: Anhydrous chromic acid water solution; [Cr acetate]: Cr-acetate reagent water solution; [BaCr]: $BaCrO_4$; [SrCr]: $SrCrO_4$
(Note 3) Remarks: In the production method, "within range/out of range" refers to the case within the range of the fourth Pattern, but out of the rnage in one of the fifth and seventh patterns

TABLE 46

| No. | Plating | Type of resin (Note 1) | Type of chromic acid (Note 2) | Ca additive | Phosphoric-acid additive | Heating temperature (° C.) | Resin coating weight (mg/m²) | Cr coating weight (mg/m²) | Ca/resin (wt/wt) | $PO_4$/resin (wt/wt) | Remarks (Note 3) Products | Remarks (Note 3) Production method |
|---|---|---|---|---|---|---|---|---|---|---|---|---|
| 14 | 55Al | AcSt | 30% | Silicate | Ditto | 120 | 20 | 20 | 0.2 | 0.5 | Out of range | |
| 15 | 55Al | AcSt | 30% | Silicate | Ditto | 120 | 100 | 20 | 0.2 | 0.5 | Within range | Within range |
| 16 | 55Al | AcSt | 30% | Silicate | Ditto | 120 | 3000 | 20 | 0.02 | 0.05 | Within range | Within range |
| 17 | 55Al | AcSt | 30% | Silicate | Ditto | 120 | 6000 | 20 | 0.02 | 0.05 | Out of range | |
| 18 | 55Al | AcSt | 30% | Silicate | Ditto | 120 | 1500 | 0.3 | 0.02 | 0.07 | Out of range | |
| 19 | 55Al | AcSt | 30% | Silicate | Ditto | 120 | 1500 | 60 | 0.02 | 0.07 | Within range | Within range |
| 20 | 55Al | AcSt | 30% | Silicate | Ditto | 120 | 1500 | 150 | 0.02 | 0.07 | Out of range | |
| 21 | 55Al | AcSt | 30% | Silicate | Ditto | 120 | 1500 | 20 | 0.0001 | 0.07 | Out of range | |
| 22 | 55Al | AcSt | 30% | Silicate | Ditto | 120 | 1500 | 20 | 0.005 | 0.07 | Within range | Within range |
| 23 | 55Al | AcSt | 30% | Silicate | Ditto | 120 | 1500 | 20 | 0.1 | 0.07 | Within range | Within range |
| 24 | 55Al | AcSt | 30% | Silicate | Ditto | 120 | 1500 | 20 | 0.3 | 0.07 | Out of range | |
| 25 | 55Al | AcSt | 30% | Silicate | Ditto | 120 | 1500 | 20 | 0.02 | 0.0001 | Out of range | |
| 26 | 55Al | AcSt | 30% | Silicate | Ditto | 120 | 1500 | 20 | 0.02 | 0.01 | Within range | Within range |
| 27 | 55Al | AcSt | 30% | Silicate | Ditto | 120 | 1500 | 20 | 0.02 | 0.3 | Within range | Within range |
| 28 | 55Al | AcSt | 30% | Silicate | Ditto | 120 | 1500 | 20 | 0.02 | 0.7 | Out of range | |

Notes 1 to 3 are the same as those in Table 45.

TABLE 47

| No. | Plating | Type of resin (Note 1) | Type of chromic acid (Note 2) | Ca additive | Phosphoric-acid additive | Heating temperature (° C.) | Resin coating weight (mg/m²) | Cr coating weight (mg/m²) | Ca/resin (wt/wt) | $PO_4$/resin (wt/wt) | Remarks (Note 3) Products | Remarks (Note 3) Production method |
|---|---|---|---|---|---|---|---|---|---|---|---|---|
| 29 | 55Al | AcSt | BaCr | Silicate | Ditto | 120 | 1500 | 20 | 0.02 | 0.07 | Within range | Out of range |
| 30 | 55Al | AcSt | SrCr | Silicate | Ditto | 120 | 1500 | 20 | 0.02 | 0.07 | Within range | Out of range |

TABLE 47-continued

| No. | Plating | Type of resin (Note 1) | Type of chromic acid (Note 2) | Ca additive | Phosphoric-acid additive | Heating temperature (° C.) | Resin coating weight ($mg/m^2$) | Cr coating weight ($mg/m^2$) | Ca/resin (wt/wt) | $PO_4$/resin (wt/wt) | Remarks (Note 3) Products | Remarks (Note 3) Production method |
|---|---|---|---|---|---|---|---|---|---|---|---|---|
| 31 | 55Al | AcSt | 30% | Silicate | Ditto | 40 | 1500 | 20 | 0.02 | 0.07 | Within range | Out of range |
| 32 | 55Al | AcSt | 30% | Silicate | Ditto | 80 | 1500 | 20 | 0.02 | 0.07 | Within range | Within range |
| 33 | 55Al | AcSt | 30% | Silicate | Ditto | 200 | 1500 | 20 | 0.02 | 0.07 | Within range | Within range |
| 34 | 55Al | AcSt | 30% | Silicate | Ditto | 300 | 1500 | 20 | 0.02 | 0.07 | Within range | Out of range |
| 35 | 55Al | AcSt | 0% | Silicate | Ditto | 120 | 1500 | 20 | 0.02 | 0.07 | Within range | Within range/ out of range |
| 36 | 55Al | AcSt | 60% | Silicate | Ditto | 120 | 1500 | 20 | 0.02 | 0.07 | Within range | Within range |
| 37 | 55Al | AcSt | 95% | Silicate | Ditto | 120 | 1500 | 20 | 0.02 | 0.07 | Within range | Within range/ out of range |
| 38 | 55Al | AcSt | Cr acetate | Silicate | Ditto | 120 | 1500 | 20 | 0.02 | 0.07 | Within range | Within range |
| 39 | 55Al | Ac | 30% | Silicate | Zinc phosphate | 120 | 1500 | 20 | 0.02 | 0.07 | Within range | Within range/ out of range |
| 40 | 55Al | AcSt2 | 30% | Silicate | Phosphoric acid and zinc phosphate | 120 | 1500 | 20 | 0.02 | 0.07 | Within range | Within range/ out of range |
| 41 | 55Al | AcSt3 | 30% | Silicate | Ditto | 120 | 1500 | 20 | 0.02 | 0.07 | Within range | Within range/ out of range |
| 42 | 55Al | AcSt4 | 30% | Silicate | Ditto | 120 | 1500 | 20 | 0.02 | 0.07 | Within range | Within range |
| 43 | 55Al | AcSt5 | 30% | Silicate | Ditto | 120 | 1500 | 20 | 0.02 | 0.07 | Within range | Within range/ out of range |
| 44 | 55Al | AcSt6 | 30% | Silicate | Ditto | 120 | 1500 | 20 | 0.02 | 0.07 | Within range | Within range/ out of range |

Notes 1 to 3 are the same as those in Table 45.

TABLE 48

| No. | Planar-portion corrosion resistance Time (hrs) | Processed-portion corrosion resistance | Antiblackening resistance | Processability Load (kgf) | Quality for other aspects | Remarks (Note 1) Film | Remarks (Note 1) Production method |
|---|---|---|---|---|---|---|---|
| 1 | 120 | 6 | 3 | 150 | | Out of range | |
| 2 | 120 | 6 | 4 | 150 | | Out of range | |
| 3 | 120 | 6 | 3 | 150 | | Out of range | |
| 4 | 480 | 8 | 4 | 150 | | Within range | Within range |
| 5 | 240 | 8 | 1 | 150 | | Out of range | |
| 6 | 240 | 8 | 2 | 150 | | Out of range | |
| 7 | 240 | 8 | 1 | 150 | | Out of range | |
| 8 | 600 | 8 | 4 | 150 | | Within range | Within range |
| 9 | 480 | 2 | 5 | 150 | | Out of range | |
| 10 | 480 | 2 | 5 | 150 | | Out of range | |
| 11 | 480 | 2 | 5 | 150 | | Out of range | |
| 12 | 960 | 10 | 5 | 150 | | Within range | Within range |
| 13 | 960 | 1 | 5 | 150 | | Out of range | |
| 14 | 480 | 2 | 5 | <50 | | Out of range | |
| 15 | 480 | 8 | 5 | 100 | | Within range | Within range |
| 16 | 1200 | 10 | 5 | 200 | | Within range | Within range |
| 17 | 1200 | 10 | 5 | 50 | | Out of range | |
| 18 | 72 | 2 | 1 | <50 | | Out of range | |
| 19 | 1200 | 10 | 5 | 200 | | Within range | Within range |
| 20 | 1200 | 10 | 5 | 200 | Appearnace: significant coloration | Out of range | |
| 21 | 480 | 4 | 5 | 150 | | Out of range | |
| 22 | 960 | 8 | 5 | 150 | | Within range | Within range |
| 23 | 960 | 10 | 5 | 150 | | Within range | Within range |
| 24 | 120 | 10 | 5 | 100 | | Out of range | |
| 25 | 480 | 4 | 5 | 150 | | Out of range | |

TABLE 48-continued

| No. | Planar-portion corrosion resistance Time (hrs) | Processed-portion corrosion resistance | Antiblackening resistance | Processability Load (kgf) | Quality for other aspects | Remarks (Note 1) Film | Production method |
|---|---|---|---|---|---|---|---|
| 26 | 960 | 8 | 5 | 150 | | Within range | Within range |
| 27 | 960 | 10 | 5 | 150 | | Within range | Within range |
| 28 | 240 | 4 | 5 | 150 | | Out of range | |

Note 1) Remarks: In the production method, "within range/out of range" refers to the case within the range of the fourth pattern, but out of the range in one of the fifth and seventh patterns.

TABLE 49

| No. | Planar-portion corrosion resistance Time (hrs) | Processed-portion corrosion resistance | Anti-blackening resistance | Processability Load (kgf) | Quality for other aspects | Remarks (Note 1) Film | Production method |
|---|---|---|---|---|---|---|---|
| 29 | 480 | 6 | 3 | 150 | | Within range | Out of range |
| 30 | 480 | 6 | 3 | 150 | | Within range | Out of range |
| 31 | 480 | 8 | 3 | 150 | | Within range | Out of range |
| 32 | 720 | 8 | 4 | 150 | | Within range | Within range |
| 33 | 960 | 10 | 5 | 150 | | Within range | Within range |
| 34 | 480 | 8 | 3 | 150 | | Within range | Out of range |
| 35 | 480 | 10 | 5 | 150 | | Within range | Within range/ out of range |
| 36 | 960 | 10 | 5 | 150 | | Within range | Within range |
| 37 | 480 | 8 | 5 | 150 | Inferior in the treatment-liquid stability | Within range | Within range/ out of range |
| 38 | 720 | 10 | 5 | 150 | | Within range | Within range |
| 39 | 960 | 6 | 5 | 150 | | Within range | Within range/ out of range |
| 40 | 960 | 6 | 5 | 150 | | Within range | Within range/ out of range |
| 41 | 960 | 10 | 5 | 100 | | Within range | Within range/ out of range |
| 42 | 960 | 8 | 5 | 150 | | Within range | Within range |
| 43 | 960 | 10 | 5 | 150 | Somewhat inferior in the treatment-liquid stability | Within range | Within range/ out of range |
| 44 | 960 | 6 | 5 | 100 | | Within range | Within range/ out of range |

Note 1)
Remarks: In the production method, "within range/out of range" refers to the case within the range of the fourth pattern, but out of the range in one of the fifth and seventh patterns.

Item Nos. 1 to 4 individually represent examples each having a film formed on the Al. Item Nos. 5 to 8 individually represent examples each having a film formed on the 55Al. Item No. 13 represents an example each having a film formed on the Al. Items Nos. 4, 8, and 12 represent examples in which films within the range of the present invention are formed on the GI, 5Al, and 55Al, respectively, each of which contains at least 30% Zn. These examples impart the effect of improving the planar-portion corrosion resistance, the antiblackening resistance, and the processed-portion corrosion resistance. These properties correspond to the plating-related problems to be solved with the individual steel sheets. Items Nos. 4, 8, and 12 improves these properties to a level that cannot be achieved with conventional chromate films. Furthermore, the items each have the processability. On the other hand, in item No. 13 that does not contain Zn, red rust developed from a processed film portion. That is, a film having a lower processed-portion corrosion resistance is formed.

Item Nos. 14 to 17 individually represent examples each using the 5Al as the base. These examples were intended to examine the influence of the Cr coating weight. Item Nos. 18 to 20 individually represent examples each using 5Al's as the base. These examples were intended to examine the influence of the Cr coating weight. Item Nos. 21 to 24 individually represent examples each using 5Al's as the base. These examples were intended to examine the influence of the additive/resin. Similarly, item Nos. 25 to 28 individually represent examples each using 5Al's as the base. These examples were intended to examine the influence of the $PO_4$/resin. When the resin coating weight is out of the range of Embodiment 7, the processability is particularly low. When the Cr amount is small, all the properties are low. When an excessive amount of Cr adheres, a film formed has an excellent corrosion resistance, antiblackening resistance, and processability; however, the discoloration is significantly increased to an extent of causing a problem in the visual quality. The addition amounts of Ca and $PO_4$ greatly influence the antiblackening resistance and the corrosion resistance. Therefore, one of them decreases in out of the range of Embodiment 7, and the compatibility thereof is difficult.

Item Nos. 29 to 44 individually represent examples intended to examine the influence of the production method.

Item Nos. 29 and 30 individually represent examples each using chromic acid that is not in a state of aqueous solution. These examples each have a tendency in which the corrosion resistance and the antiblackening resistance are relatively low in comparison to those of item No. 12. Item Nos. 31 to 34 individually represent examples intended to examine the curing temperature. In the example, a tendency is recognized in which the antiblackening resistance decreases at curing temperatures that are out of the range of the present invention. Item Nos. 35 to 37 individually represent examples intended to examine the chromium reduction ratio. In each of these examples, when the reduction ratio is excessively low, the corrosion resistance decreases lower than that in the case where the reduction ratio is within the range of Embodiment 7. Conversely, when the reduction ratio is excessively high, while preferable film properties can be obtained, the treatment liquid is prone to gel. This causes a problem in the liquid stability.

Item No. 38 represents an example in which Cr acetate was used, and a film not containing $Cr^{6+}$ is formed. In this example, high film properties can be obtained, and concurrently, the liquid stability is excellent. Item Nos. 39 to 44 individually represent examples intended to examine the influence of the resin composition. These examples show high processed-portion corrosion resistances in comparison to that in the case of acrylic resin on item No. 39. This is attributable to conditions using an acryl-styrene-type resin having the styrene copolymerization ratio (styrene/organic-resin weight ratio) and the acid number that are within the range of Embodiment 7. Regarding item No. 43, since the acid number is smaller than that within the range of Embodiment 7, the treatment-liquid stability is somewhat reduced.

Embodiment 8

The inventors of the present invention found the following. Through the forming of the film containing the new additive Ca, improvement can be achieved in the corrosion resistance of the zinc-base-plated steel sheet containing at least 30% Al even after the zinc-base-plated steel sheet was worked. Furthermore, the film having the high antiblackening resistance can be formed on the so-called 5% Al-base steel sheet. Still furthermore, for the so-called 55% Al-base steel sheet, the inventors found conditions that enable the formation of the film having a significantly high effect of inhibiting development of black rust in a corrosive environment. The aforementioned black rust can develop in a manner that since the film has a large amount of the Al component and is therefore hard, cracks occur as a result of severe processing, and corrosion develops from the crack portions. Based on the finding, the inventors achieved the present invention. The present invention has the following basic characteristics:

(1) A method for producing a highly-corrosion-resistant surface-treated steel sheet, characterized as follows. Chromate treatment is applied. Then, the chromate-treated surface is applied with a treatment liquid onto a surface of a zinc-base-plated steel sheet that contains at least 30 wt % Zn, and the surface is cured at sheet temperatures ranged from 60 to 250° C. to form a film. The treatment liquid contains a water-soluble or water-dispersible organic resin, water-soluble chromic acid or chromate, a Ca compound, and one or two phosphoric acid compounds selected from zinc phosphate, aluminum phosphate, condensed zinc phosphate, and condensed aluminum phosphate. The film is formed such that the coating weight of the organic resin is in a range of from 50 to 5,000 mg/m$^2$, the coating weight of Cr is in a range of from 1 to 100 mg/m$^2$, the coating weight of Ca is in a range of from 0.001 to 0.2 in a ratio of Ca/organic resin (weight ratio), and the total coating weight of the phosphoric acid or the phosphoric acid compound is in a range of from 0.001 to 0.5 in a ratio of $PO_4$/organic resin (weight ratio). (First Pattern)

(2) The method for producing a highly-corrosion-resistant surface-treated steel sheet according to item (1). The method is characterized in that the zinc-base-plated steel sheet that contains at least 30 wt % Zn is a Zn—Al-alloy-plated steel sheet that contains 1 to 10 wt % Al. (Second Pattern)

(3) The method for producing a highly-corrosion-resistant surface-treated steel sheet according to item (1). The method is characterized in that the zinc-base-plated steel sheet that contains at least 30 wt % Zn is a Zn—Al-alloy-plated steel sheet that contains 40 to 70 wt % Al. (Third Pattern)

Hereinbelow, Embodiment 8 will be described in detail.

(Types of Steel sheets)

In Embodiment 8, the types of the object steel sheets are limited as above for the following reasons. Steel sheets containing less-than-30% Zn are inferior in a sacrificial corrosion resistance of Zn. For this reason, the steel sheets tend to cause red rust that develops as a Fe-corrosion product. The steel sheets of this type allow red rust to develop even from a small defect caused on the film. From the viewpoint of the corrosion resistance of the steel sheet, the steel sheet should contain at least 30% Zn. However, since Zn is inherently active metal, the plating film is apt to corrode, and the amount of Zn should be limited from the viewpoint of long-term durability.

As a mean to improve the durability of the Zn-plated steel sheet, Zn—Al alloy plating was developed and has already been practically employed. Widely used steel sheets of this type include plated steel sheets that each contain Al in a range of from 1 to 10%, and in addition, Mg, MM, or the like that is optionally added depending on the case (the steel sheet hereinbelow will be referred to as a 5% Al-base-plated steel sheet). The steel sheets of the aforementioned type also include the following plated steel sheets. Each of the steel sheet contains Al in a range of from 40 to 70%, Si in a range of from 1 to 3%, and in addition, Ti or the like that is optionally added depending on the case (the steel sheet hereinbelow will be referred to as a 55% Al-base-plated steel sheet). The present invention has an object to improve the corrosion resistance of the aforementioned zinc-base-plated steel sheets that each contain at least 30 wt % Zn. Examples of the corresponding plated steel sheets used in the present markets include electro-Zn-plated steel sheets, molten-Zn-plated steel sheets, 5% Al-base-plated steel sheets, and 55% Al-base-plated steel sheets.

Compared to a Zn-plated steel sheet, while the 5% Al-base-plated steel sheet can be improved in the durability, it exhibits problems in that the surface is blackened in a high-temperature and/or high-humidity environment, and the commercial value thereof is therefore significantly decreases. The present invention improves the antiblackening resistance of the 5% Al-base-plated steel sheet and to thereby solve the above-described problems.

The 55% Al-base-plated steel sheet also exhibits problems. For this steel sheet, the corrosion resistance is improved. However, the film is formed to be hard, cracks occur during processing, and corrosion therefore develops from a processed portion. In addition, since the steel sheet contains much Al, much black rust develops, thereby significantly decreasing the visual quality. The present invention improves the processed-portion black-rust resistance of the 55% Al-base-plated steel sheet and to thereby solve the problems.

In Embodiment 8, when required, each of the individual plated steel sheets may be subjected to a pretreatment such as hot-water rinsing or alkaline degreasing. In addition, depending on the case, the steel sheet may be subjected to a pretreatment for adhering, for example, Ni, Co, and Fe, on the surface thereof.

(Application of Chromate Treatment onto Surface of Plated steel sheet)

Because of the application of the chromate treatment on the surface of the plated steel sheet, the surface is passivated. The passivation enables the corrosion resistance to be significantly improved. The conditions of the chromate treatment are not specifically limited. Ordinarily, the chromate treatment uses a treatment liquid composed such that fluoride, anion, or the like is appropriately added as a reaction accelerator to chromic acid having the Cr reduction ratio of 10 to 40%. After the liquid is applied onto the surface, the surface is cured. Thereby, a film is formed. As the coating weight of the treatment liquid, at least 1 $mg/m^2$ is required to impart the above-described effects. However, application of the liquid in an amount exceeding 100 $mg/m^2$ is not effective to further improve the effects. The application of the excessive amount of the liquid causes discoloration-attributed degradation to become conspicuous in the visual quality. This is not preferable.

(Organic-Film Coating weight: 50 to 5,000 $mg/m^2$)

The plating-surface film is required to contain the organic resin in a range of from 50 to 5,000 $mg/m^2$. The organic resin has the effect of improving the corrosion resistance of a chromate film as well as the effect of preventing processing-attributed surface-damage development. These effects depend on the coating weight. When the organic-resin amount is below 50 $mg/m^2$, corrosion-resistance improving effects are not recognized. When the organic-resin amount is above 5,000 $mg/m^2$, the film peels off during processing. A peeled substance can cause new surface-damage development. The case is therefore not preferable. For these reasons, the organic-resin coating weight should be in a range of from 50 to 5,000 $mg/m^2$. More preferably, the amount should be in a range of from 50 to 2,500 $mg/m^2$.

The organic resin to be used should be either water soluble or water dispersible. The type of the organic resin may be one of resins of an acrylic group, an acryl-styrene group, a urethane group, and a polyester group. However, for the treatment liquid, the resin preferably contains a nonionic-group component to allow stable dispersion together with other components. In addition, from the viewpoint of the corrosion resistance, a water-dispersible resin (emulsion resin) is preferably used instead of the water-soluble resin. Among the aforementioned resins, the acryl-styrene-group resin can be produced by an emulsion polymerization method that is advantageous in cost. Concurrently, the acryl-styrene-group resin is excellent in the corrosion resistance and the processability. In the acryl-styrene-group resin, when a ratio of styrene is below 10%, the corrosion resistance decreases; whereas, when the ratio of styrene is above 70%, the processability decreases. For these reasons, an inexpensive film having a corrosion resistance as well as excellent processability can be formed by using the acryl-styrene-group resin in which a ratio of styrene/organic resin (weight ratio) is in a range of from 0.1 to 0.7. When the acid number is below 1, the stability of the liquid is insufficient. However, when the acid number is above 50, the corrosion resistance decreases. For these reasons, the acid number should be in a range of from 1 to 50. This range enables excellent liquid stability and a high corrosion resistance to be compatibly obtained.

Other elements to be added, such as a dispersion stabilizer or a defoamer, greatly influence film properties (film adhesion, corrosion resistance, antiblackening resistance, water resistance, paint adhesion, slippage resistance, tape adhesion, PEF adhesion, and adhesion to defoamation urethane), liquid composition stability, and mechanical stability. As such, essentially required is to select the elements suitable to the above and other desired properties and usage conditions.

(Ca: 0.001 to 0.2 in Ratio of Ca/Organic Resin (Weight Ratio))

Ca has the effect of improving the corrosion resistance of the chromate film. In addition, Ca has the effect of significantly improving the antiblackening resistance that is the problem specific to the 5% Al-base-plated steel sheet. Furthermore, Ca has the effect of improving the processed-portion corrosion resistance that is the problem specific to the 55% Al-base-plated steel sheet. The effects of Ca are significantly influenced by the ratio to the organic resin. When the ratio of Ca/organic resin is below 0.001, sufficient effects cannot be obtained. When a ratio of Ca/organic resin is above 0.2, sufficient effects cannot be obtained. When a ratio of Ca/organic resin is below 0.001, the processed-portion corrosion resistance and the antiblackening resistance are improved. However, since steel sheet is exposed to in a corrosive environment for a long time, a tendency is recognized in which the corrosion resistance decreases in planar portions. For these reasons, the ratio of Ca/organic resin (weight ratio) should be in a range of from 0.001 to 0.2. More preferably, the ratio should be in a range of from 0.005 to 0.1.

As an adding method of Ca, Ca may be added in a state of a complex salt composed with Ca carbonate, Ca silicate, CaO, or phosphoric acid. However, the above does not limit the present invention. Attention should be directed to that fact that sufficient effects cannot be obtained in a state where the Ca component easily dissolves during film formation. As such, it is important that the additive should be included in the treatment liquid to form a compound that does not easily dissolve in the film. However, Embodiment 8 does not limit the adding method for the Ca compound.

($PO_4$: 0.001 to 0.5 in Ratio of $PO_4$/Organic Resin (Weight Ratio))

$PO_4$ is added for the reason that inclusion of $PO_4$ together with Ca in the chromate film imparts the effect of significantly improving the corrosion resistance and antiblackening resistance of Ca. When the film contains at least 0.001 in the $PO_4$/organic resin, Ca imparts either the corrosion-resistance improving effects or the blackening-phenomenon-resistance improving effects. However, when the ratio of $PO_4$/organic resin is above 0.5, the film is prone to peel off during processing. For this reason, the ratio should be at most 0.5. In the film, $PO_4$ was verified to exist in various states, for example, zinc phosphate, zinc tripolyphosphate, aluminum tripolyphosphate, and condensed phosphoric acid. The present invention is not limited by the existing state of phosphoric acid in the film. However, the present invention is intended such that a preferable state contains zinc phosphate or aluminum tripolyphosphate as a principal component and partially contains condensed phosphoric acid.

(Curing Temperatures)

The aqueous treatment liquid containing the above-described components is applied using a roll coater or the like. Then, heat-curing or hot-air curing is performed to thereby form a film. In this case, the film-formation temperature should be set to 60° C. When the temperature is below 60° C., residual moisture in the film influences the film to be inferior in the corrosion resistance and the adhesion. Even in a case where the highest-reachable sheet temperature is increase higher than 250° C., the case shows a tendency in which property-improving effects are not recognized, and a film having a reduced corrosion resistance is formed. For these reasons, the curing sheet temperatures should be in a range of from 60 to 250° C.

Hereinbelow, example will be described.

As shown in Tables 50 to 51, the chromate treatment was performed for plated steel sheets of various types. Then, the surfaces were individually applied with the treatment liquid containing the organic resin, Ca, and phosphoric acid or a phosphoric-acid group compound. The treatment liquid was adjusted to have the predetermined chemical composition. Subsequently, the surfaces were heat-cured at the highest-reachable sheet temperatures shown in Tables 50 to 51. The steel sheets were thus coated with plating films having the coating weights shown in Tables 50 to 51, and test samples were taken therefrom. The symbols in the "Plating" column in the tables are referred to in the description below. These symbols represent the types of the plated steel sheets as follows:

GI: Molten-Zn-plated steel sheet (plating amount: Z27; sheet thickness: 0.5 mm)

5Al: 5% Al—Zn-alloy-plated steel sheet (plating amount: Y22; sheet thickness: 0.5 mm)

55Al: 55% Al—Zn-alloy-plated steel sheet (plating amount: AZ-150; sheet thickness: 0.5 mm)

Al: Molten-Al-plated steel sheet (plating amount: 200 g/m$^2$; sheet thickness: 0.5 mm)

Salt spray testing (JIS Z 2371) was performed to evaluate corrosion resistances of planar portions of the test samples. The evaluation was performed based on the time at which a white-rust developed area reaches at least 10%. In addition, to evaluate processed-portion corrosion resistance, 240-hour salt spray testing was performed for each test sample for which 3T-bending processing was performed. The rust-developed extent was evaluated for the bent portions according to the criteria shown below. For evaluation of the antiblackening resistance, the blackened extent was inspected according to the following criteria shown below placing the test samples for 24 hours in an environment of 80° C. and 95% RH.

Evaluation Criteria for Bent-Portion Corrosion Resistances

10: white-rust developed area less than 10%, black-rust developed area less than 10%; 8: White-rust developed area at least 10% to less than 50%, black-rust developed area less than 10%; 6: White-rust developed area at least 50%, black-rust developed area less than 10%; 4: Black-rust developed area at least 10% to less than 50%; 2: Black-rust developed area at least 50%; and 1: Red rust developed.

For the evaluation of the antiblackening resistance, the blackened extent was inspected according to the following criteria after placing the test samples for 24 hours in an environment of 80° C. and 95% RH.

Evaluation Criteria for Blackening-Phenomenon-Resistances

5: No change; 4: Verifiable blacked area less than 25% when diagonally viewed; 3: Verifiable blacked area at least 25% when diagonally viewed; 2: Verifiable blacked area less than 25% when front-viewed; and 1: Verifiable blacked area at least 25% when front-viewed.

For evaluation of the processability, planar-portion sliding was performed in a manner in which a bead having a 1×10 mm planar end was used to press the surface of a 30 mm wide test sample at a predetermined load, and the test sample was slidably drawn in the pressed state at a predetermined speed. The testing was iterated by changing the pressing load, and the evaluation was performed according to a limiting pressing load at which galling occurred on the plating surface The evaluation results are shown in Table 52.

TABLE 50

| No. | Plating | Type of resin (Note 1) | Ca additive | Phosphoric-acid additive | Heating temperature (° C.) | Resin coating weight (mg/m$^2$) | Cr coating weight (mg/m$^2$) | Ca/resin wt/wt) | $PO_4$/resin (wt/wt) | Remarks Film |
|---|---|---|---|---|---|---|---|---|---|---|
| 1 | Gl | AcSt | — | — | 120 | 1500 | 20 | — | — | Out of range |
| 2 | Gl | AcSt | Carbonate | — | 120 | 1500 | 20 | 0.02 | — | Out of range |
| 3 | Gl | AcSt | — | Phosphoric acid and zinc phosphate | 120 | 1500 | 20 | — | 0.07 | Out of range |
| 4 | Gl | AcSt | Silicate | Phosphoric acid and zinc phosphate | 120 | 1500 | 20 | 0.02 | 0.07 | Within range |
| 5 | 5Al | AcSt | — | — | 120 | 1500 | 20 | — | — | Out of range |
| 6 | 5Al | AcSt | Carbonate | — | 120 | 1500 | 20 | 0.02 | 0 | Out of range |
| 7 | 5Al | AcSt | — | Phosphoric acid and zinc phosphate | 120 | 1500 | 20 | — | 0.07 | Out of range |
| 8 | 55Al | AcSt | Silicate | Phosphoric acid and zinc phosphate | 120 | 1500 | 20 | 0.02 | 0.07 | Within range |
| 9 | 55Al | AcSt | — | — | 120 | 1500 | 20 | — | — | Out of range |
| 10 | 55Al | AcSt | Carbonate | — | 120 | 1500 | 20 | 0.02 | — | Out of range |
| 11 | 55Al | AcSt | — | Phosphoric acid and zinc phosphate | 120 | 1500 | 20 | — | 0.07 | Out of range |
| 12 | 55Al | AcSt | Silicate | Phosphoric acid and zinc phosphate | 120 | 1500 | 20 | 0.02 | 0.07 | Within range |
| 13 | Al | AcSt | Silicate | Phosphoric acid and zinc phosphate | 120 | 1500 | 20 | 0.02 | 0.07 | Out of range |

(Note 1)

Type of resin: [AcSt]: Acryl-styrene copolymer resin (styrene polymerization ratio: 55%; acid number: 20)

TABLE 51

| No. | Plating | Type of resin (Note 1) | Ca additive | Phosphoric-acid additive | Heating temperature (° C.) | Resin coating weight (mg/m$^2$) | Cr coating weight (mg/m$^2$) | Ca/resin (wt/wt) | $PO_4$/resin (wt/wt) | Remarks Film |
|---|---|---|---|---|---|---|---|---|---|---|
| 14 | 55Al | AcSt | Silicate | " | 120 | 20 | 20 | 0.2 | 0.5 | Out of range |
| 15 | 55Al | AcSt | Silicate | " | 120 | 100 | 20 | 0.2 | 0.5 | Within range |
| 16 | 55Al | AcSt | Silicate | " | 120 | 3000 | 20 | 0.02 | 0.05 | Within range |
| 17 | 55Al | AcSt | Silicate | " | 120 | 6000 | 20 | 0.02 | 0.05 | Out of range |
| 18 | 55Al | AcSt | Silicate | " | 120 | 1500 | 0.3 | 0.02 | 0.07 | Out of range |
| 19 | 55Al | AcSt | Silicate | " | 120 | 1500 | 60 | 0.02 | 0.07 | Within range |
| 20 | 55Al | AcSt | Silicate | " | 120 | 1500 | 150 | 0.02 | 0.07 | Out of range |
| 21 | 55Al | AcSt | Silicate | " | 120 | 1500 | 20 | 0.0001 | 0.07 | Out of range |
| 22 | 55Al | AcSt | Silicate | " | 120 | 1500 | 20 | 0.005 | 0.07 | Within range |
| 23 | 55Al | AcSt | Silicate | " | 120 | 1500 | 20 | 0.1 | 0.07 | Within range |
| 24 | 55Al | AcSt | Silicate | " | 120 | 1500 | 20 | 0.3 | 0.07 | Out of range |
| 25 | 55Al | AcSt | Silicate | " | 120 | 1500 | 20 | 0.02 | 0.0001 | Out of range |
| 26 | 55Al | AcSt | Silicate | " | 120 | 1500 | 20 | 0.02 | 0.01 | Within range |
| 27 | 55Al | AcSt | Silicate | " | 120 | 1500 | 20 | 0.02 | 0.3 | Within range |
| 28 | 55Al | AcSt | Silicate | " | 120 | 1500 | 20 | 0.02 | 0.7 | Out of range |
| 29 | 55Al | AcSt | Silicate | " | 40 | 1500 | 20 | 0.02 | 0.07 | Out of range |
| 30 | 55Al | AcSt | Silicate | " | 80 | 1500 | 20 | 0.02 | 0.07 | Within range |
| 31 | 55Al | AcSt | Silicate | " | 200 | 1500 | 20 | 0.02 | 0.07 | Within range |
| 32 | 55Al | AcSt | Silicate | " | 300 | 1500 | 20 | 0.02 | 0.07 | Out of range |

(Note 1)
Type of resin: [AcSt]: Acryl-styrene copolymer resin (styrene polymerization ratio: 55%; acid number: 20

TABLE 52

| No. | Planar-portion corrosion resistance Time (hrs) | Processed-portion corrosion resistance | Antiblackening resistance | Processability Load (kgf) | Quality for other aspects | Remarks Film |
|---|---|---|---|---|---|---|
| 1 | 120 | 6 | 3 | 150 | | Out of range |
| 2 | 120 | 6 | 4 | 150 | | Out of range |
| 3 | 120 | 6 | 3 | 150 | | Out of range |
| 4 | 480 | 8 | 4 | 150 | | Within range |
| 5 | 240 | 8 | 1 | 150 | | Out of range |
| 6 | 240 | 8 | 2 | 150 | | Out of range |
| 7 | 240 | 8 | 1 | 150 | | Out of range |
| 8 | 600 | 8 | 4 | 150 | | Within range |
| 9 | 480 | 2 | 5 | 150 | | Out of range |
| 10 | 480 | 2 | 5 | 150 | | Out of range |
| 11 | 480 | 2 | 5 | 150 | | Out of range |
| 12 | 960 | 10 | 5 | 150 | | Within range |
| 13 | 960 | 1 | 5 | 150 | | Out of range |
| 14 | 480 | 2 | 5 | <50 | | Out of range |
| 15 | 480 | 8 | 5 | 100 | | Within range |
| 16 | 1200 | 10 | 5 | 200 | | Within range |
| 17 | 1200 | 10 | 5 | 50 | | Out of range |
| 18 | 72 | 2 | 1 | <50 | | Out of range |
| 19 | 1200 | 10 | 5 | 200 | | Within range |
| 20 | 1200 | 10 | 5 | 200 | Appearance: significant coloration | Out of range |
| 21 | 480 | 4 | 5 | 150 | | Out of range |
| 22 | 960 | 8 | 5 | 150 | | Within range |
| 23 | 960 | 10 | 5 | 150 | | Within range |
| 24 | 120 | 10 | 5 | 100 | | Out of range |
| 25 | 480 | 4 | 5 | 150 | | Out of range |
| 26 | 960 | 8 | 5 | 150 | | Within range |
| 27 | 960 | 10 | 5 | 150 | | Within range |
| 28 | 240 | 4 | 5 | 150 | | Out of range |
| 29 | 480 | 8 | 3 | 150 | | Out of range |
| 30 | 720 | 8 | 4 | 150 | | Within range |
| 31 | 960 | 10 | 5 | 150 | | Within range |
| 32 | 480 | 8 | 3 | 150 | | Out of range |

Item Nos. 1 to 4 individually represent examples each having a film formed on the Al. Item Nos. 5 to 8 individually represent examples each having a film formed on the 55Al. Item No. 13 represents an example each having a film formed on the Al. Items Nos. 4, 8, and 12 represent examples in which films of the present invention are formed on the GI, 5Al, and 55Al, respectively, each of which contains at least 30% Zn. These examples impart the effect of improving the planar-portion corrosion resistance, the antiblackening resistance, and the processed-portion corrosion resistance. These properties correspond to the plating-related problems to be solved with the individual steel sheets. Items Nos. 4, 8, and 12 improves these properties to a level that cannot be achieved with conventional chromate films. Furthermore, the items each have the processability. On the other hand, in item No. 13 that does not contain Zn, red rust developed from a processed film portion. That is, a film having a lower processed-portion corrosion resistance is formed.

Item Nos. 14 to 17 individually represent examples each using the 5Al as the base. These examples were intended to examine the influence of the Cr coating weight. Item Nos. 18 to 20 individually represent examples each using 5Al's as the base. These examples were intended to examine the influence of the Cr coating weight. Item Nos. 21 to 24 individually represent examples each using 5Al's as the base. These examples were intended to examine the influence of the additive/resin. Similarly, item Nos. 25 to 28 individually represent examples each using 5Al's as the base. These examples were intended to examine the influence of the $PO_4$/resin. When the resin coating weight is out of the range of the present invention, the processability is particularly low. When the Cr amount is small, all the properties are low. When an excessive amount of Cr adheres, a film formed has an excellent corrosion resistance, antiblackening resistance, and processability; however, the discoloration is significantly increased to an extent of causing a problem in the visual quality. The addition amounts of Ca or $PO_4$ greatly influence the antiblackening resistance and the corrosion resistance. Therefore, one of them decreases in out of the range of the present invention, and the compatibility thereof is difficult.

Item Nos. 29 to 32 individually represent examples intended to examine the influence of the curing temperature. These examples each have a tendency in which the antiblackening resistance is relatively low when the curing temperature is out of the range of Embodiment 8.

Embodiment 9

The inventors of the present invention found the following. Through the forming of the film containing the new additive Ca, improvement can be achieved in the corrosion resistance of the zinc-base-plated steel sheet containing at least 30% Al even after the zinc-base-plated steel sheet was worked. Furthermore, the film having the high antiblackening resistance can be formed on the so-called 5% Al-base steel sheet. Still furthermore, for the so-called 55% Al-base steel sheet, the inventors found conditions that enable the formation of the film having a significantly excellent effect of inhibiting development of black rust in a corrosive environment. The aforementioned black rust can develop in a manner that since the film has a large amount of the Al component and is therefore hard, cracks occur as a result of severe processing, and corrosion develops from the crack portions. Based on the finding, the inventors achieved Embodiment 9. Embodiment 9 has the following basic characteristics:

(1) A highly-corrosion-resistant surface-treated steel sheet characterized as follows. The steel sheet is a zinc-base-plated steel sheet that contains at least 30 wt % Zn and that has a film on a surface thereof. The film contains an organic resin, Cr, and a complex compound containing Ca—$PO_4$—$SiO_2$ as a principal component. The film is formed to satisfy the following conditions. The coating weight of the organic resin is in a range of from 50 to 5,000 mg/m$^2$, the coating weight of Cr is in a range of from 1 to 100 mg/m$^2$, a weight ratio of (Ca+$SiO_2$+$PO_4$)/organic resin is in a range of from 0.01 to 0.5, and a weight ratio of (Ca+$SiO_2$)/$PO_4$ is in a range of from 0.05 to 0.8. (First Pattern)

(2) The highly-corrosion-resistant surface-treated steel sheet according to item (1), characterized in that the zinc-base-plated steel sheet that contains at least 30 wt % Zn is a Zn—Al-alloy-plated steel sheet that contains 1 to 10 wt % Al. (Second Pattern)

(3) The highly-corrosion-resistant surface-treated steel sheet according to item (1), characterized in that the zinc-base-plated steel sheet that contains at least 30 wt % Zn is a Zn—Al-alloy-plated steel sheet that contains 40 to 70 wt % Al. (Third Pattern)

(4) A method for producing one of the surface-treated steel sheets described in items (1) to (3), characterized as follows. The film is formed by application of an aqueous treatment liquid onto the surface of the zinc-base-plated steel sheet that contains at least 30 wt % Zn. The aqueous treatment liquid contains a water-soluble or water-dispersible organic resin, water-soluble chromic acid or chromate, and a complex compound containing Ca—$PO_4$—SiO2 as a principal component. Curing is performed at sheet temperatures in a range of from 60 to 250° C. (Fourth Pattern)

(5) The method for producing the highly-corrosion-resistant surface-treated steel sheet according to item (4), characterized in that a ratio (weight ratio) of $Cr^{3+}/(Cr^{6+}+Cr^{3+})$ in the aqueous treatment liquid is 0.05 to 0.9. (Fifth Pattern)

(6) The method for producing the highly-corrosion-resistant surface-treated steel sheet according to item (4) characterized in that the water-soluble chromate in the aqueous treatment liquid is either $Cr^{3+}$ water-soluble chromic acid or chromic acid. (Sixth Pattern)

(7) The method for producing the highly-corrosion-resistant surface-treated steel sheet according to one of items (5) and (6), characterized as follows. The organic resin in the aqueous treatment liquid is an acryl-styrene copolymer emulsion resin. In the organic resin, a ratio of styrene/organic resin (weight ratio) is in a range of from 0.1 to 0.7, and the acid number is in a range of from 1 to 50. (Seventh Pattern)

Hereinbelow, Embodiment 9 will be described in detail.

In Embodiment 9, the types of the object steel sheets are limited as above for the following reasons. Steel sheets containing less-than-30% Zn are inferior in a sacrificial corrosion resistance of Zn. For this reason, the steel sheets tend to cause red rust that develops as a Fe-corrosion product. The steel sheets of this type allow red rust to develop even from a small defect caused on the film. From the viewpoint of the corrosion resistance of the steel sheet, the steel sheet should contain at least 30% Zn. However, since Zn is inherently active metal, the plating film is apt to corrode, and the amount of Zn should be limited from the viewpoint of long-term durability.

As a mean to improve the durability of the Zn-plated steel sheet, Zn—Al alloy plating was developed and has already been practically employed. Widely used steel sheets of this type include plated steel sheets that each contain Al in a range of from 1 to 10%, and in addition, Mg, MM, or the like that is optionally added depending on the case (the steel sheet hereinbelow will be referred to as a 5% Al-base-plated steel sheet). The steel sheets of the aforementioned type also include the following plated steel sheets. Each of the steel sheets contains Al in a range of from 40 to 70%, Si in a range of from 1 to 3%, and in addition, Ti or the like that is optionally added depending on the case (the steel sheet hereinbelow will be referred to as a 55% Al-base-plated steel sheet). The present invention has an object to improve the corrosion resistance of the aforementioned zinc-base-plated steel sheets that each contain at least 30 wt % Zn. Examples of the corresponding plated steel sheets used in the present markets include electro-Zn-plated steel sheets, molten-Zn-plated steel sheets, 5% Al-base-plated steel sheets, and 55% Al-base-plated steel sheets.

Compared to a Zn-plated steel sheet, while the 5% Al-base-plated steel sheet can be improved in the durability, it exhibits problems in that the surface is blackened in a high-temperature and/or high-humidity environment, and the commercial value thereof is therefore significantly decreases. The present invention improves the antiblackening resistance of the 5% Al-base-plated steel sheet and to thereby solve the above-described problems.

The 55% Al-base-plated steel sheet also exhibits problems. For this steel sheet, the corrosion resistance is improved. However, the film is formed to be hard, cracks occur during processing, and corrosion therefore develops from a processed portion. In addition, since the steel sheet contains much Al, much black rust develops, thereby significantly decreasing the visual quality. The present invention improves the processed-portion black-rust resistance of the 55% Al-base-plated steel sheet and to thereby solve the problems.

In the present invention, when required, each of the individual plated steel sheets may be subjected to a pretreatment such as hot-water rinsing or alkaline degreasing. In addition, depending on the case, the steel sheet may be subjected to a pretreatment for adhering, for example, Ni, Co, and Fe, on the surface thereof.

(Organic-Film Coating weight: 50 to 5,000 Mg/M$^2$)

The plating-surface film is required to contain the organic resin in a range of from 50 to 5,000 mg/m$^2$. The organic resin has the effect of improving the corrosion resistance of a chromate film as well as the effect of preventing processing-attributed surface-damage development. These effects are dependent on the coating weight. When the organic-resin amount is below 50 mg/m$^2$, corrosion-resistance improving effects are not recognized. When the organic-resin amount is above 5,000 mg/m$^2$, the film peels off during processing. A peeled substance can cause new surface-damage development. The case is therefore not preferable. For these reasons, preferably, the organic-resin coating weight should be in a range of from 50 to 5,000 mg/m$^2$. More preferably, the amount should be in a range of from 50 to 2,500 mg/m$^2$.

(Cr Coating weight: 1 to 100 mg/m$^2$)

The film is required to contain Cr in a range of from 1 to 100 mg/m$^2$. In particular, Cr has the effect of forming a stabilized passivation film, thereby improving the corrosion resistance of planar portions and improving the adhesion. Cr is therefore an indispensable component of the film. When Cr is below 1 mg/m$^2$, no improvement effects are recognized for both the corrosion resistance and adhesion. When the Cr coating weight is above 100 mg/m$^2$, the film is prone to peel off in portions in which severe processing is performed. For these reasons, the Cr coating weight should be in a range of from 1 to 100 mg/m$^2$.

(Complex Compound Containing Ca—$PO_4$—$SiO_2$ as Primary Component)

The most significant feature of the present invention is to form the film containing the complex compound that contains Ca—$PO_4$—$SiO_2$ as a principal component. The complex compound may be prepared, for example, as follows. A phosphoric-acid-group compound (such as zinc phosphate, polyphosphoric acid, or aluminum tripolyphosphate) is dispersed in water. In this state, Na silicate and Ca carbonate are appropriately added. As a result, deposit is produced. The deposit is then rinsed, soluble components are removed, and a residue is used as the aforementioned complex compound. The residue is usable that have a mean particle diameter in a range of from 3 to 0.1 $\mu$m. The residue has a tendency in which the smaller the particle diameter, the higher the probability of producing excellent properties. However, the present invention does not limit the production method of the complex compound and the particle diameter. The complex compound is characterized in that the individual components of Ca—$PO_4$—$SiO_2$ exist in a state where they are dispersed in the same position. However, phosphoric acid may also be added for discoloration of the film. A feature in this case is that since the phosphoric acid is distributed to positions different from those of the other components, $PO_4$ is distributed to the vicinities of positions to which most of Ca and $SiO_2$ are distributed.

(($Ca+SiO_2+PO_4$)/Organic Resin (Weight Ratio): 0.01 to 0.5)

The above-described complex compound imparts the effect of significantly improving the corrosion resistance and the antiblackening resistance. However, excessive addition adversely effects to reduce not only the processability, but also the corrosion resistance. When ($Ca+SiO_2+PO_4$)/organic resin is below 0.01, sufficient effects cannot be imparted to improve the corrosion resistance and the antiblackening resistance. When ($Ca+SiO_2+PO_4$)/organic resin is above 0.5, the processability decreases. For these reasons, the ratio of ($Ca+SiO_2+PO_4$)/organic resin should be in a range of from 0.01 to 0.5. More preferably, the ratio should be in a range of from 0.05 to 0.3.

(($Ca+SiO_2$)/$PO_4$ (Weight Ratio): 0.05 to 0.8)

The chemical composition of the captioned complex compound significantly influences the effect of improving the corrosion resistance and the antiblackening resistance. When the ratio of ($Ca+SiO_2$)/$PO_4$ is below, significant effects cannot be obtained for improving the corrosion resistance and the antiblackening resistance. When ($Ca+SiO_2$)/$PO_4$ is above 0.8, the corrosion resistance decreases. For these reasons, the ratio of ($Ca+SiO_2$)/$PO_4$ should be in a range of from 0.05 to 0.8. More preferably, the ratio should be in a range of from 0.1 to 0.5.

(Production Methods)

For producing one of the surface-treated steel sheets described above, the surface of the zinc-base-plated steel sheet containing at least 30% Zn is coated with the above-described aqueous treatment liquid. The aqueous treatment liquid contains the water-soluble or water-dispersible organic resin, and the complex compound containing Ca—$PO_4$—$SiO_2$ as a principal component. Then, curing is performed at a sheet temperature in a ranged of from 60 to 250° C.

Hereinbelow, reasons for performing the above processing will be described.

To form the above-described film, the aqueous treatment liquid to be used is prepared by blending the organic resin, Cr, and Ca—$PO_4$—$SiO_2$-group compound to satisfy a predetermined content ratio.

The organic resin to be used should be either water soluble or water dispersible. The type of the organic resin may be one of resins of an acrylic group, an acryl-styrene group, a urethane group, and a polyester group. However, for the treatment liquid, the resin preferably contains a nonionic-group component to allow stable dispersion together with other components. In addition, from the viewpoint of the corrosion resistance, a water-dispersible resin (emulsion resin) is preferably used instead of the water-soluble resin. Among the aforementioned resins, the acryl-styrene-group resin can be produced by an emulsion polymerization method that is advantageous in cost.

Concurrently, the acryl-styrene-group resin is excellent in the corrosion resistance and the processability. In the acryl-styrene-group resin, when a ratio of styrene is below 10%, the corrosion resistance decreases; whereas, when the ratio of styrene is above 70%, the processability decreases. Accordingly, an inexpensive film having a corrosion resistance as well as excellent processability can be formed by using the acryl-styrene-group resin in which a ratio of styrene/organic resin (weight ratio) is in a range of from 0.1 to 0.7. When the acid number is below 1, the stability of the liquid is insufficient. However, when the acid number is above 50, the corrosion resistance decreases. For these reasons, the acid number should be in a range of from 1 to 50. This range enables excellent liquid stability and a high corrosion resistance to be compatibly obtained.

Other elements to be added, such as a dispersion stabilizer or a defoamer, greatly influence film properties (film adhesion, corrosion resistance, antiblackening resistance, water resistance, paint adhesion, slippage resistance, tape adhesion, PEF adhesion, and adhesion to defoamation urethane), liquid composition stability, and mechanical stability. As such, it is important to select the elements suitable to the above and other desired properties and usage conditions.

As a rust-preventing component, Cr plays an important role. Effects thereof greatly depend on the conditions of Cr in the treatment liquid. To allow Cr to impart rust prevention effects, Cr should be contained in a dissolved state. Suppose a film is formed with treatment liquid to which refractory chromates, such as $ZnCrO_4$, $SrCrO_4$, $BaCrO_4$, $CuCrO_4$, $FeCrO_4$, $Ag_2CrO_4$, and $SnCrO_4$ are added. In this case, the corrosion resistance of the film is low, and concurrently, the adhesion level is low.

Embodiment 9 allows the use one of the following elements as chromic acid. One element is prepared such that, for example, anhydrous chromic acid is dissolved into water, and a part thereof is reduced into $Cr^{3+}$ by using a reducer as well as anion such as phosphoric acid when necessary. Another element is in a state of a soluble $Cr^{3+}$ compound, such as Cr nitrate, Cr sulfate, or Cr acetate; and still another element is in a state of a mixture thereof. When the element is dissolved in liquid, it reacts with or is adsorbed to the plating surface during film formation. At this time, since the surface is stabilized, improvement effects are considered attainable for the corrosion resistance as well as the film adhesion. For the above-described reasons, the treatment liquid should contain the dissolved chromic component.

The ratio (weight ratio) of $Cr^{3+}/(Cr^{6+}+Cr^{3+})$ greatly influences the film properties. When the ratio is set to a range of from 0.05 to 0.9, the film strongly adheres to the plating. This enables the formation of a film that is further improved in the corrosion resistance. However, when the ratio is below 0.05, a film having a lower adhesion is formed. When the ratio is above 0.9, the corrosion resistance decreases. For these reasons, preferably, the ratio (weight ratio) of $Cr^{3+}/(Cr^{6+}+Cr^{3+})$ should be in a range of from 0.05 to 0.9. More preferably, the ratio should be in a range of from 0.2 to 0.6.

Recently, for solving the environmental problems, the trend is growing toward high-evaluation of the formation of films that do not contain $Cr^{6+}$. In conformity to the trend, the present invention enables the formation of films that do not contain $Cr^{6+}$. The mechanism for the above is considered as follows. The Ca compound substitutes $Cr^{6+}$ to impart self-healing effects, thereby enabling a higher corrosion resistance to be produced in comparison to a film formed using $Cr^{3+}$ that does not contain the Ca compound.

Two methods can be used to add the Ca—PO4—SiO2-group compound. In one method, the compound formed in a powder state is added and mixed in the treatment liquid. In the other method, the compound formed in a particle state is firs dispersed in water by using, for example, an activator, and is then added into the treatment liquid. Either one of the method is usable, but the method to predisperse the compound in water is better because the compound is easy to handle, and is therefore advantageous in practical fabrication. An important factor in the latter method is to adjust the particle diameter before addition. Ordinarily, a usable compound has particle diameters ranged from 0.1 to 3 $\mu$m. Regarding the particulate compound, a tendency is recognized in which the smaller the particle diameter, the more significant the effect of improving the corrosion resistance. However, in the form of a film, it is difficult to obtain a mean averaged particle diameter. For this reason, the claims of the present invention do not limit the diameter.

In adding the above-described complex compound, attention should be directed to the fact that an additive causes the pH value of the treatment liquid to vary, thereby causing adverse effects for the composition stability. A pH range of from 1 to 6.5 was already verified as a range necessary to disperse the indispensable component, but the dispersion was difficult in a pH range that is below 1 or in a pH range that is above 7. In addition, sufficient effects cannot be obtained in a state where the Ca component easily dissolves during film formation. It is therefore important that the additive should be included in the treatment liquid to form a compound that does not easily dissolve in the film. However, Embodiment 9 does not limit the composite method for the Ca compound and the solubility of the Ca compound.

The aqueous treatment liquid containing the above-described components is applied onto the steel-sheet surface by using, for example, a roll coater. Then, the coated surface is either heat-cured or cured with hot air, and a film is formed. The film-formation temperature should be higher than 60° C. At a temperature lower than 60° C., residual moisture in the film reduces the corrosion resistance; and consequently, the adhesion of a film is relatively low. Even in a case where the highest-reachable sheet temperature in increased higher than 250° C., the case only shows a tendency in which property-improving effects are not recognized, and a film having a reduced corrosion resistance is formed. For these reasons, the curing sheet temperature should be in a range of from 60 to 250° C.

Hereinbelow, examples will be described.

With reference to Tables 53 to 55, treatment liquids were adjusted to have predetermined compositions. The adjusted treatment liquids were applied onto surfaces of the plated steel sheets of various types. Then, the surfaces were heat-cured at the highest-reachable sheet temperatures shown in Tables 53 to 55. The steel sheets were thus coated with plating films having the coating weights shown in Tables 53 to 55, and test samples were taken therefrom. The symbols in the "Plating" column in the tables are referred to in the description below. These symbols represent the types of the plated steel sheets as follows:

GI: Molten-Zn-plated steel sheet (plating amount: Z27; sheet thickness: 0.5 mm)

5Al: 5% Al—Zn-alloy-plated steel sheet (plating amount: Y22; sheet thickness: 0.5 mm)

55Al: 55% Al—Zn-alloy-plated steel sheet (plating amount: AZ-150; sheet thickness: 0.5 mm)

Al: Molten-Al-plated steel sheet (plating amount: 200 g/m$^2$; sheet thickness: 0.5 mm)

The complex salt shown in Tables 53 to 55 was prepared in the following manner. Zinc phosphate ($Zn_3(PO_4)_2 \cdot 4H_2O$)

was dispersed in water. In this state, Ca carbonate and Na silicate dissolved in dilute nitric acid were added to cause reaction. Deposit produced in the above was then rinsed, soluble components were removed, and a residue was used as the aforementioned complex compound. The ratio between $Ca+SiO_2$ and $PO_4$ was controlled through the amount of zinc phosphate and the addition amounts of the Ca carbonate and the sodium silicate. A ratio of $Ca/SiO_2$ obtained in the above was about 1:2. In addition, the complex compound was adjusted for use to have a mean averaged particle diameter of 0.7 $\mu$m.

Complex corrosion testing (CCT) was performed (one CCT cycle: salt spray testing (30 minutes)→humidity cabinet testing (90 minutes)→air-curing (120 minutes)) to evaluate corrosion resistances of planar portions of the test samples. The evaluation was performed based on the number of cycles at which a white-rust developed area reaches at least 10%. In addition, to evaluate processed-portion corrosion resistance, 50 cycles of the CCTs were performed for each test sample for which 3T-bending processing was performed. The rust-developed extent was evaluated for the bent portions according to the criteria shown below.

Evaluation Criteria for Bent-Portion Corrosion Resistances

10: white-rust developed area less than 10%, black-rust developed area less than 10%; 8: White-rust developed area at least 10% to less than 50%, black-rust developed area less than 10%; 6: White-rust developed area at least 50%, black-rust developed area less than 10%; 4: Black-rust developed area at least 10% to less than 50%; 2: Black-rust developed area at least 50%; and 1: Red rust developed.

For evaluation of the antiblackening resistance, the blackened extent was inspected according to the following criteria after storing the test samples in a stacked state for 480 hours in an environment of 50° C. and 98% RH.

Evaluation Criteria for Blackening-Phenomenon-Resistances

5: No change; 4: Verifiable blacked area less than 25% when diagonally viewed; 3: Verifiable blacked area at least 25% when diagonally viewed; 2: Verifiable blacked area less than 25% when front-viewed; and 1: Verifiable blacked area at least 25% when front-viewed.

For evaluation of the processability, planar-portion sliding was performed in a manner in which a bead having a 1×10 mm planar end was used to press the surface of a 30 mm wide test sample at a predetermined load, and the test sample was slidably drawn in the pressed state at a predetermined speed. The testing was iterated by changing the pressing load, and the evaluation was performed according to a limiting pressing load at which galling occurred on the plating surface The evaluation results are shown in Tables 56 and 67.

TABLE 53

| No. | Plating | Type of resin (Note 1) | Type of chromic acid (Note 2) | Additive (Note 3) | Heating temperature (° C.) | Resin coating weight (mg/m²) | Cr coating weight (mg/m²) | Additive/resin (wt/wt) | $(Ca + SiO_2)/PO_4$ (wt/wt) | Remarks (Note 4) Film | Production method |
|---|---|---|---|---|---|---|---|---|---|---|---|
| 1 | Gl | AcSt | 30% | Ca carbonate | 120 | 1500 | 20 | 0.1 | — | Out of range | |
| 2 | Gl | AcSt | 30% | $SiO_2$ | 120 | 1500 | 20 | 0.1 | — | Out of range | |
| 3 | Gl | AcSt | 30% | Zinc phosphate | 120 | 1500 | 20 | 0.1 | — | Out of range | |
| 4 | Gl | AcSt | 30% | Complex salt | 120 | 1500 | 20 | 0.1 | 0.3 | Within range | Within range |
| 5 | 5Al | AcSt | 30% | Ca carbonate | 120 | 1500 | 20 | 0.1 | — | Out of range | |
| 6 | 5Al | AcSt | 30% | $SiO_2$ | 120 | 1500 | 20 | 0.1 | — | Out of range | |
| 7 | 5Al | AcSt | 30% | Zinc phosphate | 120 | 1500 | 20 | 0.1 | — | Out of range | |
| 8 | 5Al | AcSt | 30% | Complex salt | 120 | 1500 | 20 | 0.1 | 0.3 | Within range | Within range |
| 9 | 55Al | AcSt | 30% | Ca carbonate | 120 | 1500 | 20 | 0.1 | — | Out of range | |
| 10 | 55Al | AcSt | 30% | $SiO_2$ | 120 | 1500 | 20 | 0.1 | — | Out of range | |
| 11 | 55Al | AcSt | 30% | Zinc phosphate | 120 | 1500 | 20 | 0.1 | — | Out of range | |
| 12 | 55Al | AcSt | 30% | Complex salt | 120 | 1500 | 20 | 0.1 | 0.3 | Within range | Within range |
| 13 | Al | AcSt | 30% | Complex salt | 120 | 1500 | 20 | 0.1 | 0.3 | Out of range | |

(Note 1)
Type of resin: [AcSt]: Acryl-styrene copolymer resin (styrene polymerization ratio: 55%; acid number 20); [Ac]: Acrylic resin (styrene polymerization ratio: 0%; acid number: 20): [AcSt2]. Acryl-styrene copolymer resin (styrene polymerization ratio: 5%; acid number: 20); [AcSt3]: Acryl-styrene copolymer resin (styrene polymerization ratio: 80%; acid number: 20); [AcSt4]: Acryl-styrene copolymer resin (styrene polymerization ratio: 30% acid number: 20;[AcSt5]: Acryl-styrene copolymer resin (styrene polymerization ratio: 55%; acid number: 0); [AcSt6]: Acryl-styrene copolymer resin (styrene polymerization ratio: 30%; acid number: 60)
(Note 2)
Type of chromic acid: [30%][60%][95%]: Respectively, 30%, 60%, and 95% reduction anhydrous chromic acid water solutions; [0%]: Anhydrous chromic acid water solution; [Cr acetate]: Cr-acetate regent water solution; [BaCr]: $BaCrO_4$; [SrCr]: $SrCrO_4$
(Note 3)
In the individual aqueous solutions, $PO_4$ equivalent to 1.2 (Wt/Wt) of Cr is added using orthophosphoric acid as an additional additive.
(Note 4)
Remarks: In the production method, "within range/out of range" refers to the case within the range of the fourth Pattern, but out of the range in one of the fifth and seventh patterns

TABLE 54

| No. | Plating | Type of resin (Note 1) | Type of chromic acid (Note 2) | Additive (Note 3) | Heating temperature (° C.) | Resin coating weight (mg/m²) | Cr coating weight (mg/m²) | Additive/resin (wt/wt) | $(Ca + SiO_2)/PO_4$ (wt/wt) | Remarks (Note 4) Film | Production method |
|---|---|---|---|---|---|---|---|---|---|---|---|
| 14 | 55Al | AcSt | 30% | Complex salt | 120 | 20 | 20 | 0.1 | 0.3 | Out of range | |
| 15 | 55Al | AcSt | 30% | Complex salt | 120 | 100 | 20 | 0.1 | 0.3 | Within range | Within range |

TABLE 54-continued

| No. | Plating | Type of resin (Note 1) | Type of chromic acid (Note 2) | Additive (Note 3) | Heating tempera-ture (° C.) | Resin coating weight ($mg/m^2$) | Cr coating weight ($mg/m^2$) | Additive/ resin (wt/wt) | $(Ca + SiO_2)/PO_4$ (wt/wt) | Remarks (Note 4) Film | Production method |
|---|---|---|---|---|---|---|---|---|---|---|---|
| 16 | 55Al | AcSt | 30% | Complex salt | 120 | 3000 | 20 | 0.1 | 0.3 | Within range | Within range |
| 17 | 55Al | AcSt | 30% | Complex salt | 120 | 6000 | 20 | 0.1 | 0.3 | Out of range | |
| 18 | 55Al | AcSt | 30% | Complex salt | 120 | 1500 | 0.3 | 0.1 | 0.3 | Out of range | |
| 19 | 55Al | AcSt | 30% | Complex salt | 120 | 1500 | 60 | 0.1 | 0.3 | Within range | Within range |
| 20 | 55Al | AcSt | 30% | Complex salt | 120 | 1500 | 150 | 0.1 | 0.3 | Out of range | |
| 21 | 55Al | AcSt | 30% | Complex salt | 120 | 1500 | 20 | 0.001 | 0.3 | Out of range | |
| 22 | 55Al | AcSt | 30% | Complex salt | 120 | 1500 | 20 | 0.05 | 0.3 | Within range | Within range |
| 23 | 55Al | AcSt | 30% | Complex salt | 120 | 1500 | 20 | 0.3 | 0.3 | Within range | Within range |
| 24 | 55Al | AcSt | 30% | Complex salt | 120 | 1500 | 20 | 0.7 | 0.3 | Out of range | |
| 25 | 55Al | AcSt | 30% | Complex salt | 120 | 1500 | 20 | 0.1 | 0.01 | Out of range | |
| 26 | 55Al | AcSt | 30% | Complex salt | 120 | 1500 | 20 | 0.1 | 0.1 | Within range | Within range |
| 27 | 55Al | AcSt | 30% | Complex salt | 120 | 1500 | 20 | 0.1 | 0.8 | Within range | |
| 28 | 55Al | AcSt | 30% | Complex salt | 120 | 1500 | 20 | 0.1 | 0.9 | Out of range | |

Notes 1 to 4 are the same as those in Table 53.

TABLE 55

| No. | Plating | Type of resin (Note 1) | Type of chromic acid (Note 2) | Additive (Note 3) | Heating tempera-ture (° C.) | Resin coating weight ($mg/m^2$) | Cr coating weight ($mg/m^2$) | Additive/ resin (wt/wt) | $(Ca + SiO_2)/PO_4$ (wt/wt) | Remarks (Note 4) Film | Production method |
|---|---|---|---|---|---|---|---|---|---|---|---|
| 29 | 55Al | AcSt | BaCr | Complex salt | 120 | 1500 | 20 | 0.1 | 0.3 | Within range | Out of range |
| 30 | 55Al | AcSt | SrCr | Complex salt | 120 | 1500 | 20 | 0.1 | 0.3 | Within range | Out of range |
| 31 | 55Al | AcSt | 30% | Complex salt | 40 | 1500 | 20 | 0.1 | 0.3 | Within range | Out of range |
| 32 | 55Al | AcSt | 30% | Complex salt | 80 | 1500 | 20 | 0.1 | 0.3 | Within range | Within range |
| 33 | 55Al | AcSt | 30% | Complex salt | 200 | 1500 | 20 | 0.1 | 0.3 | Within range | Within range |
| 34 | 55Al | AcSt | 30% | Complex salt | 300 | 1500 | 20 | 0.1 | 0.3 | Within range | Out of range |
| 35 | 55Al | AcSt | 0% | Complex salt | 120 | 1500 | 20 | 0.1 | 0.3 | Within range | Within range/ out of range |
| 36 | 55Al | AcSt | 60% | Complex salt | 120 | 1500 | 20 | 0.1 | 0.3 | Within range | Within range |
| 37 | 55Al | AcSt | 95% | Complex salt | 120 | 1500 | 20 | 0.1 | 0.3 | Within range | Within range/ out of range |
| 38 | 55Al | AcSt | Cr acetate | Complex salt | 120 | 1500 | 20 | 0.1 | 0.3 | Within range | Within range |
| 39 | 55Al | Ac | 30% | Complex salt | 120 | 1500 | 20 | 0.1 | 0.3 | Within range | Within range/ out of range |
| 40 | 55Al | AcSt2 | 30% | Complex salt | 120 | 1500 | 20 | 0.1 | 0.3 | Within range | Within range/ out of range |
| 41 | 55Al | AcSt3 | 30% | Complex salt | 120 | 1500 | 20 | 0.1 | 0.3 | Within range | Within range/ out of range |
| 42 | 55Al | AcSt4 | 30% | Complex salt | 120 | 1500 | 20 | 0.1 | 0.3 | Within range | Within range/ out of range |
| 43 | 55Al | AcSt5 | 30% | Complex salt | 120 | 1500 | 20 | 0.1 | 0.3 | Within range | Within range/ out of range |
| 44 | 55Al | AcSt6 | 30% | Complex salt | 120 | 1500 | 20 | 0.1 | 0.3 | Within range | Within range/ out of range |

Notes 1 to 4 are the same as those in Table 53.

TABLE 56

| No. | Planar-portion corrosion resistance (Number of cycles) | Processed-portion corrosion resistance | Anti-blackening resistance | Processability Load (kgf) | Quality for other aspects | Remarks (Note 1) Film | Production method |
|---|---|---|---|---|---|---|---|
| 1 | 40 | 5 | 3 | 150 | | Out of range | |
| 2 | 40 | 5 | 3 | 150 | | Out of range | |
| 3 | 40 | 5 | 3 | 150 | | Out of range | |
| 4 | 120 | 8 | 5 | 150 | | Within range | Within range |
| 5 | 80 | 6 | 1 | 150 | | Out of range | |
| 6 | 80 | 6 | 1 | 150 | | Out of range | |
| 7 | 80 | 6 | 1 | 150 | | Out of range | |
| 8 | 200 | 8 | 5 | 150 | | Within range | Within range |
| 9 | 120 | 2 | 4 | 150 | | Out of range | |
| 10 | 120 | 2 | 4 | 150 | | Out of range | |
| 11 | 120 | 2 | 4 | 150 | | Out of range | |
| 12 | 360 | 10 | 5 | 150 | | Within range | Within range |

TABLE 56-continued

| No. | Planar-portion corrosion resistance (Number of cycles) | Processed-portion corrosion resistance | Anti-blackening resistance | Processability Load (kgf) | Quality for other aspects | Remarks (Note 1) Film | Production method |
|---|---|---|---|---|---|---|---|
| 13 | 360 | 1 | 5 | 150 | | Out of range | |
| 14 | 120 | 5 | 4 | <50 | | Out of range | |
| 15 | 120 | 8 | 5 | 100 | | Within range | Within range |
| 16 | 360 | 10 | 5 | 200 | | Within range | Within range |
| 17 | 360 | 10 | 5 | 50 | | Out of range | |
| 18 | <40 | 1 | 1 | <50 | | Out of range | |
| 19 | 360 | 10 | 5 | 200 | | Within range | Within range |
| 20 | 360 | 10 | 5 | 200 | Appearance significant coloration | Out of range | |
| 21 | 120 | 2 | 5 | 150 | | Out of range | |
| 22 | 360 | 8 | 5 | 150 | | Within range | Within range |
| 23 | 360 | 10 | 4 | 150 | | Within range | Within range |
| 24 | 40 | 6 | 5 | 50 | | Out of range | |
| 25 | 120 | 2 | 5 | 150 | | Out of range | |
| 26 | 200 | 8 | 5 | 150 | | Within range | Within range |
| 27 | 360 | 10 | 5 | 150 | | Within range | |
| 28 | 120 | 5 | 3 | 150 | | Out of range | |

(Note 1)
Remarks: In the production method, "within range/out of range" refers to the case within the range of the fourth pattern, but out of the range in one of the fifth and seventh patterns.

TABLE 57

| No. | Planar-portion corrosion resistance (Number of cycles) | Processed-portion corrosion resistance | Anti-blackening resistance | Processability Load (kgf) | Quality for other aspects | Remarks (Note 1) Film | Production method |
|---|---|---|---|---|---|---|---|
| 29 | 200 | 7 | 4 | 150 | | Within range | Out of range |
| 30 | 200 | 7 | 4 | 150 | | Within range | Out of range |
| 31 | 200 | 7 | 5 | 150 | | Within range | Out of range |
| 32 | 360 | 8 | 5 | 150 | | Within range | Within range |
| 33 | 360 | 10 | 5 | 150 | | Within range | Within range |
| 34 | 200 | 7 | 4 | 150 | | Within range | Out of range |
| 35 | 200 | 7 | 4 | 125 | | Within range | Within range/ out of range |
| 36 | 360 | 10 | 5 | 150 | | Within range | Within range |
| 37 | 200 | 7 | 4 | 150 | Inferior in the treatment - liquid stability | Within range | Within range/ out of range |
| 38 | 200 | 8 | 4 | 150 | | Within range | Within range |
| 39 | 200 | 7 | 5 | 150 | | Within range | Within range/ out of range |
| 40 | 200 | 7 | 5 | 150 | | Within range | Within range/ out of range |
| 41 | 200 | 10 | 5 | 100 | | Within range | Within range/ out of range |
| 42 | 200 | 8 | 5 | 150 | | Within range | Within range |
| 43 | 200 | 10 | 5 | 150 | Somewhat inferior in the treatment- liquid stability | Within range | Within range/ out of range |
| 44 | 200 | 7 | 5 | 100 | | Within range | Within range/ out of range |

Note 1)
Remarks: In the production method. "within range/out of range" refers to the case within the range of the fourth pattern, but out of the range in one of the fifth and seventh pattern Item Nos. 1 to 4 individually represent examples each having a film formed on the Al. Item Nos. 5 to 8 individually represent examples each having a film formed on the 55Al. Item No. 13 represents an example each having a film formed on the Al. Items Nos. 4, 8, and 12 represent examples in which films within the range of Embodiment 9 are formed on the GI, 5Al, and 55Al, respectively, each of which contains at least 30% Zn. These examples impart the effect of improving the planar-portion corrosion resistance, the antiblackening resistance, and the processed-portion corrosion resistance. These properties correspond to the plating-related problems intended to be solved with the individual steel sheets. Items Nos. 4, 8, and 12 improves these properties to a level that cannot be achieved with conventional chromate films. Furthermore, the items each have the processability. On the other hand, in item No. 13 that does not contain Zn, red rust developed from a processed film portion. That is, a film having a lower processed-portion corrosion resistance is formed.

Item Nos. 14 to 17 individually represent examples each using the 5Al as the base. These examples were intended to examine the influence of the Cr coating weight. Item Nos. 18 to 20 individually represent examples each using 5Al's as the base. These examples were intended to examine the influence of the Cr coating weight. Item Nos. 21 to 24 individually represent examples each using 5Al's as the base. These examples were intended to examine the influence of the additive/resin. Similarly, item Nos. 25 to 28 individually represent examples each using 5Al's as the base. These examples were intended to examine the influence of the $(Ca+SiO_2)/PO_4$ in the additive. When the resin coating weight is out of the range of Embodiment 9, the processability is particularly low. When the Cr amount is small, all the properties are low. When an excessive amount of Cr adheres, a film formed has an excellent corrosion resistance, antiblackening resistance, and processability; however, the discoloration is significantly increased to an extent of causing a problem in the visual quality. The addition amounts of Ca, $PO_4$, and $SiO_2$ greatly influence the antiblackening resistance and the corrosion resistance. Therefore, one of them decreases in out of the range of Embodiment 9, and the compatibility thereof is difficult.

Item Nos. 29 to 44 individually represent examples intended to examine the influence of the production method. Item Nos. 29 and 30 individually represent examples each using chromic acid that is not in a state of aqueous solution. These examples each have a tendency in which the corrosion resistance and the antiblackening resistance are relatively low in comparison to those of item No. 12. Item Nos. 31 to 34 individually represent examples intended to examine the curing temperature. In the example, a tendency is recognized in which the antiblackening resistance decreases at curing temperatures that are out of the range of Embodiment 9. Item Nos. 35 to 37 individually represent examples intended to examine the chromium reduction ratio. In each of these examples, when the reduction ratio is excessively low, the corrosion resistance decreases lower than that in the case where the reduction ratio is within the range of the present invention. Conversely, when the reduction ratio is excessively high, while preferable film properties can be obtained, the treatment liquid is prone to gel. This causes a problem in the liquid stability. Item No. 38 represents an example in which Cr acetate was used, and a film not containing $Cr^{6+}$ is formed. In this example, excellent film properties can be obtained, and concurrently, the liquid stability is excellent. Item Nos. 39 to 44 individually represent examples intended to examine the influence of the resin composition. These examples show high processed-portion corrosion resistances in comparison to that in the case of acrylic resin on item No. 39. This is attributable to conditions using an acryl-styrene-type resin having the styrene copolymerization ratio (styrene/organic-resin weight ratio) and the acid number that are within the range of the present invention. Regarding item No. 43, since the acid number is smaller than that within the range of Embodiment 9, the treatment-liquid stability is somewhat reduced.

Embodiment 10

The inventors of the present invention found the following. Through the forming of the film containing the new additive Ca, improvement can be achieved in the corrosion resistance of the zinc-base-plated steel sheet containing at least 30% Al even after the zinc-base-plated steel sheet was worked. Furthermore, the film having the high antiblackening resistance can be formed on the so-called 5% Al-base steel sheet. Still furthermore, for the so-called 55% Al-base steel sheet, the inventors found conditions that enable the formation of the film having a significantly excellent effect of inhibiting development of black rust in a corrosive environment. The aforementioned black rust can develop in a manner that since the film has a large amount of the Al component and is therefore hard, cracks occur as a result of severe processing, and corrosion develops from the crack portions. Based on the finding, the inventors achieved the present invention. The present invention has the following basic characteristics:

(1) A production method for a highly-corrosion-resistant surface-treated steel sheet, characterized as follows. Chromate treatment is applied onto a surface of a zinc-base-plated steel sheet that contains at least 30 wt % Zn. Then, the chromate-treated surface is applied with a treatment liquid, and the surface is cured at sheet temperatures ranged from 60 to 250° C. to form a film. The treatment liquid contains an organic resin, Cr, and a complex compound containing $Ca—PO_4—SiO_2$ as a principal component. The film is formed such that the coating weight of the organic resin is in a range of from 50 to 5,000 $mg/m^2$, the coating weight of Cr is in a range of from 1 to 100 $mg/m^2$, a weight ratio of $(Ca+SiO_{2+}PO_4)$/organic resin is in a range of from 0.01 to 0.5, and a weight ratio of $(Ca+SiO_2)/PO_4$ is in a range of from 0.05 to 0.8. (First Pattern)

(2) The production method for a highly-corrosion-resistant surface-treated steel sheet according to item (1). The method is characterized in that the zinc-base-plated steel sheet that contains at least 30 wt % Zn is a Zn—Al-alloy-plated steel sheet that contains 1 to 10 wt % Al. (Second Pattern)

(3) The production method for a highly-corrosion-resistant surface-treated steel sheet according to item (1). The method is characterized in that the zinc-base-plated steel sheet that contains at least 30 wt % Zn is a Zn—Al-alloy-plated steel sheet that contains 40 to 70 wt % Al. (Third Pattern)

Hereinbelow, Embodiment 10 will be described in detail.

(Types of Steel sheets)

In Embodiment 10, the types of the object steel sheets are limited as above for the following reasons. Steel sheets containing less-than-30% Zn are inferior in a sacrificial corrosion resistance of Zn. For this reason, the steel sheets tend to cause red rust that develops as a Fe-corrosion product. The steel sheets of this type allow red rust to develop even from a small defect caused on the film. From the viewpoint of the corrosion resistance of the steel sheet, the steel sheet should contain at least 30% Zn. However, since Zn is inherently active metal, the plating film is apt to corrode, and the amount of Zn should be limited from the viewpoint of long-term durability.

As a mean to improve the durability of the Zn-plated steel sheet, Zn—Al alloy plating was developed and has already been practically employed. Widely used steel sheets of this type include plated steel sheets that each contain Al in a range of from 1 to 10%, and in addition, Mg, MM, or the like that is optionally added depending on the case (the steel sheet hereinbelow will be referred to as a 5% Al-base-plated steel sheet). The steel sheets of the aforementioned type also include the following plated steel sheets. Each of the steel sheets each contains Al in a range of from 40 to 70%, Si in a range of from 1 to 3%, and in addition, Ti or the like that is optionally added depending on the case (the steel sheet hereinbelow will be referred to as a 55% Al-base-plated steel sheet). The present invention has an object to improve the corrosion resistance of the aforementioned zinc-base-plated steel sheets that each contain at least 30 wt % Zn. Examples of the corresponding plated steel sheets used in the present markets include electro-Zn-plated steel sheets, molten-Zn-plated steel sheets, 5% Al-base-plated steel sheets, and 55% Al-base-plated steel sheets.

Compared to a Zn-plated steel sheet, while the 5% Al-base-plated steel sheet can be improved in the durability, it exhibits problems in that the surface is blackened in a high-temperature and/or high-humidity environment, and the commercial value thereof is therefore significantly decreases. The Embodiment 10 improves the antiblackening resistance of the 5% Al-base-plated steel sheet and to thereby solve the above-described problems.

The 55% Al-base-plated steel sheet also exhibits problems. For this steel sheet, the corrosion resistance is improved. However, the film is formed to be hard, cracks occurs during processing, and corrosion therefore develops from a processed portion. In addition, since the steel sheet contains much Al, much black rust develops, thereby significantly decreasing the visual quality. The present invention improves the processed-portion black-rust resistance of the 55% Al-base-plated steel sheet and to thereby solve the problems.

In Embodiment 10, when required, each of the individual plated steel sheets may be subjected to a pretreatment such as hot-water rinsing or alkaline degreasing. In addition, depending on the case, the steel sheet may be subjected to a pretreatment for adhering, for example, Ni, Co, and Fe, on the surface thereof.

(Application of Chromate Treatment onto Surface of Plated steel sheet)

Because of the application of the chromate treatment on the surface of the plated steel sheet, the surface is passivated. The passivation enables the corrosion resistance to be significantly improved. The conditions of the chromate treatment are not specifically limited. Ordinarily, the chromate treatment uses a treatment liquid composed such that fluoride, anion, or the like is appropriately added as a reaction accelerator to chromic acid having the Cr reduction ratio of 10 to 40%. After the liquid is applied onto the surface, the surface is cured. Thereby, a film is formed. As the coating weight of the treatment liquid, at least 1 $mg/m^2$ is required to impart the above-described effects. However, application of the liquid in the amount exceeding 100 $mg/m^2$ is not effective to further improve the effects. The application of the excessive amount of the liquid causes discoloration-attributed quality degradation to become conspicuous in the visual quality. This is not preferable.

(Organic-Film Coating weight: 50 to 5,000 $Mg/M^2$)

The plating-surface film is required to contain the organic resin in a range of from 50 to 5,000 $mg/m^2$. The organic resin has the effect of improving the corrosion resistance of a chromate film as well as the effect of preventing processing-attributed surface-damage development. These effects depend on the coating weight. When the organic-resin amount is below 50 $mg/m^2$, corrosion-resistance improving effects are not recognized. When the organic-resin amount is above 5,000 $mg/m^2$, the film peels off during processing. A peeled substance can cause new surface-damage development. The case is therefore not preferable. For these reasons, the organic-resin coating weight should be in a range of from 50 to 5,000 $mg/m^2$. More preferably, the amount should be in a range of from 50 to 2,500 $mg/m^2$.

The organic resin to be used should be either water soluble or water dispersible. The type of the organic resin may be one of resins of an acrylic group, an acryl-styrene group, a urethane group, and a polyester group. However, for the treatment liquid, the resin preferably contains a nonionic-group component to allow stable dispersion together with other components. In addition, from the viewpoint of the corrosion resistance, a water-dispersible resin (emulsion resin) is preferably used instead of the water-soluble resin. Among the aforementioned resins, the acryl-styrene-group resin can be produced by an emulsion polymerization method that is advantageous in cost. Concurrently, the acryl-styrene-group resin is excellent in the corrosion resistance and the processability. In the acryl-styrene-group resin, when a ratio of styrene is below 10%, the corrosion resistance decreases; whereas, when the ratio of styrene is above 70%, the processability decreases. Accordingly, a preferable film can be formed with the acryl-styrene-group resin in which a ratio of styrene/organic resin (weight ratio) is in a range of from 0.1 to 0.7. The film is a cheap and has a corrosion resistance as well as excellent processability. When the acid number is below 1, the stability of the liquid is insufficient. However, when the acid number is above 50, the corrosion resistance decreases. For these reasons, the acid number should be in a range of from 1 to 50. This range enables an excellent liquid stability and a high corrosion resistance to be compatibly obtained.

Other elements to be added, such as a dispersion stabilizer or a defoamer, greatly influence film properties (film adhesion, corrosion resistance, antiblackening resistance, water resistance, paint adhesion, slippage resistance, tape adhesion, PEF adhesion, and adhesion to defoamation urethane), liquid composition stability, and mechanical stability. As such, essentially required is to select the elements suitable to the above and other desired properties and usage conditions.

(Complex Compound Containing $Ca—PO_4—SiO_2$ as Primary Component)

The most significant feature of the present invention is to form the film containing the complex compound that contains $Ca—PO_4—SiO_2$ as a principal component. The complex compound may be prepared, for example, as follows. A phosphoric-acid-group compound (such as zinc phosphate, polyphosphoric acid, or aluminum tripolyphosphate) is dispersed in water. In this state, Ca silicate and Ca nitrate are appropriately added. As a result, deposit is produced. The deposit is then rinsed, soluble components are removed, and a residue is used as the aforementioned complex compound. The residue is usable that have a mean particle diameter in a range of from 3 to 0.1 $\mu$m. The residue has a tendency in which the smaller the particle diameter, the higher the probability of producing excellent properties. However, the present invention does not limit the production method of the complex compound and the particle diameter. The complex compound is characterized in that the individual components of $Ca—PO_4—SiO_2$ exist in a state where they are dispersed in the same position. However, phosphoric acid may also be added to prevent discoloration of the film. A feature in this case is that since the phosphoric acid is distributed to positions different from those of the other components, $PO_4$ is distributed to the vicinities of positions to which most of Ca and $SiO_2$ are distributed.

($(Ca+SiO_2+PO_4)$/Organic Resin: 0.01 to 0.5)

The above-described complex compound imparts the effect of significantly improving the corrosion resistance and the antiblackening resistance. However, excessive addition adversely effects to reduce not only the processability, but also the corrosion resistance. When $(Ca+SiO_2+PO_4)$/organic resin is below 0.01, sufficient effects cannot be imparted to improve the corrosion resistance and the antiblackening resistance. When $(Ca+SiO_2+PO_4)$/organic resin is above 0.5, the processability decreases. For these reasons, the ratio of $(Ca+SiO_2+PO_4)$/organic resin should be in a range of from 0.01 to 0.5. More preferably, the ratio should be in a range of from 0.05 to 0.3.

$((Ca+SiO_2)/PO_4$: 0.05 to 0.8)

The chemical composition of the captioned complex compound significantly influences the effect of improving the corrosion resistance and the antiblackening resistance. When the ratio of $(Ca+SiO_2)/PO_4$ is below, significant effects cannot be obtained for improving the corrosion resistance and the antiblackening resistance. When $(Ca+SiO_2)/PO_4$ is above 0.8, the corrosion resistance decreases. For these reasons, the ratio of $(Ca+SiO_2)/PO_4$ should be in a range of from 0.05 to 0.8. More preferably, the ratio should be in a range of from 0.1 to 0.5.

(Curing Temperatures)

The aqueous treatment liquid containing the above-described components is applied using a roll coater or the like. Then, heat-curing or hot-air curing is performed to thereby form a film. In this case, the film-formation temperature should be set to 60° C. When the temperature is below 60° C., residual moisture in the film influences the film to be inferior in the corrosion resistance and the adhesion. Even in a case where the highest-reachable sheet temperature is increase higher than 250° C., the case shows a tendency in which property-improving effects are not recognized, and a film having a reduced corrosion resistance is formed. For these reasons, the curing sheet temperatures should be in a range of from 60 to 250° C.

Hereinbelow, examples will be described.

As shown in Tables 58 to 59, the chromate treatment was performed for plated steel sheets of various types. Then, the surfaces were individually applied with the treatment liquid containing the organic resin and the complex compound that contains Ca—$PO_4$—$SiO_2$ as a principal component. The treatment liquid was adjusted to have the predetermined chemical composition. Subsequently, the surfaces were heat-cured at the highest-reachable sheet temperatures shown in Tables 58 to 59. The steel sheets were thus coated with plating films having the coating weights shown in Tables 58 to 59, and test samples were taken therefrom. The symbols in the "Plating" column in the tables are referred to in the description below. These symbols represent the types of the plated steel sheets as follows:

GI: Molten-Zn-plated steel sheet (plating amount: Z27; sheet thickness: 0.5 mm)

5Al: 5% Al—Zn-alloy-plated steel sheet (plating amount: Y22; sheet thickness: 0.5 mm)

55Al: 55% Al—Zn-alloy-plated steel sheet (plating amount: AZ-150; sheet thickness: 0.5 mm)

Al: Molten-Al-plated steel sheet (plating amount: 200 $g/m^2$; sheet thickness: 0.5 mm)

The complex salt shown in Tables 58 to 59 was prepared in the following manner. In a state where zinc phosphate $(Zn_3(PO_4)_2 \cdot 4H_2O)$ was dispersed in water, Ca nitrate and Na silicate are added to cause reaction. Deposit produced in the above was then rinsed, soluble components were removed, and a residue was used as the aforementioned complex compound. The ratio between $Ca+SiO_2$ and $PO_4$ was controlled through the amount of zinc phosphate and the addition amounts of the Ca carbonate and the sodium silicate. A ratio of $Ca/SiO_2$ obtained in the above was about 1:2. In addition, the complex compound was adjusted for use to have a mean averaged particle diameter of 0.7 $\mu$m.

Complex corrosion testing (CCT) was performed (one CCT cycle: salt spray testing (30 minutes)→humidity cabinet testing (90 minutes)→air-curing (120 minutes)) to evaluate corrosion resistances of planar portions of the test samples. The evaluation was performed based on the number of cycles at which a white-rust developed area reaches at least 10%. In addition, to evaluate processed-portion corrosion resistance, 50 cycles of the CCTs were performed for each test sample for which 3T-bending processing was performed. The rust-developed extent was evaluated for the bent portions according to the criteria shown below.

Evaluation Criteria for Bent-Portion Corrosion Resistances

10: white-rust developed area less than 10%, black-rust developed area less than 10%; 8: White-rust developed area at least 10% to less than 50%, black-rust developed area less than 10%; 6: White-rust developed area at least 50%, black-rust developed area less than 10%; 4: Black-rust developed area at least 10% to less than 50%; 2: Black-rust developed area at least 50%; and 1: Red rust developed.

For evaluation of the antiblackening resistance, the blackened extent was inspected according to the following criteria after storing the test samples in a stacked state for 480 hours in an environment of 50° C. and 98% RH.

Evaluation Criteria for Blackening-Phenomenon-Resistances

5: No change; 4: Verifiable blacked area less than 25% when diagonally viewed; 3: Verifiable blacked area at least 25% when diagonally viewed; 2: Verifiable blacked area less than 25% when front-viewed; and 1: Verifiable blacked area at least 25% when front-viewed.

For evaluation of the processability, planar-portion sliding was performed in a manner in which a bead having a 1×10 mm planar end was used to press the surface of a 30 mm wide test sample at a predetermined load, and the test sample was slidably drawn in the pressed state at a predetermined speed. The testing was iterated by changing the pressing load, and the evaluation was performed according to a limiting pressing load at which galling occurred on the plating surface The evaluation results are shown in Table 60.

TABLE 58

| No. | Plating | Type of resin (Note 1) | Additive | Heating temperature (° C.) | Resin coating weight ($mg/m^2$) | Cr adhesion amount ($mg/m^2$) | Additive/resin (wt/wt) | $(Ca + SiO_2)/PO_4$ (wt/wt) | Remarks Film |
|---|---|---|---|---|---|---|---|---|---|
| 1 | Gl | AcSt | Ca carbonate | 120 | 1500 | 20 | 0.1 | — | Out of range |
| 2 | Gl | AcSt | $SiO_2$ | 120 | 1500 | 20 | 0.1 | — | Out of range |
| 3 | Gl | AcSt | Zinc phosphate | 120 | 1500 | 20 | 0.1 | — | Out of range |
| 4 | Gl | AcSt | Complex salt | 120 | 1500 | 20 | 0.1 | 0.3 | Within range |
| 5 | 5Al | AcSt | Ca carbonate | 120 | 1500 | 20 | 0.1 | — | Out of range |
| 6 | 5Al | AcSt | $SiO_2$ | 120 | 1500 | 20 | 0.1 | — | Out of range |
| 7 | 5Al | AcSt | Zinc phosphate | 120 | 1500 | 20 | 0.1 | — | Out of range |
| 8 | 5Al | AcSt | Complex salt | 120 | 1500 | 20 | 0.1 | 0.3 | Within range |
| 9 | 55Al | AcSt | Ca carbonate | 120 | 1500 | 20 | 0.1 | — | Out of range |

TABLE 58-continued

| No. | Plating | Type of resin (Note 1) | Additive | Heating temperature (° C.) | Resin coating weight ($mg/m^2$) | Cr adhesion amount ($mg/m^2$) | Additive/resin (wt/wt) | $(Ca + SiO_2)/PO_4$ (wt/wt) | Remarks Film |
|---|---|---|---|---|---|---|---|---|---|
| 10 | 55Al | AcSt | $SiO_2$ | 120 | 1500 | 20 | 0.1 | — | Out of range |
| 11 | 55Al | AcSt | Zinc phosphate | 120 | 1500 | 20 | 0.1 | — | Out of range |
| 12 | 55Al | AcSt | Complex salt | 120 | 1500 | 20 | 0.1 | 0.3 | Within range |
| 13 | Al | AcSt | Complex salt | 120 | 1500 | 20 | 0.1 | 0.3 | Out of range |

(Note 1)
Type of resin: [AcSt]: Acryl-styrene copolymer resin (styrene polymerization ratio: 55%; acid number: 20)

TABLE 59

| No. | Plating | Type of resin (Note 1) | Additive | Heating temperature (° C.) | Resin coating weight ($mg/m^2$) | Cr adhesion amount ($mg/m^2$) | Additive/resin (wt/wt) | $(Ca + SiO_2)/PO_4$ (wt/wt) | Remarks Film |
|---|---|---|---|---|---|---|---|---|---|
| 14 | 55Al | AcSt | Complex salt | 120 | 20 | 20 | 0.1 | 0.3 | Out of range |
| 15 | 55Al | AcSt | Complex salt | 120 | 100 | 20 | 0.1 | 0.3 | Within range |
| 16 | 55Al | AcSt | Complex salt | 120 | 3000 | 20 | 0.1 | 0.3 | Within range |
| 17 | 55Al | AcSt | Complex salt | 120 | 6000 | 20 | 0.1 | 0.3 | Out of range |
| 18 | 55Al | AcSt | Complex salt | 120 | 1500 | 0.3 | 0.1 | 0.3 | Out of range |
| 19 | 55Al | AcSt | Complex salt | 120 | 1500 | 60 | 0.1 | 0.3 | Within range |
| 20 | 55Al | AcSt | Complex salt | 120 | 1500 | 150 | 0.1 | 0.3 | Out of range |
| 21 | 55Al | AcSt | Complex salt | 120 | 1500 | 20 | 0.001 | 0.3 | Out of range |
| 22 | 55Al | AcSt | Complex salt | 120 | 1500 | 20 | 0.05 | 0.3 | Within range |
| 23 | 55Al | AcSt | Complex salt | 120 | 1500 | 20 | 0.3 | 0.3 | Within range |
| 24 | 55Al | AcSt | Complex salt | 120 | 1500 | 20 | 0.7 | 0.3 | Out of range |
| 25 | 55Al | AcSt | Complex salt | 120 | 1500 | 20 | 0.1 | 0.01 | Out of range |
| 26 | 55Al | AcSt | Complex salt | 120 | 1500 | 20 | 0.1 | 0.1 | Within range |
| 27 | 55Al | AcSt | Complex salt | 120 | 1500 | 20 | 0.1 | 0.6 | Within range |
| 28 | 55Al | AcSt | Complex salt | 120 | 1500 | 20 | 0.1 | 0.9 | Out of range |
| 29 | 55Al | AcSt | Complex salt | 40 | 1500 | 20 | 0.1 | 0.3 | Out of range |
| 30 | 55Al | AcSt | Complex salt | 80 | 1500 | 20 | 0.1 | 0.3 | Within range |
| 31 | 55Al | AcSt | Complex salt | 200 | 1500 | 20 | 0.1 | 0.3 | Within range |
| 32 | 55Al | AcSt | Complex salt | 300 | 1500 | 20 | 0.1 | 0.3 | Out of range |

Note 1) Type of resin: [AcSt]: Acryl-styrene copolymer resin (styrene polymerization ratio: 55%; acid number: 20)

TABLE 60

| No. | Planar-portion corrosion resistance (Number of cycles) | Processed-portion corrosion resistance | Antiblackening resistance | Processability Load (kgf) | Quality for other aspects | Remarks Film |
|---|---|---|---|---|---|---|
| 1 | 40 | 5 | 3 | 150 | | Out of range |
| 2 | 40 | 5 | 3 | 150 | | Out of range |
| 3 | 40 | 5 | 3 | 150 | | Out of range |
| 4 | 120 | 8 | 5 | 150 | | Within range |
| 5 | 80 | 6 | 1 | 150 | | Out of range |
| 6 | 80 | 6 | 1 | 150 | | Out of range |
| 7 | 80 | 6 | 1 | 150 | | Out of range |
| 8 | 200 | 8 | 5 | 150 | | Within range |
| 9 | 120 | 2 | 4 | 150 | | Out of range |
| 10 | 120 | 2 | 4 | 150 | | Out of range |
| 11 | 120 | 2 | 4 | 150 | | Out of range |
| 12 | 360 | 10 | 5 | 150 | | Within range |
| 13 | 360 | 1 | 5 | 150 | | Out of range |
| 14 | 120 | 5 | 4 | <50 | | Out of range |
| 15 | 120 | 8 | 5 | 100 | | Within range |
| 16 | 360 | 10 | 5 | 200 | | Within range |
| 17 | 360 | 10 | 5 | 50 | | Out of range |
| 18 | <40 | 1 | 1 | <50 | | Out of range |
| 19 | 360 | 10 | 5 | 200 | | Within range |
| 20 | 360 | 10 | 5 | 200 | Appearance: significant coloration | Out of range |
| 21 | 120 | 2 | 5 | 150 | | Out of range |
| 22 | 360 | 8 | 5 | 150 | | Within range |
| 23 | 360 | 10 | 4 | 150 | | Within range |
| 24 | 40 | 6 | 5 | 50 | | Out of range |
| 25 | 120 | 2 | 5 | 150 | | Out of range |
| 26 | 200 | 8 | 5 | 150 | | Within range |
| 27 | 360 | 10 | 5 | 150 | | Within range |
| 28 | 120 | 5 | 3 | 150 | | Out of range |
| 29 | 200 | 7 | 5 | 150 | | Out of range |

TABLE 60-continued

| No. | Planar-portion corrosion resistance (Number of cycles) | Processed-portion corrosion resistance | Antiblackening resistance | Processability Load (kgf) | Quality for other aspects | Remarks Film |
|---|---|---|---|---|---|---|
| 30 | 360 | 8 | 5 | 150 | | Within range |
| 31 | 360 | 10 | 5 | 150 | | Within range |
| 32 | 200 | 7 | 4 | 150 | | Out of range |

Item Nos. 1 to 4 individually represent examples each having a film formed on the Al. Item Nos. 5 to 8 individually represent examples each having a film formed on the 55Al: Item No. 13 represents an example each having a film formed on the Al. Items Nos. 4, 8, and 12 represent examples in which films of Embodiment 10 are formed on the GI, 5Al, and 55Al, respectively, each of which contains at least 30% Zn. These examples impart the effect of improving the planar-portion corrosion resistance, the antiblackening resistance, and the processed-portion corrosion resistance. These properties correspond to the plating-related problems intended to be solved with the individual steel sheets. Items Nos. 4, 8, and 12 improves these properties to a level that cannot be achieved with conventional chromate films. Furthermore, the items each have the processability. On the other hand, in item No. 13 that does not contain Zn, red rust developed from a processed film portion. That is, a film having a lower processed-portion corrosion resistance is formed.

Item Nos. 14 to 17 individually represent examples each using the 5Al as the base. These examples were intended to examine the influence of the Cr coating weight. Item Nos. 18 to 20 individually represent examples each using 5Al's as the base. These examples were intended to examine the influence of the Cr coating weight. Item Nos. 21 to 24 individually represent examples each using 5Al's as the base. These examples were intended to examine the influence of the additive/resin. Similarly, item Nos. 25 to 28 individually represent examples each using 5Al's as the base. These examples were intended to examine the influence of the $(Ca+SiO_2)/PO_4$. When the resin coating weight is out of the range of the present invention, the processability is particularly low. When the Cr amount is small, all the properties are low. When an excessive amount of Cr adheres, a film formed has an excellent corrosion resistance, antiblackening resistance, and processability; however, the discoloration is significantly increased to an extent of causing a problem in the visual quality. The addition amounts of Ca or $PO_4$ greatly influence the antiblackening resistance and the corrosion resistance. Therefore, one of them decreases in out of the range of Embodiment 10, and the compatibility thereof is difficult.

Item Nos. 29 to 32 individually represent examples intended to examine the influence of the curing temperature. These examples each have a tendency in which the antiblackening resistance is relatively low when the curing temperature is out of range of Embodiment 10.

What is claimed is:

1. A surface-treated steel sheet comprising:

a steel sheet;

an Al—Zn-base alloy plating layer formed on said steel sheet;

a chemical conversion film provided on said alloy plating layer;

a concentric layer of a Cr compound that is formed on said alloy plating layer of said chemical conversion film;

said alloy plating layer containing Al in an amount of from 20 to 75%;

said chemical conversion film being formed by applying a chemical treatment liquid comprising principal components of an aqueous organic resin and chromic acid, the chemical conversion film having a weight ratio of resin/Cr in a range of from 20 to 200, and a coating weight of the Cr in a range of from 3 to 50 $mg/m^2$ (as converted to metallic chromium); and said concentric layer containing a Cr compound in a ratio of resin/Cr that is below 0.8 times a mean ratio of resin/Cr in the chemical conversion film.

2. The surface-treated steel sheet of claim 1, wherein the chemical conversion film is formed by applying a chemical treatment liquid comprising principal components of an aqueous organic resin, chromic acid, and phosphoric acid; and the chemical conversion film has a weight ratio of resin/Cr in a range of from 20 to 200, a weight ratio of $PO_4/Cr$ in a range of from 0.5 to 4.0, and the coating weight of the Cr in a range of from 3 to 50 $mg/m^2$ (as converted to metallic chromium).

3. The surface-treated steel sheet of claim 1, wherein the Al—Zn-base alloy plating layer is formed of a phase (phase A) comprising a principal component of Al and a phase (phase B) comprising a principal component of Zn; and the Al—Zn-base alloy plating layer has an area ratio of B/(A+B) of the phase (phase B) on the plating surface in a range of from 0.1 to 0.6.

4. The surface-treated steel sheet of claim 3, wherein in said concentric layer of the Cr compound, the thickness of a portion existing in an upper layer of the phase (phase B) comprising the principal component of Zn is greater than the thickness of a portion existing in an upper layer of the phase A comprising the principal component of Al.

5. The surface-treated steel sheet of claim 2, wherein the phosphoric acid is concentrated in said concentric layer of the Cr compound such that mean $PO_4/Cr$ of said concentric layer of the Cr compound is at least 1.01 with respect to a mean $PO_4/Cr$ of said chemical conversion film.

6. A surface-treated steel sheet comprising:

a steel sheet;

a zinc-base plating layer formed on said steel sheet; and a film formed on said zinc-base plating layer, the film containing chromium in an amount of from 0.1 to 100 $mg/m^2$ and calcium in an amount of from 0.1 to 200 $mg/m^2$, the film being formed by using a treatment liquid including a water-soluble chromium compound.

7. The surface-treated steel sheet of claim 6, wherein said zinc-base plating layer is a Zn—Al-base plating layer containing aluminum in an amount of from 4 to 25 weight percent.

8. The surface-treated steel sheet of claim 6, wherein said zinc-base plating layer is a Zn—Al-base plating layer containing aluminum 25 to 75 wt %.

9. A method for producing the surface-treated steel sheet as defined in claim 6, comprising the steps of:

(a) preparing a treatment liquid including a water-soluble chromium compound, calcium or a compound of the calcium, the treatment liquid comprising hexavalent chromium ions in a range of from 0.1 to 50 g/l and calcium in a range of from 1 to 50 g/l;

(b) applying the treatment liquid onto a surface of a zinc-base-plated steel sheet; and (c) heating at a highest-reachable sheet temperature in a range of from 60 to 300° C. without performing rinsing to form a film.

10. The method of claim 9, wherein the treatment liquid has a weight ratio of trivalent chromium ions/(trivalent chromium ions+hexavalent chromium ions) in a range of from 0.2 to 0.8.

11. A method for producing the surface-treated steel sheet as defined in claim 6, comprising the steps of:

(a) preparing a treatment liquid including a water-soluble chromium compound wherein a chromium compound comprises a trivalent-chromium compound, and calcium or a compound of the calcium, the treatment liquid containing trivalent chromium ions in a range of from 0.1 to 50 g/l and calcium in a range of from 1 to 50 g/l;

(b) applying the treatment liquid onto a surface of a zinc-base-plated steel sheet; and (c) heating the zinc-base-plated steel sheet at a highest-reachable sheet temperature in a range of from 60 to 300° C. without performing rinsing to form a film.

12. The method of claim 11, wherein the water-soluble chromium compound is chromium carboxylate.

13. A surface-treated steel sheet having antiblackening resistance, comprising:

a steel sheet;

a zinc-base plating layer formed on said steel sheet, said zinc-base plating layer being a Zn—Al-base plating layer containing aluminum in an amount of from 25 to 75 wt %; and a film formed on said zinc-base plating layer, said film containing chromium in an amount of 0.1 to 100 mg/m$^2$ and a compound in an amount of 0.1 to 100 mg/m$^2$ as converted to phosphorus, said compound containing phosphoric acid and at least one element selected from the group consisting of zinc and aluminum, the film being formed by using a treatment liquid including a water-soluble chromium compound.

14. A method for producing the surface-treated steel sheet as defined in claim 13, comprising the steps of:

(a) preparing a treatment liquid including a water-soluble chromium compound, and phosphoric acid or salt of the phosphoric acid, the treatment liquid comprising hexavalent chromium ions in a range of from 0.1 to 50 g/l and phosphoric acid in a range of from 1 to 50 g/l;

(b) applying the treatment liquid onto a surface of a zinc-base-plated steel sheet; and (c) heating the zinc-base-plated steel sheet at a highest-reachable sheet temperature in a range of from 60 to 300° C. without performing rinsing to form a film.

15. The method of claim 14, wherein a weight ratio of trivalent chromium ions/(trivalent chromium ions+hexavalent chromium ions) in the treatment liquid is in a range of from 0.2 to 0.8.

16. A method for producing the surface-treated steel sheet as defined in claim 13, comprising the steps of:

(a) preparing a treatment liquid including a water-soluble chromium compound wherein a chromium compound comprises a trivalent-chromium compound, and phosphoric acid or salt of the phosphoric acid, the treatment liquid comprising trivalent chromium ions in a range of from 0.1 to 50 g/l and phosphoric acid in a range of from 1 to 50 g/l;

(b) applying the treatment liquid onto a surface of a zinc-base-plated steel sheet; and (c) heating said zinc-base-plated steel sheet at a highest-reachable sheet temperature in a range of from 60 to 300° C. without performing rinsing to form a film.

17. The method of claim 16, wherein the water-soluble chromium compound is chromium carboxylate.

18. A surface-treated steel sheet, comprising:

a steel sheet;

a zinc-base plating layer formed on said steel sheet; and a film formed on said zinc-base plating layer, said film including chromium in a range of from 0.1 to 100 mg/m$^2$, calcium in a range of from 1 to 200 mg/m$^2$, and a compound in a range of from 0.1 to 100 mg/m$^2$ as converted to phosphorus, said compound containing phosphoric acid and at least one selected from the group consisting of zinc and aluminum, the film being formed by using a treatment liquid including a water-soluble chromium compound.

19. The surface-treated steel sheet of claim 18, wherein said zinc-base plating layer is a Zn—Al-base plating layer including aluminum in an amount of from 4 to 25 wt %.

20. The surface-treated steel sheet of claim 18, wherein said zinc-base plating layer is a Zn—Al-base plating layer including in an amount of from 25 to 75 wt %.

21. A method for producing the surface-treated steel sheet as defined in claim 18, comprising the steps of:

(a) preparing a treatment liquid including a water-soluble chromium compound, calcium or a compound of the calcium, phosphoric acid or salt of the phosphoric acid, said treatment liquid containing hexavalent chromium ions in an amount of from 0.1 to 50 g/l, calcium in an amount of from 1 to 50 g/l, and phosphoric acid in an amount of from 1 to 50 g/l;

(b) applying the treatment liquid onto a surface of a zinc-base-plated steel sheet; and (c) heating the zinc-base-plated steel sheet at a highest-reachable sheet temperature in a range of from 60 to 300° C. without performing rinsing to form a film.

22. The method of claim 21, wherein a weight ratio of trivalent chromium ions/(trivalent chromium ions+hexavalent chromium ions) in the treatment liquid is in a range of from 0.2 to 0.8.

23. A method for producing the surface-treated steel sheet as defined in claim 18, comprising the steps of:

(a) preparing a treatment liquid including a water-soluble chromium compound wherein a chromium compound is composed of a trivalent-chromium compound, calcium or a compound thereof, and phosphoric acid or salt thereof, said treatment liquid comprising trivalent chromium ions in an amount of from 0.1 to 50 g/l, calcium in an amount of from 1 to 50 g/l, and phosphoric acid in an amount of from 1 to 50 g/l;

(b) applying the treatment liquid onto a surface of a zinc-base-plated steel sheet; and (c) heating the zinc-base-plated steel sheet at a highest-reachable sheet temperature in a range of from 60 to 300° C. without performing rinsing to form a film.

24. The method of claim 23, wherein the water-soluble chromium compound is chromium carboxylate.

25. A surface-treated steel sheet, comprising:

a steel sheet;

a zinc-base plating layer formed on said steel sheet, said zinc-base plating layer including 30 wt % zinc; and a film formed on said zinc-base plating layer, said film including an organic resin, Cr, Ca, and silica or a silica-group compound, the coating weight of the organic resin being in a range of from 50 to 5,000 $mg/m^2$, the coating weight of the Cr being in a range of from 1 to 100 $mg/m^2$, the coating weight of the Ca being in a range of from 0.001 to 0.2 in Ca/organic resin (weight ratio), and the coating weight of the silica or the silica-group compound being in a range of from 0.001 to 0.5 in $SiO_2$/organic resin (weight ratio), the film being formed by using a treatment liquid including a water-soluble chromium compound.

26. The surface-treated steel sheet of claim 25, wherein said zinc-base plating layer is a Zn—Al-base plating layer containing Al in an amount of from 4 to 25 wt %.

27. The surface-treated steel sheet of claim 25, wherein said zinc-base plating layer is a Zn—Al-base plating layer containing Al in an amount of from 40 to 70 wt %.

28. A method for producing the surface-treated steel as defined in claim 25, comprising the steps of:

(a) preparing an aqueous treatment liquid comprising one of a water-soluble organic resin and a water-dispersible organic resin, water-soluble chromic acid or chromate, a Ca compound, and silica or a silica-group compound;

(b) applying the aqueous treatment liquid onto a surface of a zinc-base-plated steel sheet having a zinc-base plating layer containing at least 30 wt % zinc; and (c) drying the applied treatment liquid at a sheet temperature in a range of from 60 to 250° C. without performing rinsing.

29. The method of claim 28, wherein a ratio (weight ratio) of $Cr^{3+}/(Cr^{6+}+Cr^{3+})$ in the aqueous treatment liquid is in a range of from 0.05 to 0.9.

30. The method of claim 28, wherein the water-soluble chromic acid is one of $Cr^{3+}$ water-soluble chromic acid and chromate.

31. The method of claim 28, wherein the organic resin in the aqueous treatment liquid is an acryl-styrene copolymer emulsion resin; and the organic resin has a weight ratio of styrene/organic resin in a range of from 0.1 to 0.7, and an acid number of from 1 to 50.

32. A method for producing a surface-treated steel sheet, comprising the steps of:

applying chromate treatment onto a surface of a zinc-base-plated steel sheet containing at least 30 wt % zinc by using a treatment liquid including a water-soluble chromium compound;

applying a treatment liquid comprising an organic resin, a Ca compound, and silica or a silica-group compound; and drying the applied treatment liquid at a sheet temperature in a range of from 60 to 250° C. to form a film, said film has a coating weight of the organic resin in a range of from 50 to 5,000 $mg/m^2$, a coating weight of the Cr in a range of from 1 to 100 $mg/m^2$, a coating weight of the Ca in a range of from 0.001 to 0.2 in Ca/organic resin (weight ratio), and the coating weight of the silica or the silica-group compound in a range of from 0.001 to 0.5 in $SiO_2$/organic resin (weight ratio).

33. The method of claim 32, wherein said zinc-base plating layer is a Zn—Al alloy plating layer containing Al in an amount of from 1 to 10 wt %.

34. The method of claim 32, wherein said zinc-base plating layer is a Zn—Al alloy plating layer containing Al in an amount of from 40 to 70 wt %.

35. A surface-treated steel sheet, comprising:

a steel sheet;

a zinc-base plating layer formed on said steel sheet, said zinc-base plating layer containing at least 30 wt % zinc; and a film formed on said zinc-base plating layer, said film comprising an organic resin, Cr, Ca, and phosphoric acid or a phosphoric acid compound, the film having a coating weight of the organic resin in a range of from 50 to 5,000 $mg/m^2$, a coating weight of the Cr in a range of from 1 to 100 $m/m^2$, a coating weight of the Ca in a range of from 0.001 to 0.2 in Ca/organic resin (weight ratio), and a total coating weight of the phosphoric acid or the phosphoric acid compound in a range of from 0.001 to 0.5 in $PO_4$/organic resin (weight ratio), the film being formed by using a treatment liquid including a water-soluble chromium compound.

36. The surface-treated steel sheet of claim 35, wherein said zinc-base plating layer is a Zn—Al-base plating layer containing Al in a range of from 1 to 10 wt %.

37. The surface-treated steel sheet of claim 35, wherein said zinc-base plating layer is a Zn—Al-base plating layer containing Al in a range of from 4 to 70 wt %.

38. A method for producing the surface-treated steel sheet as defined in claim 35, comprising the steps of:

(a) preparing an aqueous treatment liquid comprising a water-soluble organic resin or a water-dispersible organic resin, water-soluble chromic acid or chromate, a Ca compound, and at least one phosphoric acid compound selected from the group consisting of zinc phosphate, aluminum phosphate, condensed zinc phosphate, and condensed aluminum phosphate;

(b) applying the aqueous treatment liquid onto a surface of a zinc-base-plated steel sheet having a zinc-base plating layer containing at least 30 wt % zinc; and (c) drying the applied treatment liquid at a sheet temperature in a range of from 60 to 250° C. without performing rinsing.

39. The method of claim 38, wherein a ratio (weight ratio) of $Cr^{3+}/(Cr^{6+}+Cr^{3+})$ in the aqueous treatment liquid is in a range of from 0.05 to 0.9.

40. The method of claim 38, wherein the water-soluble chromic acid is one of $Cr^{3+}$ water-soluble chromic acid and chromate.

41. The method of claim 38, wherein the organic resin in the aqueous treatment liquid is an acryl-styrene copolymer emulsion resin;

the organic resin has a weight ratio of styrene/organic resin in a range of from 0.1 to 0.7; and the organic resin has an acid number is in a range of from 1 to 50.

42. A method for producing a surface-treated steel sheet, comprising the steps of:

applying chromate treatment onto a surface of a zinc-base-plated steel sheet containing at least 30 wt % zinc by using a treatment liquid including a water-soluble chromium compound;

applying a treatment liquid including an organic resin, a Ca compound, and at least one phosphoric acid compound selected from the group of zinc phosphate, aluminum phosphate, condensed zinc phosphate, and condensed aluminum phosphate; and drying the applied treatment liquid at a sheet temperature in a range of from 60 to 250° C. to form a film, said film having a coating weight of the organic resin in a range of from 50 to 5,000 $mg/m^2$, a coating weight of the Cr in a range of from 1 to 100 $mg/m^2$, a coating weight of the Ca is in a range of from 0.001 to 0.2 in Ca/organic resin (weight ratio), and a total coating weight of the phosphoric acid compound(s) in a range of from 0.001 to 0.5 in $PO_4$/organic resin (weight ratio).

43. The method of claim 42, wherein said zinc-base plating layer is a Zn—Al alloy plating layer containing Al in a range of from 1 to 10 wt %.

44. The method of claim 42, wherein said zinc-base plating layer is a Zn—Al alloy plating layer containing Al in a range of from 40 to 70 wt %.

45.A surface-treated steel sheet comprising:

a steel sheet;

a zinc-base plating layer formed on said steel sheet, said zinc-base plating layer containing at least 30 wt % zinc; and a film formed on said zinc-base plating layer, said film including an organic resin, Cr, and a complex compound comprising Ca—$PO_4$—$SiO_2$ as a principal component, said film having a coating weight of the organic resin in a range of from 50 to 5,000 $mg/m^2$, a coating weight of the Cr in a range of from 1 to 100 $mg/m^2$, a weight ratio of $(Ca+SiO_2+PO_4)$/organic resin in a range of from 0.01 to 0.5, and a weight ratio of $(Ca+SiO_2)/PO_4$ in a range of from 0.05 to 0.8, the film being formed by using a treatment liquid including a water-soluble chromium compound.

46. The surface-treated steel sheet of claim 45, wherein said zinc-base plating layer is a Zn—Al-base plating layer containing Al in a range of from 1 to 10 wt %.

47. The surface-treated steel sheet of claim 45, wherein said zinc-base plating layer is a Zn—Al-base plating layer containing Al in a range of from 40 to 70 wt %.

48. A method for producing the surface-treated steel sheet as defined in claim 45, comprising the steps of:

(a) preparing an aqueous treatment liquid including a water-soluble organic resin or a water-dispersible organic resin, water-soluble chromic acid or chromate, and a complex compound comprising Ca—$PO_4$—$SiO_2$ as a principal component;

(b) applying the aqueous treatment liquid onto a surface of a zinc-base-plated steel sheet having a zinc-base plating layer containing at least 30 wt % zinc; and (c) drying the applied treatment liquid at a sheet temperature in a range of from 60 to 250° C.

49. The method of claim 48, wherein a ratio (weight ratio) of $Cr^{3+}/(Cr^{6+}+Cr^{3+})$ in the aqueous treatment liquid is in a range of from 0.05 to 0.9.

50. The method of claim 48, wherein the water-soluble chromic acid is one of $Cr^{3+}$ water-soluble chromic acid and chromate.

51. The method of claim 48, wherein the organic resin in the aqueous treatment liquid is an acryl-styrene copolymer emulsion resin;

the organic resin has a weight ratio of styrene/organic resin in a range of from 0.1 to 0.7; and the organic resin has an acid number in a range of from 1 to 50.

52. A method for producing a surface-treated steel sheet, comprising the steps of:

applying chromate treatment onto a surface of a zinc-base-plated steel sheet containing at least 30 wt % zinc by using a treatment liquid including a water-soluble chromium compound;

applying a treatment liquid comprising an organic resin and a complex compound comprising Ca—$PO_4$—$SiO_2$ as a principal component; and drying the applied treatment liquid at a sheet temperature in a range of from 60 to 250° C. to form a film, said film having a coating weight of the organic resin in a range of from 50 to 5,000 $mg/m^2$, a coating weight of the Cr in a range of from 1 to 100 $mg/m^2$, a weight ratio of $(Ca+SiO_2+PO_4)$/organic resin in a range of from 0.01 to 0.5, and a weight ratio of $(Ca+SiO_2)/PO_4$ in a range of from 0.05 to 0.8.

53. The method of claim 52, wherein said zinc-base plating layer is a Zn—Al alloy plating layer containing Al in a range of from 1 to 10 wt %.

54. The method of claim 52, wherein said zinc-base plating layer is a Zn—Al alloy plating layer containing Al in a range of from 40 to 70 wt %.

* * * * *